US006761053B2

(12) United States Patent
Tazoe

(10) Patent No.: US 6,761,053 B2
(45) Date of Patent: Jul. 13, 2004

(54) PLATE REDUCTION PRESS APPARATUS AND METHODS

(75) Inventor: Nobuhiro Tazoe, Yokohama (JP)

(73) Assignees: Ishikawajima-Harima Heavy Industries Co., Ltd., Tokyo (JP); NKK Corporation, Tokyo (JP)

( * ) Notice: Subject to any disclaimer, the term of this patent is extended or adjusted under 35 U.S.C. 154(b) by 0 days.

(21) Appl. No.: 10/394,028

(22) Filed: Mar. 24, 2003

(65) Prior Publication Data

US 2003/0177805 A1 Sep. 25, 2003

Related U.S. Application Data

(62) Division of application No. 10/105,436, filed on Mar. 26, 2002, which is a division of application No. 09/912,505, filed on Jul. 26, 2001, now Pat. No. 6,467,323, which is a division of application No. 09/308,293, filed on May 12, 1999, now Pat. No. 6,341,516, which is a continuation of application No. PCT/JP98/04092, filed on Sep. 11, 1998.

(30) Foreign Application Priority Data

| | | |
|---|---|---|
| Sep. 16, 1997 | (JP) | 8-250983 |
| Oct. 9, 1997 | (JP) | 8-277490 |
| Oct. 14, 1997 | (JP) | 8-280414 |
| Oct. 21, 1997 | (JP) | 8-288638 |
| Nov. 26, 1997 | (JP) | 8-324669 |
| Dec. 3, 1997 | (JP) | 8-332569 |
| Dec. 9, 1997 | (JP) | 8-338375 |
| Dec. 9, 1997 | (JP) | 8-338376 |
| Feb. 17, 1998 | (JP) | 9-34744 |
| Feb. 19, 1998 | (JP) | 9-37012 |
| Feb. 19, 1998 | (JP) | 9-37013 |
| Feb. 24, 1998 | (JP) | 9-42326 |
| Feb. 24, 1998 | (JP) | 9-42328 |
| Jun. 15, 1998 | (JP) | 9-166546 |
| Jun. 16, 1998 | (JP) | 9-167981 |
| Jun. 16, 1998 | (JP) | 9-167985 |

(51) Int. Cl.[7] ..... B21B 39/12

(52) U.S. Cl. ..... 72/184; 72/251

(58) Field of Search ..... 72/187, 190, 206, 72/251, 426, 405.06, 184

(56) References Cited

U.S. PATENT DOCUMENTS

| | | | |
|---|---|---|---|
| 1,549,527 | A | 8/1925 | Fielding |
| 2,402,546 | A | 6/1946 | Gaykowski |
| 2,603,989 | A | 7/1952 | Sheperdson |

(List continued on next page.)

FOREIGN PATENT DOCUMENTS

| | | | | |
|---|---|---|---|---|
| DE | 3837643 | | 5/1990 | |
| JP | 46-5044 | | 2/1971 | |
| JP | 60-115302 | | 6/1985 | |
| JP | 61-180635 | | 8/1986 | |
| JP | 61-222651 | | 10/1986 | |
| JP | 02-014139 | | 4/1990 | |
| JP | 02-175011 | | 7/1990 | |
| JP | 2-175011 | | 7/1990 | |
| SU | 1507470 | | 9/1989 | |
| WO | 90/02004 | * | 3/1990 | ..... 72/206 |

OTHER PUBLICATIONS

European Search Report issued in EP 98 94 1824 dated Apr. 9, 2003 and mailed Apr. 25, 2003.

*Primary Examiner*—Lowell A. Larson
(74) *Attorney, Agent, or Firm*—Griffin & Szipl, P.C.

(57) ABSTRACT

A material 1 to be shaped is reduced and formed by bringing dies with convex forming surfaces, when viewed from the side of the transfer line of the material 1, close to the transfer line from above and below the material 1, in synchronism with each other, while giving the dies a swinging motion in such a manner that the portions of the forming surfaces of the dies, in contact with the material 1, are transferred from the upstream to the downstream side in the direction of the transfer line.

13 Claims, 81 Drawing Sheets

U.S. PATENT DOCUMENTS

| | | | | | |
|---|---|---|---|---|---|
| 3,054,439 | A | | 9/1962 | Hallam | |
| 3,114,276 | A | | 12/1963 | Uebing et al. | |
| 3,133,343 | A | | 5/1964 | Kratkay | |
| 3,209,578 | A | * | 10/1965 | Muller | 72/426 |
| 3,460,370 | A | * | 8/1969 | Kralowetz | 72/405.06 |
| 3,485,081 | A | | 12/1969 | Kocks | |
| 3,583,186 | A | | 6/1971 | Andersson | |
| 3,583,192 | A | | 6/1971 | Kocks | |
| 3,584,489 | A | | 6/1971 | Peytavin | |
| 3,728,890 | A | | 4/1973 | Kocks et al. | |
| 3,850,022 | A | * | 11/1974 | Kralowetz et al. | 72/426 |
| 3,921,429 | A | | 11/1975 | Sendzimir | |
| 3,955,391 | A | | 5/1976 | Wilson | |
| 5,077,999 | A | | 1/1992 | Rohde | |
| 5,146,781 | A | | 9/1992 | Wilson et al. | |
| 5,313,813 | A | | 5/1994 | Heitze et al. | |
| 5,331,833 | A | | 7/1994 | Heitze | |
| 5,435,165 | A | * | 7/1995 | Morel et al. | 72/251 |
| 5,617,985 | A | | 4/1997 | Baer | |

* cited by examiner (A)

(B)

(A)

(B)

(A)

(B)

(A)

(B)

PLATE REDUCTION PRESS APPARATUS AND METHODS

This application is a divisional application of U.S. patent application Ser. No. 10/105,436, filed Mar. 26, 2002, which in turn is a divisional of U.S. patent application Ser. No. 09/912,505, filed Jul. 26, 2001, now U.S. Pat. No. 6,467,323, issued Oct. 22, 2002, which in turn is a division of U.S. patent application Ser. No. 09/308,293 filed May 12, 1999, now U.S. Pat. No. 6,341,516, issued Jan. 29, 2002, which is a continuation of PCT/JP98/04092 the entire disclosures of the above applications are considered to be part of the present disclosure and are specifically incorporated by reference herein.

BACKGROUND OF THE INVENTION

1. Technical Field of the Invention

The present invention relates to a plate thickness reduction press apparatus that transfers and reduces a slab, and the methods concerned with its use.

2. Prior Art

1. FIG. 1 shows an example of a roughing mill used for hot rolling, and the roughing mill is provided with work rolls 2*a*, 2*b* arranged vertically opposite each other on opposite sides of a transfer line S that transfers a slab-like material 1 to be shaped, substantially horizontally, and backup rolls 3*a*, 3*b* contacting the work rolls 2*a*, 2*b* on the side opposite to the transfer line.

In the above-mentioned roughing mill, the work roll 2*a* above the transfer line S is rotated counterclockwise, and the work roll 2*b* underneath the transfer line S is rotated clockwise, so that the material 1 to be shaped is caught between both work rolls 2*a*, 2*b*, and by pressing the upper backup roll 3*a* downwards, the material 1 to be shaped is moved from the upstream A side of the transfer line to the downstream B side of the line, and the material 1 to be shaped is pressed and formed in the direction of the thickness of the slab. However, unless the nip angle θ of the material 1 to be shaped as it enters into the work rolls 2*a*, 2*b* is less than about 17°, slipping will occur between the upper and lower surfaces of the material 1 to be shaped and the outer surfaces of both work rolls 2*a*, 2*b*, and the work rolls 2*a*, 2*b* will no longer be able to grip and reduce the material 1 to be shaped.

More explicitly, when the diameter D of the work rolls 2*a*, 2*b* is 1,200 mm, the reduction Δt of a single rolling pass is about 50 mm according to the above-mentioned nip angle θ condition for the work rolls 2*a*, 2*b*, so when a material 1 to be shaped with a thickness T0 of 250 mm is rolled, the thickness T1 of the slab after being reduced and formed by a roughing mill becomes about 200 mm.

According to the prior art, therefore, the material 1 to be shaped is rolled in a reversing mill, in which the material is moved backwards and forwards while gradually reducing the thickness of the plate, and when the thickness of the material 1 to be shaped is reduced to about 90 mm, the material 1 is sent to a finishing mill.

Another system for reducing and forming the material 1 to be shaped according to the prior art is shown in FIG. 2; dies 14*a*, 14*b* with profiles like the plane shape of dies for a stentering press machine are positioned opposite each other above and below a transfer line S, and both dies 14*a*, 14*b* are made to approach each other and separate from each other in the direction orthogonal to the direction of movement of the material 1 using reciprocating means such as hydraulic cylinders, in synchronism with the transfer of the material 1, while reducing and forming the material 1 to be shaped in the direction of the thickness of the plate.

The dies 14*a*, 14*b* are constructed with flat forming surfaces 19*a*, 19*b* gradually sloping from the upstream A side of the transfer line towards the downstream B side of the line, and flat forming surfaces 19*c*, 19*d* that continue from the aforementioned forming surfaces 19*a*, 19*b* in a direction parallel to and on opposite sides of the transfer line S.

The width of the dies 14*a*, 14*b* is set according to the plate width (about 2,000 mm or more) of the material 1 to be shaped.

However, when the material 1 to be shaped is rolled with the reversing method using the roughing mill shown in FIG. 1, space is required at each of the upstream A and downstream B ends of the transfer line S of the roughing mill, for pulling out the material 1 to be shaped as it comes out of the roughing mill, so the equipment must be long and large.

When the material 1 to be shaped is reduced and formed in the direction of its plate thickness using the dies 14*a*, 14*b* shown in FIG. 2, the areas of the forming surfaces 19*a*, 19*b*, 19*c* and 19*d* in contact with the material 1 to be shaped are much longer than those of the dies of a stentering press machine, and the contact areas increase as the dies 14*a*, 14*b* approach the transfer line S, so that a large load must be applied to each of the dies 14*a*, 14*b*, during reduction.

Furthermore, the power transmission members such as the eccentric shafts and rods for moving the dies 14*a*, 14*b*, the housing, etc. must be strong enough to withstand the above reducing loads, so each of these members and the housing must be made large in size.

Moreover, when the material 1 to be shaped is reduced and formed in the direction of its plate thickness using the dies 14*a*, 14*b*, some of the material 1 is forced backwards towards the upstream A side on the transfer line depending on the shape and the stroke of the dies 14*a*, 14*b*, therefore, it becomes difficult to transfer the material 1 to be shaped to the downstream B side of the transfer line.

When the material 1 to be shaped is reduced and formed in the direction of its plate thickness using the dies 14*a*, 14*b* shown in FIG. 2, the height of the lower surface of the material 1 after being reduced by the dies 14*a*, 14*b* is higher than the height of the lower surface of the material 1 immediately before being reduced by the dies, by an amount corresponding to the reduction in thickness.

Consequently, the leading end of the material 1 to be shaped tends to droop downwards, therefore the table rollers (not illustrated) installed on the downstream B side of the transfer line, to support the material 1 being shaped, may catch the leading end of the material 1, possibly resulting in damage to both the table rollers and the material 1 being shaped.

Recently, the flying-sizing press machine shown in FIG. 3 has been proposed.

This flying-sizing press machine is provided with a housing 4 erected on a transfer line S so as to allow movement of a material 1 to be shaped, an upper shaft box 6*a* and a lower shaft box 6*b* housed in window portions 5 of the housing 4 opposite each other on opposite sides of the transfer line S, upper and lower rotating shafts 7*a*, 7*b* extending substantially horizontally in the direction orthogonal to the transfer line S and supported by the upper shaft box 6*a* or the lower shaft box 6*b* by bearings (not illustrated) on the non-eccentric portions, rods 9*a*, 9*b* located above and below the transfer line S, respectively, connected to eccentric portions of the rotating shafts 7*a*, 7*b* through bearings 8*a*, 8*b* at the end portions thereof, rod support boxes 11*a*, 11*b* connected to intermediate portions of the upper and lower rods 9*a*, 9*b* by bearings 10*a*, 10*b* with spherical surfaces and housed in the window portions 5 of the housing 4 and free to slide vertically, die holders 13*a*, 13*b* connected to the top portions of the rods 9*a*, 9*b* through bearings 12*a*, 12*b* with spherical surfaces, dies 14*a*, 14*b* mounted on the die holders 13*a*, 13*b*, and hydraulic cylinders 15*a*, 15*b* whose cylinder units are connected to intermediate locations along the length of the rods 9*a*, 9*b* by means of bearings and the tips of the piston rods are connected to the die holders 13*a*, 13*b* through bearings.

The rotating shafts 7*a*, 7*b* are connected to the output shaft (not illustrated) of a motor through a universal coupling and a speed reduction gear, and when the motor is operated, the upper and lower dies 14*a*, 14*b* approach towards and move away from the transfer line S in synchronism with the transfer operation.

The dies 14*a*, 14*b* are provided with flat forming surfaces 16*a*, 16*b* gradually sloping from the upstream A side of the transfer line towards the downstream B side of the transfer line so as to approach the transfer line S, and other flat forming surfaces 17*a*, 17*b* continuing from the aforementioned forming surfaces 16*a*, 16*b* in a direction parallel to the transfer line S. The width of the dies 14*a*, 14*b* is determined by the plate width (about 2,000 mm or more) of the material 1 to be shaped.

A position adjusting screw 18 is provided at the top of the housing 4, to enable the upper shaft box 6*a* to be moved towards or away from the transfer line S, and by rotating the position adjusting screw 18 about its axis, the die 14*a* can be raised and lowered through the rotating shaft 7*a*, rod 9*a*, and the die holder 13*a*.

When the material 1 to be shaped is reduced and formed in the direction of the plate thickness using the flying-sizing press machine shown in FIG. 3, the position adjusting screw 18 is rotated appropriately to adjust the position of the upper shaft box 6*a*, so that the spacing between the upper and lower dies 14*a*, 16*b* is determined according to the plate thickness of the material 1 to be shaped by reducing and forming in the direction of plate thickness.

Next, the motor is operated to rotate the upper and lower rotating shafts 7*a*, 7*b*, and the material 1 to be shaped is inserted between the upper and lower dies 14*a*, 14*b*, and the material 1 is reduced and formed by means of the upper and lower dies 14*a*, 14*b* that move towards and away from each other and with respect to the transfer line S while moving in the direction of the transfer line S as determined by the displacement of the eccentric portions of the rotating shafts 7*a*, 7*b*.

At this time, appropriate hydraulic pressure is applied to the hydraulic chambers of the hydraulic cylinders 15*a*, 15*b*, and the angles of the die holders 13*a*, 13*b* are changed so that the forming surfaces 17*a*, 17*b* of the upper and lower dies 14*a*, 14*b*, on the downstream B side of the transfer line, are always parallel to the transfer line S.

However, the flying-sizing press machine shown in FIG. 3 has much larger contact areas between the forming surfaces 16*a*, 16*b*, 17*a* and 17*b* of the dies 14*a*, 14*b* and the material 1 to be formed, compared to the dies of a plate reduction press machine, and because the above-mentioned contact areas increase as the dies 14*a*, 14*b* approach the transfer line S, a large load must be applied to the dies 14*a*, 14*b* during reduction.

In addition, the die holders 13*a*, 13*b*, rods 9*a*, 9*b*, rotating shafts 7*a*, 7*b*, shaft boxes 6*a*, 6*b*, housing 4, etc. must be strong enough to withstand the reducing load applied to the dies 14*a*, 14*b*, so that these members are made larger in size.

Also, the flying-sizing press machine shown in FIG. 3 may suffer from the problem that the leading and trailing ends of the material 1 being reduced and formed are locally bent to the left or right, or with a camber so that when a long material 1 is being formed it generally warps, unless the centers of the reducing forces from the dies 14*a*, 14*b* on the material 1 to be shaped are in close alignment when the material 1 is reduced and formed by the upper and lower dies 14*a*, 14*b*.

2. With a conventional rolling mill known in the prior art, in which a material is rolled between two work rolls, there is a reduction ratio limit of normally about 25% due to the nip angle limitation. Therefore, it is not possible to reduce the thickness of a material by a large ratio (for example, reducing a material from about 250 mm thickness to 30 to 60 mm) in a single pass, therefore three or four rolling mills are arranged in tandem in a tandem rolling system, or the material to be rolled is rolled backwards and forwards in a reverse rolling system. However, these systems are accompanied with practical problems such as the need for a long rolling line.

On the other hand the planetary mill, Sendzimir mill, cluster mill, etc. have been proposed as means of pressing that allow a large reduction in one pass. However, with these rolling mills, small rolls press the material to be rolled at a high rotational speed, resulting in a great impact, therefore the life of the bearings, etc., is so short that these mills are not suitable for mass production facilities.

On the other hand, various kinds of press apparatus modified from the conventional stentering press machines have been proposed (for example, Japanese patent No. 014139, 1990, unexamined Japanese patent publication Nos. 222651, 1986, 175011, 1990, etc.).

An example of the "Flying-sizing press apparatus" according to the unexamined Japanese patent publication No. 175011, 1990 is shown in FIG. 4; rotating shafts 22 are arranged in the upper and lower sides or the left and right sides of the transfer line Z of a material to be shaped, and the bosses of rods 23 with a required shape are connected to eccentric portions of the rotating shafts 22, and in addition, dies 24 arranged on opposite sides of the transfer line of the material to be shaped are connected to the tips of the rods 23; when the rotating shafts 22 are rotated, the rods 23 coupled to the eccentric portions of the rotating shafts cause the dies 24 to press both the upper and lower surfaces of the material 1 to be shaped, thereby the thickness of the material to be shaped is reduced.

However, the above-mentioned high-reduction means are associated with problems such as (1) a material to be reduced cannot be easily pressed by the flying-sizing apparatus in which the material is reduced as it is being transferred, (2) the means are complicated with many component parts, (3) many parts must slide under heavy loads, (4) the means are not suitable for heavily loaded frequent cycles of operation, etc.

With conventional high-reduction pressing means known in the prior art, the position of the dies is controlled to adjust the thickness of the material to be pressed by means of a screw, wedge, hydraulic cylinder, etc., and, as a result, there are the practical problems that the equipment is large, costly, complicated, and vibrates considerably.

3. Conventionally, a roughing-down mill is used to roll a slab. The slab to be rolled is as short as 5 m to 12 m, and the slab is rolled by a plurality of roughing-down mills or by reversing mills in which the slab is fed forwards and backwards as it is rolled. In addition, a reduction press machine is also used. Recently, because a long slab manufactured by a continuous casting system has been introduced, there is a demand for the continuous transfer of the slab to a subsequent pressing system. When a material is rough rolled using a roughing-down mill, the minimum nip angle (about 17°) must be satisfied, so the reduction limit Δt per pass is about 50 mm. Because the slab is continuous, reverse rolling is not applicable, so that to obtain the desired thickness, a plurality of roughing-down mills must be installed in series, or if a single rolling mill is to be employed, the diameter of the work rolls should be very large.

Consequently, a reduction press machine is used. FIG. 5 shows an example of such a machine in which the dies are pressed by sliders, to provide a flying-press machine that can press a moving slab. Dies 32 provided above and below the slab 1 are mounted on sliders 33, and the sliders 33 are moved up and down by the crank mechanisms 34. The dies 32, sliders 33 and crank mechanisms 34 are reciprocated in the direction of transferring the slab, by the feeding crank mechanisms 35. The slab 1 is conveyed by pinch rolls 36 and transfer tables 37. When the slab is being reduced, the dies 32, sliders 33 and crank mechanisms 34 are moved in the direction of transferring the slab by means of the feeding crank mechanisms 35, and the pinch rolls 36 transfer the slab 1 in synchronism with this transfer speed. A start-stop system can also be used; the slab 1 is stopped when the system is working as a reduction press machine and the slab is reduced, and after completing reduction, the slab is transferred by a length equal to a pressing length, and then pressing is repeated.

There are problems in the design and manufacturing cost of the aforementioned roughing-down mill with large diameter rolls, and the use of rolls with a large diameter results in a shorter life for the rolls because of the low rolling speed and difficulty in cooling the rolls. With the reduction press machine using sliders and feeding crank mechanisms shown in FIG. 5, the cost of the equipment is high because the mechanisms for reciprocating the sliders, etc., in the direction of movement of a slab are complicated and large in scale. In addition, the sliders vibrate significantly in the vertical direction. With a reduction press machine using a start-stop system, the slab must be accelerated and decelerated repeatedly from standstill to transfer speed, and vice versa. The slab is transferred using pinch rolls and transfer tables, and these apparatus become large due to the high acceleration and deceleration.

4. When a material is reduced by a large amount, according to the prior art, long dies were used to reduce the material while it was fed through the dies by the length thereof during one or several pressings. Defining the longitudinal and lateral directions as the direction in which the pressed material is moved and the direction perpendicular to the longitudinal direction, respectively, the material to be pressed by a large amount in the longitudinal direction is pressed by dies that are long in the longitudinal direction using single pressing or by means of a plurality of pressing operations while feeding the material to be pressed in the longitudinal direction. FIG. 6 shows an example of the above-mentioned reduction press machine, and FIG. 7 illustrates its operation. The reduction press is equipped with (lies 42 above and below a material 1 to be pressed, hydraulic cylinders 43 for pressing down the dies 42, and a frame 44 that supports the hydraulic cylinders 43. A pressing operation is described using the symbols L for the length of the dies 42, T for the original thickness of the material 1 to be pressed, and t for the thickness of the material after pressing. FIG. 7(A) shows the state of the dies 42 set to a location with thickness T on a portion of material to be pressed next, adjacent to a portion with thickness t which has been pressed. (B) shows the state in which the dies have pressed down from the state (A). (C) is the state in which the dies 42 have been separated from the material 1 being pressed, that has then been moved longitudinally by the pressing length L, and completely prepared for the next pressing, which is the same state as (A). Operations (A) to (C) are repeated until all the material is reduced to the required thickness.

The longer the dies, the greater the force that is required for reduction, so the reduction press machine must be large. With a press machine, pressing is usually repeated at high speed. When an apparatus with a large mass is reciprocated at a high speed, a large power is required to accelerate and decelerate the apparatus, therefore the ratio of the power required for acceleration and deceleration to the power needed for reducing the material to be pressed is so large that much power is spent on driving the apparatus. When the material is reduced, the volume corresponding to the thinned portion must be displaced longitudinally or laterally because the volumes of the material before and after reduction are substantially the same. If the dies are long, the material is constrained so that it is displaced longitudinally (this phenomenon is called material flow), so that pressing becomes difficult especially when the reduction is large.

When a material to be rolled is reduced conventionally in a horizontal mill, the gap between the rolls of the horizontal mill is set so that the rolls are capable of gripping the material to be rolled considering the thickness of the material after forming, therefore the reduction in thickness allowed for a single pass is limited so that when a large reduction in the thickness is required, a plurality of horizontal mills have to be installed in series, or the material must be moved backwards and forwards through a horizontal mill while the thickness is gradually reduced, according to the prior art. Another system was also proposed in the unexamined Japanese patent publication No. 175011, 1990; eccentric portions are provided in rotating shafts, the motion of the eccentric portions is changed to an up/down movement using rods, and a material to be pressed is reduced continuously by these up/down movements.

The system with a plurality of horizontal mills arranged in tandem (series) has the problems that the equipment is large and the cost is high. The system of passing a material to be pressed backwards and forwards through a horizontal mill has the problems that the operations are complicated and a long rolling time is required. The system disclosed in the unexamined Japanese patent application No. 175011, 1990 has the difficulty that large equipment must be used, because a fairly large rotating torque must be applied to the rotating shafts to produce the required reducing force as the movement of the eccentric portions of the rotating shafts has to be changed to an up/down motion to produce the necessary reducing force.

5. Conventionally, a roughing-down mill is used to press a slab. The slab to be pressed is as short as 5 to 12 m, and to obtain the specified thickness, a plurality of roughing-down mills are provided, or the slab is moved backwards and forwards as it is pressed in the reversing rolling method. Other systems also used practically include a flying press machine that transfers a slab while it is being pressed, and a start-stop reduction press machine which stops conveying the material as it is being pressed and transfers the material during a time when it is not being pressed.

Since long slabs are produced by continuous casting equipment, there is a practical demand for a slab to be conveyed continuously to a subsequent press apparatus. When a slab is rough rolled in a roughing-down mill, there is a nip angle limitation (about 17°), so the reduction per rolling cannot be made so large. Because the slab is continuous, it cannot be rolled by reverse rolling, therefore to obtain the preferred thickness, a plurality of roughing-down mills must be installed in series, or if a single mill is involved, the diameter of the work rolls must be made very large. There are difficulties, in terms of design and cost, in manufacturing such a roughing-down mill with large-diameter rolls, and large diameter rolls must be operated at a low speed when rolling a slab, so the rolls cannot be easily cooled, and the life of the rolls becomes shorter. Because a flying press can provide a large reduction in thickness and is capable of reducing a material while it is being conveyed, the press can continuously transfer the material being pressed to a downstream rolling mill. However, it has been difficult to adjust the speed of the material to be pressed so that the flying press and the downstream rolling mill can operate simultaneously to reduce and roll the material. In addition, it has not been possible to arrange a start-stop reduction press machine and a rolling mill in tandem to reduce a slab continuously; with the start-stop reduction press, the material being pressed is stopped during pressing, and is transferred when it is not being pressed.

Another system in practical use is the flying system in which the sliders that press down on a slab are moved up and down in synchronism with the transfer speed of the slab.

In the start-stop system, the heavy slab is accelerated and decelerated every cycle from standstill to the maximum speed Vmax, and accordingly the capacity of the transfer facilities such as the pinch rolls and transfer tables must be large. Because of the discontinuous operation, it is difficult to carry out further operations on a downstream press machine. The flying system requires a large capacity apparatus to produce the swinging motion, and to accelerate and decelerate the heavy sliders according to the speed of the slab. Another problem with this system is that this large capacity apparatus for producing the swinging motion causes considerable vibrations in the press machine.

Still another problem with this system is that if the speed of the slab deviates from that of the sliders, flaws may be produced in the slab or the equipment may be damaged.

Recently, a high-reduction press machine that can reduce a thick slab (material to be pressed) to nearly ⅓ of its original thickness in a single reduction operation, has been developed. FIG. 8 shows an example of a reduction press machine used for hot pressing. With this reduction press machine, dies 52*a*, 52*b* are disposed opposite each other vertically on opposite sides of the transfer line S, and are simultaneously moved towards and away from a material 1 to be pressed that travels on the transfer line S by the reciprocating apparatus 53*a*, 53*b* incorporating eccentric axes, rods, and hydraulic cylinders, so that material of a thickness of, for example, 250 mm can be reduced to 90 mm by a single reducing operation.

However, the reduction of the aforementioned high-reduction press machine can be as large as 160 mm, that is, the reduction on one side is as large as 80 mm. According to the prior art, there is a small difference of thickness before and after pressing, so the transfer levels of the transfer devices of a press machine on the inlet and outlet sides are substantially the same. With the above-mentioned high-reduction press machine, however, there is the problem that the material 1 to be pressed is bent if the transfer levels are identical. Another problem of the machine is that the transfer device is overloaded.

SUMMARY OF THE INVENTION

1. The present invention has been accomplished under the circumstances mentioned above, and the first object of the present invention is to provide a plate reduction press apparatus and methods that can efficiently reduce a material to be shaped in the direction of the thickness of the plate, can securely transfer the material to be shaped, can decrease the load imposed on the dies during reduction, and can prevent bending of the material to be shaped to the left or right as a result of the reducing and forming operations.

To achieve the aforementioned first object of the present invention, in the plate reduction pressing method of the present invention, dies with convex forming surfaces protruding towards the transfer line are moved towards the transfer line from above and below the material to be shaped, when viewed from the side of the transfer line, in synchronism with the movement of the material to be shaped, in such a manner that a portion of the forming surfaces of the material is moved from the upstream side to the downstream side of the transfer line and the material to be shaped is reduced in the direction of the plate thickness.

The plate thickness reduction press apparatus of another embodiment of the present invention, is provided with die holders arranged opposite each other above and below a transfer line in which a material to be shaped is moved horizontally, dies mounted on the above-mentioned die holders and comprised of convex forming surfaces protruding towards the transfer line when viewed from the side of the transfer line, upstream eccentric shafts arranged for each die holder on the opposite side from the transfer line and extending in the direction lateral to the transfer line, downstream eccentric shafts arranged for each die holder on the opposite side from the transfer line in alignment with the aforementioned upstream eccentric shafts, in the downstream direction of the transfer line, and comprised of eccentric portions with a different phase angle from the phase angle of the eccentric portions of the upstream eccentric shafts, upstream rods whose tips are connected to portions of the die holders, close to the ends on the upstream side of the transfer line through bearings and the other ends of which are connected to the eccentric portions of the upstream eccentric shafts through bearings, downstream rods whose tips are connected to portions of the die holders, close to the ends on the downstream side of the transfer line through bearings and the other ends of which are connected to the eccentric portions of the downstream eccentric shafts through bearings, and mechanisms for moving the dies backwards and forwards that reciprocate the above-mentioned die holders relative to the direction of the transfer line.

According to the plate reduction press apparatus of another embodiment of the present invention, the mechanisms for moving the dies backwards and forwards in the plate press apparatus are provided with arms one end of each of which is fixed to the die holder, and guide members which are installed near the die holders and guide the other end of each of the arms.

In the plate reduction press apparatus according to the invention, the mechanisms for moving the dies backwards and forwards are provided with actuators one end of each of which is connected to one of the die holders through a first bearing and the other end of each thereof is connected to a predetermined fixing member through a second bearing.

The plate reduction press apparatus of another embodiment of the present invention is composed of the mechanisms for moving the dies backwards and forwards in the plate reduction press apparatus, comprised of eccentric shafts for backwards and forwards movements, provided near the die holders and rods for backwards and forwards movements, one end of each of the aforementioned rods being connected to one of the die holders through a first bearing and the other end thereof being connected to one of the eccentric portions of the eccentric shafts for backwards and forwards movements.

In the plate reduction press apparatus of a still further embodiment of the invention, the mechanisms for moving the dies backwards and forwards in the plate reduction press apparatus of the present invention are composed of levers one end of each of which is connected to one of the die holders through a first bearing and the other end thereof is connected to a predetermined fixing member through a second bearing.

According to the plate reduction pressing method of the present invention, dies with convex forming surfaces protruding towards the transfer line are moved towards the transfer line from above and below the material to be shaped in synchronism with the movement of the material to be shaped, and given a swinging motion such that the portions of the forming surfaces in contact with the material to be shaped move from the downstream side of the transfer line to the upstream side thereof, thereby the areas of the material being shaped, in contact with the forming surfaces, are made small to reduce the pressing load on the dies.

In any of the plate reduction press apparatus according to the present invention, the die holders on which the dies are mounted are given a swinging motion by the upstream eccentric shafts, downstream eccentric shafts, upstream rods and downstream rods in such a manner that the portions of the forming surfaces of the dies, in contact with the material to be shaped, are shifted from the downstream side to the upstream side of the transfer line, while moving the dies towards the transfer line, thereby the areas of the forming surfaces in contact with the material to be shaped are made small to reduce the load applied to the dies during pressing.

Also, when the forming surfaces of the dies are in contact with the material to be shaped, the mechanisms for moving the dies backwards and forwards move the die holders towards the downstream side of the transfer line, and convey the material being reduced and formed without any material being displaced backwards, towards the downstream side of the transfer line.

To achieve the above-mentioned first object of the present invention, the plate reduction press apparatus according to one embodiment of the invention is provided with dies arranged vertically opposite each other on opposite sides of a transfer line in which a material to be shaped is transferred horizontally, and moving towards and away from the transfer line in synchronism with each other, a plurality of upstream table rollers arranged on the upstream side of the dies on the transfer line in such a manner that the lower surface of the material to be shaped, which is to be inserted between the dies, can be supported substantially horizontally, a plurality of downstream up and down table rollers arranged on the downstream side of the dies on the transfer line in such a manner that the downstream up and down table rollers can be raised and lowered and can support the lower surface of the material being shaped and fed out of the dies, and a plurality of downstream table rollers arranged on the downstream side of the downstream up and down table rollers on the transfer line in such a manner that the lower surface of the material being shaped and fed out of the dies can be supported substantially horizontally at a height substantially the same as the height of the aforementioned upstream table rollers.

The plate reduction press apparatus according to a further embodiment of the invention is provided with dies arranged vertically opposite each other on opposite sides of a transfer line in which a material to be shaped is transferred horizontally, and moving towards and away from the transfer line in synchronism with each other, a plurality of upstream up and down table rollers on the upstream side of the dies on the transfer line in such a manner that the upstream up and down table rollers can be raised and lowered, and the lower surface of the material to be shaped, which is to be inserted between the dies, can be supported and a plurality of downstream table rollers arranged on the downstream side of the dies on the transfer line in such a manner that the lower surface of the material being shaped and fed out of the dies can be supported.

The plate reduction press apparatus according to yet another embodiment of the present invention is comprised of dies arranged vertically opposite each other on opposite sides of a transfer line in which a material to be shaped is transferred horizontally, and moving towards and away from the transfer line in synchronism with each other, a plurality of upstream up and down table rollers on the upstream side of the dies on the transfer line in such a manner that the upstream up and down table rollers can be raised and lowered, and the lower surface of the material to be shaped, which is to be inserted between the dies, can be supported, and a plurality of downstream up and down table rollers arranged on the downstream side of the dies in such a manner that the lower surface of the material being shaped and fed out of the dies can be supported.

According to the method of operating the plate reduction press apparatus according to one embodiment of the invention, when a long material to be shaped is inserted, reduced and formed in the direction of plate thickness between both dies, the vertical positions of the downstream up and down table rollers near the dies are determined in such a manner that the material being shaped and fed out of the dies is substantially horizontal, and the vertical positions of the downstream up and down table rollers on the side farther from the dies are determined in such a manner that the material being shaped gradually descends towards the downstream table rollers.

In the method of operating the plate reduction press apparatus according to one embodiment, when a long material to be shaped is inserted, reduced and formed in the direction of the plate thickness between both dies, the vertical positions of the upstream up and down table rollers near the dies are determined in such a manner that the material to be shaped, which is to be inserted between the dies, is substantially horizontal.

According to a further embodiment of the present invention for operating the plate reduction press apparatus, when a long material to be shaped is inserted, reduced and formed in the direction of the plate thickness between both dies, the vertical positions of the upstream up and down table rollers near the dies and the downstream up and down table rollers are determined in such a manner that the material to be shaped, which is to be inserted between the dies, and the material being shaped and fed out of the dies are substantially horizontal.

In the method according to a further embodiment of the present invention for operating the plate reduction press apparatus of the invention, the positions of the upper surfaces of the downstream up and down table rollers are determined to be identical to the positions of the upper surfaces of the upstream table rollers and the downstream table rollers, when no long material to be shaped is inserted, or being reduced or formed in the direction of the plate thickness between both dies.

When using the plate reduction press apparatus of the present invention according to the method of another embodiment of the invention, the positions of the upper surfaces of the upstream up and down table rollers are determined to be identical to the positions of the upper surfaces of the downstream table rollers, when no long material to be shaped is inserted, or being reduced or formed in the direction of the plate thickness between both dies.

In the method for operating the plate reduction press apparatus according to one embodiment of the present invention, when no long material to be shaped is inserted, or being reduced or formed in the direction of the plate thickness between both dies, the positions of the upper surfaces of the upstream up and down table rollers and the downstream table rollers are determined to be identical to each other.

With the plate reduction press apparatus of one embodiment of the present invention, the vertical positions of the downstream up and down table rollers located on the transfer line downstream of the dies are adjusted according to the amount of the reduction in the direction of the plate thickness of the material being shaped by the dies, and the lower surface of the material being shaped and fed out from the dies is maintained in the most suitable state.

In the plate reduction press apparatus of another embodiment of the present invention, the vertical positions of the upstream up and down table rollers located on the transfer line upstream of the dies are adjusted according to the amount of the reduction in the direction of the plate thickness of the material to be shaped, and the lower surface of the material to be inserted between the dies and shaped is maintained in the most suitable state.

In the plate reduction press apparatus according to one embodiment of the present invention, the vertical positions of the upstream up and down table rollers located on the transfer line upstream of the dies and the downstream up and down table rollers located on the transfer line downstream of the dies are adjusted according to the amount of the reduction in the direction of the plate thickness of the material being formed by the dies, and the lower surface of the material being shaped and fed out from between the dies is maintained in the most suitable state.

When using the plate reduction press apparatus of the invention according to the method of one embodiment, the vertical positions of the downstream up and down table rollers on the portion of the transfer line near to the press machine are determined in such a manner that the material being reduced, shaped and fed out from between the dies is substantially horizontal, and the vertical positions of the downstream up and down table rollers farther down the transfer line are determined in such a manner that the material being shaped and fed out of the aforementioned downstream up and down table rollers gradually descends towards the downstream table rollers, and the portion of the material being reduced and shaped is moved smoothly.

According to the method of one embodiment of the present invention for operating the plate reduction press apparatus of the invention, the vertical positions of the upstream up and down table rollers near the dies are determined in such a manner that a long material to be shaped, which is to be inserted between the dies, is substantially horizontal, when the long material to be shaped is inserted, reduced and formed in the direction of the plate thickness between both dies, the portion of the material to be reduced and shaped is moved smoothly.

When the plate reduction press apparatus of the present invention is operated according to the method of one embodiment of the invention, the vertical positions of the upstream up and down table rollers and the downstream up and down table rollers are determined in such a manner that the material being reduced, shaped and fed out from between the dies is substantially horizontal, and the portion of the material to be reduced and shaped and the portion of the material being reduced and shaped are moved smoothly.

According to the method of the present invention for operating the high-reduction press apparatus of the invention, the vertical positions of the downstream up and down table rollers are determined to correspond with the positions of the upstream table rollers and the downstream table rollers, and material passed between the dies without being reduced and shaped is moved smoothly.

When the plate reduction press apparatus of the present invention is operated by the method of a further embodiment, the positions of the upper surfaces of the upstream up and down table rollers are determined to be identical to the positions of the upper surfaces of the downstream table rollers, and material passed between the dies without being reduced and formed is moved smoothly.

In the method of the present invention for operating the high-reduction press apparatus according to one embodiment of the invention, the vertical positions of the upstream up and down table rollers and the downstream up and down table rollers are determined to be the same as each other, and material passed between the dies without being reduced and shaped is moved smoothly.

Furthermore, according to the plate reduction pressing method according to one embodiment of the present invention for achieving the aforementioned first object of the invention, a first reduction in plate thickness is performed; in this sub-method the material to be shaped is transferred from the upstream side of the transfer line to the downstream side of the transfer line, upstream dies with forming surfaces facing the above-mentioned material to be shaped are moved towards the material to be shaped as the upstream dies are moved in the downstream direction of the transfer line and the upstream dies are moved away from the material to be shaped as the upstream dies are moved in the upstream direction of the transfer line, in synchronism with each other, and the aforementioned material to be shaped is reduced and shaped in the direction of the plate thickness sequentially, and then the second reduction in plate thickness is carried out; in this sub-method, downstream dies with forming surfaces facing the above-mentioned material to be shaped are moved towards the material being shaped in the opposite phase to the phase of the upstream dies while the downstream dies are moved in the downstream direction of the transfer line from above and below a portion of the material, whose thickness has been reduced by the first plate thickness reduction sub-method, and the downstream dies are moved away from the material being shaped as the downstream dies are moved in the upstream direction of the transfer line, in synchronism with each other, and the material which has been shaped by the first plate reduction is further reduced and shaped in the direction of the plate thickness sequentially.

With the plate reduction press apparatus according to a further embodiment of the present invention, upstream sliders are arranged vertically opposite each other on opposite sides of a transfer line; in which a material to be shaped is transferred, mechanisms for moving the upstream sliders move the above-mentioned upstream sliders towards the transfer line and move the upstream sliders away from the transfer line, upstream dies are mounted on the upstream sliders in such a manner that the upstream dies can move along the direction of the transfer line, and are comprised of forming surfaces facing the transfer line, mechanisms for moving the upstream dies move the above-mentioned upstream dies in a reciprocating manner in the direction of the transfer line, downstream sliders are located on the transfer line downstream of the upstream sliders, opposite each other on opposite sides of the transfer line, mechanisms for moving the downstream sliders move the downstream sliders towards the transfer line and move the downstream sliders away from the transfer line, downstream dies are mounted on the downstream sliders in such a manner that the downstream dies can move along the direction of the transfer line, and are comprised of forming surfaces facing the transfer line, and mechanisms for moving the downstream dies move the downstream dies in a reciprocating manner in the direction of the transfer line.

The plate reduction press apparatus according to a further embodiment of the present invention is provided with, in addition to the components of the plate reduction press apparatus of the invention, mechanisms for moving the upstream sliders comprised of upstream crank shafts arranged on the opposite side of the upstream sliders from the transfer line, and upstream rods one end of each of which is connected to an eccentric portion of one of the upstream crank shafts through a first bearing and the other end of each of which is connected to one of the upstream sliders through a second bearing, and mechanisms for moving the downstream slider comprised of downstream crank shafts arranged on the opposite side of the downstream sliders from the transfer line, and downstream rods one end of each of which is connected to an eccentric portion of one of the downstream crank shafts through a third bearing and the other end of each of which is connected to one of the downstream sliders through a fourth bearing.

Furthermore, the plate reduction press apparatus in one embodiment of the present invention is provided with, in addition to the component devices of the plate reduction press apparatus of the invention as described above, a synchronous drive mechanism that rotates the upstream crank shafts and the downstream crank shafts in synchronism in the same direction in such a manner that the eccentric portions of both of the upstream and downstream crank shafts maintain a phase difference of 180°.

Moreover, the plate reduction press apparatus of a further embodiment of the present invention is comprised of, in addition to the component devices of the plate reduction press apparatus of the invention, upstream crank shafts and downstream crank shafts supported by bearings in such a manner that both the above-mentioned crank shafts are substantially parallel to the direction orthogonal to the transfer line.

In the plate reduction pressing method according to one embodiment of the present invention, an unreduced and unformed portion of the material to be shaped is reduced and formed in the direction of its plate thickness by the upper and lower upstream dies, in the first plate thickness reduction sub-method, and then the portion of the material to be shaped, that has been reduced and formed, is further reduced and formed in the direction of its plate thickness by the upper and lower downstream dies, in the second plate thickness reduction sub-method, thereby the material to be shaped is reduced and shaped efficiently in the direction of its plate thickness.

In addition, the first and second plate thickness reduction sub-methods are operated alternately on an unreduced and unformed portion and a partially reduced portion of the material to be shaped, respectively, in order to reduce the loads applied to the upstream and downstream dies during reduction.

In any of the plate reduction press apparatus of the present invention, the mechanisms for moving the upstream sliders move the upstream dies towards the transfer line together with the upstream sliders, and an unreduced and unformed portion of the material to be shaped is reduced in the direction of its plate thickness by the upper and lower upstream dies, and then the mechanisms for moving the downstream sliders move the downstream sliders and downstream dies towards the transfer line, and the portion of the material to be shaped, already reduced by the upstream dies, is further reduced in the direction of its plate thickness by the upper and lower downstream dies, thus the material to be shaped is reduced and formed efficiently in the direction of its plate thickness.

In addition, the upstream and downstream dies are moved towards and away from the transfer line, in the opposite phase to each other, by means of the mechanisms for moving the upstream and downstream sliders, respectively, so that the loads applied to the upstream and downstream dies during reduction are made smaller.

According to the plate reduction press apparatus of one embodiment of the present invention, as invented to achieve the first object of the invention, a pair of dies are arranged opposite each other on opposite sides of a transfer line of a material to be shaped and moved toward and away from each other in synchronism with each other, upstream side guides are arranged in the close vicinity of the aforementioned dies in the upstream direction of the transfer line in such a manner that the upstream side guides are opposite each other in the lateral direction of the material to be shaped on opposite sides of the transfer line, and comprised of a first pair of side guide units that can move towards and away from the transfer line, and downstream side guides arranged in the close vicinity of the above-mentioned dies in the downstream direction of the transfer line in such a manner that the downstream side guides are opposite each other in the lateral direction of the material being shaped on opposite sides of the transfer line, and comprised of a second pair of side guide units that can move towards and away from the transfer line.

The plate reduction press apparatus of the present invention is provided with a pair of dies arranged opposite each other on opposite sides of a transfer line of a material to be shaped and moved towards and away from each other in synchronism with each other, upstream side guides arranged in the close vicinity of the aforementioned dies in the upstream direction of the transfer line in such a manner that the upstream side guides are opposite each other in the lateral direction of the material to be shaped on opposite sides of the transfer line, and comprised of a first pair of side units that can move towards and away from the transfer line, upstream vertical rollers supported by the corresponding upstream side guides in such a manner that the upstream vertical rollers can contact the lateral edges of the material to be shaped, when the material passes between the above-mentioned upstream side guides, downstream side guides arranged in the close vicinity of the aforementioned dies in the downstream direction of the transfer line in such a manner that the down stream side guides are opposite each other in the lateral direction of the material being shaped on opposite sides of the transfer line, and comprised of a second pair of side guide units that can move towards and away from the transfer line, and downstream vertical rollers supported by the corresponding downstream side guides in such a manner that the downstream vertical rollers can contact the lateral edges of the material being shaped, when the material passes between the downstream side guides.

In any of the plate reduction press apparatus according to one embodiment of the present invention, a material to be reduced and shaped is moved from the upstream side to the downstream side of the transfer line, guided into the upper and lower dies by the left and right side guide units of the upstream side guides, the material to be shaped, after being reduced and formed by the dies and fed out on the downstream side of the transfer line, is prevented from being deflected to the left or right, by the left and right side guide units of the downstream side guides.

With the plate reduction press apparatus according to one embodiment of the present invention, when the material to be shaped is guided into the dies by the left and right side guide units of the upstream side guides, the lateral edges of the material are guided by the upstream vertical rollers to protect the lateral edges of the material to be shaped from rubbing against the side guide units, and the lateral edges of the material to be shaped are restrained by the left and right side guide units of the downstream side guides to prevent the material to be shaped from being deflected to the left or right, and guided by the downstream vertical rollers to protect the lateral edges of the material to be shaped from rubbing against the side guide units.

2. The second object of the present invention is to provide a plate reduction press apparatus with (1) the capability of a flying press apparatus that can reduce a material to be pressed while it is being moved, (2) small number of component parts and a simple configuration, (3) a reduced number of portions that slide under load, (4) the capability for operating under a heavy load at a high operating rate, and (5) a simply constructed means of adjusting the positions of the dies and correcting the thickness of a material to be pressed.

The plate reduction press apparatus according to one embodiment of the present invention offers a plate reduction press apparatus provided with upper and lower drive shafts arranged opposite each other above and below a material to be pressed, and made to rotate, upper and lower press frames one end of each of which engages with one of the aforementioned drive shafts in a freely slidable manner, and the other ends of which are connected together in a freely rotatable manner, a horizontal guide device that supports the above-mentioned press frames at the point of connection in a manner that allows them to slide in the horizontal direction, and upper and lower dies mounted at the ends of the upper and lower press frames, opposite the material to be pressed, in which the upper and lower drive shafts are constructed as a pair of eccentric shafts that are located at both lateral ends and which have a phase difference relative to each other, and the upper and lower dies that are opened and closed with a rolling action by rotating the drive shafts, and the material to be pressed is transferred as the material is being pressed.

According to the configuration of the present invention as described above, when the drive shafts are rotated, the upper and lower dies move in a circular path, while rolling laterally at the same time, and are opened and closed by the pair of eccentric shafts of which the phase angles are shifted relative to each other. Consequently, the material to be pressed can be conveyed while being pressed, because the upper and lower dies move in the direction of the line while they are closing. In addition, because the upper and lower dies close with a rolling action, the load during pressing can be reduced. The amount of reduction is determined by the eccentricity of the eccentric shafts, so high-reduction pressing is possible without being limited by a nip angle, etc. Moreover, because the material to be pressed is conveyed while being reduced, the apparatus operates as a flying press.

In addition, only the eccentric shafts withstand loads during pressing, and the horizontal guide device is acted on by only a rather small load that only cancels the moments applied to the press frames, and furthermore, the moments applied to the upper and lower press frames cancel each other, so that the load imposed on the horizontal guide device is further reduced. Therefore, the construction can be simplified with a small number of component parts, and with a small number of portions that slide under load during pressing, and as a result, the apparatus can operate with high loads at a high operating frequency.

According to the plate reduction press apparatus according to a further embodiment of the present invention, a driving device to rotate and drive the drive shafts is provided, and the rotational speed of the driving device can be varied, and the rotational speed is determined in such a manner that the speed of moving the dies during reducing substantially matches the speed of feeding the material to be pressed.

With this configuration, the speed of the dies in the line direction can be made to be substantially equal to the speed of feeding the material to be pressed (a slab), so the load on the driving device that rotates and drives the drive shafts can be reduced.

The plate reduction press apparatus according to a further embodiment is provided with a looper device that creates a slack portion in the material to be pressed on the downstream side and holds up the material. In this configuration, the looper device can absorb deviations between the speed of the dies in the line direction and the speed of feeding the material to be pressed, so that the line speed can be synchronized with a finish rolling mill located further downstream.

The plate reduction press apparatus according to a further embodiment of the present invention provides a plate reduction press apparatus configured with upper and lower crank shafts arranged opposite each other above and below a material to be pressed and made to rotate, upper and lower press frames one end of each of which engages with one of the aforementioned crank shafts in a freely slidable manner, and the other ends of which are connected together in a freely rotatable manner, horizontal guide devices that support the above-mentioned press frames at the point of connection in a manner that allows them to move horizontally, and upper and lower dies mounted at the ends of the upper and lower press frames, opposite the material to be pressed; in which the crank shafts rotate to open and close the upper and lower dies, so transferring the material while pressing the material to be pressed, the material is transferred.

According to the above configuration based on the present invention, the upper and lower dies move in a circular path when the crank shafts rotate, and open and close. Consequently, as the upper and lower dies move in the direction of the line while closing, the material to be pressed can be conveyed while being reduced. The amount of reduction is determined by the eccentricity of the crank shafts, therefore high-reduction pressing is possible without being limited by a nip angle, etc. Also, the apparatus operates as a flying press because the material to be pressed is transferred while being reduced.

In addition, only the crank shafts withstand loads during pressing, and because the horizontal guide devices are acted on by only relatively small loads that are sufficient to only cancel the moments acting on the press frames, and also because the moments applied to the upper and lower press frames cancel each other, the loads on the horizontal guide devices become still smaller. As a result, the construction of the apparatus is made simple with few component parts, and with a small number of components that slide under load during pressing, so that the apparatus can operate with large loads at a high operating frequency.

With the plate reduction press apparatus according to yet another embodiment of the present invention, a driving device for rotating and driving the crank shafts is provided, and the rotational speed of the driving device is variable and is determined in such a manner that the speed of the dies in the line direction during pressing substantially matches the speed of feeding the material to be pressed.

With this configuration mentioned above, the speed of the dies in the line direction can be made to be substantially the same as the speed of feeding the material to be pressed (a slab), so the load on the driving device that rotates and drives the crank shafts can be reduced.

The plate reduction press apparatus according to another embodiment is provided with a looper device that creates a slack portion in the material to be pressed on the downstream side and holds up the material. Using this configuration, the looper device can absorb differences between the speed of the dies in the line direction and the speed of feeding the material to be pressed, so that the speed of the line can be synchronized with that of a finish rolling mill located further downstream.

The plate reduction press apparatus according to another embodiment is provided with up and down height adjusting plates that are maintained between the dies and the press frames, and the plates adjust the heights of the dies. By replacing these height adjusting plates, the heights of the dies can be adjusted freely, so compared to a conventional screw mechanism, etc., the construction of the apparatus can be made tougher, simpler, and more compact than a conventional one, consequently, the apparatus vibrates less and fails less often than a conventional machine, so the apparatus according to the present invention can be maintained more easily whilst the cost is reduced.

According to a further embodiment of the present invention, a hot slab pressing method is provided in which the feeding speed of the material to be pressed is made variable, relative to the maximum speed of the dies in the line direction. According to a preferred embodiment of the present invention, the speed of feeding the material to be pressed is varied in such a manner that at the beginning of pressing, the speed is made greater than the aforementioned maximum speed, and is made smaller at the intermediate and final stages.

The plate reduction press apparatus according to another embodiment of the present invention is comprised of upper and lower eccentric drive shafts arranged opposite each other above and below a material to be pressed and made to rotate, upper and lower synchronous eccentric shafts that rotate around the axes of the above-mentioned eccentric drive shafts, upper and lower press frames one end of each of which engages with one of the synchronous eccentric shafts in a freely slidable manner, and the other ends of which are connected together in a freely rotatable manner, and upper and lower dies mounted at the ends of the upper and lower press frames, facing the material to be pressed; in which the upper and lower dies are opened and closed by rotating the upper and lower eccentric drive shafts, and when the material to be pressed is pressed by the dies, the synchronous eccentric shafts synchronize the speed of the press frames in the direction of the transfer line with the speed of the material to be pressed in the direction of the transfer line.

With the configuration mentioned above according to the present invention, when the drive shafts are rotated, the upper and lower eccentric shafts rotate around fixed axes, and due to the rotation of the eccentric shafts, the upper and lower dies move in circular paths while opening and closing. As a result, the upper and lower dies can convey the material to be pressed in the direction of the line while reducing the material, by synchronizing the speed of the press frames in the direction of the line with the speed of the material to be pressed by means of the synchronous eccentric shafts during pressing with the dies. In this way, the amount of the reduction is determined by the eccentricity of the eccentric shafts without any nip angle restriction, etc., so high-reduction pressing can be carried out.

In this apparatus, only the eccentric shafts (dual-eccentric shafts) that rotate around the axes of the fixed shafts withstand loads during pressing, and only rather small loads that merely cancel the moments acting on the press frames are applied to the connection portions, in addition, because the moments acting on the upper and lower press frames cancel each other, the loads are further reduced. Therefore, there are few component parts, the construction is simple, there are only a small number of sliding locations which are loaded during pressing, and the apparatus can operate with high loads at a high operating frequency.

3. The third object of the present invention is to offer a plate reduction press apparatus and methods by means of which a slab is transferred while the plate thickness is being reduced with a high reduction ratio, and for which the construction of the apparatus is rather simple and which can reduce the slab with little vibration, and for which the required length of the apparatus in the line direction can be reduced.

To achieve the aforementioned third object, one embodiment of the present invention presents a plate reduction press apparatus provided with crank shafts arranged above and below a material to be pressed, sliders which engage with the above-mentioned crank shafts in a freely slidable manner and are moved with an eccentric motion, dies mounted on the sliders facing the material to be pressed, and a driving device for driving and rotating the crank shafts, in which the aforementioned crank shafts are composed of eccentric shafts that engage with the sliders, and support shafts arranged on both sides of the eccentric shafts with shaft center lines offset from the shaft center lines of the eccentric shafts, and at least one of the support shafts is comprised of a counterweight with an eccentric center substantially in a direction at 180°, to the direction of eccentricity of the eccentric shafts.

The crank shafts engage directly with the sliders, and when the crank shafts rotate, the eccentric shafts are rotated eccentrically about the axes of the support shafts, so the sliders move up and down and reduce the material to be pressed, while also moving backwards and forwards in the direction of the flow of material to be pressed. Thus, the sliders and the dies also move in the direction of the flow of material to be pressed during pressing, therefore the mechanisms for feeding the material during pressing, shown in FIG. 8, are not required. Consequently, the apparatus operates as a flying press and has a small number of component parts and a simple construction. In addition, because the counterweight provided on the support shafts is offset in a direction substantially 180° to the eccentricity of the eccentric shafts, the accelerations and decelerations acting on the sliders are canceled and the vibration of the apparatus is reduced.

The plate reduction press apparatus according to another embodiment of the present invention is comprised of upper and lower press frames one end of each of which engages with one of the crank shafts in a freely slidable manner and is rotated eccentrically, and the other ends of which are connected together in a freely rotatable manner, horizontal guide devices that restrain the press frames at the point where they are connected together in a manner such that they are free to move in the horizontal direction, dies mounted at the ends of the above-mentioned press frames facing the material to be pressed, and a driving device for driving and rotating the aforementioned crank shafts, in which the crank shafts are provided with eccentric shafts engaged with the above-mentioned ends of the press frames, and support shafts arranged on both sides of the eccentric shafts with shaft center lines eccentric to the shaft center lines of the eccentric shafts, and at least one of the support shafts is comprised of a counterweight with an eccentric center substantially in a direction at 180°, to the direction of eccentricity of the eccentric shafts.

In this configuration as mentioned above, the ends of the press frames move in a circular path as the crank shafts rotate, so the dies connected thereto move up and down and reduce the material to be pressed, while also moving backwards and forwards in the direction of the flow of the material to be pressed, consequently by selecting the direction of rotation of the crank shafts, the dies can be made to move in the direction of the flow of the material to be pressed during pressing, that is, a flying press operation can be achieved. The other ends of the upper and lower press frames are connected together in a freely rotatable manner, and are guided so that they can only move in the horizontal direction, therefore the reaction moment imposed on one end during pressing can be canceled by the one from the other end. The apparatus according to this embodiment also does not require the mechanisms for feeding the material during pressing, shown in FIG. 8. Consequently there are few components and the construction is simple. In addition, the support shafts are provided with a counterweight of set in a direction substantially at 180° to the direction of eccentricity of the eccentric shafts, so that accelerations and decelerations produced at the two ends are canceled out and the vibration of the apparatus can be reduced.

According to a further embodiment of the invention, the aforementioned counterweight has a mass sufficient to store rotational energy and also works as a flywheel.

As the counterweight rotates on a support shaft, it can store rotational energy, and it functions as a flywheel by means of a sufficient mass provided in the counterweight.

According to a still further embodiment of the invention, the inertia force due to the eccentricity of the counterweight is determined so as to substantially cancel out the inertia forces from the sliders and the inertia forces of the ends of the press frames.

Using the configuration described above, the vibration of the reduction press apparatus can be greatly reduced.

According to a still further embodiment of the invention which is aimed at achieving the third object mentioned above, the apparatus is provided with dies arranged above and below a slab, and equipped with sliders for each of the dies to give the dies an up, down, backwards and forwards swinging motion and a driving device for driving the sliders, in which each of the sliders is composed of a main unit with a circular hole with its center line in the lateral direction of the slab, and a crank with a first axis that engages with the circular hole and a second shaft with a diameter smaller than the diameter of the first shaft with its center line offset from the axis of the first shaft, and the second shaft is rotated and driven by the driving device.

When the second shaft rotates, the first shaft operates as a crank about the center line of the second shaft, and the first shaft engages with the circular hole and, moves the main unit up and down, and backwards and forwards. Thereby, the sliders press the dies, and can move the dies in a forward direction during pressing, so that the slab is transferred forwards (in the direction of the flow of the slab) while being reduced, therefore a continuous pressing operation is enabled. The invention thus provides a large amount of reduction because the dies press the slab from both the upper and lower sides of the slab.

According to another embodiment of the invention, there are dies arranged above or below a slab, sliders for giving the dies an up and down and backwards and forwards swinging motion, a driving device for driving the sliders, and slab supporting members arranged opposite the dies above and below the slab, in which each of the sliders is comprised of a main unit with a circular hole with its axis in the lateral direction of the slab, a first shaft engaged with the circular hole, and a crank composed of a second shaft with a diameter smaller than the diameter of the first shaft and with its center line offset from the axis of the first shaft, and the second shaft is rotated and driven by the driving device.

The apparatus according to this embodiment is provided with dies either above or below the slab, and slab supporting members are arranged opposite the dies above or below the slab, to support the slab. Compared to the invention of the prior embodiment, the amount of the reduction is smaller, and there is friction between the slab and the support members when the slab being reduced moves forwards, but the construction is simpler, and the cost can be further reduced.

In the scope of the invention according to a still further embodiment, the circular holes and the cranks provided in the aforementioned sliders are arranged in pluralities in a row along the direction of flow of the slab, and one crank accepts the force due to the moment of the load, and the other cranks produce pressing forces in this configuration.

By arranging pluralities of circular holes and cranks in a row in the direction of flow of the slab (forwards), the dies can be maintained parallel to each other. In addition, the pressing loads can be distributed to several cranks, so the construction of each crank can be made simpler.

In the invention according to yet another embodiment, the circular holes and the cranks provided in the above-mentioned sliders are arranged in pluralities in a row, and one crank accepts the force due to the load moments, and the other cranks are configured to produce pressing forces.

With this configuration, one crank bears the forces due to the unbalanced moments of the loads, and the other cranks generate only pressing forces, so the overall efficiency of a press machine can be increased.

With the invention according to still a further embodiment, the slab is conveyed by pinch rolls or tables, and when the sliders press the slab, it is conveyed at the same speed as the speed of the sliders in the forward direction.

When the sliders press the slab, the slab is transferred at the same speed as the forward speed of the sliders, and at other times, the slab is conveyed at an appropriate speed, for example, a speed synchronized with that of a subsequent machine. In this way, the slab can be reduced most suitably and conveyed continuously.

In the invention according to another embodiment, the distance L in which the slab moves in a cycle of the pressing period plus the period with a normal transfer speed, is not longer than the length L1 of the dies in the direction of flow of the slab.

Because the distance L slab 1 moves per cycle is no longer than the length L1 of the dies in the direction of flow of the slab, the reduction length for the next cycle is slightly superimposed on the length reduced in the previous cycle. Thus, the reduction in thickness can be properly accomplished.

According to a further embodiment of the present invention, aimed at achieving the third object mentioned above, the plate reduction press apparatus is provided with a pair of dies arranged opposite each other above and below a slab, and a swinging device that gives each of the dies a swinging motion backwards and forwards, towards the slab, and eccentric shafts rotating in the above-mentioned circular holes, in which each of the aforementioned eccentric shafts is comprised of a first shaft rotating in a circular hole with center line A on the same axis as the circular hole, and driving a second shaft with a center line B offset from that of the first shaft by a difference c.

According to this configuration, the two eccentric shafts rotating in a pair of circular holes in the sliders are located at an inclined angle or perpendicular to the direction of feeding the slab, therefore compared to the case in which the eccentric shafts are installed parallel to the line direction, the required length of the apparatus in the direction of the line can be reduced. In particular, when the eccentric shafts are arranged at an inclined angle, the pressing forces acting on the two eccentric shafts can be shared equally, so that the length of the apparatus in the direction of the line can be reduced at the same time as giving equal loading to each eccentric shaft. When the eccentric shafts are installed perpendicular to the direction of feed of the slab, it is possible to load the inner eccentric shafts more than the outer ones, and to make the outer eccentric shafts smaller.

Another embodiment of the present invention provides a plate reduction pressing method using a pair of dies arranged opposite each other above and below a slab, and a swinging device that moves each of the dies towards the slab, in which the slab is synchronized with the feeding speed of the dies when the slab is being pressed by the dies, and during the non-pressing period when the slab is separated from the dies, the slab is fed at a constant speed corresponding to a predetermined cycle speed.

Using this method mentioned above, the slab can be conveyed according to the upstream and downstream slab transfer speeds, so the entire line can be operated continuously.

4. The fourth object of the present invention is to provide plate reduction press apparatus and methods that can press a slab at a high speed with a large reduction, using a small pressing force, small driving power, and a small configuration of the entire press facilities.

To achieve the fourth object given above, the invention discloses a plate reduction press apparatus in which the longitudinal direction is defined as the direction in which a material to be pressed moves after being pressed, and N dies each of which has the same length in the longitudinal direction are arranged with an interval of NL between each die, and press the material.

Instead of using dies with a length of NL in the longitudinal direction, N dies each with a length L are arranged in tandem, and the interval between each of the dies is made to be NL. After each of the dies has finished pressing a material to be pressed, the material is moved longitudinally by a length NL. In this way, the material to be pressed can be reduced continually in lengths equal to the length NL. When a press machine is reciprocated at a high speed, inertia forces are created, and the magnitude of these forces depends on the GD2 of the component members that are being reciprocated. The GD2 value of a reciprocating body is greater than the sum of the GD2 values of each segment if the body is divided into N segments. Accordingly, the apparatus can be operated at a higher speed by dividing the dies into segments, because the total inertia force is smaller. In addition, the driving power is reduced when the dies are divided.

With the invention according to another embodiment, the lateral direction is defined as the direction orthogonal to the aforementioned longitudinal direction, and the longitudinal length of the dies is less than the length of the dies in the lateral direction.

The volumes of a material to be pressed, before and after pressing, are substantially equal to each other, therefore the volume of a reduced portion is spread out both longitudinally and laterally. However, if dies are long in the longitudinal direction, the material cannot be displaced easily in the longitudinal direction, so pressing with a large reduction becomes difficult, however because the length of the dies in the longitudinal direction is smaller than the length thereof in the lateral direction, the material can also be displaced fairly easily in the longitudinal direction, so that pressing with a large reduction can be achieved, and also the driving power of the plate reduction press apparatus is reduced.

In the invention according to a still further embodiment, the N dies press a material to be pressed at the same time.

As N dies press simultaneously, the pressing time can be made short and high-speed pressing can be achieved.

With the invention according another embodiment, at least one of the dies presses at a different time from the time the other dies press.

The power for driving a plurality of dies can be reduced by separating the dies into several or a couple of groups and differentiating the pressing times.

According to the plate reduction pressing method according to one embodiment for achieving the aforementioned fourth object of the present invention, the number of press machines pressing a material to be pressed with a press length L in the direction of the flow of the material to be pressed is defined as K, the press machines are arranged with K=1 on the upstream side of the pressing line, and with K increasing sequentially to K=N on the downstream side when N press machines are arranged in tandem, the material to be pressed is pressed in sequence from K=N to K=1, then after the material to be pressed is fed by a length NL, that is, the total of the pressing lengths of all the press machines, the pressing sequence from K=N to K=1 is repeated. The pressing force of each press machine is reduced by shortening the length L of the material to be pressed by each press machine from K=1 to K=N, so that press facilities are made smaller.

According to a still further embodiment of the invention, the number of press machines pressing a material to be pressed with a press length L in the direction of the flow of the material to be pressed is defined as K, the press machines are arranged with K=1 on the upstream side of the pressing line, and with K increasing sequentially to K=N on the downstream side when N press machines are arranged in a tandem configuration, each press machine reduces the material by Δt, press machine K reduces the material by at from its thickness after being pressed by press machine K−1, and the material is pressed by repeatedly feeding the material by one press length L after pressing the material in sequence from press machine K=1 to press machine K=N.

Each press machine, K=1 to K=N, presses the same portion of a material to be pressed in turn, by an amount Δt each, that is, by a total of NΔt, therefore a large amount of reduction can be obtained in total, although each press machine only exerts a small pressing force. Accordingly, the capacity of each press machine can be small, and the pressing facilities are reduced in size.

5. The fifth object of the present invention is to provide a plate reduction press apparatus and methods with which a reduction operation by a reduction press machine and a rolling operation by a downstream rolling mill can be carried out at the same time, the capacities of the device for transferring the material to be pressed and the device to provide a swinging motion during reduction are small, the apparatus can be easily operated in series with downstream equipment, and even if the moving speed of the dies becomes different from the moving speed of the conveyor device during a pressing operation, the equipment will not be damaged, the material being pressed will not be bent, nor will the conveyor device be overloaded.

To achieve the fifth object described above, the invention is provided with speed adjusting rolls arranged between a reduction press machine and a rolling mill with spaces provided to deflect the material to be pressed, metering instruments arranged near the aforementioned speed adjusting rolls or in the vicinity thereof, to measure the length of the material to be pressed which has passed, and a control apparatus for controlling the operations of the above-mentioned reduction press machine and adjusting both speed adjusting rolls according to the measurement of the length metering instrument.

The control apparatus controls the operations of both the speed adjusting rolls and the press machine so that the material to be pressed is deflected between the press machine and the rolling mill to absorb any speed difference between the press machine and the rolling mill when the material is passing between them, length metering instruments are provided at both ends of the deflection between the press machine and the rolling mill to determine the difference between lengths passed, and the difference between the lengths passed is absorbed by the deflection and maintained in a predetermined range. Thereby, the press machine can press the material simultaneously with the operation of the rolling mill. The press machine can be either a flying press machine or a start-stop press machine, as far as simultaneous operation is concerned.

According to another embodiment of the invention, the aforementioned control apparatus takes the difference in the measured lengths of material which has passed the two length metering instruments over a period of a multiple of pressing cycles of the press machine, adjusts the number of pressing cycles of the press machine or the transfer speed of the speed adjusting rolls, or a combination thereof, and controls the pressing operations in such a manner that the difference in the lengths passed is brought to 0.

The difference in the lengths of material passed over a period of a multiple of pressing cycles of the press machine is absorbed by the deflection, while the control apparatus makes an adjustment by increasing or decreasing the number of pressing cycles per unit time of the press machine, or increases or decreases the transfer speed of each speed adjusting roll, or a combination of both, in order to bring the difference in the lengths passed close to 0.

According to a further embodiment of the invention, a deflection metering instrument is provided to measure the deflection of the material to be pressed, between the above-mentioned speed adjusting rolls, and the aforementioned control apparatus controls the pressing operations according to measurements thereof in such a manner that the deflections remain within a predetermined range.

Using the configuration described above, the deflection is kept within a predetermined range, so the press machine and the rolling mill are protected from excessive forces that might otherwise be applied if the deflection became too small, and also the elongation of the material being pressed at a high temperature due to an excessive deflection, can be prevented from occurring.

The invention according to a further embodiment provides a conveyor apparatus for the material being pressed that can be raised and lowered and is arranged between the aforementioned speed adjusting rolls, in which the material to be pressed is conveyed substantially at the same level as the transfer level of the speed adjusting rolls, when the leading end or trailing end of the material to be pressed passes the conveyor apparatus.

At the section where the material to be pressed is given a deflection, the conveyor apparatus is provided that can be raised and lowered and is equipped with rolls for conveying the material being pressed, in which the rolls are lowered when a deflection has been formed, and when the leading end or trailing end of the material to be pressed passes the conveyor apparatus, the level of the conveyor rolls is made substantially the same as the transfer level of the speed adjusting rolls. In this way, the leading end or trailing end of the material to be pressed or being pressed can pass smoothly across the section used for the deflection.

The invention according to a still further embodiment is aimed at achieving the fifth object described above in the pressing method of a crank type press machine that presses a material to be transferred and pressed using upper and lower dies, in which the dies are moved at the same speed as the speed of the material to be pressed during the pressing period, and the speed of feeding the material to be pressed is adjusted during the period when there is no pressing taking place in such a manner that during one cycle, the material to be pressed is moved by a predetermined distance L.

The material to be transferred and pressed is pressed by dies from above and below the material, and during pressing, the material is transferred at the same speed as that of the dies, and when the material is not being pressed, the speed of the material is adjusted to move the material by a distance L for each cycle, so that the material to be pressed can be transferred at the same speed during each cycle. In addition, the variations in the transfer speed during a cycle are much less than those of a start-stop apparatus, and the vibration of the equipment is much less than that of a slider system.

The invention of another embodiment is provided with dies arranged above and below a material to be pressed, crank devices for pressing each of the dies, and transfer devices for transferring the material to be pressed, in which the transfer devices move the material to be pressed at the same speed as the dies when the crank devices are pressing the material to be pressed with the dies, and when the material to be pressed is not being pressed, the transfer devices adjust the speed of feeding the material to be pressed and move the material by a predetermined distance L during one cycle of the pressing operation, and the above-mentioned distance L is not greater than the length L0 which is the reduction length of the dies in the direction of flow of the material to be pressed.

The upper crank device presses the material to be pressed when the die is near its lowest point of travel, and the lower crank device presses the same when the die is in the vicinity of the highest point of travel. As long as the dies are pressing the material to be pressed, the transfer devices transfer the material to be pressed and being pressed at the same speed as that of the dies. The distance L in which the transfer devices move the material to be pressed during one cycle of the crank devices is less than the length L0 in which the dies press the material in the direction of transfer, so the material to be pressed is pressed sequentially by one length at a time. In this mode of operation, variations in the transfer speed of the material to be pressed are limited to a reasonable range, therefore large-capacity transfer devices are not required. Furthermore, with this configuration it is not necessary to give heavy sliders a swinging motion to match the speed of the material to be pressed, therefore, no high-capacity device is required for the swinging motion. In addition, as the material to be pressed is transferred substantially continuously, the apparatus can be integrated easily with a downstream rolling mill.

According to a still further embodiment of the invention, in the pressing method of a crank type press machine that presses a material to be pressed and transferred using dies on both sides in the lateral direction of the transfer line, during the pressing period, the material to be pressed is moved at the same speed as the speed of the dies, and during the period when it is not being pressed, the speed of feeding the material to be pressed is adjusted in such a manner that during one cycle the material to be pressed is moved by a predetermined distance L.

The material to be pressed and transferred is pressed by the dies from both sides in the lateral direction, and during pressing, the material to be pressed is transferred at the same speed as that of the dies, and when the press machine is not pressing, the speed of the material to be pressed is adjusted to move the material by a distance L per cycle, so that the material to be pressed can be transferred at the same speed during each cycle. In addition, the variations in the transfer speed during a cycle are much less than those of a start-stop system, and the vibration is also much less than that of a slider system.

The invention of one embodiment is configured with dies arranged on both sides in the lateral direction of a material to be pressed, crank devices that press each of the dies in the lateral direction, and transfer devices that transfer the material to be pressed, in which the transfer devices move the material to be pressed at the same speed as the speed of the dies when the crank devices are pressing the material to be pressed in the lateral direction through the dies, and when the material to be pressed is not being pressed, the speed of feeding the material to be pressed is adjusted, and the material to be pressed is moved by a predetermined distance L in one cycle of a pressing operation, and the above-mentioned distance L is not greater than the length L0 which is the reduction length of the dies in the direction of flow of the material to be pressed.

The invention of a further embodiment is a modification of the invention of a prior embodiment using the apparatus of a prior embodiment for lateral pressing; the crank devices on both sides in the lateral direction of the material to be pressed, press the material in the lateral direction, using the dies, when they are near the point of travel closest to the material. While the dies press the material to be pressed, the transfer devices transfer the material at the same speed as that of the dies. Because the distance La that the transfer devices move the material to be pressed in one cycle of the crank devices is less than the pressing length La0 of the dies in the direction of flow of the material, the material to be pressed is pressed sequentially by a length La during each cycle. These operations keep the variations in the transfer speed of the material to be pressed in the limits of a reasonable range, so that no large-capacity transfer devices are required. In addition, because the configuration is such that heavy sliders do not have to be given a swinging motion corresponding to the speed of the material to be pressed, no large-capacity swinging device is needed. Also, as the material to be pressed is transferred essentially continuously, the material can be easily passed on to a downstream rolling machine.

According to yet another embodiment of the invention, a looper that forms a loop in the material to be pressed and adjusts the length thereof is provided downstream of the transfer devices specified above.

The transfer speed of the material to be pressed varies during one cycle of the crank devices. Consequently, the looper is provided to enable the material to be smoothly passed on to a subsequent rolling mill etc.

To achieve the fifth object described above, the invention of a further embodiment relates to the pressing method of a crank type press machine that presses a material to be transferred with pinch rolls and pressed with upper and lower dies; during the pressing period, the pinch rolls rotate in such a manner that the peripheral speed of the pinch rolls is made equal to the combination of the horizontal speed of the dies and the elongation speed of the material to be pressed, added or subtracted, and transfer the material to be pressed, and when the press machine is not pressing, the speed of feeding the material to be pressed is adjusted in such a manner that during one cycle, the material to be pressed is moved by a predetermined distance L, and the pressure of the pinch rolls during the pressing period is made smaller than the pressure thereof during the non-pressing period.

The material to be pressed and transferred is pressed by the dies from above and below the material, and during the pressing period, the pinch rolls are rotated at the peripheral speed equal to the sum of the horizontal speed of the dies plus or minus the elongation speed of the material to be pressed, and transfer the material to be pressed, and when the apparatus is not pressing, the speed of the pinch rolls is adjusted to give a moving distance of L per cycle, so the material to be pressed can be transferred at an equal speed during each cycle. In addition, because the pressure of the pinch rolls is made smaller during pressing than during the non-pressing period, even if there is a deviation between the sum of the speeds and the transfer speed of the pinch rolls, flaws can be prevented from being produced in the material to be pressed. Furthermore, variations in the transfer speed during a cycle are significantly smaller than those of a start-stop system, and the vibration is much less than that of a slider system.

The plate reduction press apparatus of another embodiment is provided with dies arranged above and below a material to be pressed, crank devices that press each of the dies, and pinch rolls that transfer the material to be pressed, in which the pinch rolls rotate in such a manner that the peripheral speed of the pinch rolls is made equal to a combination of the horizontal speed of the dies plus or minus the elongation speed of the material to be pressed, and transfer the material to be pressed when the crank devices are pressing the material to be pressed through the dies, and when the press machine is not pressing, the speed of feeding the material to be pressed is adjusted in such a manner that during one cycle, the material to be pressed is moved by a predetermined distance L and the distance L is not greater than the reduction length L0 of the dies in the direction of flow of the material to be pressed, and the pressure of the pinch rolls is made smaller during pressing with the dies than the pressure during the non-pressing period.

The upper crank devices press the material to be pressed using the dies, near the lowest point of travel, and the lower crank devices press the material with the dies near to the uppermost point of travel. While the dies are pressing the material to be pressed, the pinch rolls rotate at the same peripheral speed as the combined speed of the speed of the dies plus or minus the elongation speed of the material to be pressed, so that the material to be pressed is transferred. Because the distance L by which the pinch rolls transfer the material to be pressed during one cycle of the crank devices is less than the pressing length L0 of the dies in the direction of flow, the material to be pressed is pressed sequentially in steps each of length L. In addition, because the pressure of the pinch rolls is made smaller during pressing than the pressure during the non-pressing period, the material is protected from the occurrence of flaws even if there is a deviation between the combination speed and the transfer speed of the pinch rolls. Variations in the transfer speed of the material to be pressed are kept within reasonable limits during these operations, so no large-capacity transfer apparatus is required. Also, the configuration does not require heavy sliders to be given a swinging motion in synchronism with the speed of the material to be pressed, therefore no large-capacity swinging apparatus is needed. Because the material to be pressed is transferred essentially continuously, the press apparatus can easily be used in tandem with a downstream rolling mill.

According to the invention of another embodiment, the pressure on the above-mentioned pinch rolls is made smaller for a predetermined time t before or after the press machine begins to press.

By reducing the pressure on the pinch rolls at a predetermined time t before the press machine begins to press, the pinching force of the pinching rolls on the material to be pressed decreases, therefore the dies can grip the material to be pressed more firmly. The time t is the time required for gripping. When the pressure of the pinch rolls is made smaller at a predetermined time t after the beginning of pressing, it is intended to make sure the dies are capable of gripping the material to be pressed more firmly.

In the invention of a further embodiment, the pressure of the above-mentioned pinch rolls is made smaller when the pressing load becomes more than a predetermined value.

The pinch rolls press the material to be pressed with a high pressure until the pressing load of the press machine becomes more than a predetermined value, to securely feed the material to be pressed into the press machine, and thereafter the pressure is reduced.

The invention of a still further embodiment, aimed at achieving the fifth object mentioned above is comprised of inlet transfer devices that are arranged on the upstream side of a press machine, to transfer a material to be pressed, and can be raised and lowered, and outlet transfer devices that are arranged on the downstream side of the press machine, and transfer the material being pressed, and can be raised and lowered, in which the aforementioned inlet transfer devices are adjusted to give a height of transfer according to information which has been input concerning the thickness of the material to be pressed, in such a manner that the center line of the thickness of the material to be pressed is the same as the center line of the press machine, and the above-mentioned outlet transfer devices are adjusted for a height of transferring according to information about the thickness of the material after being pressed, in such a manner that the center line of the thickness of the material is the same as the center line of the press machine.

With a press machine in which a material to be pressed is transferred and pressed by dies from above and below the material, the press is designed so that a line midway between the dies is at a predetermined height, and the line passing through this height is called the press center line. The thickness of a material to be pressed has been measured during a process on the upstream side of the transfer line, when the material is delivered to the press machine. The height of transfer from the inlet transfer devices is determined so that the center of the thickness of the material coincides with the press center line. In addition, the thickness of the material after being pressed by the press machine is known from the design value of the press or by measurement, so the height of transfer of the outlet transfer devices is determined so that the center of the thickness of the material after being pressed matches the press center line. Consequently, the material being pressed is not bent after pressing, and also the outlet transfer devices will not be damaged.

In another embodiment of the invention, inlet transfer devices are provided that are arranged on the upstream side of a press machine for pressing a material to be pressed between upper and lower dies, that transfer the material to be pressed, and can be raised and lowered, and outlet transfer devices that are arranged on the downstream side of the aforementioned press machine, transfer the material being pressed, and can be raised and lowered, in which when the material to be pressed is passed through the press machine without being pressed with the upper and lower dies open, the transfer heights of the above-mentioned inlet transfer devices and the aforementioned outlet transfer devices are determined to be identical to each other and higher than the upper surface of the opened lower die.

In practice, a material to be pressed must sometimes be passed through a press machine without pressing, or a material which has been pressed unsuccessfully must be transferred in the reverse direction. In such cases, the upper and lower dies are opened, the transfer heights of the inlet transfer devices and the outlet transfer devices are made identical to each other and higher than the upper surface of the opened lower die, then the material to be pressed or which has been pressed can be passed either forwards or backwards.

According to a still further embodiment of the invention, the transfer method concerns the transfer devices that are arranged on the upstream and downstream sides of a press machine and can adjust the transfer height of a material to be pressed, in which both transfer devices can transfer the material to be pressed or after being pressed while the transfer devices maintain the height of the center of the thickness of the material to be pressed, unchanged during pressing.

The transfer devices arranged on the upstream and downstream sides of the press machine do not cause bending or otherwise adversely affect the material to be pressed and avoid unnecessary loads being imposed on the transfer devices, by adjusting the height of the center of the thickness of the material being pressed so that the height of the center of the thickness of the material is kept at the same level during transfer and pressing.

According to another embodiment of the invention, the transfer method concerns the transfer devices that are arranged on the upstream and downstream sides of a press machine and can adjust the transfer height of a material to be pressed, in which when the press dies are opened vertically in such a manner that the material to be pressed does not contact the dies when the material to be pressed is passed through the press machine, both transfer devices transfer the material to be pressed at the same height.

In practice, a material to be pressed must sometimes be passed through a press machine without pressing, or a material which has been pressed unsuccessfully must be transferred in the reverse direction. At this time, the press dies are opened upwards and downwards so that they do not touch the material to be pressed, and the material to be pressed is transferred with both transfer devices maintained at the same height.

The other objects and advantages of the present invention will be revealed as follows by referring to the attached drawings.

BRIEF DESCRIPTION OF THE DRAWINGS

FIGS. 69(A), 68(B) and 69(C) show the operation of the nineteenth embodiment, for the case in which each die presses in sequence.

DESCRIPTION OF THE PREFERRED EMBODIMENTS

Figure 1:
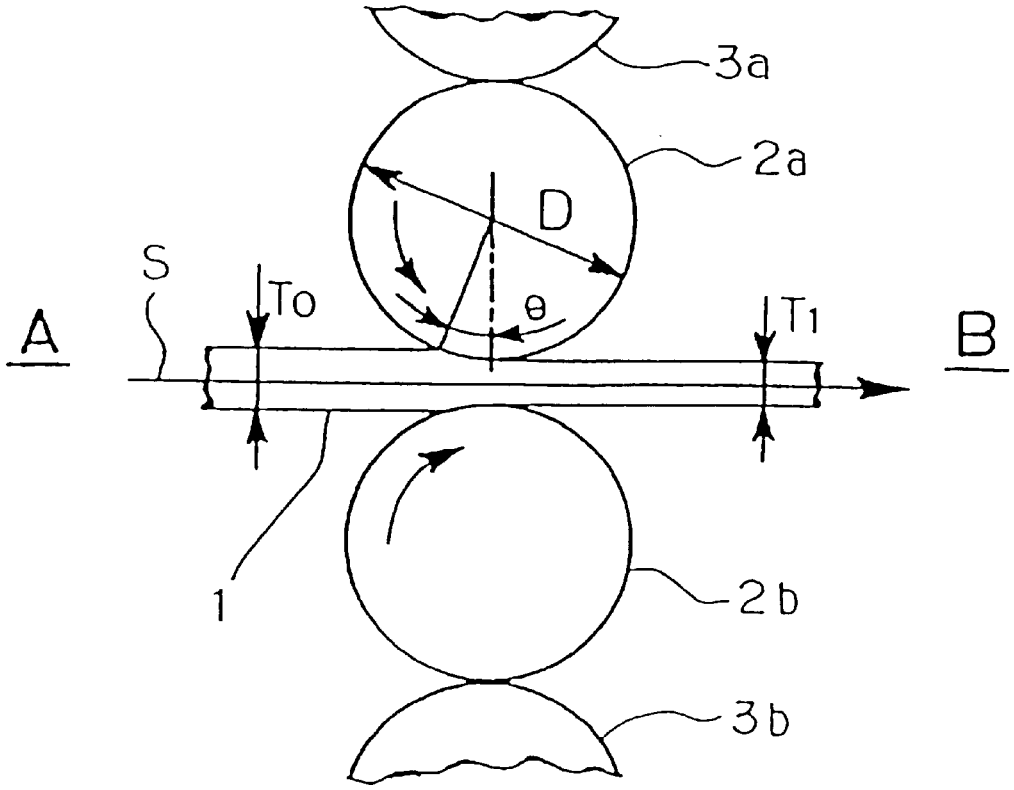
FIG. 1 is a schematic view of an example of a rolling mill used for hot rolling.

The embodiments of the present invention are described as follows referring to the drawings.

(First Embodiment)

FIGS. 9 to 13 show the first embodiment of the plate reduction press apparatus according to the present invention; this apparatus is provided with a housing 101 erected in a predetermined place on a transfer line S so that a plate-like material 1 to be shaped can pass through the center portion, upstream eccentric shafts 103*a*. 103*b* extending in the lateral direction of the material 1 to be shaped and provided with eccentric portions 102*a*, 102*b*, downstream eccentric shafts 105*a*, 105*b* extending in the same direction as the aforementioned upstream eccentric shafts 103*a*, 103*b* and provided with eccentric portions 104*a*, 104*b*, upstream rods 106*a*, 106*b* and downstream rods 107*a*, 107*b* extending up and down, die holders 109*a*, 109*b* for mounting dies 108*a*, 108*b*, and mechanisms 121*a*, 121*b* for moving the dies backwards and forwards.

The upstream eccentric shafts 103*a*, 103*b* are arranged inside the housing 101 such that the shafts are opposite each other above and below the transfer line S, and the non-eccentric portions 110*a*, 110*b* at both ends of the shafts are supported by upstream shaft boxes (not illustrated) mounted in the housing 101 through bearings.

The downstream eccentric shafts 105*a*, 105*b* are arranged inside the housing 101 in such a manner that the shafts are opposite each other above and below the transfer line S on the downstream B side of the transfer line downstream of the upstream eccentric shafts 103*a*, 103*b*, and the non-eccentric portions 111*a*, 111*b* at both ends of the shafts are supported by downstream shaft boxes (not illustrated) mounted in the housing 101 through bearings.

The drive shaft (not illustrated) of a motor is connected to one end of each of the upstream eccentric shafts 103*a*, 103*b* and the downstream eccentric shafts 105*a*, 105*b*, through a universal coupling and a gear box, so that each of the eccentric shafts 103*a*, 103*b*, 105*a* and 105*b* can rotate in synchronism together.

The gear box mentioned above is configured in such a manner that when the motor is operated, both upper eccentric shafts 103*a*, 105*a* rotate counterclockwise so that the eccentric portion 104*a* of the downstream eccentric shaft 105*a* rotates with a phase angle 90° ahead of the phase angle of the eccentric portion 102*a* of the upstream eccentric shaft 103*a*, and at the same time, both lower eccentric shafts 103*b*, 105*b* beneath the transfer line S rotate clockwise so that the eccentric portion 104*b* of the downstream eccentric shaft 105*b* rotates with a phase angle 90° ahead of the phase of the eccentric portion 102*b* of the upstream eccentric shaft 103*b*, as shown in FIGS. 11 through 15; in addition, the eccentric portions 102*a*, 104*a* and the eccentric portions 102*b*, 104*b* are positioned symmetrically to each other on opposite sides of the transfer line S.

The big ends of the upstream rods 106*a*, 106*b* are connected to the eccentric portions 102*a*, 102*b* of the upstream eccentric shafts 103*a*, 103*b* through bearings 112*a*, 112*b*.

The big ends of the downstream rods 107*a*, 107*b* are connected to the eccentric portions 104*a*, 104*b* of the downstream eccentric shafts 105*a*, 105*b* through bearings 113*a*, 113*b*.

The die holders 109*a*, 109*b* are installed inside the housing, such that the holders are opposite each other on opposite sides of the transfer line S.

Brackets 114*a*, 114*b* provided near the upstream A side of the transfer line on the die holders 109*a*, 109*b* are connected to the tips of the aforementioned upstream rods 106*a*, 106*b* by the pins 115*a*, 115*b* and bearings 116*a*, 116*b* extending substantially horizontally in the lateral direction of the material 1 to be shaped.

The tips of the above-mentioned downstream rods 107*a*, 107*b* are connected to brackets 117*a*, 117*b* provided near the downstream B side of the transfer line on the die holders 109*a*, 109*b*, by the pins 118*a*, 118*b* and bearings 119*a*, 119*b*, that are parallel to the pins 115*a*, 115*b*.

By means of these upstream rods 106*a*, 106*b* and downstream rods 107*a*, 107*b*, and the displacements of the eccentric portions 102*a*, 102*b* associated with the rotation of the above-mentioned upstream eccentric shafts 103*a*, 103*b* and the displacement of the eccentric portions 104*a*, 104*b* associated with the downstream eccentric shafts 105*a*, 105*b*, motion is transmitted to the die holders 109*a*, 109*b*, so that the die holders 109*a*, 109*b* move towards and away from the transfer line S with a swinging action.

The dies 109*a*, 109*b* mounted on each of the die holders 108*a*, 108*b* face the material 1 to be shaped, as it is being passed through the transfer line S, and when viewed from the side of the transfer line S, the dies are provided with forming surfaces 120*a*, 120*b* that are convex circular arcs projecting towards the transfer line S.

Mechanisms 121*a*, 121*b* for moving the dies backwards and forwards are composed of arms 122*a*, 122*b* one end of each of which is fixed to the end of one of the die holders 109*a*, 109*b*, near the downstream B side of the transfer line, and projecting in the downstream B direction of the transfer line, guide members 124*a*, 124*b* fixed at locations near to the downstream B side of the transfer line of the housing 101 and comprised of grooves 123*a*, 123*b* inclined at an angle to the transfer line so that the distance from the transfer line increase in the downstream B direction, and guide rings 126*a*, 126*b* connected to the tips of the arms 122*a*, 122*b* through pins 125*a*, 125*b* in a rotatable manner, which engage with the grooves 123*a*, 123*b* of the guide members 124*a*, 124*b* in a movable manner.

The mechanisms 121*a*, 121*b* for moving the dies backwards and forwards give the die holders 109*a*, 109*b* a reciprocating motion relative to the transfer line S, so that the die holders 109*a*, 109*b* move towards and away from the transfer line S with a swinging motion, associated with the rotation of the upstream eccentric shafts 103*a*, 103*b* and the downstream eccentric shafts 105*a*, 105*b*, as described previously.

The operation of the plate reduction press apparatus shown in FIGS. 10 through 13 is described as follows, with particular emphasis on the upstream eccentric shaft 103*a*, downstream eccentric shaft 105*a*, upstream rods 106*a*, downstream rods 107*a*, dies 108*a*, and die holders 109*a*, on the upstream side of the transfer line S.

Figure 10:
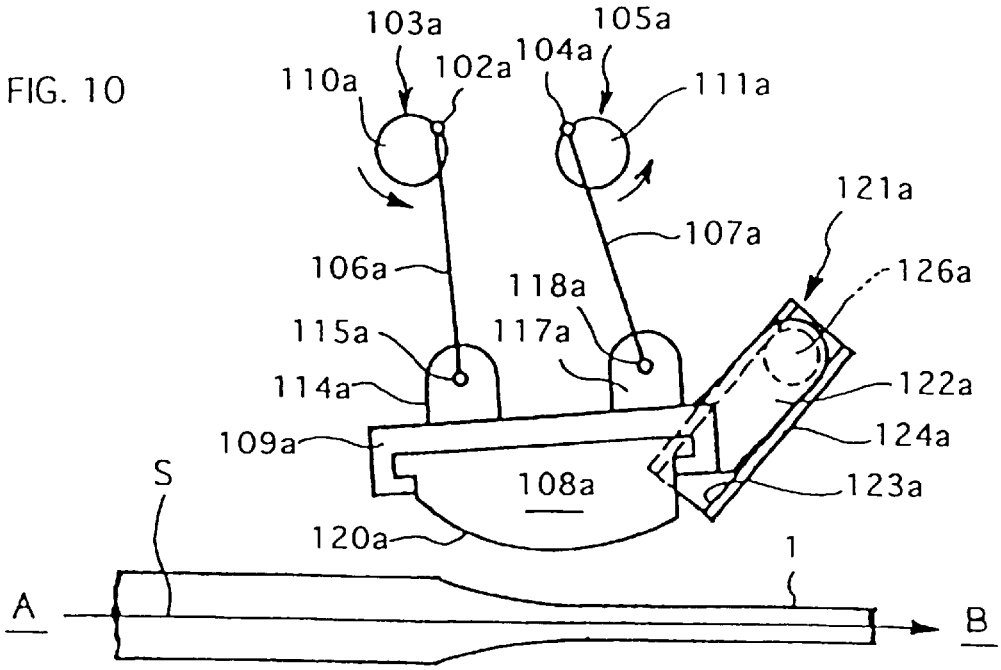
FIG. 10 is a conceptual view showing the displacement of the dies shown in FIG. 9 with respect to the transfer line, and the swinging motion of the dies.

When the angles of the eccentric portion 102*a* of the upstream eccentric shaft 103*a* and the eccentric portion 104*a* of the downstream eccentric shaft 105*a* are defined such that top dead center is 0° (360°), and both eccentric portions 102*a*, 104*a* are rotated with the angle of rotation increasing in the counterclockwise direction, and as shown in FIG. 10, the angle of rotation of the eccentric portion 104*a* of about 45° is assumed to correspond to the angle of rotation of the eccentric portion 102*a* of about 315°; the die 108*a* is then in the farthest position from the transfer line S, and the guide ring 126*a* is located at the end of the guide member 124*a*, nearest to the downstream side of the transfer line.

When both eccentric shafts 103*a*, 105*a* rotate counterclockwise from the aforementioned state, the die 108*a* moves towards the transfer line S.

At this time, because the phase angle of the eccentric portion 104*a* is 90° ahead of the phase angle of the eccentric portion 102*a*, the end of the die 108*a*, near to the downstream B side of the transfer line, moves towards the transfer line S before the end near the upstream A side of the transfer line, and at the same time, the guide ring 126*a* moves towards the upstream A side of the transfer line, in the guide member 124*a*.

Figure 11:
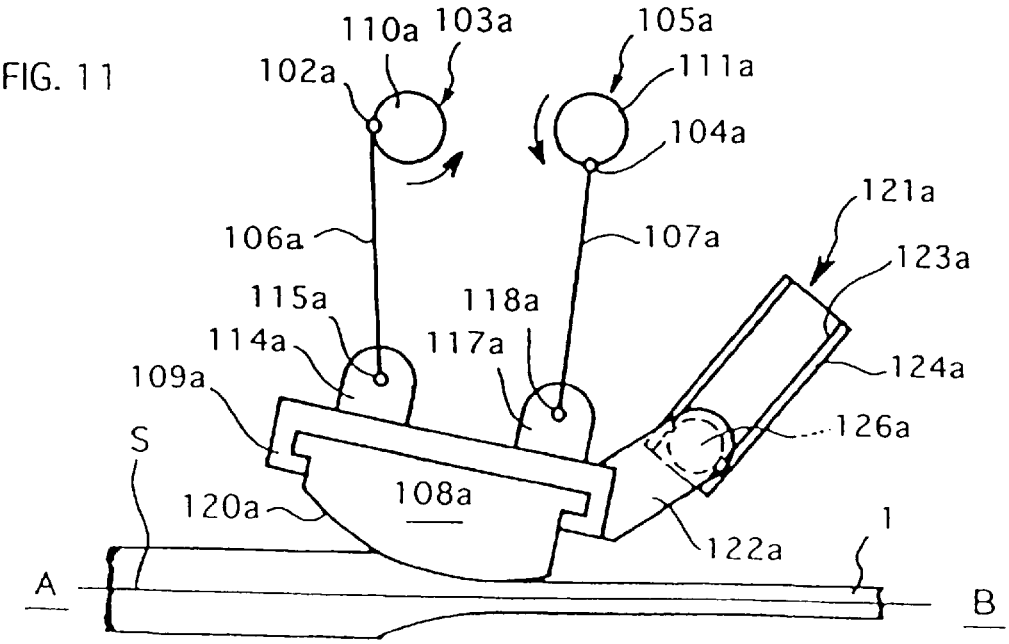
FIG. 11 is a conceptual view showing the displacement of the dies shown in FIG. 9 with respect to the transfer line, and the swinging motion of the dies.

As shown in FIG. 11, when the angle of rotation of the eccentric portion 102*a* becomes about 90° and the angle of rotation of the eccentric portion 104*a* is about 180°, the guide ring 126*a* reaches the end of the guide member 124*a*, near the upstream A side of the transfer line, and the portion of the forming surface 120*a* of the die 108*a*, near to the downstream B side of the transfer line, presses the material 1 to be shaped, as it passes along the transfer line S.

When both eccentric shafts 103*a*, 105*a* rotate and the angle of rotation of the eccentric portion 102*a* increases and the angle of rotation of the eccentric portion 104*a* becomes greater than 180°, the guide ring 126*a* begins to move towards the downstream B side of the transfer line, in the guide member 124*a*, and the die 108*a* swings in such a manner that the portion of the forming surface 120*a* of the die 108*a*, in contact with the material 1 to be shaped, moves towards the upstream A side of the transfer line from the downstream B side thereof, thus the material 1 to be shaped is subjected to a reducing and forming process.

After this, the die 108*a* moves towards the downstream B side of the transfer line, and feeds the material 1 being reduced and formed towards the downstream B side of the transfer line without any material being forced backwards.

Figure 12:
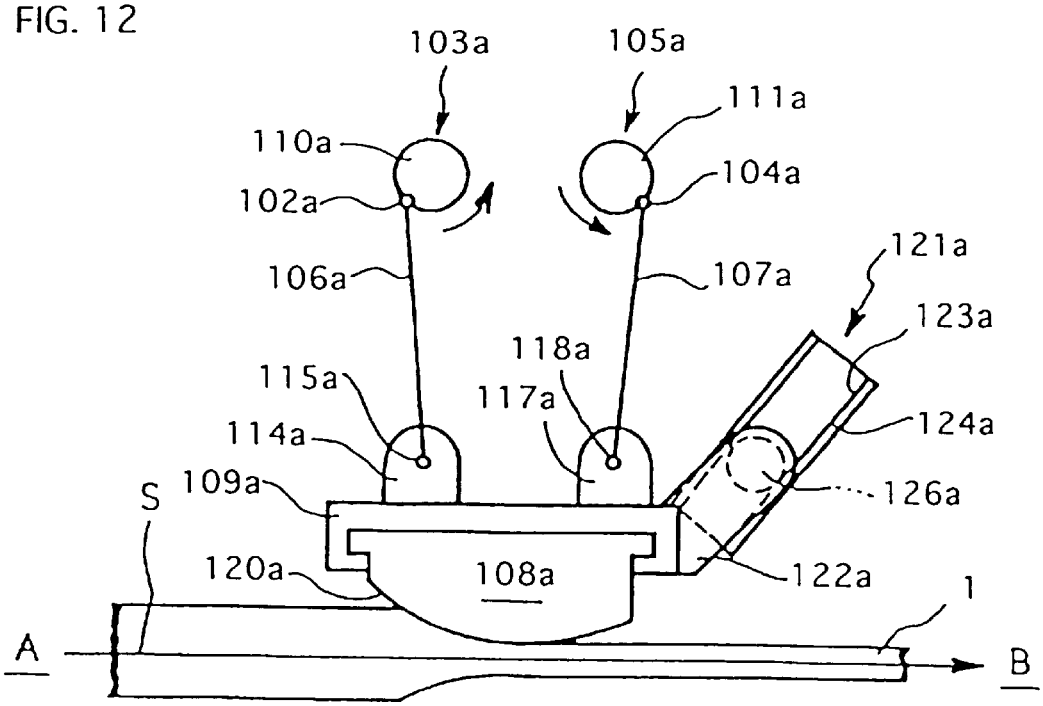
FIG. 12 is a conceptual view showing the displacement of the dies shown in FIG. 9 with respect to the transfer line, and swinging motion of the dies.

As shown in FIG. 12, after the angle of rotation of the eccentric portion 102*a* becomes about 135° and the angle of rotation of the eccentric portion 104*a* is about 225°, the portion of the forming surface 120*a* of the aforementioned die 108*a*, near the upstream A side of the transfer line, reduces and forms the material 1 to be shaped as the die 108*a* swings in the downstream direction.

Figure 13:
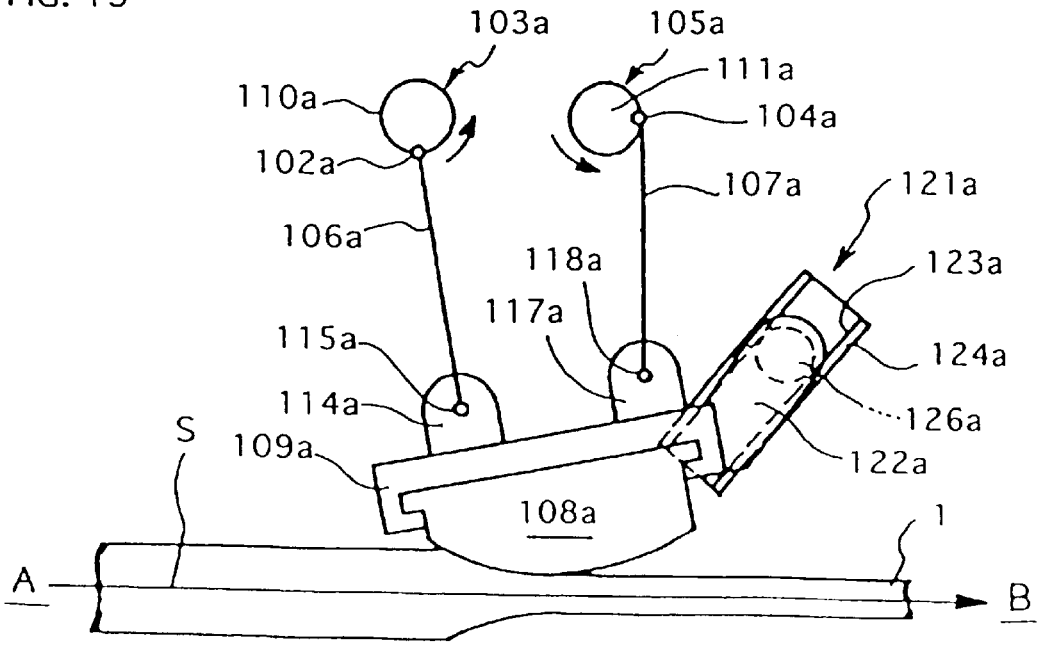
FIG. 13 is a conceptual view showing the displacement of the dies shown in FIG. 9 with respect to the transfer line, and the swinging motion of the dies.

Furthermore, as shown in FIG. 13, when the angles of rotation of the eccentric portions 102*a*. 104*a* become about 180° and 270°, respectively, the die 108*a* moves away from the transfer line S.

During these operations, the upstream eccentric shaft, 103*b*, downstream eccentric shaft 105*b*, upstream rod 106*b*, downstream rod 107*b*, die 108*b*, and die holder 109*b*, below the transfer line S, also operate in the same way as the ones above the transfer line S as described above, thereby the material 1 to be shaped is reduced and formed from above and below the material.

In the plate reduction press apparatus shown in FIGS. 9 through 13 as described above, the die holders 109*a*, 109*b* on which the dies 108*a*, 108*b* are mounted are given a swinging motion by the upstream eccentric shafts 103*a*, 103*b*, downstream eccentric shafts 105*a*, 105*b*, upstream rods 106*a*, 106*b*, and downstream rods 107*a*, 107*b*, in such a manner that the portions of the forming surfaces 120*a*, 120*b*, in contact with the material 1 to be shaped, of the dies 108*a*, 108*b* are transferred from the downstream B side of the transfer line towards the upstream A side thereof as the die holders are brought close to the transfer line S, so that the areas of the forming surfaces 120*a*, 120*b* in contact with the material 1 to be shaped are made smaller, so the pressing loads on the dies 108*a*, 108*b* can be reduced.

Consequently, the forces imposed on the power transmission members such as the eccentric shafts 103*a*, 103*b*, 105*a*, and 105*b* and the rods 106*a*, 106*b*, 107*a*, and 107*b*, are reduced, so that these components can be made more compact than those known in the prior art.

Moreover, because the die holders 109*a*, 109*b* are moved towards the downstream B side of the transfer line by the mechanisms 121*a*, 121*b* for moving the dies backwards and forwards when the forming surfaces 120*a*, 120*b* of the dies 108*a*, 108*b* are in contact with the material 1 to be shaped, the material is never forced backwards, but the material 1 that is reduced and formed can be fed forwards to the downstream B side of the transfer line.

(Second Embodiment)

Figure 14:
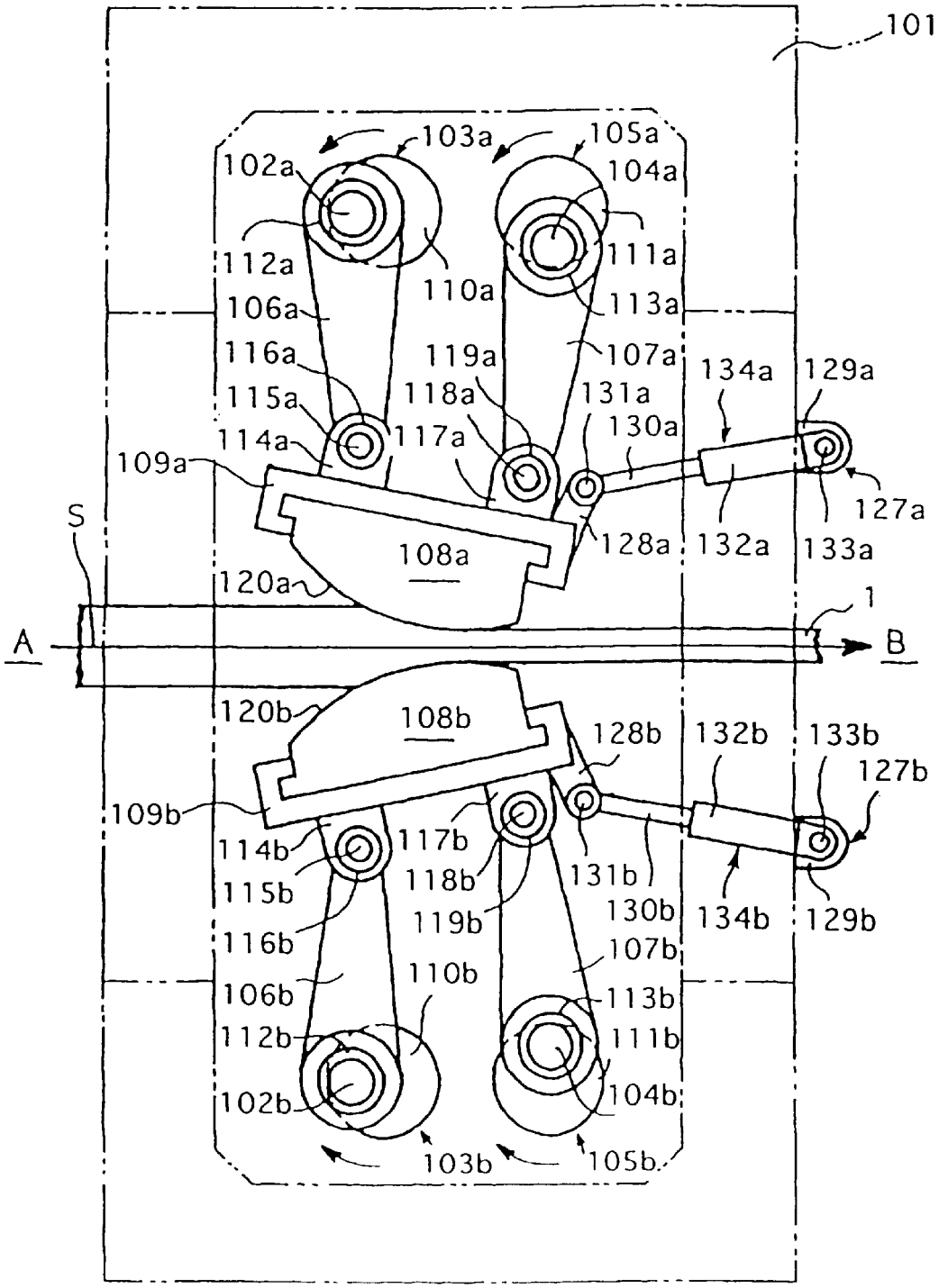
FIG. 14 is a general view seen from the side of the transfer line, of the second embodiment of the plate reduction press apparatus according to the present invention.

FIG. 14 shows the second embodiment of the plate reduction press apparatus according to the present invention; in the following figures, the item numbers indicate the same components as those shown in FIGS. 9 through 13.

This plate reduction press apparatus incorporates mechanisms 127*a*, 127*b* for moving the dies backwards and forwards in place of the mechanisms 121*a*, 121*b* shown in FIGS. 9 through 13 for moving the dies backwards and forwards.

The mechanisms 127*a*, 127*b* for moving the dies backwards and forwards are composed of brackets 128*a*, 128*b* fixed to the end portions of the die holders 109*a*, 109*b*, near to the downstream B side of the transfer line, brackets 129*a*, 129*b* fixed to portions of the housing 101, near to the downstream B side of the transfer line, and hydraulic cylinders 134*a*, 134*b*, the tips of the piston rods 130*a*, 130*b* of which are connected to the brackets 128*a*, 128*b* through bearings by the pins 131*a*, 131*b* and the cylinders 132*a*, 132*b* of which are connected to the brackets 129*a*, 129*b* through bearings by the pins 133*a*, 133*b*.

Also with this plate reduction press apparatus, hydraulic pressure is applied to the hydraulic chambers on the head side of the hydraulic cylinders 134*a*, 134*b* when the forming surfaces 120*a*, 120*b* of the dies 108*a*, 108*b* are not in contact with the material 1 to be shaped, thereby the die holders 109*a*, 109*b* together with the dies 108*a*, 108*b* are moved towards the upstream A side of the transfer line, and when the forming surfaces 120*a*, 120*b* of the dies 108*a*, 108*b*, are brought into contact with the material 1 to be shaped, hydraulic pressure is applied to the hydraulic chambers on the rod side of the hydraulic cylinders 134*a*, 134*b*, thus the die holders 109*a*, 109*b* together with the dies 108*a*, 108*b* are moved towards the downstream B side of the transfer line; in this way, as for plate reduction press apparatus described previously by referring to FIGS. 9 through 13, the material 1 being shaped can be fed towards the downstream B side of the transfer line, without forcing any material in the backward direction.

Also, other types of actuators such as screw jacks can be applied instead of the hydraulic cylinders 134*a*, 134*b*.

(Third Embodiment)

Figure 15:
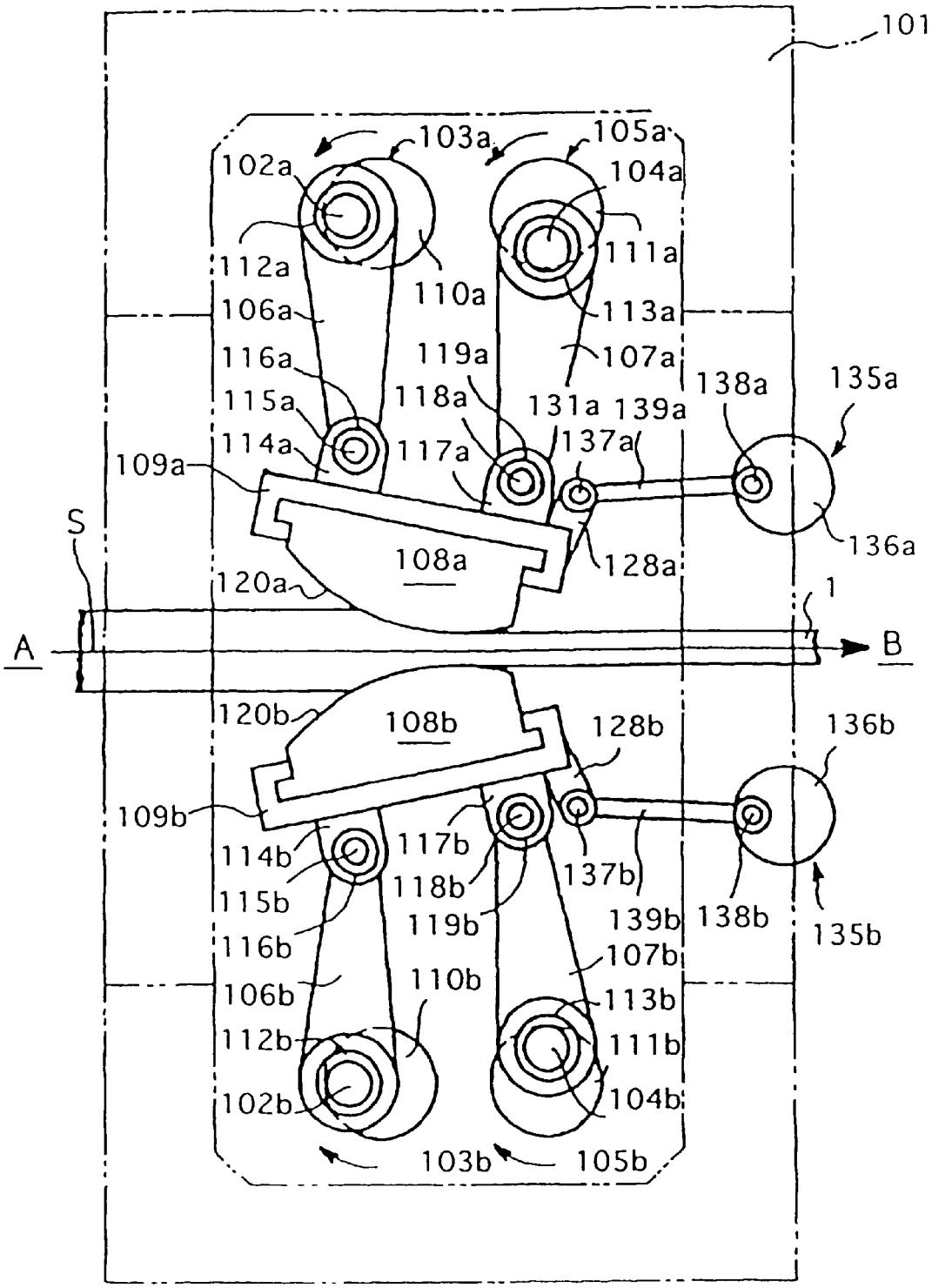
FIG. 15 is a general view seen from the side of the transfer line, of the third embodiment of the plate reduction press apparatus according to the present invention.

FIG. 15 shows the third embodiment of the plate reduction press apparatus according to the present invention, and in the figure, item numbers refer to the same components as those shown in FIGS. 9 through 13.

In this plate reduction press apparatus, mechanisms 135*a*, 135*b* for moving the dies backwards and forwards are used in place of the mechanisms 121*a*, 121*b* for moving the dies backwards and forwards, shown in FIGS. 9 through 13.

The mechanisms 135*a*, 135*b* for moving the dies backwards and forwards are composed of brackets 128*a*, 128*b* fixed to the end portions of the die holders 109*a*, 109*b*, on the downstream B side of the transfer line, eccentric shafts 136*a*, 136*b* for the backwards and forwards movements, provided at locations on the housing 101, near the downstream B side of the transfer line, which can rotate, and extending substantially horizontally in the lateral direction of the material 1 to be shaped, and rods 139*a*, 139*b* for backwards and forwards motion one end of each of which is connected to the bracket 128*a* or 128*b* by the pin 137*a* or 137*b*, and the other ends of which are connected to the eccentric portions 138*a*, 138*b*, of the eccentric shafts 136*a*, 136*b* for backward and forward movements through bearings.

Also with this plate reduction press apparatus, the eccentric shafts 136*a*, 136*b* for backward and forward movements are rotated, and the dies 108*a*, 108*b* are moved to the upstream A side of the transfer line together with the die holders 109*a*, 109*b*, while the forming surfaces 120*a*, 120*b* of the dies 108*a*, 108*b* are not in contact with the material 1 to be shaped, and when the forming surfaces 120*a*, 120*b* of the dies 108*a*, 108*b* come in contact with the material 1 to be shaped, the eccentric shafts 136*a*, 136*b* for backward and forward movements are rotated to move the dies 108*a*, 108*b* together with the die holders 109*a*, 109*b* in the downstream B direction of the transfer line, thereby the material 1 after being reduced and formed can be fed out to the downstream B side of the transfer line without any of the material being forced backwards, in the same manner as with the plate reduction press apparatus described previously by referring to FIGS. 9 through 13.

(Fourth Embodiment)

Figure 16:
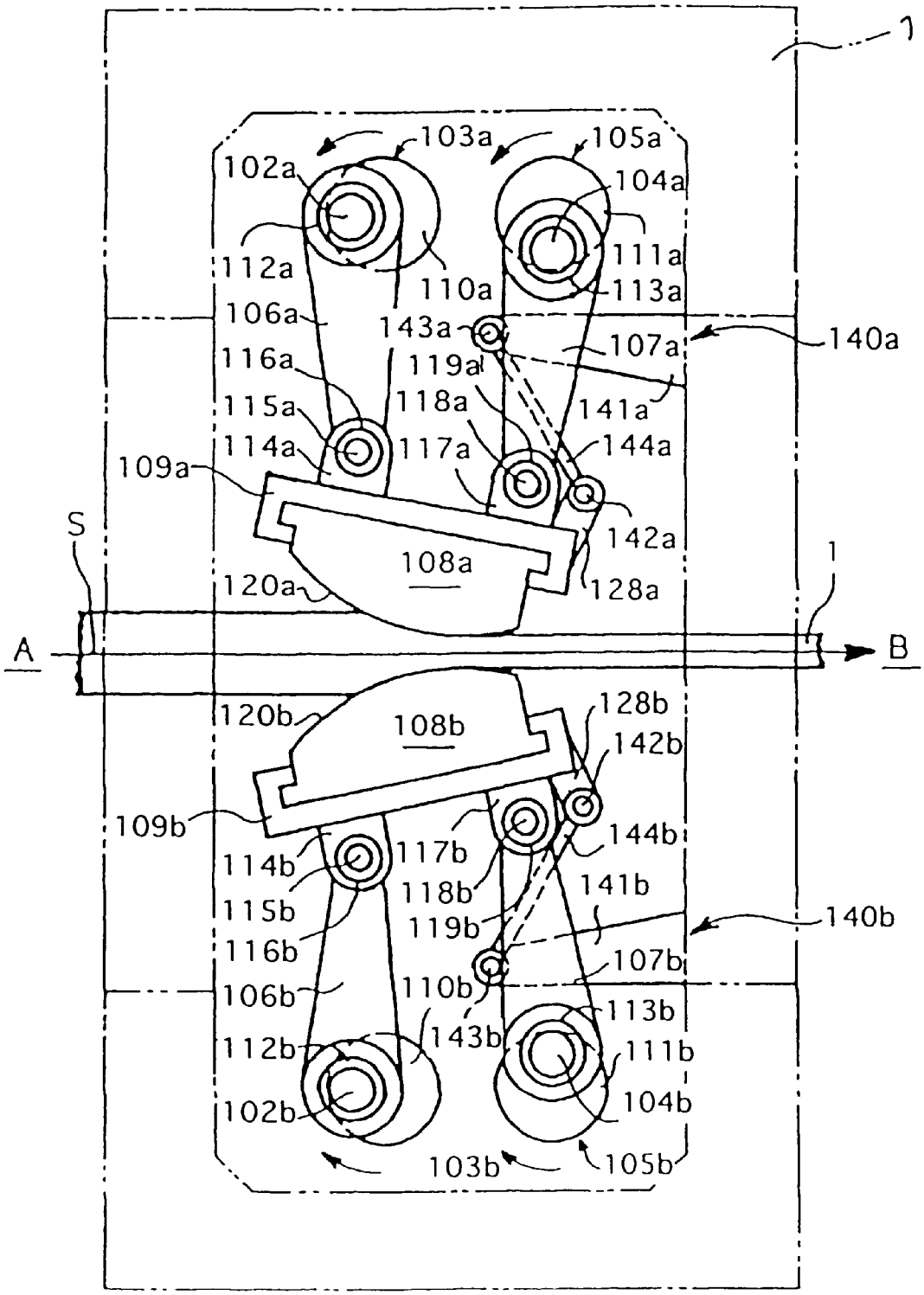
FIG. 16 is a general view seen from the side of the transfer line, of the fourth embodiment of the plate reduction press apparatus according to the present invention.

FIG. 16 shows the fourth embodiment of the plate reduction press apparatus according to the present invention, and in the figure, item numbers refer to the same components as those in FIGS. 9 through 13.

This plate reduction press apparatus incorporates mechanisms 140*a*, 140*b* for moving the dies backwards and forwards in place of the mechanisms 121*a*, 121*b* for moving the dies backwards and forwards shown in FIGS. 9 to 13.

The mechanisms 140*a*, 140*b* for moving the dies backwards and forwards are composed of brackets 128*a*, 128*b* fixed to the end portions of the die holders 109*a*, 109*b*, closest to the downstream B side of the transfer line, brackets 141*a*, 141*b* whose bases are fixed to predetermined locations on the housing 101 in such a manner that the tips of the brackets are positioned on the side of the die holders 109*a*, 109*b* on the opposite side to the transfer line, and levers 144*a*, 144*b* one end of each of which is connected to the bracket 128*a* or 128*b* by the pin 142*a* or 142*b*, and the other ends of which are connected to the brackets 141*a*, 141*b* through the bearings of pins 143*a*, 143*b*.

The mounting locations of brackets 128*a*, 128*b*, 141*a*, and 141*b*, the distances between connecting points of levers 144*a*, 144*b*, and the locations of the bearings of levers 144*a*, 144*b* with respect to the brackets 128*a*, 128*b*, 141*a*, and 141*b* are predetermined in such a manner that as the eccentric shafts 103*a*, 103*b*, 105*a*, and 105*b* rotate, the (lie holders 109*a*, 109*b* with the dies 108*a*, 108*b* mounted on them, move in substantially the same way as those of the plate reduction press apparatus shown in FIGS. 9 to 13.

This plate reduction press apparatus shown in FIG. 16 according to the present invention can feed out the material 1 after being reduced and formed in the downstream B direction of the transfer line without causing any of the material to be forced backwards, in the same manner as the plate reduction press apparatus described previously according to FIGS. 9 to 13.

As described above, the plate reduction press apparatus and methods according to the present invention offer the following advantages.

(1) The plate reduction pressing method of the present invention can reduce the areas of the forming surfaces of the dies that are in contact with a material to be shaped and the loads applied to the dies during pressing, because the forming surfaces of the dies are convex towards the transfer line, and the dies are given a swinging motion in such a manner that the areas of the forming surfaces, that are in contact with the material to be shaped move from the ends in the downstream direction of the transfer line to the ends in the upstream direction while the dies are being moved towards the transfer line from above and below the material to be shaped in synchronism with each other.

(2) In any of the plate reduction press apparatus of further embodiments the present invention, the displacements of the eccentric portions of the upstream and downstream eccentric shafts, with different phase angles, are transmitted to the die holders through the upstream and downstream rods and the dies are given a swinging motion in such a manner that the portions of the convex forming surfaces, that are in contact with the material to be shaped, move from the ends in the downstream direction of the transfer line to the upstream ends, so that the areas of the forming surfaces of the dies that are in contact with the material to be shaped, are made smaller, therefore the loads applied to the dies during pressing can be reduced.

(3) In any of the plate reduction press apparatus specified in claims 2 through 6 of the present invention, the loads applied to the dies during pressing are reduced, so the required strengths of the upstream and downstream eccentric shafts, upstream and downstream rods, etc. become moderate, so that these components can be made compact.

(4) With any of the plate reduction press apparatus of the present invention, the loads applied to the dies during pressing are reduced, the die holders are moved in the downstream direction of the transfer line by the mechanisms for moving the dies backwards and forwards when the forming surfaces of the dies are in contact with the material to be shaped, so the material after being reduced and formed is fed out in the downstream direction of the transfer line without forcing any of the material in the backward direction.

(Fifth Embodiment)

Figure 17:
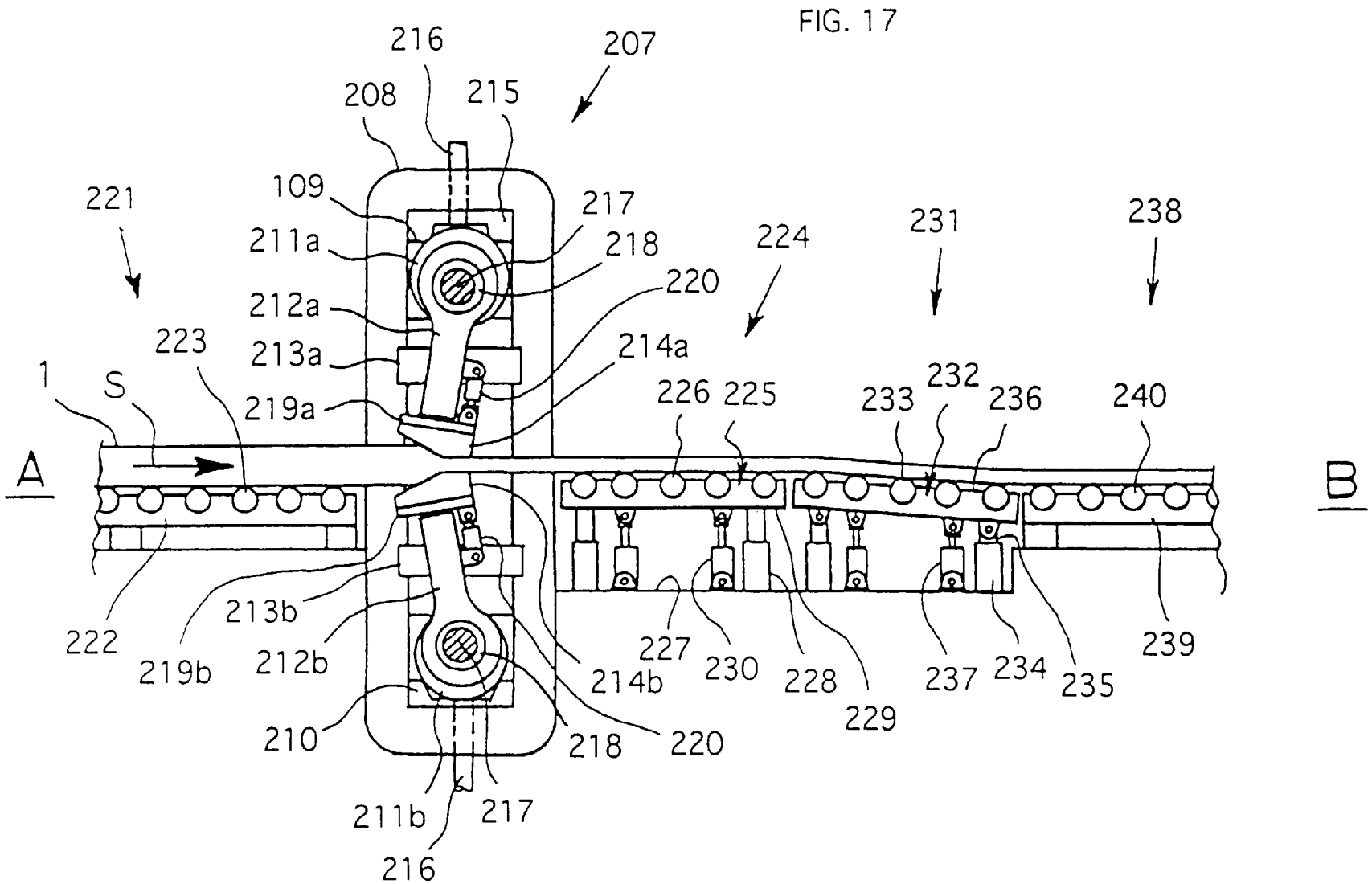
FIG. 17 is a side view showing the fifth embodiment of the plate reduction press apparatus according to the present invention.
Figure 18:
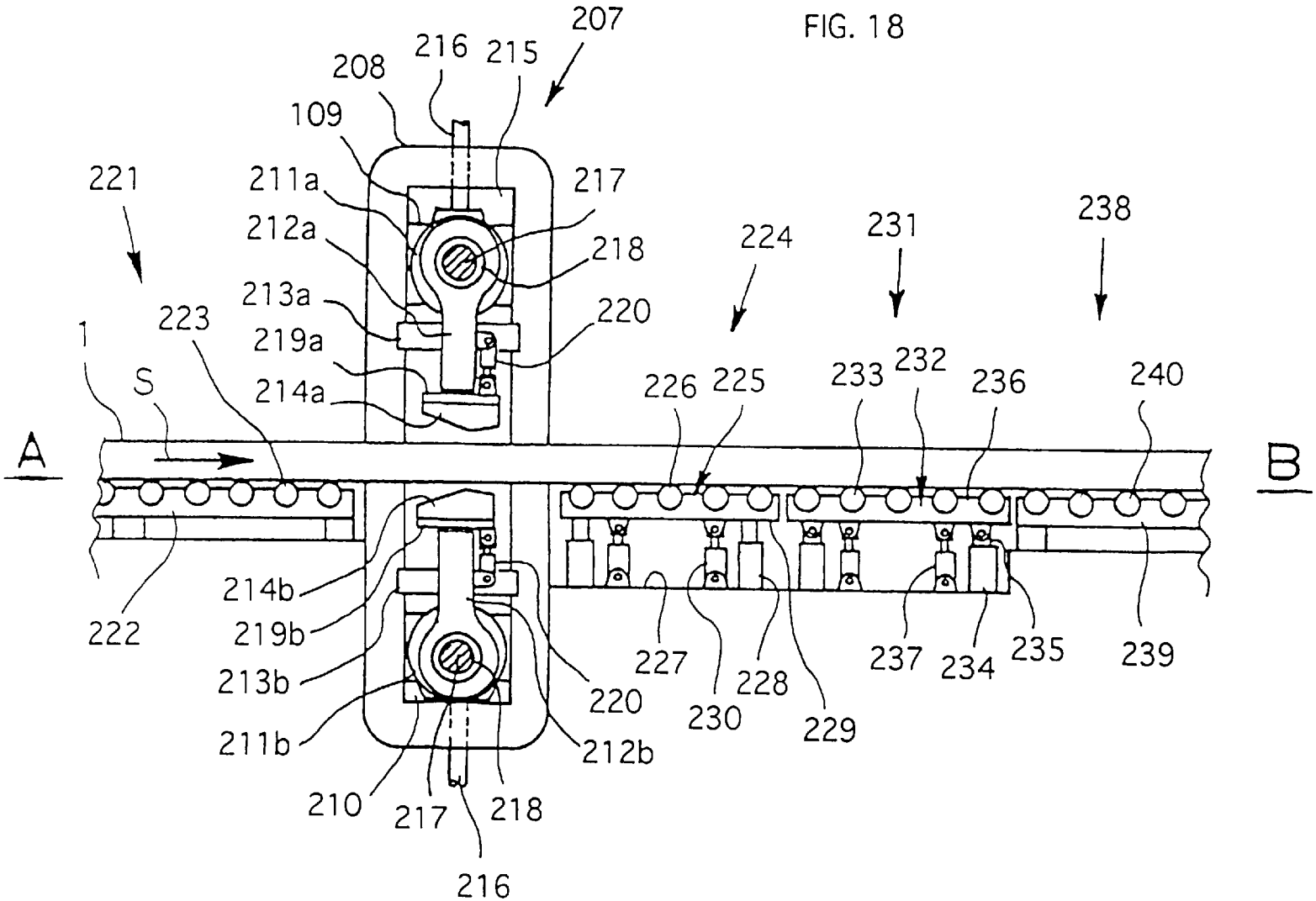
FIG. 18 is a side view of the embodiment of FIG. 17 showing the location of the up/down table rollers when the material to be shaped is not being reduced or formed.

FIGS. 17 and 18 show the fifth embodiment of the plate reduction press apparatus according to the present invention.

Item number 207 represents the main unit of a press machine that is comprised of a housing 208, upper shaft box 209, lower shaft box 210, upper and lower rotating shafts 211*a*, 211*b*, upper and lower rods 212*a*, 212*b*, upper and lower rod support boxes 213*a*, 213*b*, and upper and lower dies 214*a*, 214*b*.

The housing 208 is provided with a window 215 on both sides in the lateral direction of the transfer line S on which a material 1 to be shaped is transferred horizontally, and extending in the vertical direction thereof.

The upper shaft box 209 engages with the upper end portion of the aforementioned window 215 in such a manner that it can slide in the vertical direction, and the vertical position of the upper shaft box is determined by an adjusting screw 216 which is mounted in the upper part of the housing 208 and driven by a driving device (not illustrated).

The lower shaft box 210 engages with the lower part of the window 215 of the above-mentioned housing 208, in such a manner that it is free to move in the vertical direction, and the vertical position thereof is determined by an adjusting screw 216 which is mounted in the lower part of the housing 208 and rotated by a driving device (not illustrated).

Each of the upper and lower rotating shafts 211*a*, 211*b* is provided with an eccentric portion 217 at an intermediate location in the axial direction, and both ends thereof are supported by the aforementioned upper and lower shaft boxes 209, 210, respectively, and the other end of each shaft is connected to the driving device (not illustrated) through a universal joint.

The big ends of each of the upper and lower rods 212*a*, 212*b* are coupled to the eccentric portions 217 of each of the rotating shafts 211*a*, 211*b*, through bearings 218, and the die holders 219*a*, 219*b* are connected to tips of the rods 212*a*, 212*b*, through ball joints (not illustrated).

The piston rods of the hydraulic cylinders 220 that are attached to the rods 212*a*, 212*b* through bearings are connected to the die holders 219*a*, 219*b* so that the angles of the dies 214*a*, 214*b* mounted on the die holders 219*a*, 219*b* can be adjusted by actuating the above-mentioned hydraulic cylinders 220.

Each of the upper and lower rod support boxes 213*a*, 213*b* is attached to an intermediate location on each of the rods 212*a*, 212*b*, through spherical bearings (not illustrated) located substantially in the middle, and each of the rod support boxes engages with the window 215 in a manner such that it can freely slide up and down.

Figure 2:
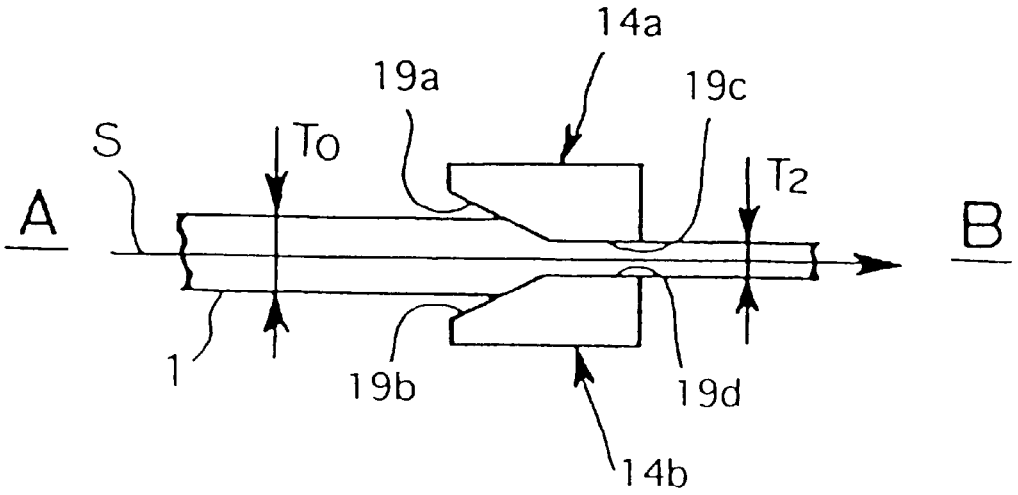
FIG. 2 is a schematic view showing an example of reduction forming in the direction of plate thickness of a material to be shaped using dies.

The upper and lower dies 214*a*, 214*b* are provided with similar profiles to those of the dies 14*a*, 14*b* shown in FIG. 2, and are mounted on the die holders 219*a*, 219*b*, respectively, opposite each other on opposite sides of the transfer line S, in a freely detachable manner, and when the rotating shafts 211*a*, 211*b* rotate, the dies are driven by the rods 212*a*, 212*b*, and move towards and away from the transfer line S in synchronism with each other.

Item number 221 represents an upstream table comprised of a fixed frame 222 installed on the upstream A side of the transfer line of the main press apparatus unit 207 and extending substantially horizontally along the transfer line S, and a plurality of upstream table rollers 223 that are provided in a freely rotatable manner at predetermined intervals in the transfer line direction so as to support the lower surface of a material to be inserted between the dies 214*a*, 214*b* and shaped by the main press apparatus unit 207, substantially horizontally.

Item number 224 indicates the first up/down table which is composed of a first up/down frame 225 installed in the close vicinity of the main press apparatus unit 207 on the downstream B side of the transfer line, and extending substantially horizontally along the transfer line S in a manner such that it can be moved up and down, and a plurality of up/down table rollers 226 that are provided in a freely rotatable manner on the first up/down frame 225 at predetermined intervals along the transfer line so that the rollers can support the lower surface of the material 1 after being formed, as the material is fed out from between the dies 214*a*, 214*b* of the main press apparatus unit 207.

The aforementioned first up/down frame 225 is composed of a plurality of guide members 228 erected at predetermined locations on the floor surface 227 on the downstream side of the transfer line S, and a main frame unit 229 equipped with leg portions that engage with the guide members 228 in a manner such that they can move up and down, in which the main frame unit 229 is connected to the piston rods of the hydraulic cylinders 230 installed at predetermined intervals in the longitudinal direction of the main frame unit 229, and attached to the floor surface 227 through bearings. When the hydraulic cylinders 230 are operated, the main frame unit 229 is raised and lowered in a substantially horizontal state, and the height of each up/down table roller 226 can be adjusted relative to the transfer line S.

Item number 231 indicates a second up/down table comprised of a second up/down frame 232 extending along the transfer line S from the above-mentioned up/down table 224 in the downstream B direction of the transfer line and free to move up and down, and a plurality of up/down table rollers 232 provided on the second up/down frame 232 at predetermined intervals in the direction of the transfer line in a freely rotatable manner so that the rollers can support the lower surface of the material 1 after being shaped and fed out from the first up/down table 224.

The aforementioned second up/down frame 232 is composed of a plurality of guide members 234 erected at predetermined locations on the floor surface 227 beneath the transfer line S, leg portions 235 engaging with the guide members 234 in a manner so that they can move up and down, and a main frame unit 236 supported on the leg portions 235 through bearings; the main frame unit 236 is connected to the piston rods of a plurality of hydraulic cylinders 237 arranged along the main frame unit 236 at predetermined intervals and supported on the floor surface 227 by bearings.

Each of the aforementioned hydraulic cylinders 237 can be operated individually, and by actuating each of the above-mentioned hydraulic cylinders 237 individually, the second up/down frame 232 is raised and lowered in such a manner that the height of the second up/down table 231 at the upstream end in the direction of the transfer line S becomes identical to the height of the first up/down table 224, and the height of the end in the downstream direction of the transfer line S is slightly higher than the height of the downstream table 238 to be detailed later.

In addition, the first and second up/down tables 224, 231 can also be lowered to a horizontal position substantially at the same height as the upstream table 221 by the hydraulic cylinders 230, 237 provided for the first and second up/down tables 224, 231.

Item number 238 shows the downstream table configured with a fixed frame 239 arranged adjacent to the second up/down table 231 on the downstream B side of the transfer line and extending substantially horizontally along the transfer line S, and provided with a plurality of downstream table rollers 240 installed at predetermined intervals in the transfer line in a freely rotatable manner so that the lower surface of the material 1 after being shaped and fed out from the second up/down table 231 can be supported substantially horizontally at a height essentially the same as the height of the upstream table 221.

The operation of the plate reduction press apparatus shown in FIGS. 17 and 18 is described as follows.

When a long material 1 to be shaped is to be reduced and formed in the direction of its plate thickness by means of dies 214*a*, 214*b*, first a driving device (not illustrated) rotates the up/down adjusting screws 216 of the main press apparatus 207, thereby moving the upper and lower shaft boxes 209, 210 up or down along the housing 208, and the dies 214*a*, 214*b* are moved towards or away from the transfer line S by the rotating shafts 211*a*, 211*b*, rods 212*a*, 212*b* and die holders 219*a*, 219*b* connected to each of the shaft boxes 209 or 210, thus the gap between the die 214*a* and the die 214*b* can be determined.

Referring to FIG. 17, the hydraulic cylinders 230 of the first up/down table 224, arranged in the close vicinity of the main press apparatus unit 207 on the downstream B side of the transfer line, are actuated to raise or lower the first up/down frame 225, thereby the height of the first up/down table 224 is set so that the up/down table rollers 226 will come in contact with the lower surface of the material 1 after being reduced, formed and fed out from the dies 214*a*, 214*b*, and the material after being shaped will be supported approximately horizontally.

In addition, by raising and lowering the second up/down frame 232 by individually operating the hydraulic cylinders 237 of the second up/down table 231, provided on the downstream B side of the first up/down table 224 in the transfer line, the position of the second up/down table 231 in the vertical direction is determined such that the material 1 after being shaped will gradually descend from the level of the first up/down table 224 towards the downstream table 238.

After that, the driving device (not illustrated) of the main press apparatus unit 207 is operated to rotate the rotating shafts 211*a*, 211*b*, thereby the upper and lower dies 214*a*, 214*b* are continuously moved towards and away from the transfer line S of the material 1 to be shaped, and also the material 1 to be shaped is placed on the upstream table 221 from the upstream A side of the transfer line, and moved and inserted between the dies 214*a*, 214*b*, and the angles of the dies 214*a*, 214*b* are changed appropriately by the hydraulic cylinders 220*a*, 220*b*, both the upper and lower surfaces of the material 1 to be shaped, are pressed by the dies 214*a*, 214*b* simultaneously while the material 1 to be shaped is moving, and by repeating these operations, the thickness of the material 1 being shaped is reduced as shown in FIG. 2, to a predetermined dimension.

The material 1 after being shaped by the dies 214*a*, 214*b* of the main press apparatus unit 207, moves on to the first up/down table 224, is guided downwards by the second up/down table 231 and smoothly transferred onto the downstream table 238, and is transferred to the downstream B side of the transfer line.

The plate reduction press apparatus shown in FIGS. 17 and 18 is provided with a plurality of up/down table rollers 226 adjacent to the main press apparatus 207 on the downstream B side of the transfer line, that can be raised and lowered to match the lower surface of the material 1 being reduced, formed and fed out of the dies 214*a*, 214*b*, and a plurality of up/down table rollers 233 on the downstream B side of the up/down table rollers 226, whose heights can be set such that the material after being shaped gradually descends from the height of the up/down table rollers 226 towards the downstream table rollers 240, thereby preventing the leading end portion of the material 1 being reduced and shaped by the dies 214*a*, 214*b* of the main press apparatus unit 207 from drooping, and also preventing the leading end portion of the material 1 being shaped from being caught by the downstream table rollers 240 installed on the downstream B side of the transfer line S. Consequently, both the downstream table rollers 240 and the material 1 being shaped can be protected from being damaged, thereby the material 1 to be shaped can be reduced and formed in the direction of the plate thickness, and the material 1 being shaped can also be transferred securely to the downstream B side.

If a long material 1 to be shaped is to be passed without being reduced and formed by the dies 214*a*, 214*b* in the direction of the plate thickness, the first and second up/down tables 224, 231 are positioned as shown in FIG. 18.

First, a driving device (not illustrated) rotates the upper and lower adjusting screws 216 of the main press apparatus unit 207, thereby moving the upper shaft box 209 and the lower shaft box 210 upwards and downwards, respectively, along the housing 208, thereby separating the dies 214*a*, 214*b* from the transfer line S of the material 1 to be shaped by the rotating shafts 211*a*, 211*b*, rods 212*a*, 212*b* and die holders 219*a*, 219*b* connected to each of the shaft boxes 209, 210, and the driving device (not illustrated) of the main press apparatus unit 207 is operated to rotate the rotating shafts 211*a*, 211*b* so that each of the dies 214*a*, 214*b* is moved to the farthest location from the transfer line S of the material 1 to be shaped, and stopped there.

Also, the hydraulic cylinders 230 of the first up/down table 224 located in the close vicinity of the main press apparatus unit 207 on the downstream B side of the transfer line are operated, and the first up/down frame 225 is lowered, and also the hydraulic cylinders 237 of the second up/down table 231 are operated to lower the second up/down frame 232, thereby the positions of the up/down tables 224, 231 in the vertical direction are set at a height equivalent to the height of the upstream and downstream tables 221, 238.

After that, the material 1 to be shaped is loaded on and transferred by the upstream table 221 from the upstream A side of the transfer line (A side shown in FIG. 18), passed through the dies 214*a*, 214*b* of the main press apparatus unit 207, and sent out to the first up/down table 224 on the downstream B side of the transfer line of the main unit 207.

The material 1 to be shaped, after moving onto the first up/down table 224, is further guided by the second up/down table 231 and transferred onto the downstream table 238, and conveyed towards the downstream B side of the transfer line of the material 1 to be shaped.

In this way, with the plate reduction press apparatus shown in FIGS. 17 and 18, the vertical positions of the first and second up/down tables 224, 231 installed on the downstream B side of the transfer line of the main press apparatus 207 in a manner such that they can move up and down, can be set at the same level as those of the upstream table 221 and the downstream table 238. Consequently, even when the material 1 to be shaped is neither reduced nor formed in the direction of its plate thickness, the material 1 to be shaped can be conveyed securely to the downstream B side.

(Sixth Embodiment)

Figure 19:
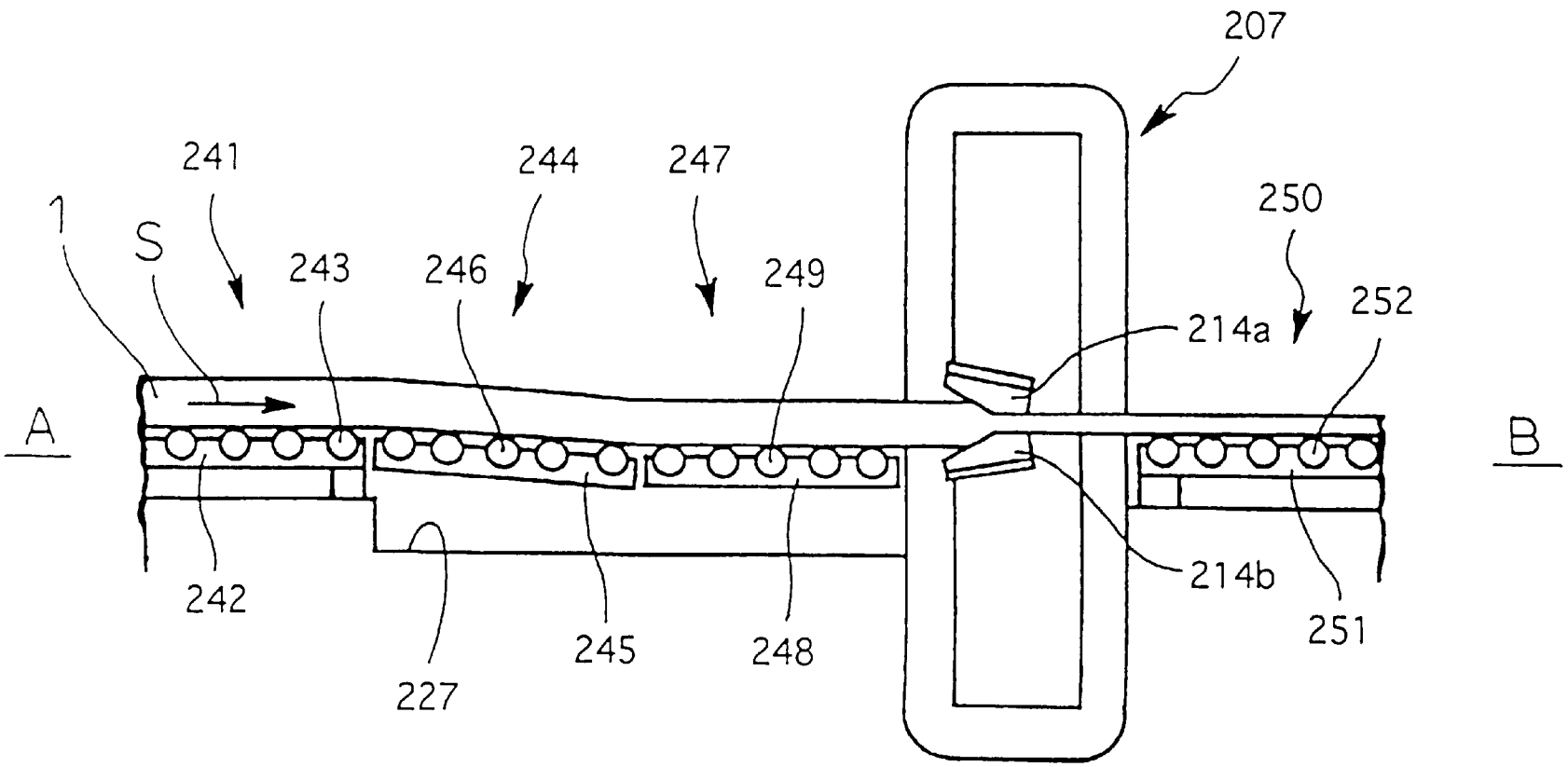
FIG. 19 is a side view showing the sixth embodiment of the plate reduction press apparatus according to the present invention.
Figure 20:
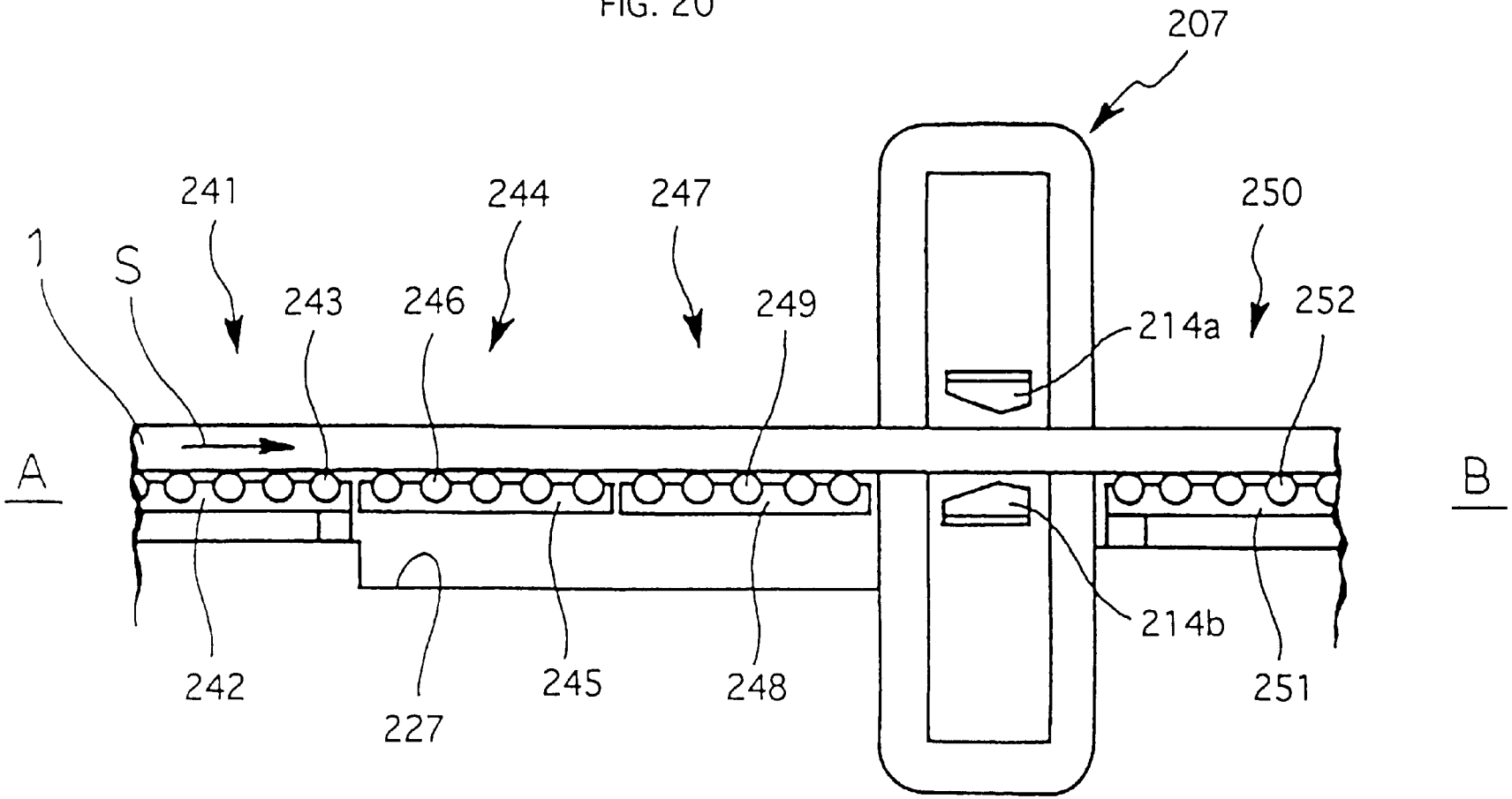
FIG. 20 is a side view of the embodiment of FIG. 19 showing the location of the up/down table rollers when the material to be shaped is not being reduced or formed.

FIGS. 19 and 20 show the sixth embodiment of the plate reduction press apparatus according to the present invention; item numbers in the figures represent the same components as in FIGS. 17 and 18.

Item number 241 indicates an upstream table composed of a fixed frame 242 provided on the upstream A side of the transfer line of the main press apparatus 207, and extending substantially horizontally along the transfer line S, and a plurality of upstream table rollers 243 provided on the aforementioned fixed frame 242 at predetermined intervals in the direction of the transfer line in a freely rotatable manner, so that the lower surface of the material 1 can be inserted between and shaped by the dies 214*a*, 214*b* of the main press apparatus unit 207.

Item number 244 shows a first up/down table that is composed of a first up/down frame 245 installed on the downstream B side of the upstream table 241 in the transfer line and extending along the transfer line S in a manner such that it can move up and down, and a plurality of up/down table rollers 246 installed at predetermined intervals in the direction of the transfer line in a freely rotatable manner so as to support the lower surface of the material to be shaped and fed out from the above-mentioned upstream table 241.

The aforementioned first up/down frame 245 is supported on the floor surface 27 by up/down mechanisms (not illustrated) similar to the guide members 234 and the hydraulic cylinders 237 (see FIGS. 17 and 18) described before, and can be raised and lowered with respect to the transfer line S.

Item number 247 is a second up/down table, installed between the first up/down table 244 and the main press apparatus 207 and extending substantially horizontally along the transfer line S in a manner such that it can move up and down and which is provided with a second up/down frame 248 and a plurality of up/down table rollers 249 installed on the second up/down frame 248 at predetermined intervals in the direction of the transfer line in a freely rotatable manner so as to support the lower surface of the material to be shaped and fed out from the first up/down table 244.

The aforementioned second up/down frame 248 is supported on the floor surface 227 by up/down mechanisms (not illustrated) similar to the guide members 228 and the hydraulic cylinders 230 (see FIGS. 17 and 18) described before, and can be raised and lowered with respect to the transfer line S.

In addition, the above-mentioned first and second up/down tables 244, 247 can be raised to a position substantially at the same height as the above mentioned upstream table 241 by the up/down mechanisms provided for the tables, respectively.

Item number 250 indicates a downstream table installed on the downstream B side of the main press apparatus unit 207 in the transfer line, which is provided with a fixed frame 251, and extending substantially horizontally along the transfer line S, a plurality of downstream table rollers 252 installed on the fixed frame 251 at predetermined intervals in the transfer line in a freely rotatable manner, so that the lower surface of the material 1 after being shaped and fed out from between the dies 214*a*, 214*b* can be supported substantially horizontally and essentially at the same height as the above-mentioned upstream table 241.

The operation of the plate reduction press apparatus shown in FIGS. 19 and 20 is described in the following paragraphs.

When a long material 1 to be shaped is reduced and formed in the direction of its plate thickness using the dies 214*a*, 214*b*, first the gap between the die 214*a* and the die 214*b*, in the main press apparatus unit 207, is determined.

Then, as shown in FIG. 19, the up/down mechanisms (not illustrated) adjust the heights of the first and second up/down tables 244, 247 in such a manner that the up/down table rollers 246, 249 contact the lower surface of the material 1 to be shaped, when fed out from the upstream table 241 towards the dies 214*a*, 214*b*, and the center lines of the material 1 before and after being pressed, upstream and downstream of the main press apparatus 207, are at the same height and the material 1 to be shaped and after being shaped is maintained substantially horizontal.

Next, the upper and lower dies 214*a*, 214*b* are continuously moved towards and away from each other in the main press apparatus unit 207, and the material 1 to be shaped is placed on the upstream table 221 and transferred from the upstream A side of the transfer line, and inserted between the above-mentioned dies 214*a*, 214*b*, thereby reducing the thickness of the material 1 being shaped as shown in FIG. 2 to a predetermined dimension.

The material 1 after being shaped by the dies 214*a*, 214*b* of the main press apparatus unit 207 is transferred smoothly onto the downstream table 250, and conveyed to the downstream B side of the transfer line of the material 1 being shaped.

As described above, the plate reduction press apparatus shown in FIGS. 19 and 20 is provided with a plurality of up/down table rollers 246, 249 on the upstream A side of the main press apparatus unit 207 on the transfer line, that can be raised and lowered according to the position of the lower surface of the material 1 being reduced, formed and fed out from the dies 214*a*, 214*b*, therefore the leading end portion of the material 1 being reduced and formed by the dies 214*a*, 214*b* of the main press apparatus unit 207 can be prevented from drooping and also the leading end portion of the material 1 being shaped can be prevented from being caught by the downstream table rollers 252 installed on the downstream B side of the transfer line S. Therefore, both the downstream table rollers 252 and the material 1 being shaped can be protected from damage, so that the material 1 being shaped can be reduced and formed in the direction of the plate thickness efficiently, and can be transferred securely to the downstream B side.

When a long material 1 is to be passed without being reduced or formed in the direction of the plate thickness with the dies 214*a*, 214*b*, the first up/down table 244 and the second up/down table 247 are positioned as shown in FIG. 20.

First, the upper and lower dies 214*a*, 214*b* of the main press apparatus unit 207 are moved away from the transfer line S of the material 1 to be shaped, and each of the dies 214*a*, 214*b* is moved to a position farthest from the transfer line S of the material 1, and stopped there.

In addition, the up/down mechanisms (not illustrated) raise the first and second up/down tables 244, 247, and each of the up/down table rollers 247, 249 is adjusted to be at the same height as the upstream table rollers 243 of the upstream table 241 and the downstream table rollers 252 of the downstream table 250.

Thereafter, the material 1 to be shaped is loaded on the upstream table 241 from the upstream A side of the transfer line (A side shown in FIG. 20) and transferred, passing from the first and second up/down tables 244, 247 between the dies 214*a*, 214*b* of the main press apparatus unit 207, and is fed out onto the downstream table 250 on the downstream B side of the transfer line of the main press apparatus unit 207.

In the manner described above, with the plate reduction press apparatus shown in FIGS. 19 and 20, the vertical positions of the first up/down table 244 and the second up/down table 247, installed on the upstream A side of the transfer line of the main press apparatus unit 207, can be set to be at the same height as the upstream table 241 and the downstream table 250, so that even when the material 1 to be shaped is neither reduced nor formed in the direction of the plate thickness, the material 1 to be shaped can be securely transferred to the downstream B side.

However, the plate reduction press apparatus and the operating methods according to the present invention are not limited only to the embodiments described above, but, for example, the up/down table rollers can be configured in a manner such that they can be moved up and down individually, or the up/down table rollers can be installed on both the upstream and downstream sides of the transfer line of the main press apparatus unit, or otherwise, various modifications can be made as long as the claims of the present invention are satisfied, as a matter of course.

The following various advantages can be gained as described above, according to the plate reduction press apparatus and the operating methods of the present invention.

(1) The plate reduction press apparatus of the present invention is provided with the movable up/down table rollers downstream of the dies, to support the lower surface of the material after being reduced and shaped by the dies in the direction of the plate thickness, therefore drooping of the leading end portion of the material being reduced and shaped by the dies can be prevented, and the table rollers and the material being shaped can be protected from damage that might otherwise occur due to the drooping of the material.

(2) With the plate reduction press apparatus specified in claim 8 of the present invention, the movable up/down table rollers are provided upstream of the dies, to support the lower surface of the material to be inserted into and shaped by the dies, so drooping of the leading end portion of the material being reduced and shaped by the dies can be prevented, and the table rollers and the material being shaped can be protected from damage that might otherwise occur due to the drooping of the material.

(3) In the plate reduction press apparatus of a further embodiment, the movable up/down table rollers are installed upstream of the dies to support the lower surface of the material to be inserted into and shaped by the dies, and the movable up/down table rollers are provided downstream of the dies to support the lower surface of the material reduced and shaped by the dies in the direction of the plate thickness, so the drooping of the leading end portion of the material being reduced and shaped by the dies can be prevented, and the table rollers and the material being shaped can be protected from damage that might otherwise occur due to the drooping of the material.

(4) According to the method of operating the plate reduction press apparatus, of the present invention, some of the movable up/down table rollers that are provided to support the lower surface of the material being reduced and shaped by the dies in the direction of the plate thickness, are set in such a manner that the material being shaped gradually descends towards the downstream table rollers, so the leading end portion of the material being reduced and shaped can be prevented from being caught by the downstream table rollers, and therefore the material being shaped can be securely transferred towards the downstream side.

(5) In a further embodiment of the method of operating the plate reduction press apparatus of the present invention, the up/down table rollers are set so that the material to be shaped, which is to be inserted into the dies, is placed in a substantially horizontal position before being reduced and formed, therefore the leading end portion of the material being reduced and formed can be prevented from being caught by the downstream table rollers, and the material being shaped can be transferred securely in the downstream direction.

(6) According to the method of operating the plate reduction press apparatus of another embodiment of the present invention, the up/down table rollers are set in such a manner that the material to be shaped, is placed in a substantially horizontal position before being inserted into, reduced and formed by the dies, and the material after being reduced and formed by the dies in the direction of plate thickness is also approximately horizontal, consequently the material after being reduced and formed can be protected from being caught by the downstream table rollers, and so the material being shaped can be transferred securely in the downstream direction.

(7) In any of the methods of operating the plate reduction press apparatus discussed above according to the present invention, the heights of the up/down table rollers can be set equal to those of the upstream and downstream table rollers, so that a material that is being neither reduced nor shaped by the dies can be transferred securely in the downstream direction.

(Seventh Embodiment)

FIGS. 21 through 25 show an example of a plate reduction press apparatus according to the present invention; this plate reduction press apparatus is provided with a housing 319 erected at a predetermined location on the transfer line S so that the material 1 to be shaped can pass through the center portion of the housing, a pair of upstream sliders 324*a*, 324*b* arranged above and below the transfer line S opposite each other, a pair of downstream sliders 325*a*, 325*b* located on the downstream B side of the upstream sliders 324*a*, 324*b* in the transfer line, opposite each other above and below the transfer line S, upstream dies 330*a*, 330*b* supported by the upstream sliders 324*a*, 324*b*, downstream dies 333*a*, 333*b* supported by the downstream sliders 325*a*, 325*b*, mechanisms 336*a*, 336*b* for moving the upstream sliders that move the upstream sliders 324*a*, 324*b* towards the transfer line S and move the sliders away from the line S, the mechanisms 344*a*, 344*b* for moving the downstream sliders that move the downstream sliders 325*a*, 325*b* towards and away from the transfer line S, upstream hydraulic cylinders 352*a*, 352*b* as the mechanisms for moving the upstream dies that move the upstream dies 330*a*, 330*b* backwards and forwards along the transfer line S, hydraulic cylinders 354*a*, 354*b* as the mechanisms for moving the downstream dies that move the downstream dies 333*a*, 333*b* backwards and forwards along the transfer line S, and synchronous driving mechanisms 356*a*, 356*b* corresponding to both the above-mentioned mechanisms 336*a*, 336*b*, 344*a* and 344*b* for moving the sliders.

Inside a housing 319, upstream slider holders 320*a*, 320*b* are installed opposite each other above and below a transfer line S near the upstream A side of the transfer line, and constructed to be concave in the direction away from the transfer line, and downstream slider holders 321*a*, 321*b* are installed opposite each other on opposite sides of the transfer line S near the downstream B side of the transfer line, and constructed to be concave in the direction away from the transfer line; the downstream slider holders 321*a*, 321*b* are located closer to the transfer line S than the upstream slider holders 320*a*, 320*b*.

On the outer surface of the housing 319, there are rod insertion holes 322*a*, 322*b* communicating with the upstream slider holders 320*a*, 320*b* from the top and bottom of the housing, near the upstream A side of the transfer line, and rod insertion holes 323*a*, 323*b* communicating with the downstream slider holders 321*a*, 321*b* from the top and bottom of the housing, near the downstream B side of the transfer line, for each of the slider holders 320*a*, 320*b*, 321*a*, and 321*b*, at 2 locations each in a row in the lateral direction of the material 1 to be shaped.

The upstream sliders 324*a*, 324*b* are housed in the upstream slider holders 320*a*, 320*b* so that the sliders can slide in the direction towards and away from the transfer line S, and the downstream sliders 325*a*, 325*b* are housed in the downstream slider holders 321*a*, 321*b* so that the sliders can slide in the direction towards and away from the transfer line S.

On the surfaces facing the transfer line S of the upstream sliders 324*a*, 324*b* and the downstream sliders 325*a*, 325*b*, die holders 326*a*, 326*b*, 327*a*, and 327*b* are provided that can move backwards and forwards substantially horizontally in the direction of the transfer line S.

On the surfaces farthest from the transfer line, of the upstream sliders 324*a*, 324*b* and the downstream sliders 325*a*, 325*b*, brackets 328*a*, 328*b*, 329*b*, and 329*b* are constructed with 2 brackets at each location, immediately opposite the rod insertion holes 322*a*, 322*b*, 323*a*, and 323*b*.

The upstream dies 330*a*, 330*b* are provided with flat forming surfaces 331*a*, 331*b* that gradually approach the transfer line S from the upstream A side to the downstream B side of the transfer line, and flat forming surfaces 332*a*, 332*b* continuing from the downstream B side of the above-mentioned forming surfaces 331*a*, 331*b* in the direction of the transfer line, facing the transfer line S substantially horizontally, and the dies 330*a*, 330*b* are mounted on the aforementioned die holders 326*a*, 326*b*.

The downstream dies 333*a*, 333*b* are provided with flat forming surfaces 334*a*, 334*b* that gradually approach the transfer line S from the upstream A side to the downstream B side of the transfer line, and flat forming surfaces 335*a*, 335*b* continuing from the downstream B side of the above-mentioned forming surfaces 334*a*, 334*b* substantially parallel to and facing the transfer line S, and the dies 333*a*, 333*b* are mounted on the aforementioned die holders 327*a*, 327*b*.

The mechanisms 336*a*, 336*b* for moving the upstream sliders are composed of shaft boxes 337*a*, 337*b* above and below the housing 319 and positioned on the sides away from above-mentioned upstream slider holders 320*a*, 320*b*, crank shafts 339*a*, 339*b* extending substantially horizontally in the direction orthogonal to the transfer line S, whose non-eccentric portions 338*a*, 338*b* are supported by the shaft boxes 337*a*, 337*b* through bearings, and rods 342*a*, 342*b* inserted through the above-mentioned rod insertion holes 322*a*, 322*b*, and the big ends of which are connected to the eccentric portions 340*a*, 340*b* of the crank shafts 339*a*, 339*b*, and the tips of which are connected to the brackets 328*a*, 328*b* of the upstream sliders 324*a*, 324*b* by the pins 341*a*, 341*b* parallel to the crank shafts 339*a*, 339*b*, through bearings.

The shaft box 337*a* located above the transfer line S is supported by a support member 343*a* provided above the housing 319, and the shaft box 337*b* located below the transfer line S is supported by a support member 343*b* provided on the lower part of the housing in a manner such that it can be moved up and down.

In addition, the location of the shaft box 337*b* with respect to the transfer line S can be determined by moving it up or down with a position adjusting screw (not illustrated).

In these mechanisms 336*a*, 336*b*, for moving the upstream sliders, when the crank shafts 339*a*, 339*b* rotate, the displacements of the eccentric portions 340*a*, 340*b* are transmitted to the upstream sliders 324*a*, 324*b* through the rods 342*a*, 342*b*, and the die holders 326*a*, 326*b* and the upstream dies 330*a*, 330*b* move towards and away from the transfer line S together with the above-mentioned upstream sliders 324*a*, 324*b*.

The mechanisms 344*a*, 344*b* for moving the downstream sliders are composed of shaft boxes 345*a*, 345*b* arranged on the top and bottom of the housing 319 on the sides farther from the transfer line than the aforementioned downstream slider holders 321*a*, 321*b*, crank shafts 347*a*, 347*b* extending substantially horizontally in the direction orthogonal to the transfer line S, whose non-eccentric portions 346*a*, 346*b* are supported by the shaft boxes 345*a*, 345*b* through bearings, and rods 350*a*, 350*b* inserted through the above-mentioned rod insertion holes 323*a*, 323*b*, the big ends of which are connected to the eccentric portions 348*a*, 348*b* of the crank shafts 347*a*, 347*b* through bearings, and the tips of which are connected to the brackets 329*a*, 329*b* of the downstream sliders 325*a*, 325*b* through the bearings of pins 349*a*, 349*b* parallel to the crank shafts 347*a*, 347*b*.

The shaft box 345*a* located above the transfer line S is supported by and fixed to a support member 351*a* provided on top of the housing 319, and the shaft box 345*b* located below the transfer line S is supported by a support member 351*b* provided on bottom of the housing 319 in a manner such that its can be moved up and down.

Further, the location of the shaft box 345*b* with respect to the transfer line S can be set by moving it up or down with a position adjusting screw (not illustrated).

In the aforementioned mechanisms 344*a*, 344*b* for moving the downstream sliders, the displacements of the eccentric portions 348*a*, 348*b* associated with the rotation of the crank shafts 347*a*, 347*b* are transmitted to the downstream sliders 325*a*, 325*b* through the rods 350*a*, 350*b*, and the die holders 327*a*, 327*b* and the downstream dies 333*a*, 333*b* move towards and away from the transfer line S together with the above-mentioned downstream sliders 325*a*, 325*b*.

Upstream hydraulic cylinders 352*a*, 352*b* are installed on the upstream A side of the upstream sliders 324*a*, 324*b* on the transfer line so that the piston rods 353*a*, 353*b* point towards the downstream B side of the transfer line and are located parallel to the transfer line S, and the aforementioned piston rods 353*a*, 353*b* are connected to the upstream dies 330*a*, 330*b*.

With these upstream hydraulic cylinders 352*a*, 352*b*, when hydraulic pressure is applied to the hydraulic chambers on the head side, the piston rods 353*a*, 353*b* are pushed out, and the die holders 326*a*, 326*b* and the upstream dies 330*a*, 330*b* move towards the downstream B side of the upstream sliders 324*a*, 324*b* on the transfer line, and when hydraulic pressure is applied to the hydraulic chambers on the rod side, the piston rods 353*a*, 353*b* are retracted, and the die holders 326*a*, 326*b* and the upstream dies 330*a*, 330*b* move towards the upstream A side of the upstream sliders 324*a*, 324*b* on the transfer line.

The downstream hydraulic cylinders 354*a*, 354*b* are mounted near the downstream B side of the downstream sliders 325*a*, 325*b* on the transfer line so that the piston rods 355*a*, 355*b* point towards the upstream A side of the transfer line and are located parallel to the transfer line S, and the above-mentioned piston rods 355*a*, 355*b* are connected to the downstream dies 333*a*, 333*b*.

With these downstream hydraulic cylinders 354*a*, 354*b*, when hydraulic pressure is applied to the hydraulic chambers on the rod side, the piston rods 355*a*, 355*b* are retracted, and the die holders 327*a*, 327*b* and the upstream dies 333*a*, 333*b* move towards the downstream B side of the downstream sliders 325*a*, 325*b* on the transfer line, and when hydraulic pressure is applied to the hydraulic chambers on the head side, the piston rods 355*a*, 355*b* are pushed out, and the die holders 327*a*, 327*b* and the downstream dies 333*a*, 333*b* move towards the upstream A side of the downstream sliders 325*a*, 325*b* on the transfer line.

Synchronous drive mechanisms 356*a*, 356*b* are provided with input shafts 357*a*, 357*b*, upstream output shafts 358*a*. 358*b*, downstream output shafts 359*a*, 359*b*, and a plurality of gears (not illustrated) that transmit the rotation of the input shafts 357*a*, 357*b* to the output shafts 358*a*, 358*b*, 359*a*, and 359*b*, and when the input shafts 357*a*, 357*b* rotate, the output shafts 358*a*, 358*b*, 359*a*, and 359*b* rotate in the same direction at the same rotational speed.

The upstream output shaft 358*a* of the synchronous drive mechanism 356*a* is connected on one side through a universal coupling (not illustrated) to, a non-eccentric portion 338*a* of the crank shaft 339*a* that is a component of the mechanism 336*a* for moving the upstream slider and the downstream output shaft 359*a* is connected through a universal coupling (not illustrated), to a non-eccentric portion 338*b* of the crank shaft 347*a* that is a component of the mechanism 344*a* for moving the downstream slider.

The crank shafts 339*a*, 347*a* are connected to the aforementioned output shafts 358*a*, 359*a* in such a state that there is a phase angle difference of 180° between the eccentric portion 340*a* of the crank shaft 339*a* and the eccentric portion 348*a* of the crank shaft 347*a*.

The upstream output shaft 358*b* of the other synchronous drive mechanism 356*b*, is connected via a universal coupling (not illustrated) to a non-eccentric portion 338*b* of the crank shaft 339*b*, that is a component of the mechanism 336*b* for moving the upstream slider, and the downstream output shaft 359*b*, is connected through a universal coupling (not illustrated) to a non-eccentric portion 338*b* of the crank shaft 347*b* that is a component of the mechanism 344*b* for moving the downstream slider.

The crank shafts 339*b*, 347*b* are connected to the aforementioned output shafts 358*b*, 359*b* in such a state that there is a phase angle difference of 180° between the eccentric portion 340*b* of the crank shaft 339*b* and the eccentric portion 348*b* of the crank shaft 347*b*.

The input shafts 357*a*, 357*b* of the synchronous drive mechanisms 356*a*, 356*b*, are connected to the output shafts of motors through universal couplings (not illustrated), and one motor operates so that the crank shafts 339*a*, 347*a* rotate counterclockwise in FIGS. 21 through 24, and the other motor operates so that the crank shafts 339*b*, 347*b* rotate clockwise in FIGS. 21 through 24.

The rotational speeds of the upper and lower motors are controlled by a control device (not illustrated) synchronously in such a manner that the speed of rotation corresponds to the speed of the material 1 to be shaped, moving on the transfer line S, and the phase angles of the upper crank shafts 339*a*, 347*a* and the lower crank shafts 339*b*, 347*b* are symmetrical with respect to the transfer line S.

When the material 1 to be shaped is reduced and formed by the plate reduction press apparatus as shown in FIGS. 21 through 25, position adjusting screws (not illustrated) for the lower shaft boxes 337*b*, 345*b* of the transfer line S are rotated appropriately, thereby the space between the upper dies 330*a*, 330*b* and the space between the downstream dies 333*a*, 333*b* are determined according to the plate thickness of the material 1 to be reduced and formed.

Also, both of the motors (not illustrated) connected to the synchronous drive mechanisms 356*a*, 356*b* are operated to rotate the crank shafts 339*a*, 347*a* above the transfer line S counterclockwise and the crank shafts 339*b*, 347*b* below the transfer line S clockwise.

Thus, as the crank shafts 339*a*, 339*b* rotate the displacements of the eccentric portions 340*a*, 340*b*, are transmitted to the upstream sliders 324*a*, 324*b* through the rods 342*a*, 342*b*, and the upstream dies 330*a*, 330*b* move towards and away from the transfer line S together with the above-mentioned upstream sliders 324*a*, 324*b*, and as the crank shafts 347*a*, 347*b* rotate the displacements of the eccentric portions 348*a*, 348*b* are transmitted to the downstream sliders 325*a*, 325*b* through the rods 350*a*, 350*b*, and the downstream dies 333*a*, 333*b* move towards and away from the transfer line S in the reverse phase to the aforementioned upstream dies 330*a*, 330*b*, together with the above-mentioned sliders 325*a*, 325*b*.

Figure 21:
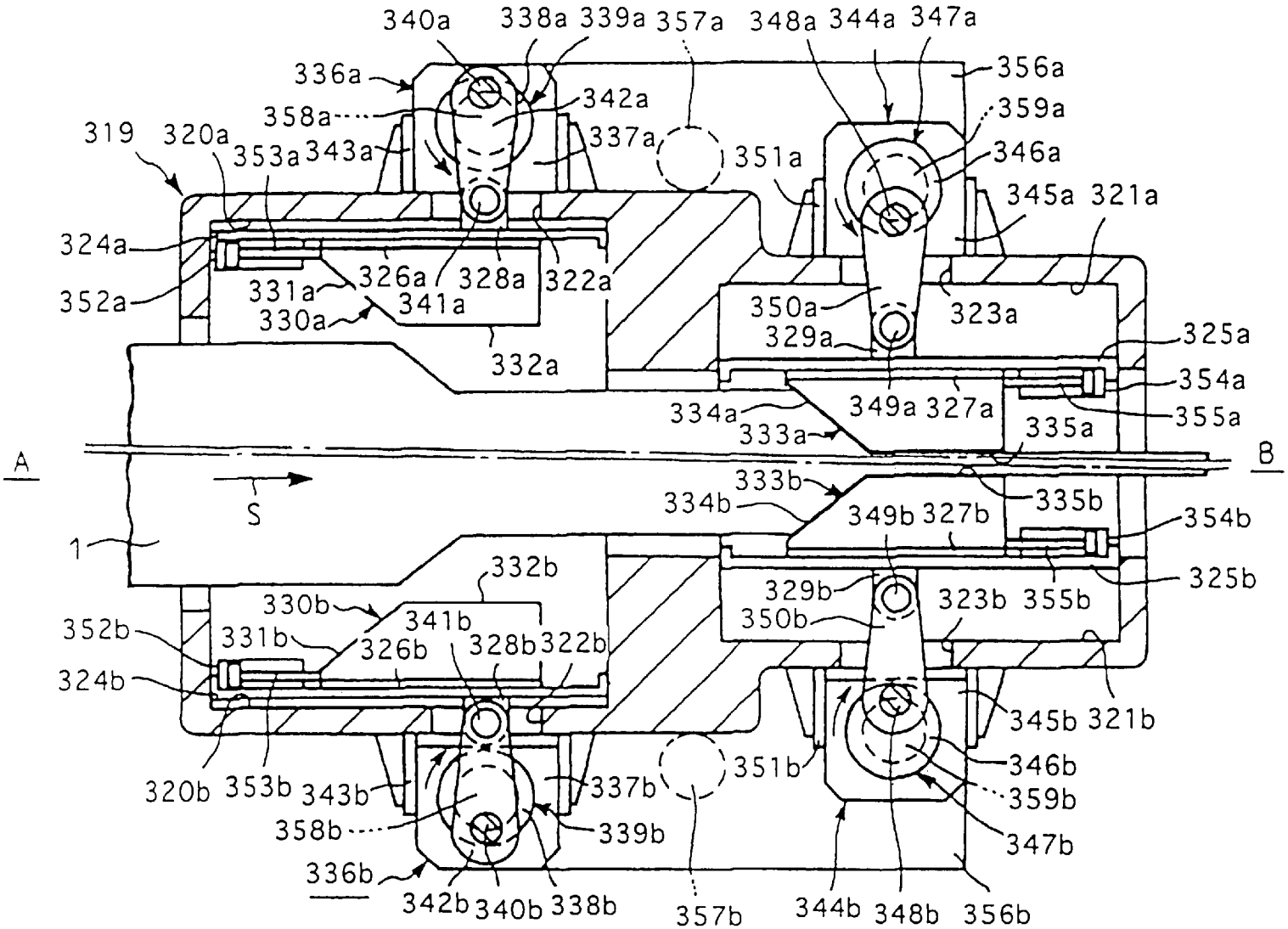
FIG. 21 is a conceptual view seen from the side of the transfer line of the seventh embodiment of the plate reduction press apparatus according to the present invention, when the upstream dies are in the most separated position from the transfer line and the downstream dies are in the closest position to the transfer line.
Figure 23:
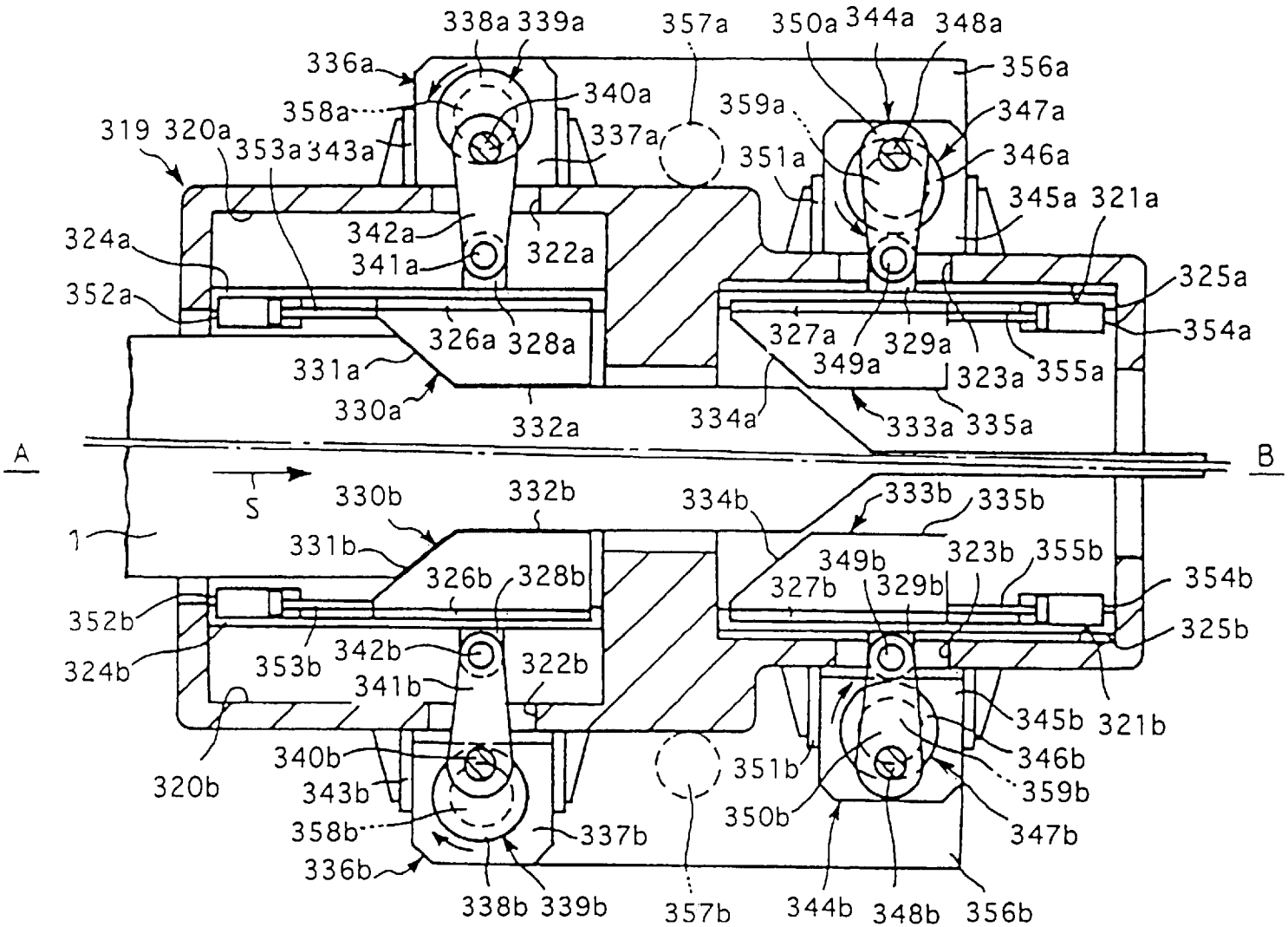
FIG. 23 is a conceptual view seen from the side of the transfer line of the seventh embodiment of the plate reduction press apparatus according to the present invention, when the upstream dies are in the closest position to the transfer line and the downstream dies are in the most separated position from the transfer line.
Figure 24:
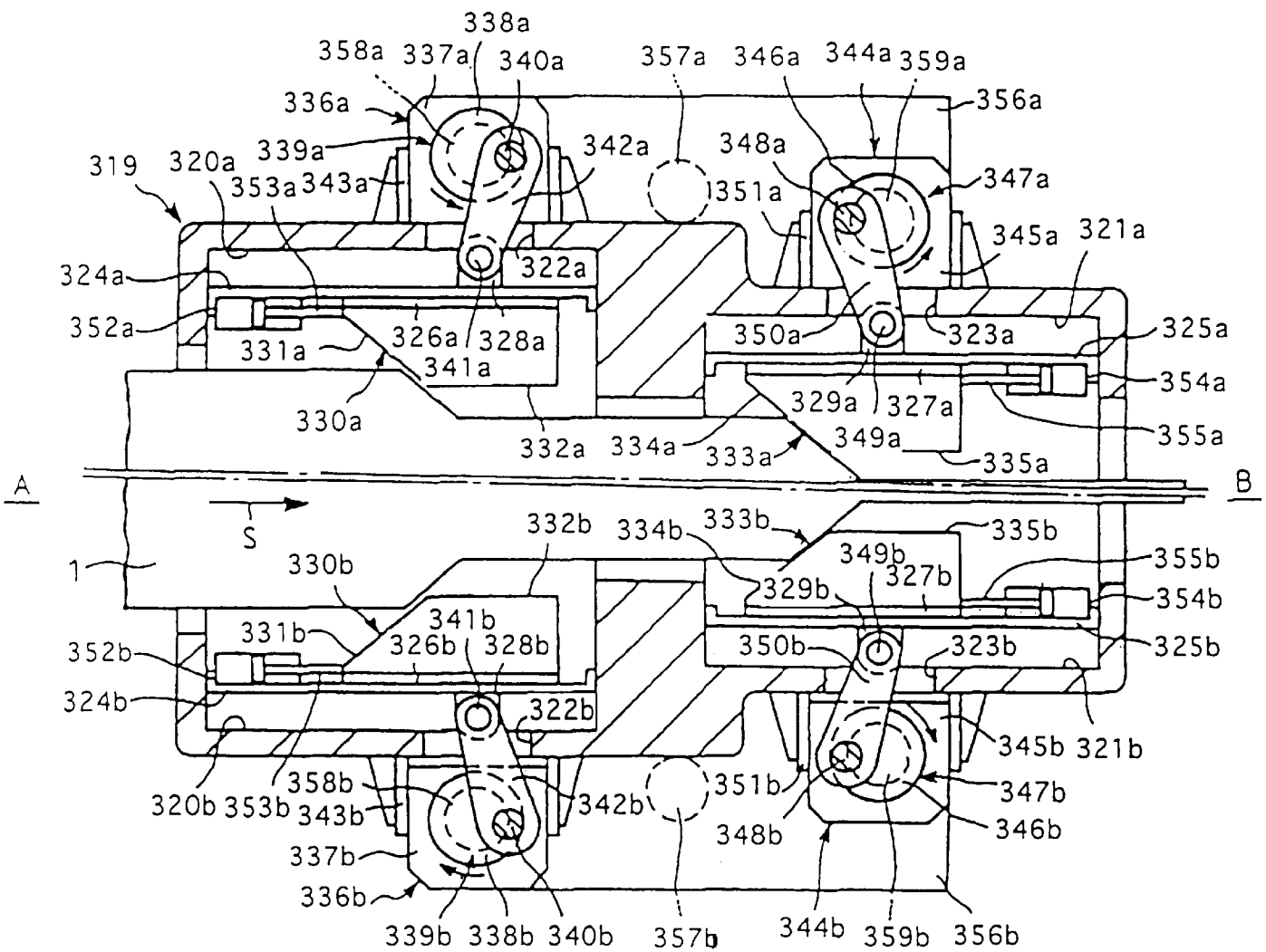
FIG. 24 is a conceptual view seen from the side of the transfer line of the seventh embodiment of the plate reduction press apparatus according to the present invention, when the upstream dies are moving away from the transfer line and the downstream dies are moving towards the transfer line.
Figure 25:
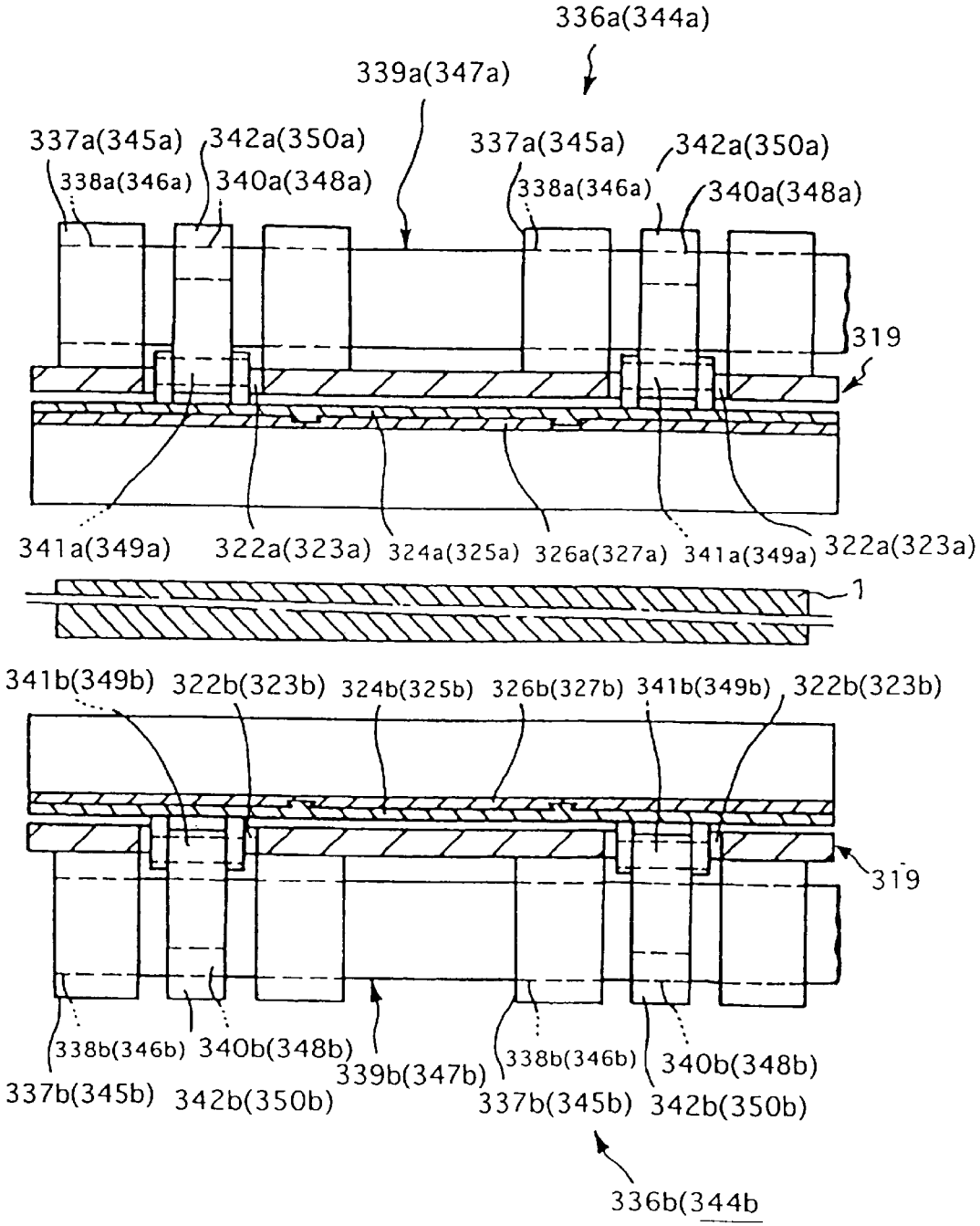
FIG. 25 is a conceptual view showing the mechanisms for moving the sliders shown in FIGS. 21 through 24, in a sectional view in the longitudinal direction of the transfer line.
Figure 26:
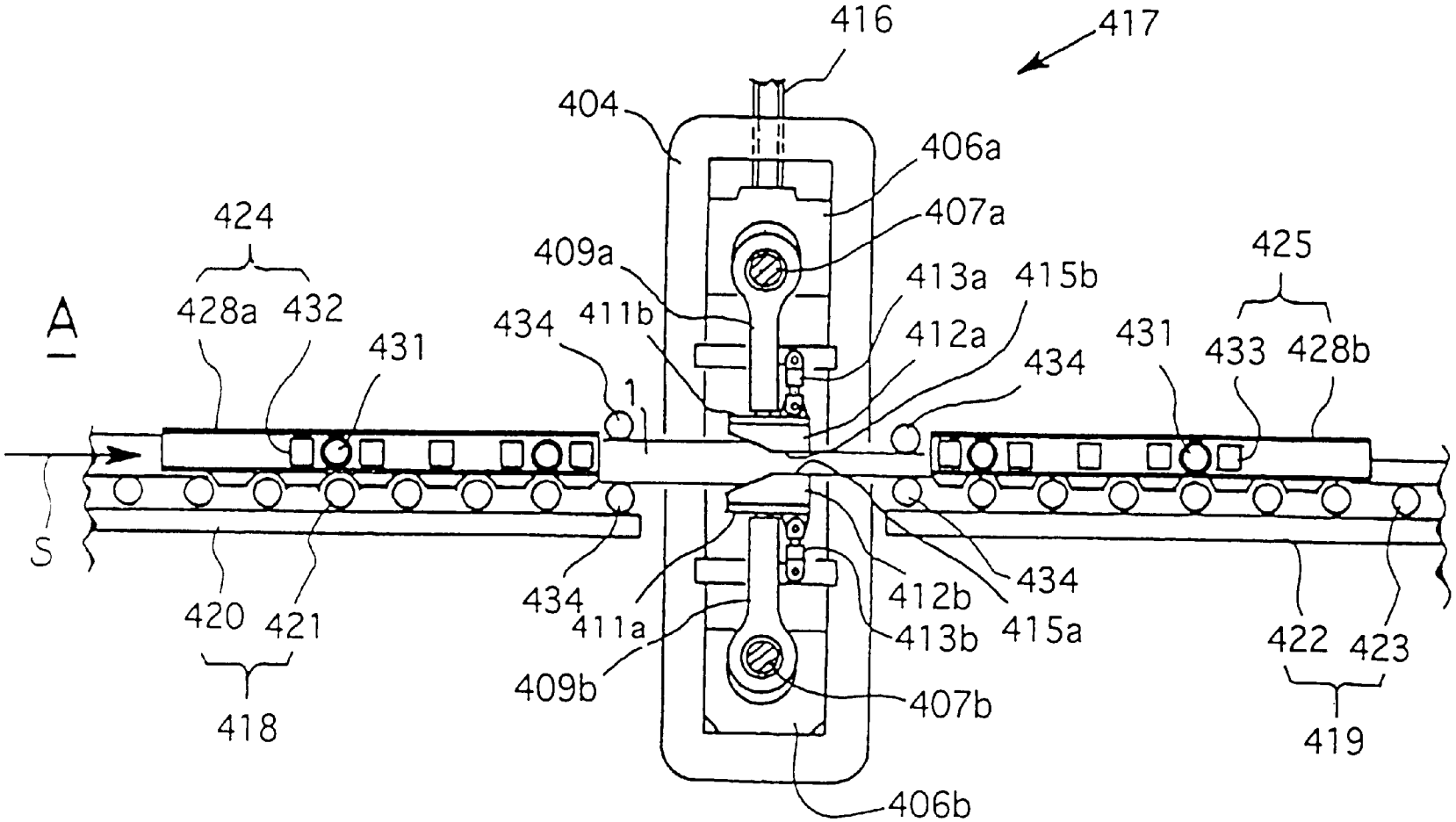
FIG. 26 is a side view showing the eighth embodiment of the plate reduction press apparatus according to the present invention.

Moreover, when the upstream dies 330*a*, 330*b* move towards the transfer line S, hydraulic pressure is applied to the fluid chambers on the head side of the upstream hydraulic cylinders 352*a*, 352*b*, and the upstream dies 330*a*, 330*b* are moved to the downstream B side of the transfer line (see FIGS. 22 and 23), and when the upstream dies 330*a*, 330*b* move away from the transfer line S, hydraulic pressure is applied to the fluid chambers on the rod side of the upstream hydraulic cylinders 352*a*, 352*b*, so that the upstream dies 330*a*, 330*b* are moved towards the upstream A side of the transfer line (see FIGS. 24 and 21).

Figure 22:
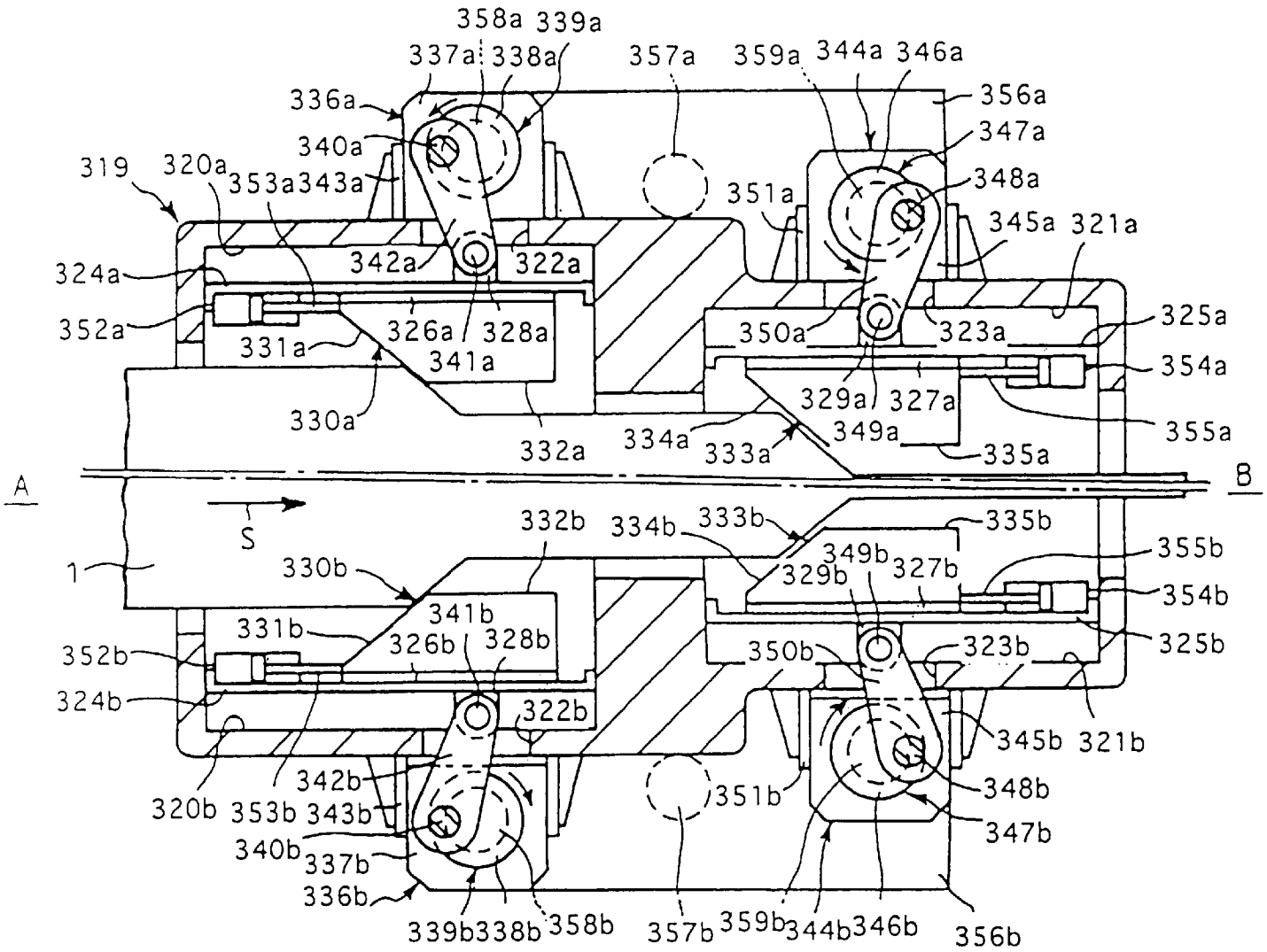
FIG. 22 is a conceptual view seen from the side of the transfer line of the seventh embodiment of the plate reduction press apparatus according to the present invention, when the upstream dies are moving towards the transfer line and the downstream dies are moving away from the transfer line.

In the same way as above, when the downstream dies 333*a*, 333*b* move towards the transfer line S, hydraulic pressure is applied to the hydraulic chambers on the rod side of the downstream hydraulic cylinders 354*a*, 354*b*, and the downstream dies 333*a*, 333*b* are moved towards the downstream B side of the transfer line (see FIGS. 24 and 21), and when the downstream dies 333*a*, 333*b* move away from the transfer line S, hydraulic pressure is applied to the hydraulic chambers on the head side of the downstream hydraulic cylinders 354*a*, 354*b*, so that the downstream dies 333*a*, 333*b* are moved towards the upstream A side of the transfer line (see FIGS. 22 and 23).

Next, the end on the downstream B side of the transfer line of the material 1, to be reduced and shaped in the direction of the plate thickness, is inserted between the upstream dies 330*a*, 330*b* from the upstream A side of the transfer line, and the aforementioned material 1 to be shaped is moved towards the downstream B side of the transfer line, then the first plate reduction sub-method is carried out, in which the material 1 to be shaped is reduced and formed in the direction of the plate thickness, by means of the upper and lower upstream dies 330*a*, 330*b* that move towards the transfer line S and move in the downstream B direction of the transfer line.

At this time, the downstream dies 333*a*, 333*b* are moving away from the transfer line S and moving in the upstream A direction of the transfer line.

As the material 1 to be shaped moves towards the downstream B side of the transfer line, the first plate reduction sub-method as described above presses the portion of the end near the downstream B side of the transfer line of the material 1 to be shaped, then the end near the downstream B side of the transfer line of the material 1 after being shaped by the first plate thickness reduction sub-method, is inserted between the downstream dies 333*a*, 333*b*, and the material 1 to be shaped is further reduced and formed in the direction of the plate thickness by the upper and lower downstream dies 333*a*, 333*b* that move towards the transfer line S and also move in the downstream B direction of the transfer line, and this is defined as a second plate reduction sub-method.

At this time, because the upstream dies 330*a*, 330*b* are moving away from the transfer line S and moving in the upstream A direction of the transfer line, the rotational force transmitted from the upper and lower motors to the synchronous drive mechanisms 356*a*, 356*b* can be utilized efficiently to reduce and form the material 1 to be shaped by the downstream dies 333*a*, 333*b*.

In addition, the inertia forces of the crank shafts 339*a*, 339*b* and the rods 342*a*, 342*b* of the mechanisms 336*a*, 336*b* for moving the upstream sliders, the upstream dies 330*a*, 330*b*, etc. are transmitted to the downstream dies 333*a*, 333*b* through the synchronous drive mechanisms 356*a*, 356*b*, the crank shafts 347*a*, 347*b* and the rods 350*a*, 350*b* of the mechanisms 344*a*, 344*b*, for moving the downstream sliders etc., and assist the aforementioned downstream dies 333*a*, 333*b* to reduce and form the material 1 to be shaped.

When the second plate reduction sub-method is completed for the portion of the end near the downstream B side of the transfer line of the material 1 to be shaped, the upstream dies 330*a*. 330*b* are in the farthest position from the transfer line S (see FIG. 21), and as the material 1 to be shaped moves in the downstream B direction of the transfer line, all unreduced portion of the material 1 to be shaped, which is following after the portion already reduced by the first plate reduction sub-method, is inserted between the upstream dies 330*a*, 330*b*, so that the material 1 to be shaped is reduced by the first plate reduction sub-method as the upper and lower upstream dies 330*a*, 330*b* move towards the transfer line S.

In addition, because the downstream dies 333*a*, 333*b* are moving away from the transfer line S (see FIG. 22), the rotational forces transmitted from the upper and lower motors to the synchronous drive mechanisms 356*a*, 356*b* can be utilized efficiently to reduce and form the material 1 to be shaped by the upstream dies 330*a*, 330*b*.

Furthermore, the inertia forces of the crank shafts 347*a*, 347*b* and the rods 350*a*, 350*b* of the mechanisms 344*a*, 344*b* for moving the downstream sliders, the downstream dies 333*a*, 333*b*, etc. are transmitted to the upstream dies 330*a*, 330*b* through the synchronous drive mechanisms 356*a*, 356*b*, the crank shafts 339*a*, 339*b* and the rods 342*a*, 342*b* of the mechanisms 330*a*, 330*b* for moving the upstream sliders, etc., and assist the above-mentioned upstream dies 330*a*, 330*b* to press and form the material 1 to be shaped.

When the first plate reduction sub-method is completed for the portion of the material 1 to be shaped, as described above, the downstream dies 333*a*, 333*b* are in the farthest position from the transfer line S (see FIG. 23), and as the material 1 to be shaped moves in the downstream B direction of the transfer line, the portion of the material 1 to be shaped, that has been reduced by the first plate reduction sub-method, and is in continuation with a portion which has already been reduced by the second plate reduction sub-method, is inserted between the downstream dies 333*a*, 333*b*, and as the upper and lower downstream dies 333*a*, 333*b* move towards the transfer line S, the material 1 to be shaped is processed by the second plate reduction sub-method, and as soon as it is finished, the upstream dies 330*a*, 330*b* move away from the transfer line S (see FIG. 24).

With the plate reduction press apparatus illustrated in FIGS. 21 through 25, as described above, an unreduced portion of the material to be shaped is subjected to the first plate reduction sub-method in which the portion is reduced and formed in the direction of the plate thickness by means of the upstream dies 330*a*, 330*b*, and then the portion that has been reduced and formed of the material 1 to be shaped is further reduced and formed by the downstream dies 333*a*, 333*b* in the direction of the plate thickness, according to the second plate reduction sub-method, and so the material 1 to be shaped can be efficiently reduced and formed in the direction of the plate thickness.

Because the first and second plate reduction sub-methods are operated alternately on an unreduced portion of the material 1 to be shaped and a portion which has already been reduced by the first sub-method, respectively, the loads applied to the upstream dies 330*a*, 330*b* and the downstream dies 333*a*, 333*b* during pressing can be reduced, and therefore the rotational forces of the upper and lower motors transmitted to the synchronous drive mechanisms 356*a*, 356*b* can be used efficiently.

Consequently, the strengths required for the mechanisms 336*a*, 336*b*, 344*a*, and 344*b* for moving the sliders composed of various components and members such as the housing 319, sliders 324*a*, 324*b*, 325*a*, and 325*b*, die holders 326*a*, 326*b*, 327*a*, and 327*b*, shaft boxes 337*a*, 337*b*, 345*a*, and 345*b*, crank shafts 339*a*, 339*b*, 347*a*, and 347*b*, and rods 342*a*, 342*b*, 350*a*, and 350*b* can be reduced, so that these mechanisms, components and members can be made more compact.

Moreover, when the upstream dies 330*a*, 330*b* and the downstream dies 333*a*, 333*b* reduce and form the material 1 to be shaped, the dies move towards the downstream B side of the transfer line, so the movement of the material in a backward direction towards the upstream A side of the transfer line, when the material 1 to be shaped is reduced and formed, can be avoided.

The plate reduction press apparatus and sub-methods according to the present invention are not limited only to the embodiments described above, but for example, the hydraulic cylinders can be replaced by expanding actuators such as screw jacks, for the die moving mechanisms; all the crank shafts can be rotated by a single motor; each crank shaft can be rotated by an individual motor; the number of rods that transmit the displacements of the eccentric portions of the crank shafts to the sliders can be changed; or any other modifications can be incorporated unless they deviate from the claims of the present invention.

As described above, the plate reduction press apparatus and sub-methods of the present invention provide the following various advantages.

(1) According to the plate reduction pressing sub-method of the present invention, an unreduced portion of the material to be shaped is reduced and formed by the first plate reduction sub-method in which the upper and lower upstream dies reduce the material in the direction of the plate thickness, and then the portion of the material to be shaped, after being reduced and formed by the first sub-method, is further reduced and formed by the upper and lower downstream dies in the direction of the plate thickness, by the second plate reduction sub-method, therefore the material to be shaped can be reduced and formed efficiently in the direction of the plate thickness.

(2) According to the plate reduction pressing methods of the present invention, the first and second plate reduction sub-methods are carried out alternately on an unreduced portion of the material to be shaped and a portion of the material to be shaped, that has been reduced by the first sub-method, consequently the loads to be applied to the upstream and downstream dies during pressing can be reduced.

(3) With any of the plate reduction press apparatus of the present invention as discussed above, the mechanisms for moving the upstream sliders move the upstream dies together with the upstream sliders towards the transfer line, and an unreduced portion of the material to be shaped is reduced by the upper and lower upstream dies in the direction of the plate thickness, and then the mechanism for moving the downstream sliders move the downstream dies together with the downstream sliders towards the transfer line, and the portion of the material to be shaped, already reduced by the upstream dies, is further reduced by the upper and lower downstream dies in the direction of the plate thickness, so that the material to be shaped can be reduced and formed efficiently in the direction of the plate thickness.

(4) In any of the plate reduction press apparatus of the present invention discussed above, the upstream dies are moved towards and away from the transfer line by the mechanisms for moving the upstream sliders in the reverse phase to the phase that the downstream dies are moved towards and away from the transfer line by the mechanisms for moving the downstream sliders, therefore the loads applied to the upstream and downstream dies during pressing are reduced, so the strengths required for the various components and members constituting the sliders on which the dies are mounted and the mechanisms for moving the sliders, can be reduced and they can be made more compact.

(Eighth Embodiment)

Figure 3:
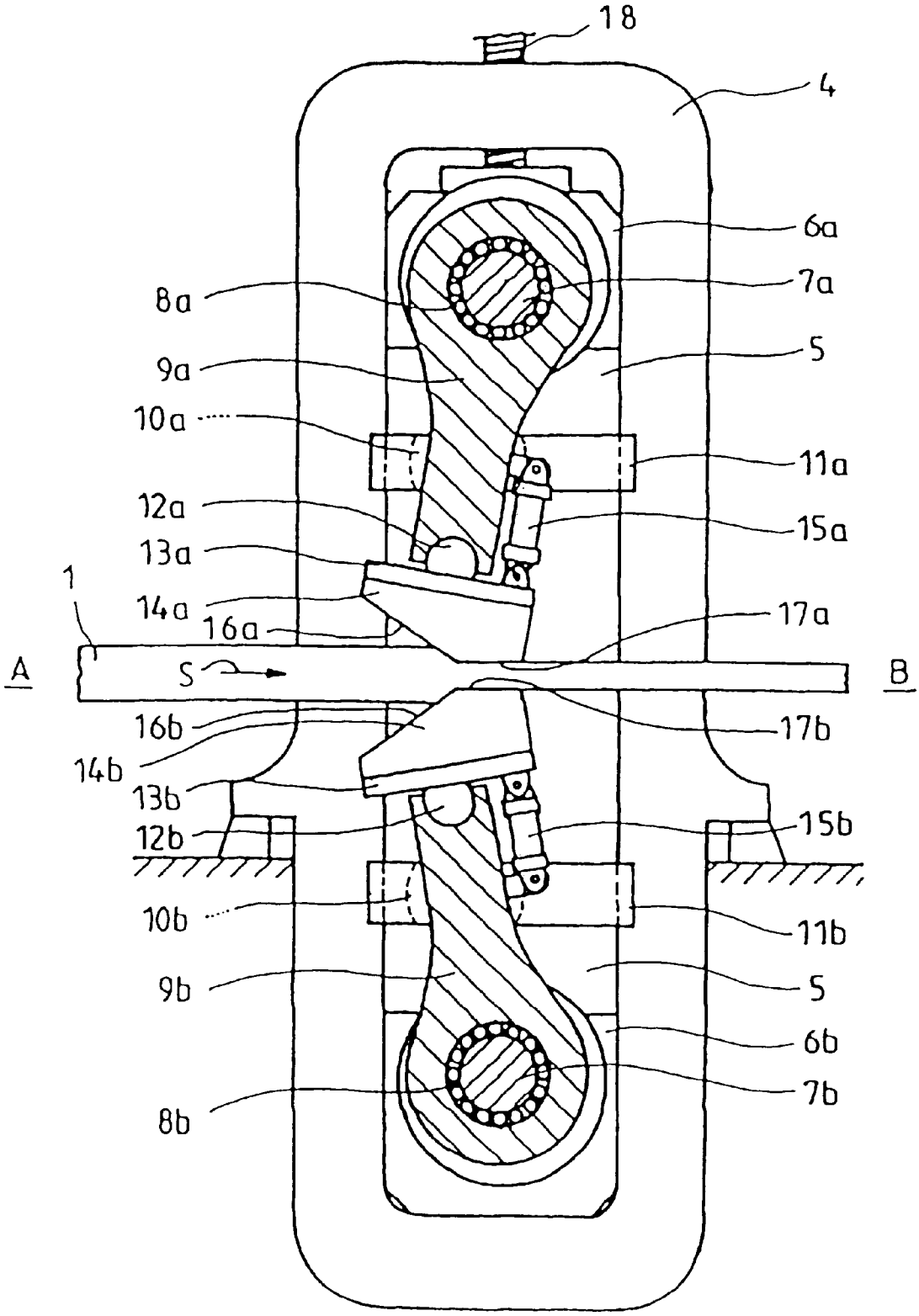
FIG. 3 is a conceptual view showing an example of a flying sizing press apparatus.
Figure 4:
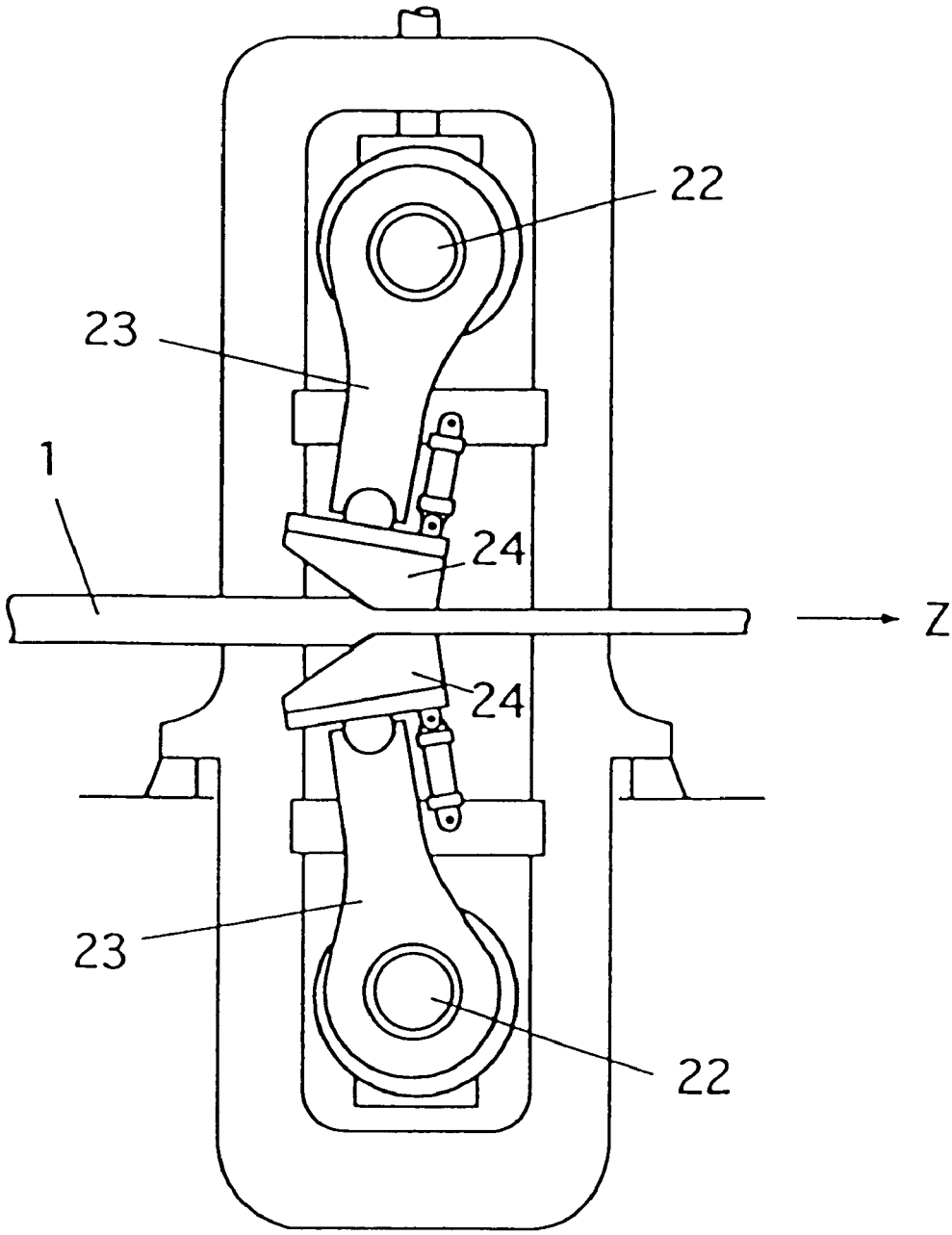
FIG. 4 is a structural view of a conventional high-reduction press machine.
Figure 5:
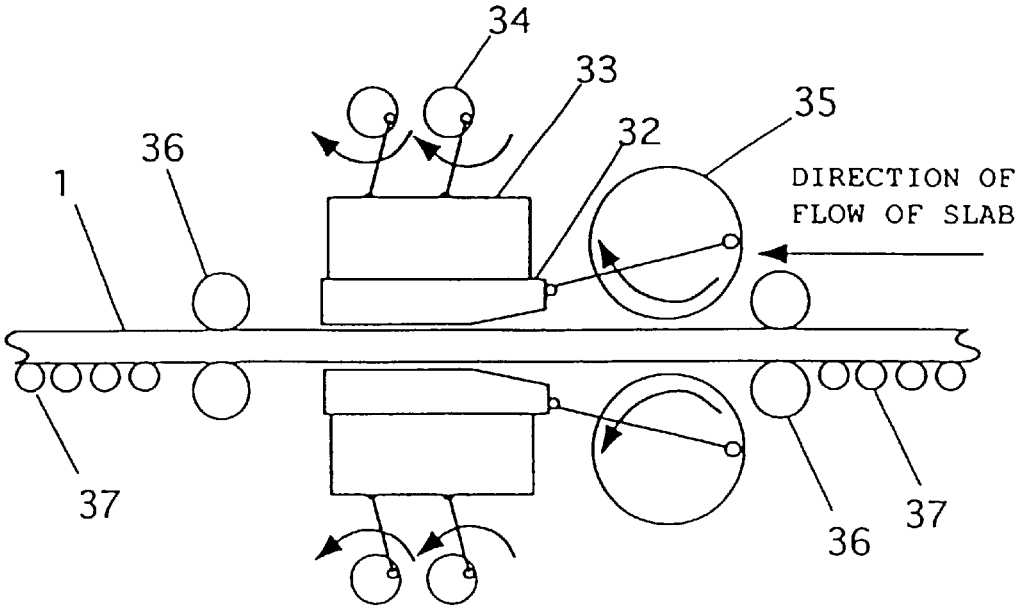
FIG. 5 is a view showing a conventional flying reduction press machine.
Figure 6:
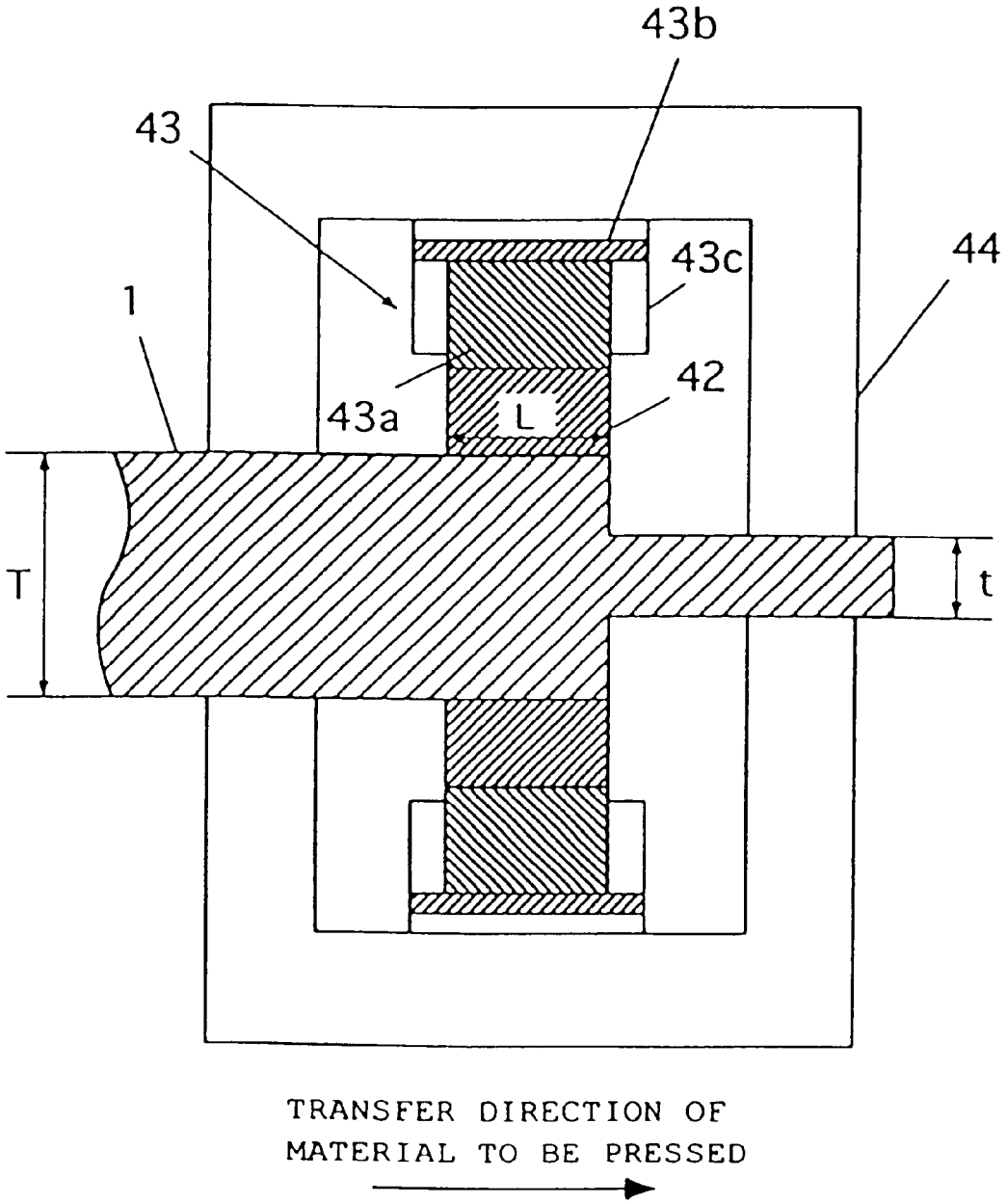
FIG. 6 is a view showing an example of the configuration of a reduction press machine using conventional long dies.
Figure 7:
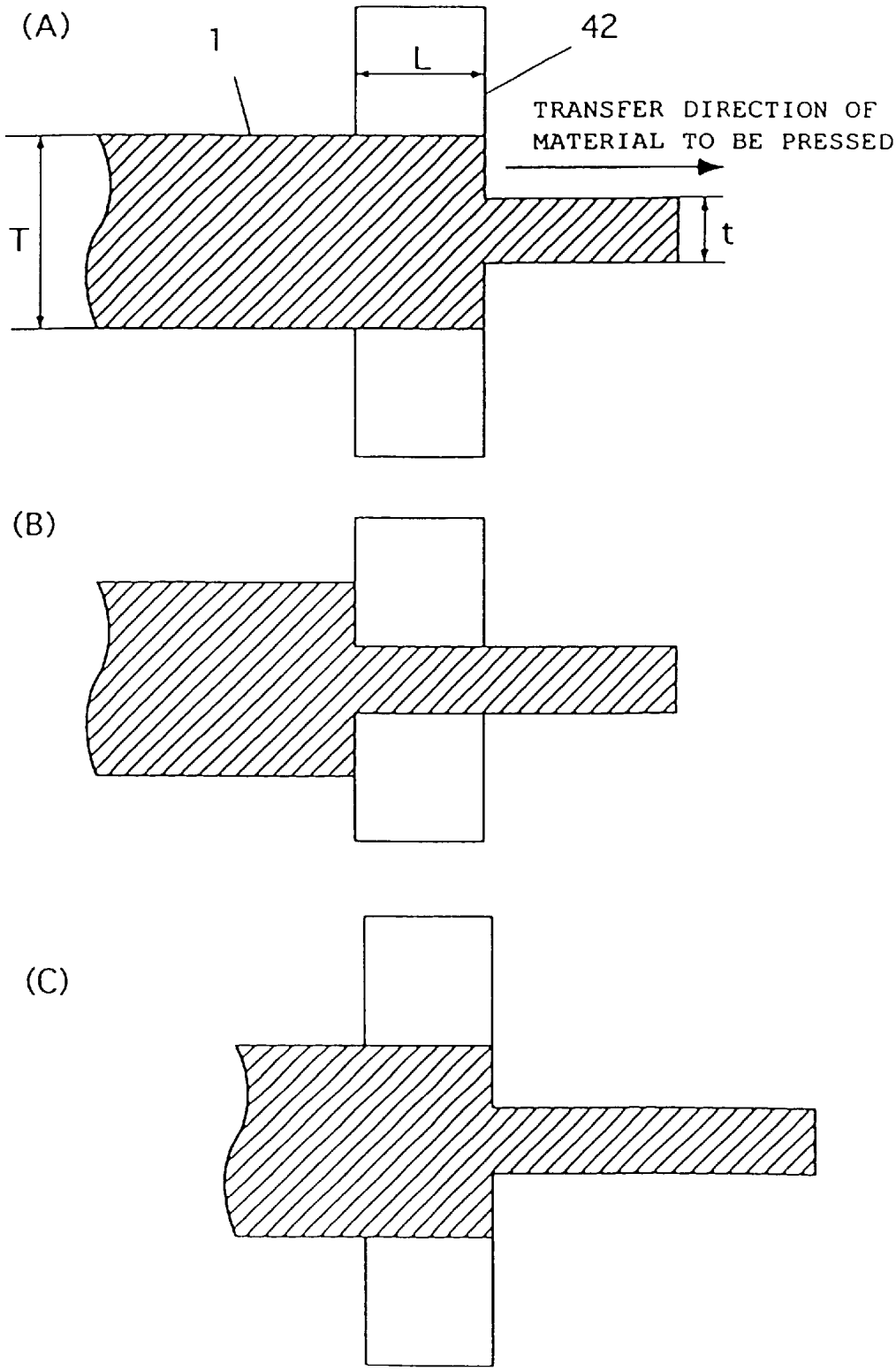
FIGS. 7(A), 7(B), and 7(C) are views showing the operation of the apparatus shown in FIG. 6.
Figure 8:
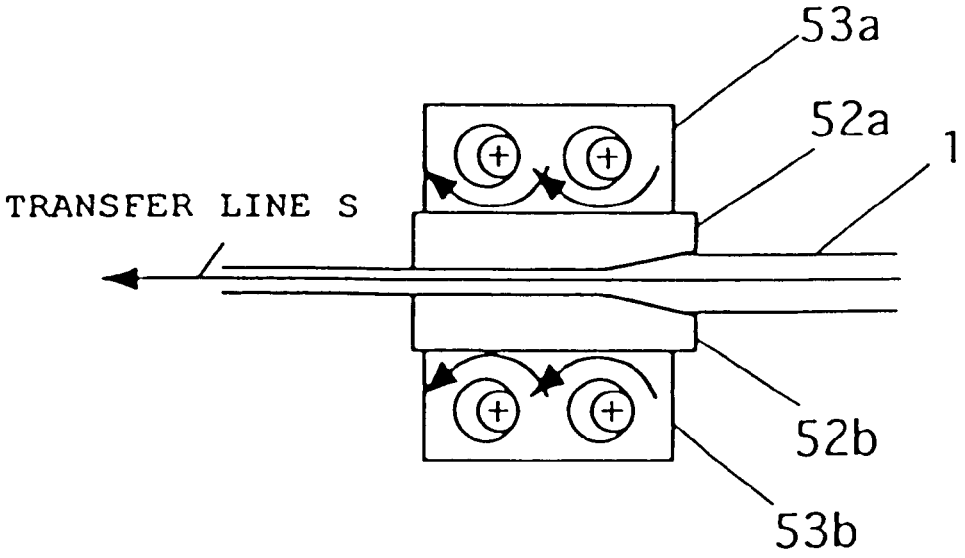
FIG. 8 shows the method of reducing thickness used during hot pressing.
Figure 9:
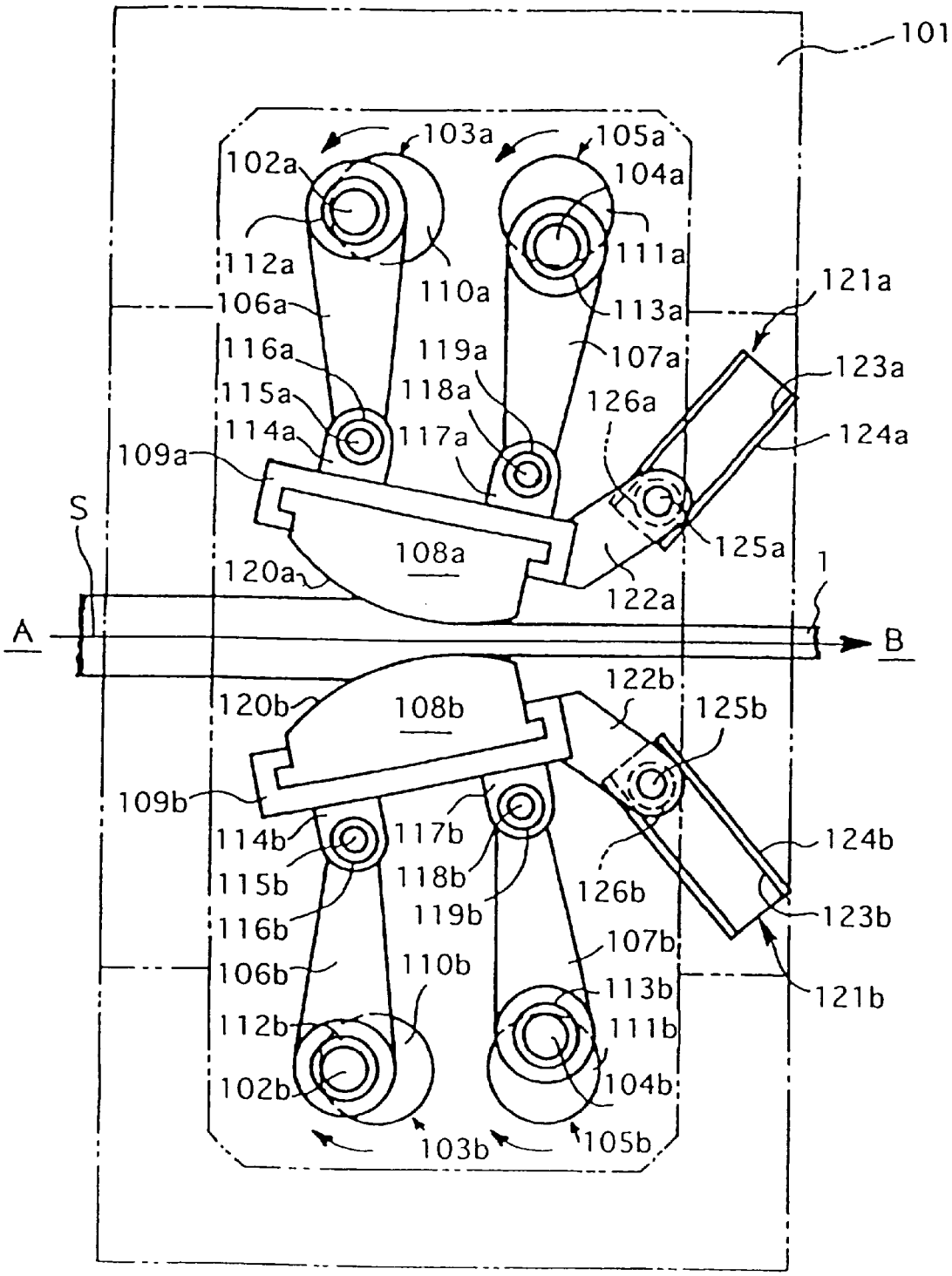
FIG. 9 is a general view seen from the side of the transfer line, of the first embodiment of the plate reduction press apparatus according to the present invention.

FIGS. 26 through 29 show an embodiment of the plate reduction press apparatus according to the present invention, and the item numbers in the figures identify components in the same way as in FIG. 3.

Item number 417 indicates a flying sizing press apparatus, which is configured in the same way as that shown in FIG. 3.

An upstream roller table 418 is arranged on the upstream A side of dies 412*a*, 412*b* on the transfer line, and a downstream roller table 419 is arranged on the downstream B side of the transfer line.

The upstream roller table 418 is provided with a fixed frame 420 that is parallel to the material 1 to be shaped in the lateral direction at a predetermined distance below the transfer line S and extending substantially horizontal along the transfer line S, and a plurality of table rollers 421 arranged on the fixed frame 420 at predetermined intervals so that the rollers can support the lower surface of the material 1 to be shaped, which is to be inserted between the dies 412*a*, 412*b*, substantially horizontally, and that are supported by the fixed frame 420 in a freely rotatable manner.

The downstream roller table 419 is composed of a fixed frame 422 installed parallel to the material 1 to be shaped in the lateral direction at a predetermined distance below the transfer line S, and extending along the transfer line S substantially horizontally, and a plurality of table rollers 423 arranged on the aforementioned fixed frame 422 at predetermined intervals in a freely rotatable manner, so that the rollers can support the lower surface of the material 1 being shaped and fed out from the dies 412*a*, 412*b* of the flying sizing press apparatus 417.

Figure 27:
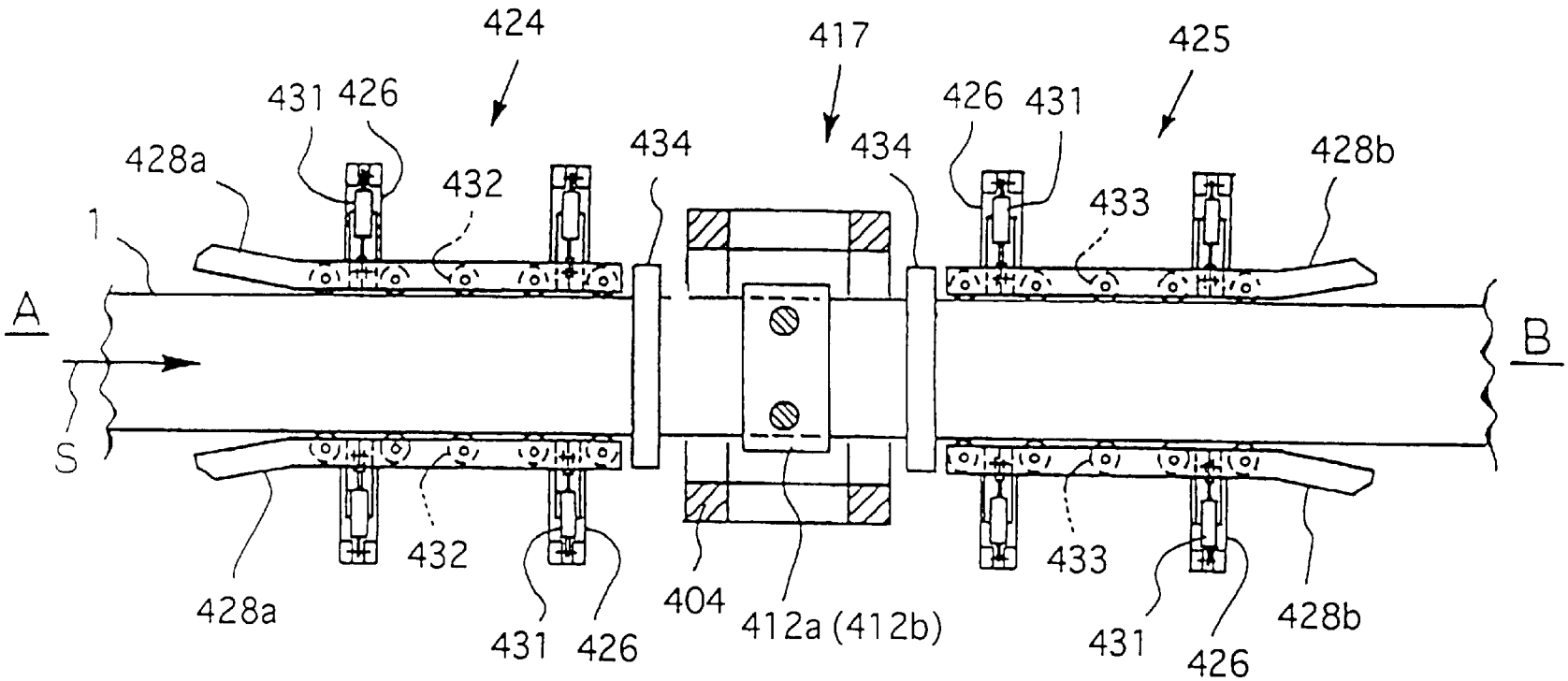
FIG. 27 is a plan view of the apparatus shown in FIG. 26.
Figure 28:
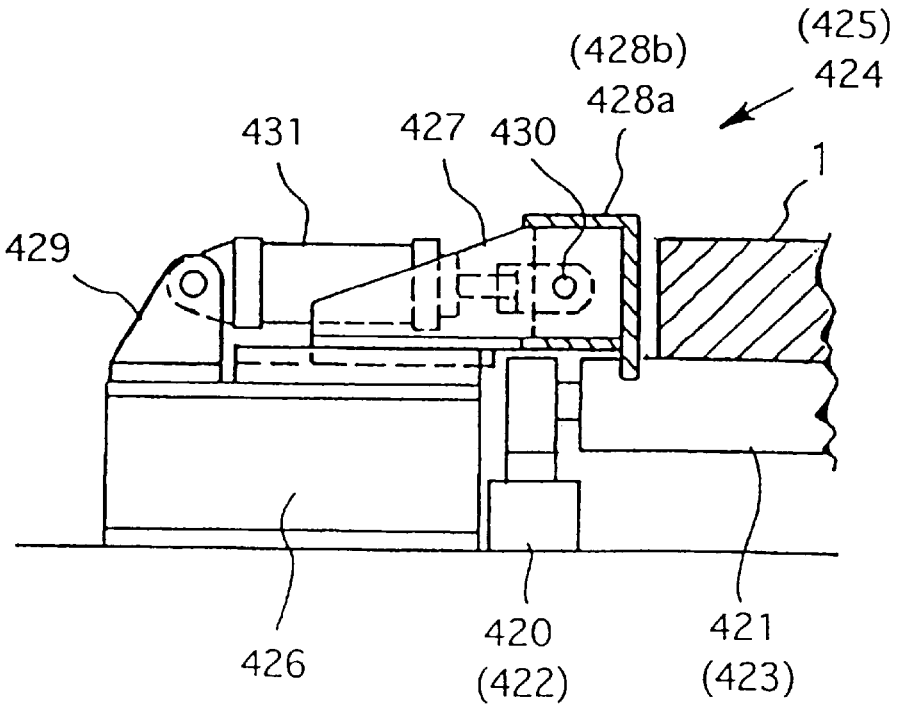
FIG. 28 is a sectional view of the cylinder mounting portion of the side guide shown in FIG. 26.
Figure 29:
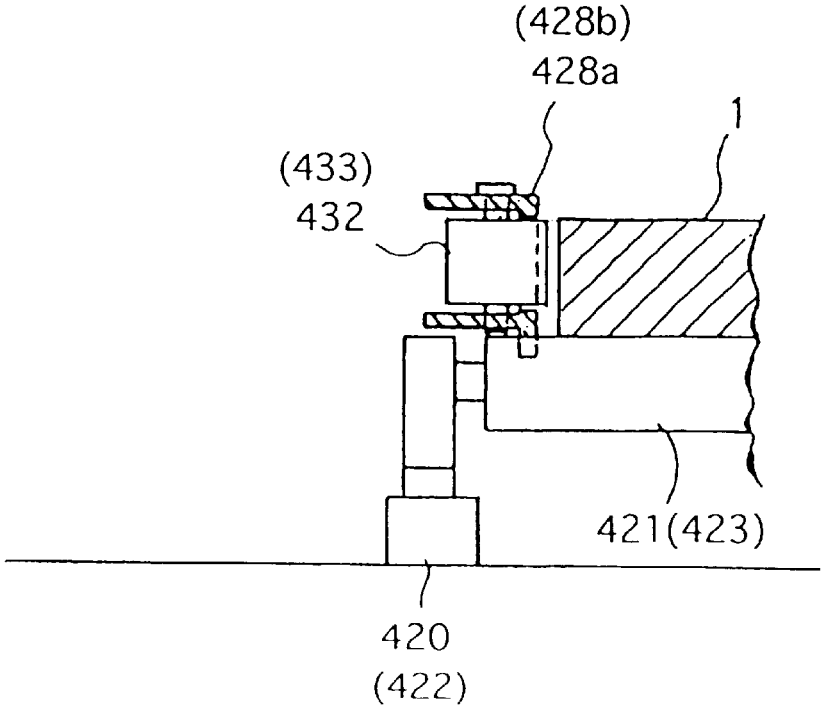
FIG. 29 is a sectional view of the vertical roller support portion of the side guides shown in FIG. 26.

On the upstream A side of the transfer line in the close vicinity of the dies 412*a*, 412*b* of the flying sizing press apparatus 417, a pair of upstream side guides 424 are installed, that face the material 1 to be shaped in the lateral direction of the transfer line S above the table rollers 421 of the upstream roller table 418, and that are capable of being moved towards or away from the transfer line S, and on the downstream B side of the transfer line in the close vicinity of the above-mentioned dies 412*a*, 412*b*, a pair of downstream side guides 425 are installed, that face the material 1 to be shaped in the lateral direction of the transfer line S above the table rollers 423 of the downstream roller table and that can be moved towards and away from the transfer line S. As shown in FIGS. 27 through 28 the upstream side guides 424 and the downstream side guides 425 are provided with a plurality of guide frames 426 arranged on the floor further from the transfer line than the fixed frames 420, 422 of the upstream and downstream roller tables 418, 419, at predetermined intervals along the transfer line S and extending horizontally in a direction orthogonal to the transfer line S, a plurality of brackets 427 supported by the aforementioned guide frames 426 in a manner such that they are free to move in the direction orthogonal to the transfer line S, and a pair of main side guide units 428*a*, 428*b* installed on and fixed to the tip portions of each of the brackets 427 and extending in the direction parallel to the transfer line S.

The main side guide units 428*a* of the upstream side guides 424 are forced, as shown in FIG. 27, in such a manner that the ends in the upstream A direction of the transfer line become gradually wider towards the upstream side of the transfer line S, and the main side guide units 428 of the downstream side guides 425 are formed, as shown in FIG. 27, in such a manner that the ends in the downstream B direction of the transfer line become gradually wider towards the downstream side of the transfer line S.

Furthermore, the upstream and downstream side guides 424, 425 are provided with hydraulic cylinders 431 whose bases are supported by the brackets 429 at the ends of the guide frames 426 farthest from the transfer line, and the tips of the rods of which are connected to predetermined locations on the main side guide units 428*a*, 428*b* through pins 430; by applying hydraulic pressure to the hydraulic chambers on the head or rod side, the left and right main side guide units 428*a*, 428*b* can be moved towards or away from the transfer line S in synchronism with each other.

Moreover, the upstream side guides 424 are composed of a plurality of upstream vertical rollers 432 supported by the left and right main side guide units 428 at predetermined intervals through bearings so that the vertical rollers 432 can contact the lateral edges of the material 1 to be shaped, when the material passes between the upstream side guides 424, and the downstream side guides 425 are composed of a plurality of downstream vertical rollers 433 supported by the left and right main side guide units 428*b* at predetermined intervals through bearings in such a manner that the vertical rollers 433 can contact the lateral edges of the material 1 to be shaped, when the material passes between the aforementioned downstream side guides 425.

Item numbers 434 denote pinch rolls which are arranged on the upstream A and downstream B sides of the transfer line in the close vicinity of the flying sizing press apparatus 417.

The operation of the plate reduction press apparatus shown in FIGS. 26 to 29 is described as follows.

When a long material 1 to be shaped is inserted between the upper and lower dies 412*a*, 412*b* of the flying sizing press apparatus 417 and the material 1 to be shaped is reduced and formed in the direction of the plate thickness by the dies 412*a*, 412*b*, appropriate hydraulic pressures are applied to the hydraulic chambers on the rod and head sides of the hydraulic cylinders 431 of the upstream and downstream side guides 424, 425, to make the upstream and downstream side guides 424, 425 move towards or away from the transfer line S, thereby the gaps between the left and right main side guide units 428*a*, 428*b* of the upstream and downstream side guides 424, 425 are adjusted to predetermined amounts (for example, about +10 mm) from the edges of the material 1 to be shaped.

In addition, by rotating the position adjusting screw 416 appropriately, the gap between the upper and lower dies 412*a*, 412*b* is set according to the plate thickness of the material 1 to be reduced and formed in the direction of the plate thickness.

Next, motors rotate the upper and lower rotating shafts 407*a*, 407*b*, and simultaneously the material 1 to be reduced and shaped is supplied from the upstream side of the transfer line S onto the upstream roller table 418.

When the material 1 to be shaped is moving from the upstream side to the downstream side of the transfer line S on the upstream roller table 418, the lateral edges of the material are guided by the main side guide units 428*a* of the upstream side guides 424 and the upstream vertical rollers 432 near the upstream side of the flying sizing press apparatus 417 and made to move along the transfer line S, in such a way that the lateral center line of the material is guided into alignment with the lateral center line of the upper and lower dies 412*a*, 412*b* of the flying sizing press apparatus 417.

Thus, while the material 1 to be shaped is moving from the upstream A side to the downstream B side of the transfer line S along the line S, the material is reduced and formed in the direction of the plate thickness by the upper and lower dies 412*a*, 412*b* that move towards and away from the transfer line S according to the displacement of the eccentric portions of the rotating shafts 407*a*, 407*b*.

During this time, the angles of the die holders 411*a*, 411*b* are adjusted by applying hydraulic pressure to the hydraulic chambers on the rod and head sides of the hydraulic cylinders 413*a*, 413*b*, in such a manner that the forming surfaces 415*a*, 415*b* of the upper and lower dies 412*a*, 412*b*, near the downstream B side of the transfer line, remain parallel to the transfer line S at all times.

When the material 1 to be shaped is reduced and formed by the dies 412*a*, 412*b* of the flying sizing press apparatus 417 and transferred in the downstream direction of the transfer line S, lateral deflections of the material are restrained by the main side guide units 428*b* of the downstream side guides 425 and the downstream vertical rollers 433, in the vicinity of the flying sizing press apparatus 417 on the downstream side of the transfer line, and the lateral edges of the material are thereby guided and transferred along the transfer line S.

As described above, the plate reduction press apparatus shown in FIGS. 26 to 29 is provided with the upstream side guides 424 equipped with a pair of main side guide units 428*a* which support the upstream vertical rollers 432 through bearings, in the close vicinity of the dies 412*a*, 412*b* on the upstream A side of the transfer line, therefore the material 1 to be reduced and shaped in the direction of the plate thickness by the upper and lower dies 412*a*, 412*b* can be moved along the transfer line S, and also can be guided so as to align the lateral center line of the material with the lateral center line of the upper and lower dies 412*a*, 412*b* of the flying sizing press apparatus 417, and consequently, the lateral edges of the material 1 to be shaped can be prevented from being abraded by the main side guide units 428*a*.

In addition, downstream side guides 425 are provided, equipped with a pair of main side guide units 328*b* that support the downstream vertical rollers 433 through bearings, in the close vicinity of the dies 412*a*, 412*b* on the downstream side of the transfer line, therefore lateral deflections of the material 1 after being reduced by the upper and lower dies 412*a*, 412*b* in the direction of plate thickness can be prevented, and the lateral edges of the material 1 being shaped can be protected from being abraded by the main side guide units 428*b*.

As described above, the plate reduction press apparatus according to the present invention provides the following various advantages.

(1) In any of the plate reduction press apparatus specified in claims 21 or 22 of the present invention, a long material to be shaped can be reduced and formed continuously in the direction of the plate thickness because the material to be reduced and formed is guided into the upper and lower dies by the upstream side guides when the material is moving from the upstream to the downstream sides of the transfer line, and after the material has been reduced and formed by the dies and fed out to the downstream side of the transfer line, lateral deflections of the material are prevented by the downstream side guides.

(2) With the plate reduction press apparatus specified in claim 22 of the present invention, the lateral edges of the material to be shaped, when being introduced into the dies by the upstream side guides, are guided by the upstream vertical rollers, thereby protecting the lateral edges of the material from abrasion with the main side guide units of the upstream side guides, and the lateral edges of the material being shaped are prevented from being deflected laterally by the downstream side guides, and are guided by the downstream vertical rollers, in such a manner that abrasion of the lateral edges of the material from the main side guide units of the downstream side guides can be prevented.

(Ninth Embodiment)

Figure 30:
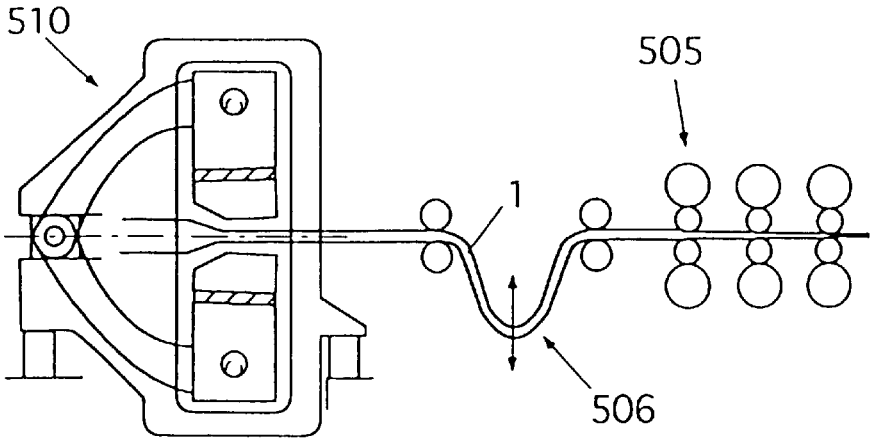
FIG. 30 shows the configuration of the press equipment provided with the plate reduction press apparatus according to the ninth embodiment of the invention.

FIG. 30 shows the configuration of a rolling mill operating together with the plate reduction press apparatus according to the present invention. In this figure, a looper device 506 is provided downstream of the plate reduction press apparatus 510 of the present invention, and a finishing rolling mill 505 is installed further downstream. The looper device 506 holds up a material being pressed in a slack loop, and the slack absorbs any differences in the line speeds of the plate reduction press apparatus 510 and the finish rolling mill 505.

Figure 31:
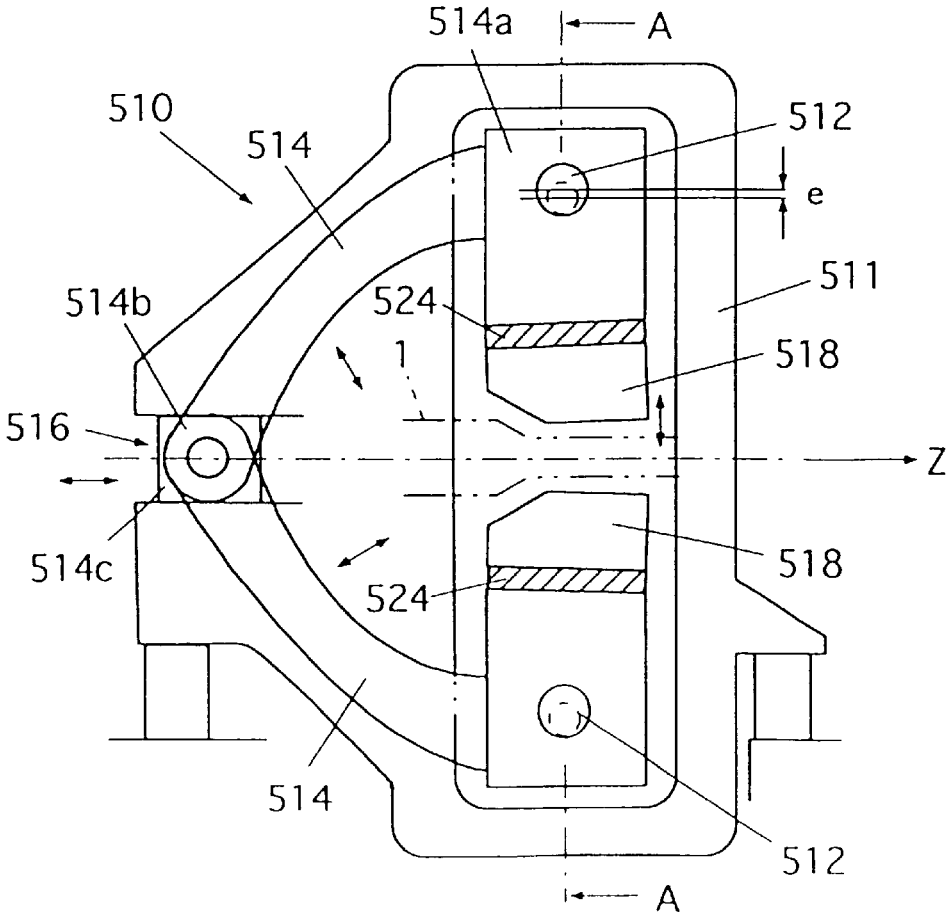
FIG. 31 is a side view of the plate reduction press apparatus shown in FIG. 30.
Figure 32:
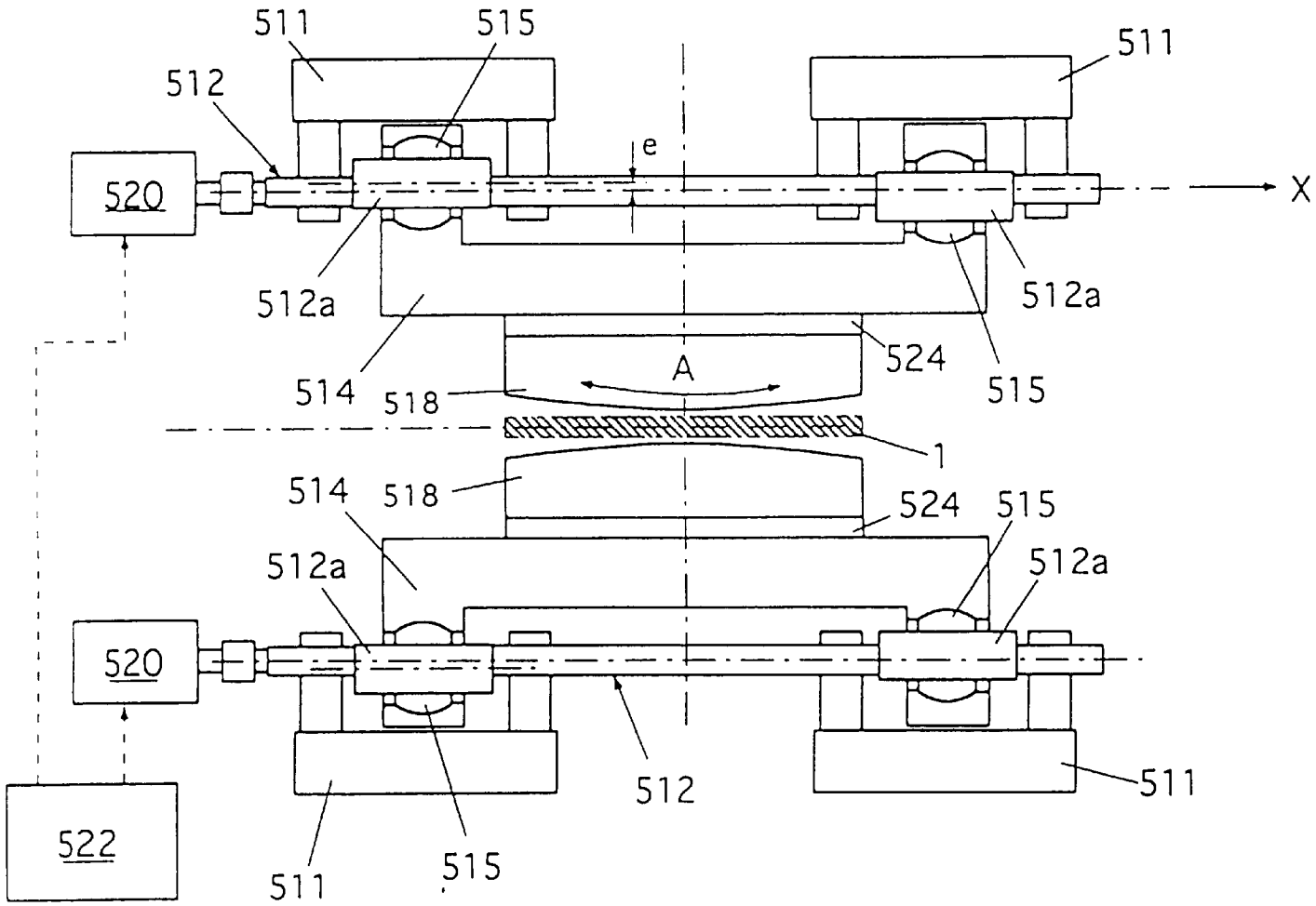
FIG. 32 is a sectional view along the line A—A in FIG. 31.

FIG. 31 is a side view of the plate reduction press apparatus shown in FIG. 30, and FIG. 32 is a sectional view along the line A—A in FIG. 31. As shown in FIGS. 31 and 32, the plate reduction press apparatus 510 according to the present invention is provided with upper and lower drive shafts 512 arranged opposite each other above and below a material 1 to be pressed and made to rotate, upper and lower pressing frames 514 one end of each of which (right end in FIG. 31) engages with one of the drive shafts 512 in a freely slidable manner, and the other ends 514*b* (left end in the figure) of which are connected together in a freely rotatable manner, a horizontal guide device 516 that supports the connection portions 514*c* of the pressing frames 514 so that they can move in the horizontal direction, and upper and lower dies 518 mounted at one end of the upper and lower pressing frames 514 opposite the material to be pressed. In FIG. 31, 511 indicates the main frame of the unit.

The upper and lower drive shafts 512 are provided with eccentric shafts 512*a* at both ends in the lateral direction, which have different phase angles. In addition, spherical seats 515 are provided at the places where the eccentric shafts 512*a* engage with the press frames 514, and the press frames 514 can roll about the axis X of the drive shafts as shown by the arrows A. The contacting surfaces between the dies 518 and the material 1 to be pressed are circular arcs and are convex towards the material to be pressed, and can smoothly press the material when the press frames roll.

As shown in FIG. 32, there are driving devices 520 that drive and rotate the drive shafts 512. These driving devices 520 are controlled by a speed controller 522, and the rotational speed of the driving devices 520 can be freely controlled. In this embodiment, height adjusting plates 524 are sandwiched between the dies 518 and the press frames 514, and by changing the thickness of the height adjusting plates 524, the heights of the dies 518 are adjusted.

Figure 33:
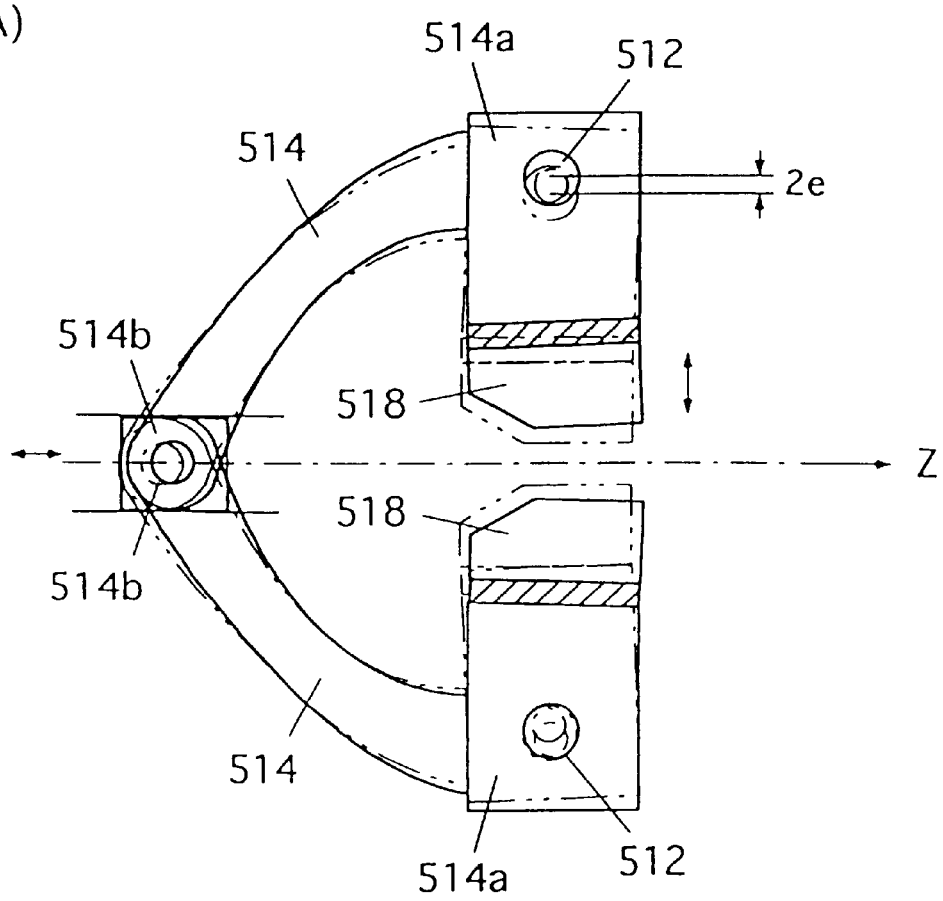
FIG. 33 is a schematic view showing the paths in which the dies move.
Figure 33:
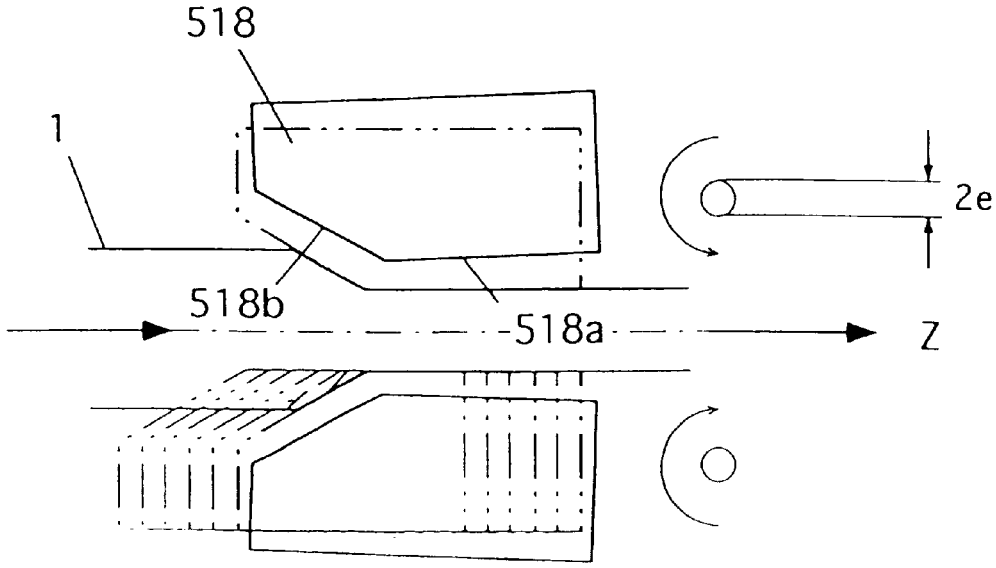
Figure 34:
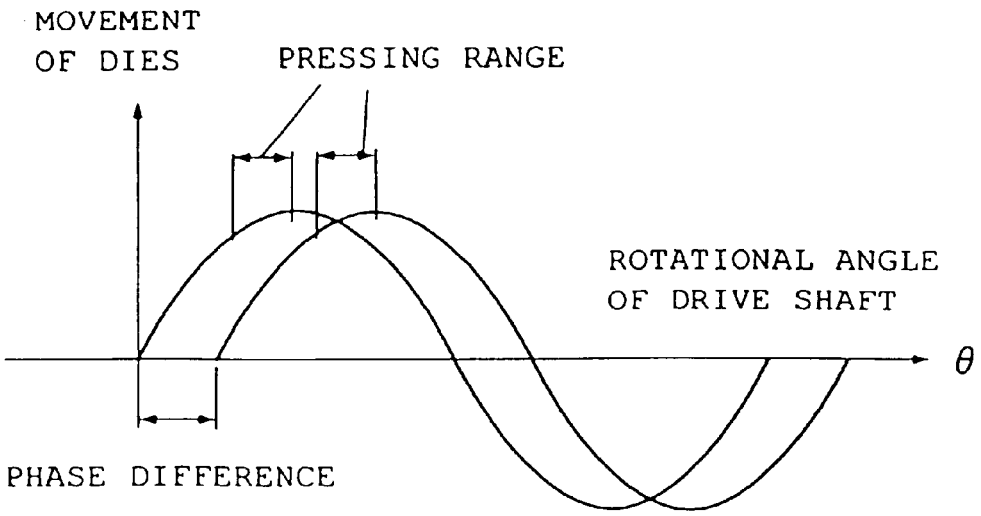
FIG. 34 is a view showing the movement of the dies in the up and down direction relative to the angular position θ of the drive shafts.

FIG. 33 schematically shows the paths in which the dies move; (A) shows the general movement of the dies 518 and the press frames 514, and (B) shows the movement of the dies 518 only. FIG. 34 shows the displacements of the dies 518 in the up and down direction with respect to the angle of rotation of the drive shafts. As shown in FIGS. 33 and 34, when each drive shaft 512 rotates, the corresponding eccentric shafts 512*a* rotate in circles with a diameter equal to twice the eccentricity e of the shaft, which cause the up and down press frames 514 to move in such a manner that while the left end portion 514*b* is moving backwards and forwards in the direction of the line, the right end portion 514*a* (in FIG. 31) moves up and down. Consequently, as shown in FIG. 33, each of the upper and lower dies 518 move in a circular path with a diameter equal to twice the eccentricity e of the eccentric shafts 512*a*, and at the same time, the dies open and close and also roll in the lateral direction. Therefore, as the upper and lower dies 518 move in the direction of the line while closing, the material 1 to be pressed can be conveyed while it is being reduced. In addition, because the upper and lower dies 518 close with a rolling action, the loads during pressing can be reduced. The amount of the reduction is determined by the eccentricity e of the eccentric shafts 512*a*, therefore high-reduction pressing can be carried out without being restricted by a nip angle etc. Also because the material 1 to be pressed is transferred while being reduced, a flying press operation can be achieved.

As shown in FIG. 33(B), the dies 518 are mounted at a small angle to the press frames 514 when the dies are open (shown by the solid lines in the figure) so that the parallel portions 518 become parallel to each other during pressing (shown by the double dotted chain lines in the figure). At this time, the area pressed during a cycle is shown by the hatched area in the figure.

As shown in FIG. 34, the pair of eccentric shafts 512*a* positioned at the two ends in the lateral direction are shifted in phase relative to each other, and so the ranges in which the two ends press the material 1 to be pressed are different from each other, and because the upper and lower dies 518 close with a rolling action, the loads during pressing can be reduced.

In addition, the speed controller 522 of the driving devices 520 determines the rotational speed of the drive shafts 512 so that when the dies 518 press, the speed of the dies in the line direction substantially match the feeding speed of the material 1 to be pressed. In this configuration, it is possible to match the speed of the dies 518 in the line direction substantially with the feeding speed of the material 1 to be pressed, therefore loads on the driving devices 520 that drive and rotate the drive shafts 512 can be reduced.

In this way, the plate reduction press apparatus according to the present invention provides various advantages such as (1) flying press operation is enabled, in which a material to be pressed is reduced while being transferred, (2) the number of component parts is small, and the construction is simple, (3) a small number of components need to slide under load during pressing, (4) high-load and high-cycle operations are possible, (5) the thickness of a material to be pressed can be corrected by adjusting the position of the dies using a simple method, and so forth.

(Tenth Embodiment)

Figure 35:
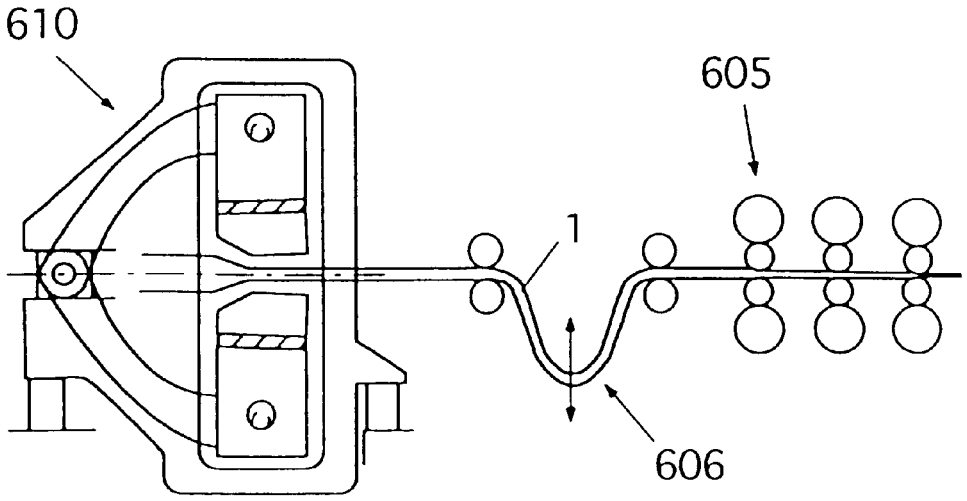
FIG. 35 shows the configuration of a rolling facility provided with the plate reduction press apparatus according to the tenth embodiment of the present invention.

FIG. 35 shows the configuration of a rolling facility used together with the plate reduction press apparatus according to the present invention. In this figure, a looper device 606 is installed on the downstream side of the hot slab press apparatus 610 according to the present invention, and further downstream, a finishing rolling mill 605 is provided. The looper device 606 holds up a material being pressed in a slack loop, so that the slack length of the material, smooths out any differences between the line speeds of the hot slab press apparatus 610 and the finishing rolling mill 605.

Figure 36:
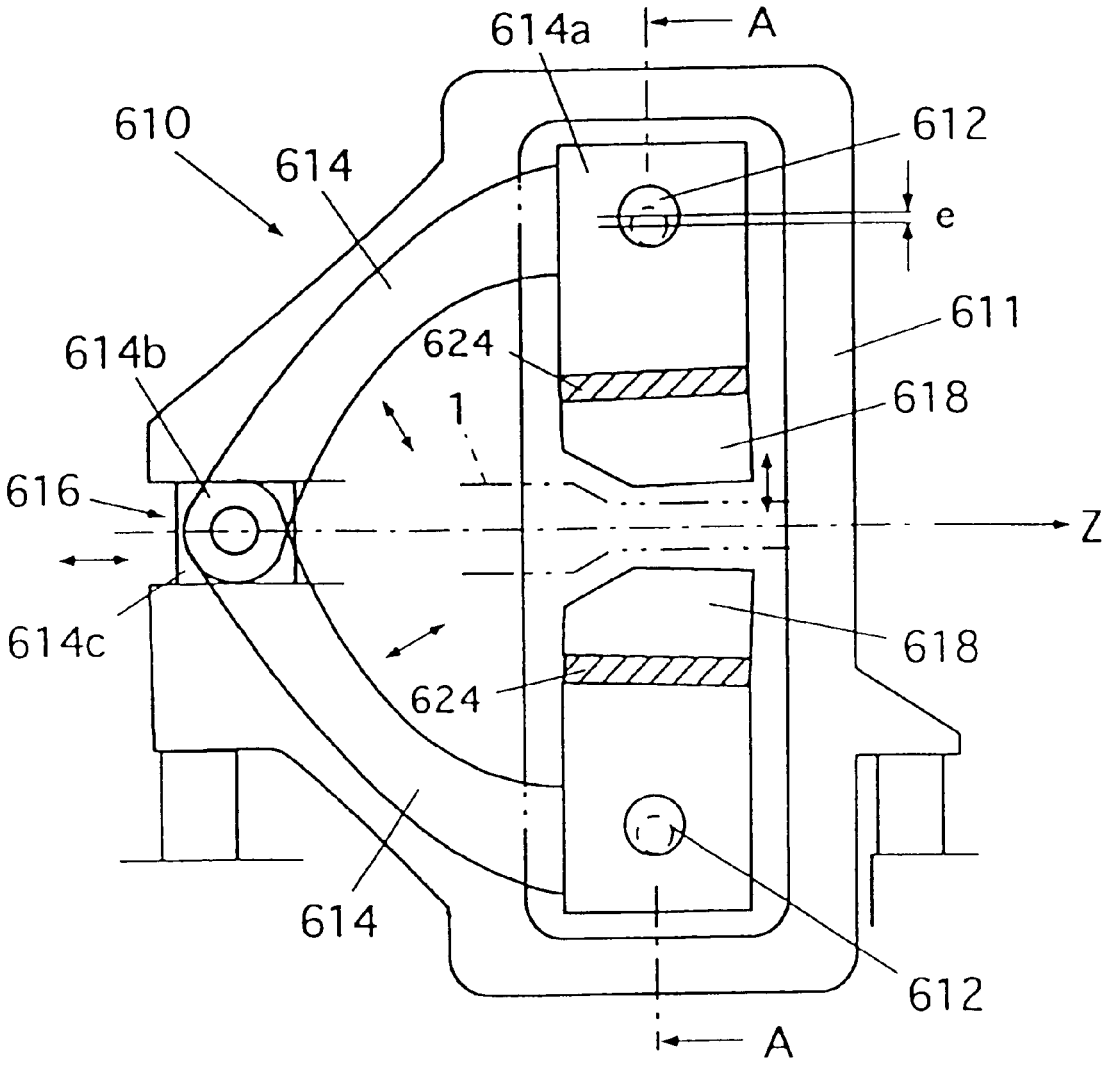
FIG. 36 is a side view of the plate reduction press apparatus shown in FIG. 35.
Figure 37:
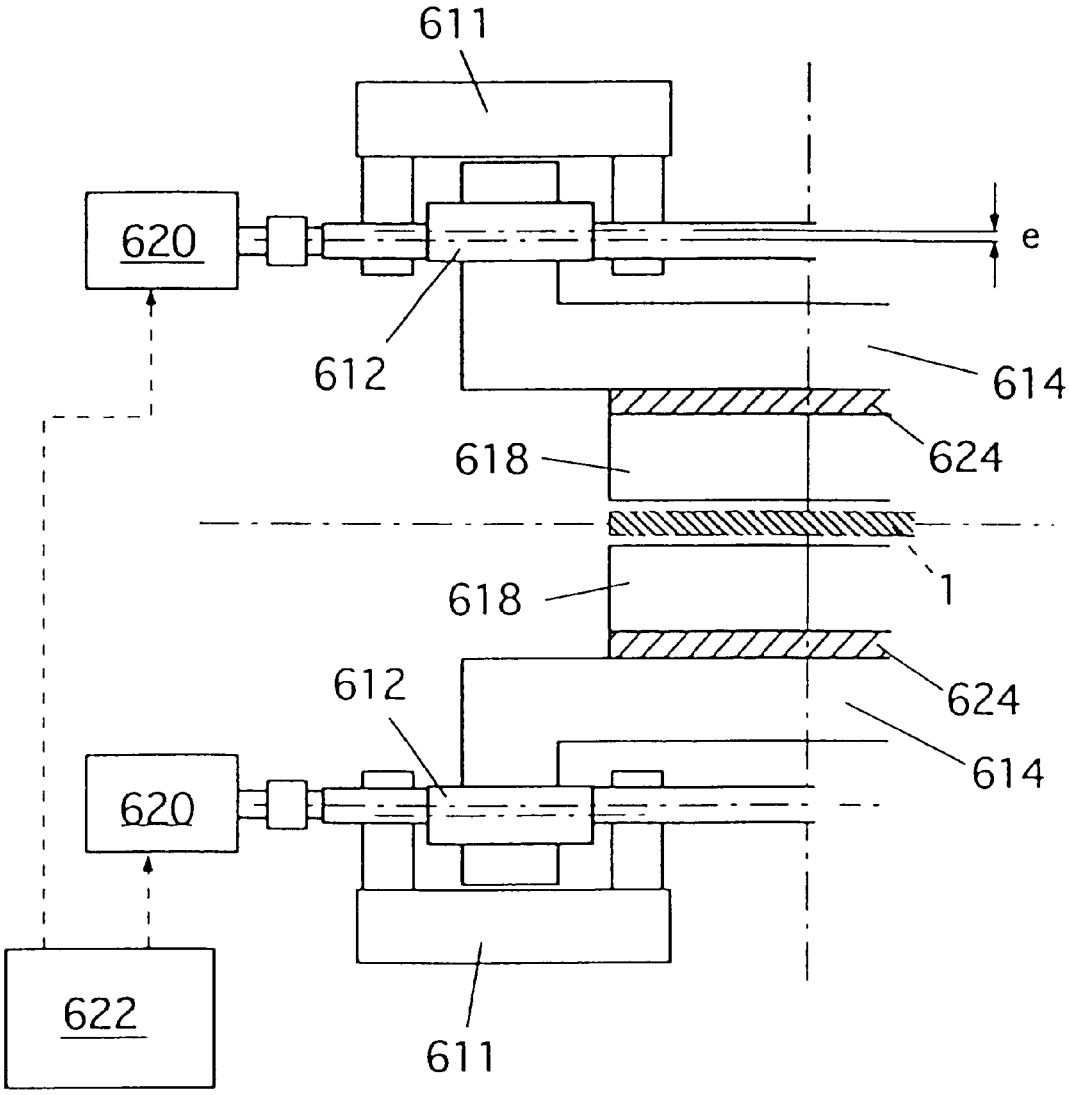
FIG. 37 is a sectional view along the line A—A in FIG. 36.

FIG. 36 is a side view of the hot slab press apparatus shown in FIG. 35, and FIG. 37 is a sectional view along the line A—A in FIG. 36. As shown in FIGS. 36 and 37, the hot slab press apparatus 610 according to the present invention is composed of upper and lower crank shafts 612 arranged opposite each other above and below the material 1 to be pressed and made to rotate, upper and lower press frames 614 one end 614*a* (right end in the figure) of each of which is engaged with one of the crank shafts 612 in a freely slidable manner, and the other ends 614*b* (left end) are connected together in a freely rotatable manner, a horizontal guide device 616 for supporting the connecting portion 614*c* of the press frames 614 so that they can move horizontally, and upper and lower dies 618 mounted at one end of each of the upper and lower press frames 614 facing the material 1 to be pressed. In this figure, 611 is the main frame unit.

As shown in FIG. 37, driving devices 620 are provided to drive and rotate the crank shafts 612, and the driving devices 620 are controlled by a speed controller 622, so that the rotational speed of the driving devices 620 can be freely controlled.

With this embodiment, height adjusting plates 624 are placed between the dies 618 and the press frames 614, and by changing the thicknesses of the height adjusting plates 624, the heights of the dies 618 are adjusted.

Figure 38:
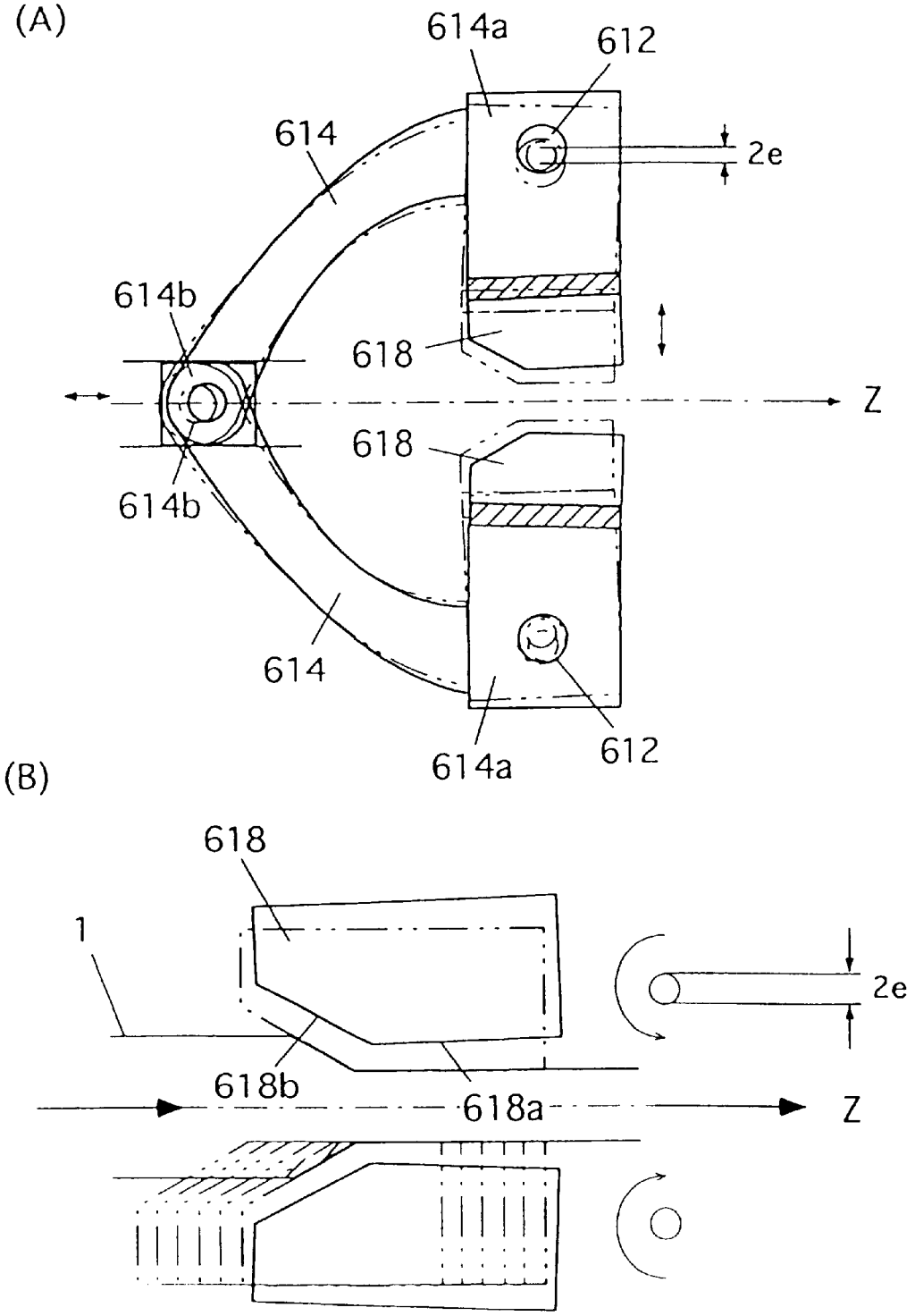
FIGS. 38(A) and 38(B) are schematic views showing the paths in which the dies move.

FIG. 38 schematically shows the paths in which the dies move; (A) shows the general movement of the dies 618 and the press frames 614, and (B) shows the movements of the dies 618 only. As shown in FIG. 38, when the crank shafts 612 rotate, each of the crank shafts 612 rotates in a circle with a diameter equal to twice the eccentricity e of the shaft, and following this motion, the upper and lower press frames 614 move in such a manner that while the left end portion 614*b* moves backwards and forwards in the direction of the line, the right end portions 614*a* (in FIG. 36) move up and down. Therefore, as shown in this figure, each of the upper and lower dies 618 moves in a circular path with a diameter equal to twice the eccentricity e of one of the crank shafts 612, and as the upper and lower dies 618 move in the line direction while closing, the material 1 to be pressed can be transferred while it is being pressed. The amount of the reduction depends on the eccentricity e of the crank shafts 612, and a high-reduction pressing operation can be achieved without being restricted by a nip angle etc. In addition, a flying press system can be realized because the material 1 to be pressed is conveyed while being reduced.

As shown in FIG. 38(B), the dies 618 are mounted on the press frames 614 at a small angle thereto when the dies are open (solid lines in the figure) so that the parallel portions 618*a* are parallel to each other during pressing (double-dotted chain lines in the figure). For this configuration the area pressed during a cycle is shown by the hatched area in the figure.

In addition, the speed controller 622 of the drive devices 620 determines the rotational speed of the crank shafts 612 to make the speed of the dies 618 in the line direction during pressing substantially agree with the feeding speed of the material 1 to be pressed. In this configuration, the speed of the dies 618 in the direction of the line can be made to be substantially identical to the feeding speed of the material 1 to be pressed, so variations in the loads on the crank shafts, caused by a difference in speeds, can be reduced.

Figure 39:
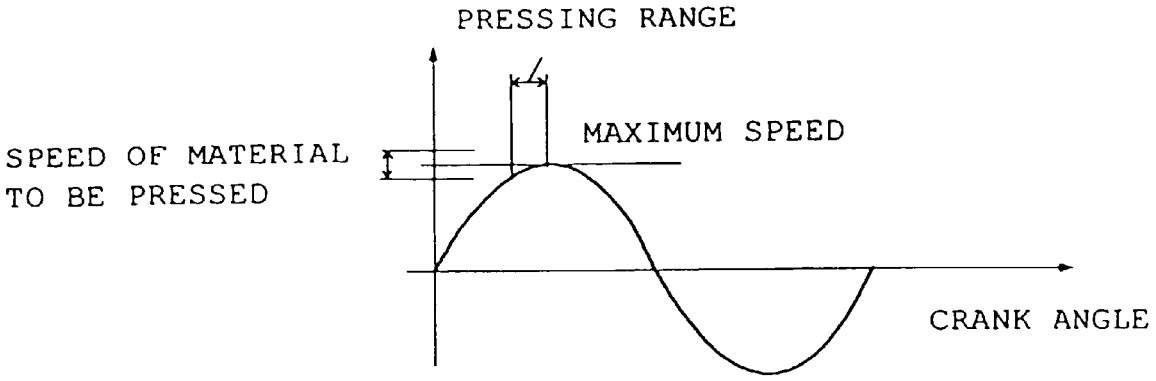
FIG. 39 is a diagram showing the plate reduction pressing method according to the present invention.

FIG. 39 is a diagram showing how a hot slab is pressed according to the present invention. In this figure, the abscissa and the ordinate indicate the crank angle and the speed in the line direction, respectively. According to the method of the present invention, the speed for feeding a material to be pressed is variable and made equal to the maximum speed of the dies in the line direction. More preferably, the speed of feeding the material to be pressed should be varied in such a manner that the speed is greater than the above-mentioned maximum speed at the beginning of pressing, and then be made smaller at an intermediate time during pressing. Accordingly, the loads applied to the press crank shafts, produced by variations in the inertia forces and speeds of the material to be pressed, can be reduced.

As can be understood from the above description, the hot slab press apparatus and pressing methods according to the present invention present excellent practical advantages including (1) a flying pressing system can be established to press a material while it is being conveyed, (2) there are few component parts and the construction is simple, (3) there are few parts which slide under load during pressing, (4) the system can be operated at high loads with fast operating cycles, (5) the position of the dies can be adjusted using a simple method, and the thickness of the material to be pressed can be corrected, and so on.

(Eleventh Embodiment)

Figure 40:
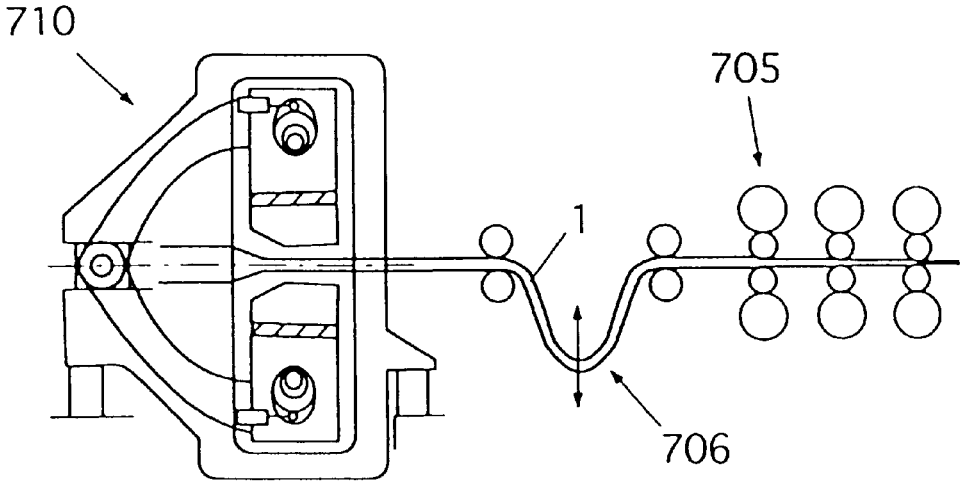
FIG. 40 shows the configuration of a rolling facility provided with the plate reduction press apparatus according to the eleventh embodiment of the present invention.

FIG. 40 shows the configuration of a rolling facility used together with the plate reduction press apparatus according to the present invention. In this figure, a looper device 706 is installed on the downstream side of the plate reduction press apparatus 710 according to the present invention, and further downstream, a finishing rolling mill 706 is provided. The looper device 706 holds up a material being pressed in a slack loop, so that the slack portion of the material smooths out any differences in the line speeds of the plate reduction press apparatus 710 and the finish rolling mill 705.

Figure 41:
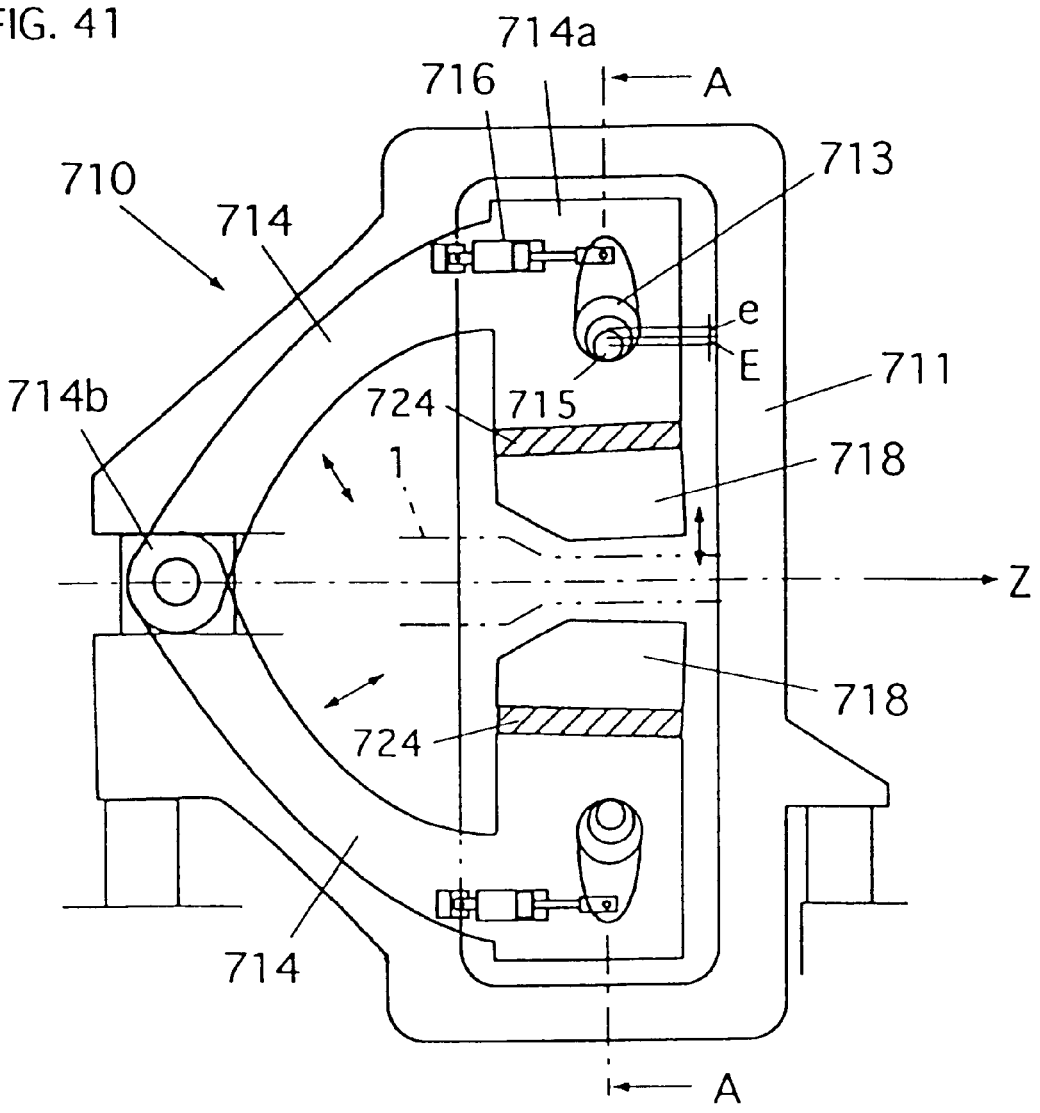
FIG. 41 is a side view of the plate reduction press apparatus shown in FIG. 40.
Figure 42:
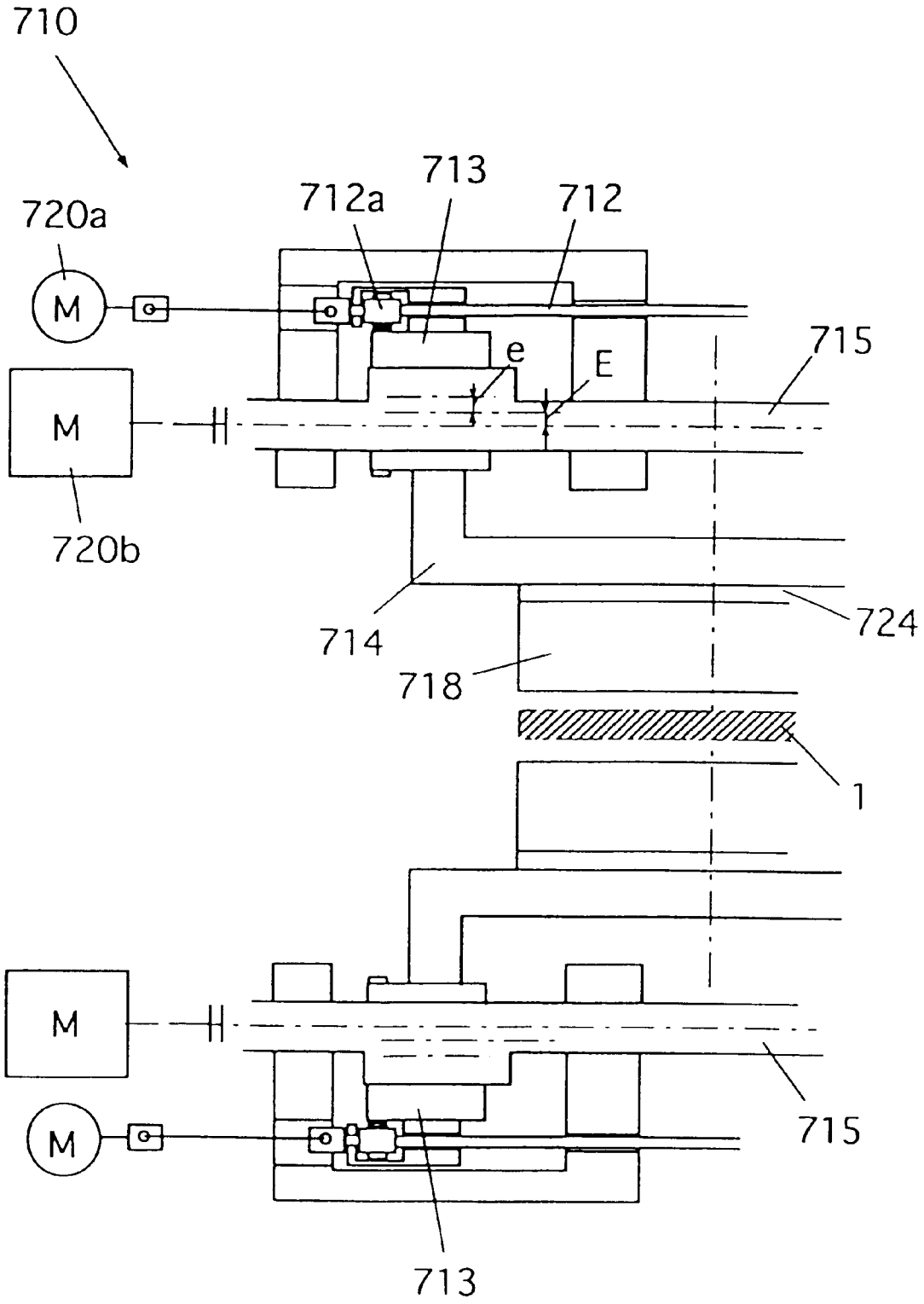
FIG. 42 is a sectional view along the line A—A in FIG. 41.

FIG. 41 is a side view of the plate reduction press apparatus shown in FIG. 40, and FIG. 42 is a sectional view along the line A—A in FIG. 41. As shown in FIGS. 41 and 42, the plate reduction press apparatus 710 according to the present invention is provided with upper and lower eccentric drive shafts 715 arranged opposite each other above and below a material 1 to be pressed and driven and rotated by driving devices 720*b*, upper and lower synchronous eccentric shafts 713 which are rotated by the eccentric drive shafts 715, upper and lower press frames 714 one end 714*a* of each of which is engaged with one of the synchronous eccentric shafts 713 in a freely slidable manner, and the other ends 714*b* are connected together in a freely rotatable manner, and upper and lower dies 718 mounted opposite each other at one end of each of the upper and lower press frames 714. In this figure, 711 indicates the main frame unit.

Referring to FIG. 42, the upper and lower dies 718 are opened and closed by rotating the upper and lower eccentric drive shafts 715, and when the dies 718 are pressing, the speed of the press frames 714 in the direction of the line is synchronized with the speed at which the material to be pressed is being conveyed in the line direction by means of the synchronous eccentric shafts 713, while pressing the material.

The outer peripheries of the synchronous eccentric shafts 713, are equipped with gear teeth, and the shafts are driven and rotated by the driving devices 720*a* by the small gear wheels 712*a* mounted on the drive shafts 712. As shown in FIG. 42, each shaft can be connected to the driving devices 720*a*, 720*b*, through universal joints etc., or, although not illustrated, each shaft may also be driven by a differential device.

Also with this embodiment, height adjusting plates 724 are positioned between the dies 718 and the press frames 714, so by varying the thicknesses of the height adjusting plates 724, the heights of the dies 718 can be adjusted.

Figure 43:
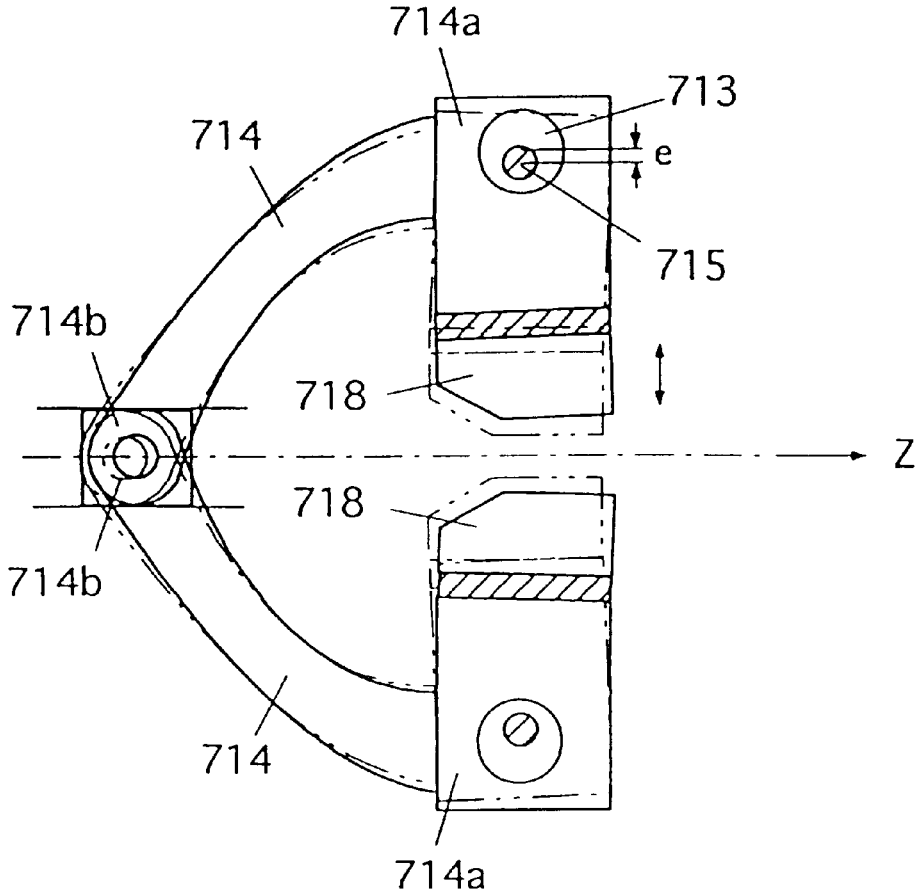
FIGS. 43(A) and 43(B) are schematic views showing the paths in which the dies move.
Figure 43:
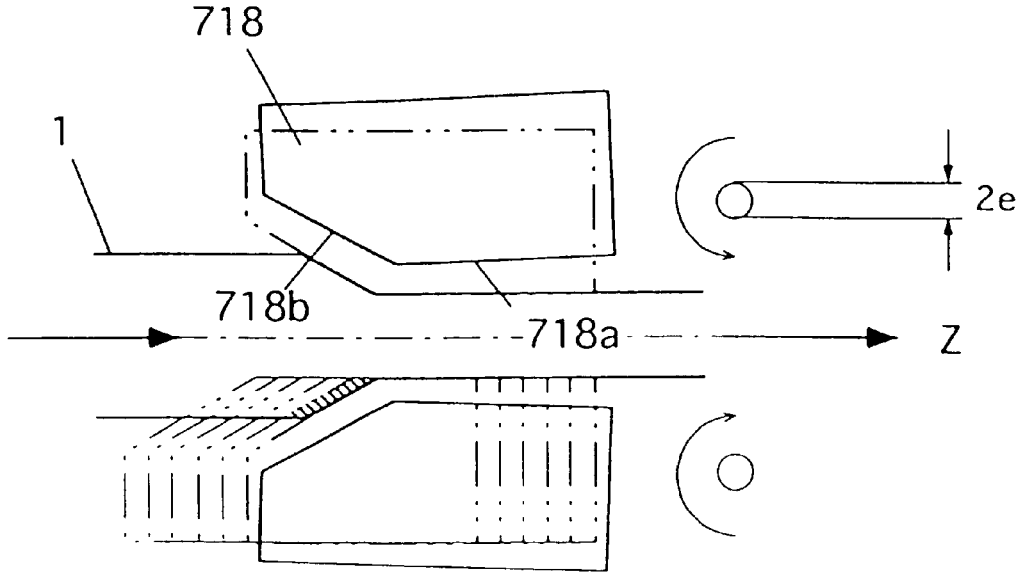
Figure 44:
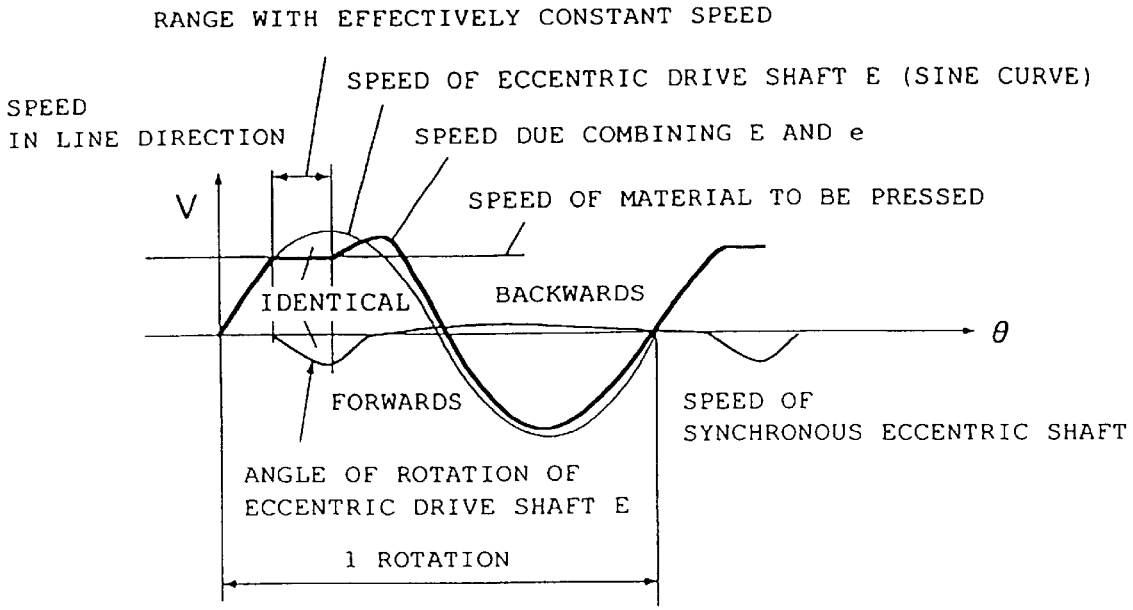
FIG. 44 is a view showing the movement of the dies in the up and down direction relative to the angular position θ of the synchronous eccentric shafts.

FIG. 43 schematically shows the paths in which the dies move; (A) shows the general movement of the dies 718 and the press frames 714, and (B) shows the movements of the dies 718 only. FIG. 44 shows the displacements of the dies 718 in the up and down direction with respect to the rotational angle θ of the synchronous eccentric shafts. As shown in FIGS. 43 and 44, when the drive shafts 712 are rotated, the upper and lower synchronous eccentric shafts 713 rotate around the eccentric drive shafts 715, therefore the synchronous eccentric shafts 715 move in a circle with a diameter equal to twice the eccentricity e thereof, and the outer peripheries thereof cause the upper and lower press frames 714 to move in such a manner that the left end 714*b* moves backwards and forwards in the line direction, while the right end 714*a* (in FIG. 41) move up and down. Consequently as shown in FIG. 43(B), each of the upper and lower dies 718 moves in a circular path with a diameter equal to twice the eccentricity e of the synchronous eccentric shafts 712*a*, while opening and closing.

Also as shown in FIG. 44, which shows the relation in speed that results from combining the eccentricity E of the eccentric drive shafts 715 and the eccentricity e of the synchronous eccentric shafts 713, and a pseudo constant speed can be produced over a range by varying the speed pattern. The amount of the reduction at that time depends on the eccentricity e of the synchronous eccentric shafts 713, so a high-reduction operation can be carried out without being restricted by a nip angle etc. Furthermore, because the material 1 to be pressed is conveyed by the synchronous drive devices 716 while being reduced, a flying pressing operation can be easily performed.

In addition, only the synchronous eccentric shafts 713 (double synchronous eccentric shafts) that are rotated by the eccentric drive shafts 715 withstand loads during pressing, and the connection portion 714*c* and the synchronous drive devices 716 have to withstand only rather small loads that only cancel moments acting on the press frames 714, and in addition, the moments applied to the upper and lower press frames 714 cancel each other, so the loads on the connection portion and the driving devices are further reduced. As a result, there are few component parts, the construction is simple, there are few portions that slide under load during pressing, and the system can operate under high loads at a high operating rate.

As shown in FIG. 43(B), the dies 718 are mounted on the press frames 714 at a slight angle thereto when the dies are open (solid lines in the figure) so that during pressing (double-dotted chain lines in the figure), the parallel portions 718*a* are parallel to each other. At this time, the area pressed during one cycle is shown by the hatched area in the figure.

Obviously from the description above, the plate reduction press apparatus according to the present invention provides excellent advantages including (1) a material to be pressed can be pressed by a flying press operation, in which the material is reduced while it is being transferred, (2) there are few component parts and the construction is simple, (3) a small number of parts slide under load during pressing, and (4) the system can be operated at high loads at a high operating rate.

(Twelfth Embodiment)

Figure 45:
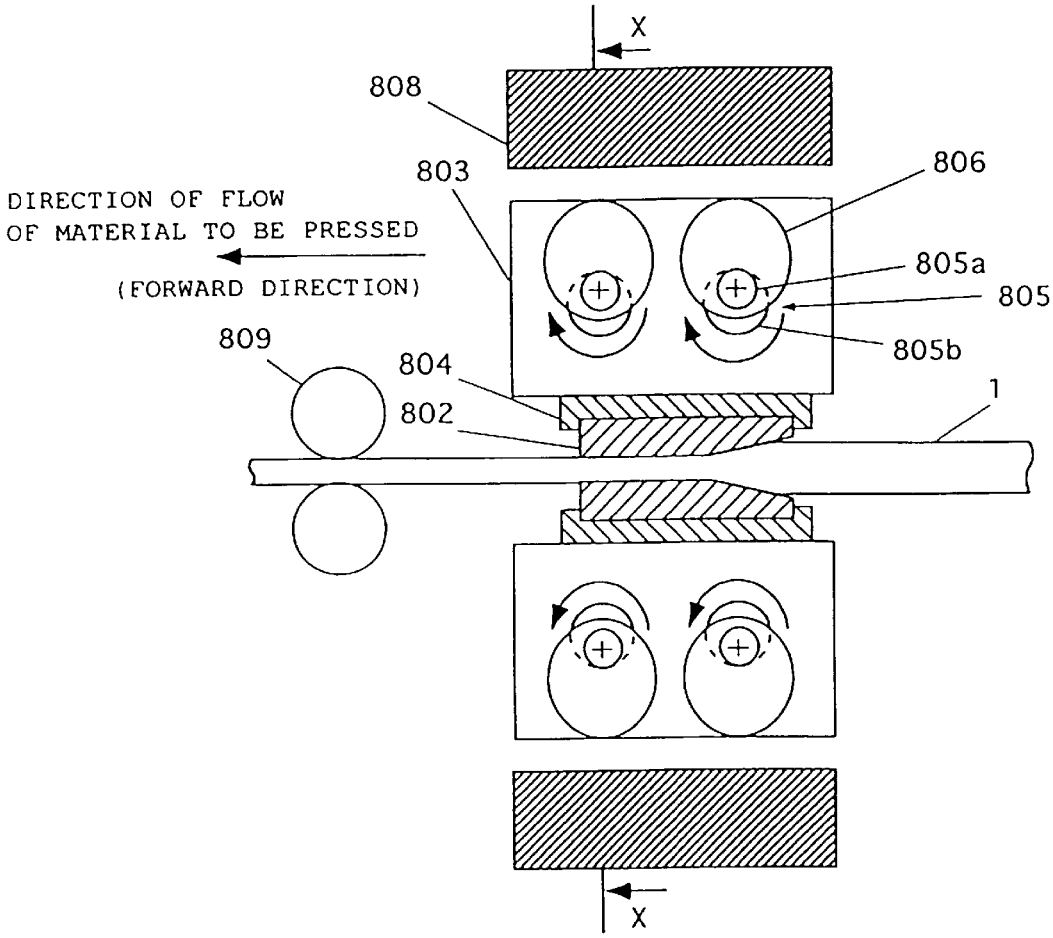
FIG. 45 shows the configuration of the twelfth embodiment of the present invention.
Figure 46:
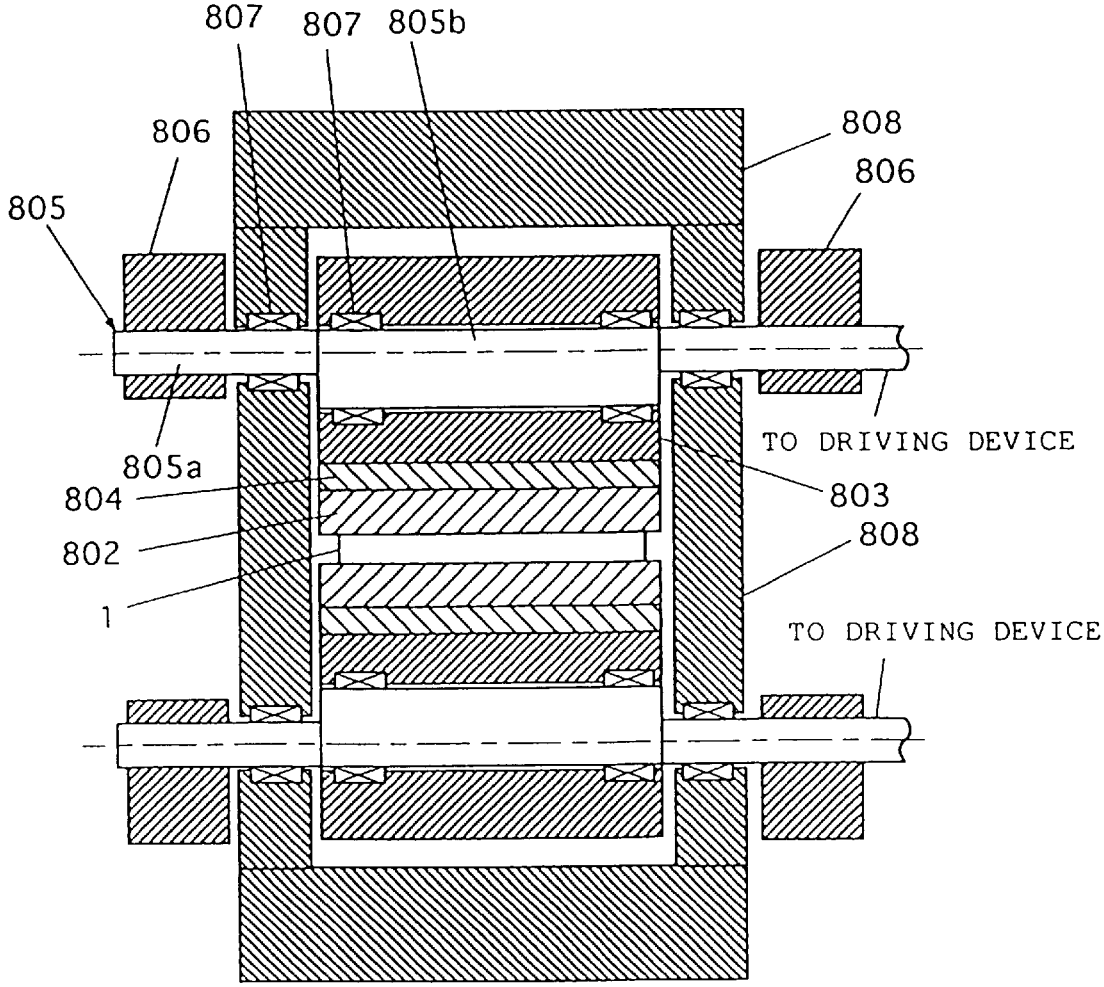
FIG. 46 is a sectional view along the line X—X in FIG. 45.

FIG. 45 shows the configuration of the plate reduction press apparatus according to the twelfth embodiment of the invention, and FIG. 46 is a sectional view along the line X—X in FIG. 45. Upper and lower dies 802 are provided above and below a material 1 to be pressed. Cooling water is supplied to the inside of the dies 802, to cool the dies. Other vise, cooling water can also be sprayed from outside.

The dies 802 are mounted on sliders 803 through die holders 804, in a detachable manner. Two crank shafts 805 engage in a freely slidable manner with the sliders 803 in the lateral direction of the material 1 to be pressed, arranged in a row in the direction (forward direction) of flow of the material. The crank shafts 805 are composed of eccentric shafts 805*b* engaging with the sliders 803, and support shafts 805*a* connected to both ends of the eccentric shafts 805*b* in the axial direction thereof, and one of the ends of the support shafts 805*a* is connected to a driving device not illustrated which drives and rotates the crank 805. The support shafts 805*a* and the eccentric shafts 805*b* are connected so that the center line thereof are offset from each other, thus the eccentric shafts 805*b* are rotated eccentrically around the support shafts 805*a*.

Counterweights 806 are attached at each end of the support shafts 805*a* of the eccentric shafts 805*b*. The counterweights 806 are mounted with the centers of gravity thereof offset from the center lines of the support shafts 805*a*, and the angle of the offset is 180° from the direction of the eccentricity of the eccentric shafts 805*b* with respect to the support shafts 805*a*. The inertia forces (unbalanced forces) due to the eccentricity of the counterweights 806 substantially cancel the inertia forces due to the sliders 803, dies 802 and die holders 804, so that the vibration of the apparatus can be reduced greatly.

The dies 802, sliders 803, die holders 804, crank shafts 805, and counterweights 806 are arranged symmetrically above and below the material 1 to be pressed, and composed into one body by the main frame unit 808. The eccentric shafts 805*b* are connected to the sliders 803 in a freely rotatable manner through the bearings 807, and the support shafts 805*a* are supported through the bearings 807 provided on the main frame unit 808, in a freely rotatable manner.

Figure 47:
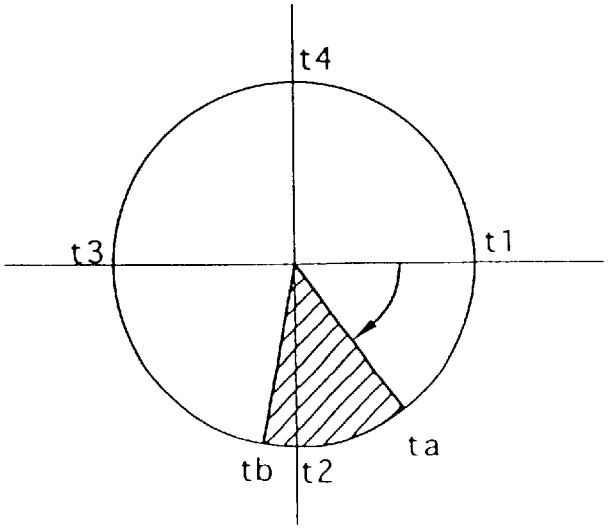
FIG. 47 shows one cycle of the operation of a slider.
Figure 48:
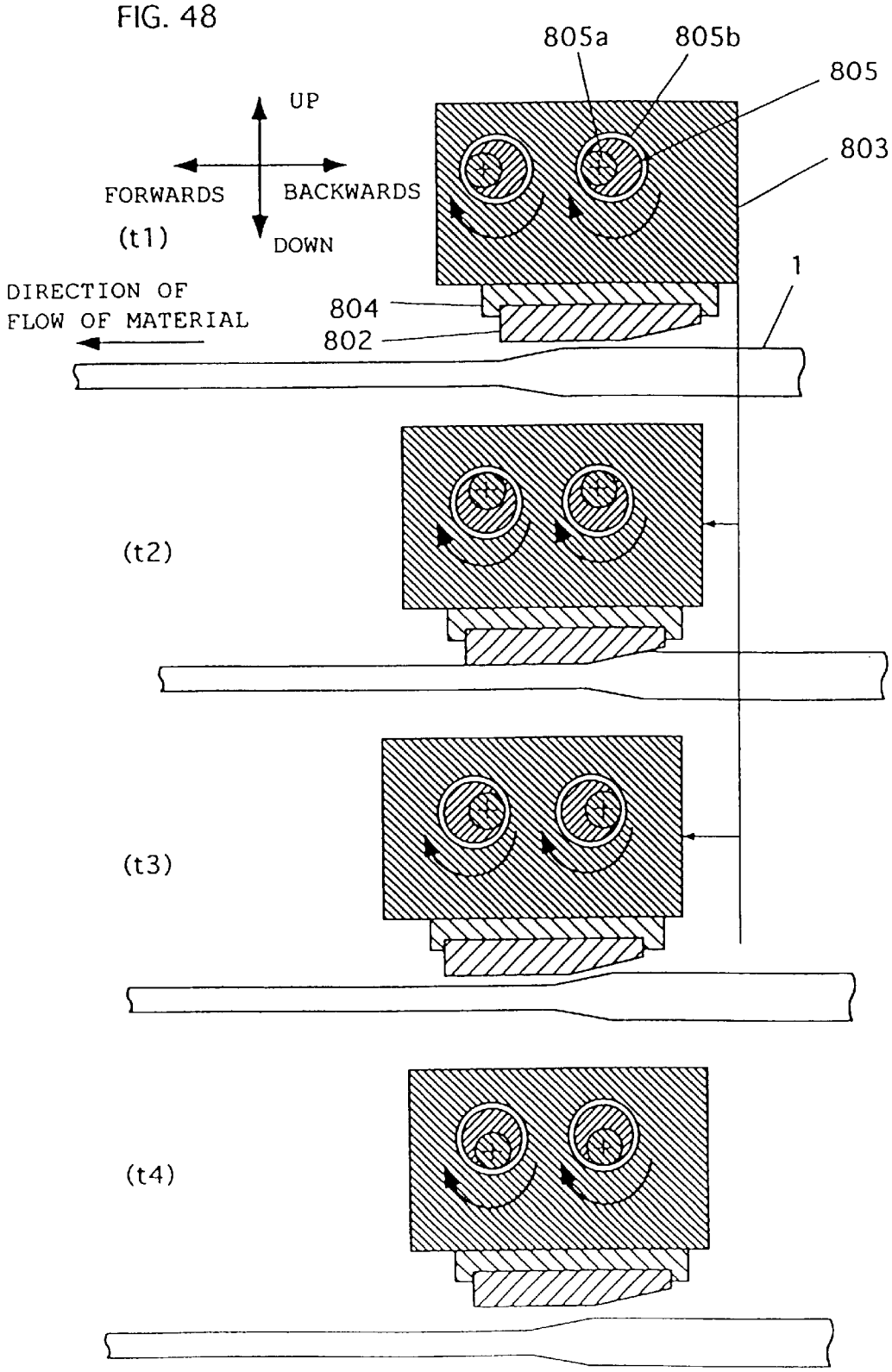
FIG. 48 shows one cycle of the operation of a slider and the material to be pressed.

Next, the operation is described. FIG. 47 shows one cycle of operation of the sliders 803. FIG. 48 illustrates the movements of the sliders 803 and the material 1 to be pressed, during one operating cycle. In FIG. 47, in a cycle time increase in the sequence t1–t2–t3–t4–t1, and the material is pressed during, the period ta–tb which includes t2. In FIG. 48, t1–t4 corresponds to t1–t4 in FIG. 47. At t1, the sliders 803 are raised to an intermediate position, and are located at the farthest position in the backward direction. At t2, the state during pressing is shown, and the sliders are located at an intermediate position in the backward and forward direction. At t3, the sliders are partly raised, and at the farther position in the forward direction. Hence, the sliders 803 move forwards during the period t1–t2–t3 as shown by the arrows, and move at the maximum speed at t2 during pressing. Consequently, the material 1 to be pressed is transferred by the pinch rolls 809 when the sliders 803 are pressing, according to the speed of the sliders, thereby the material can be conveyed continuously at a speed most suitable for pressing, even during a pressing period. Because the counterweights 806 move with phase angles offset by 180° from those of the sliders 803, the vibration caused by the sliders 803 is reduced. In addition, the counterweights also function as flywheels that contribute to a reduction of the power required from the driving devices.

(Thirteenth Embodiment)

Figure 49:
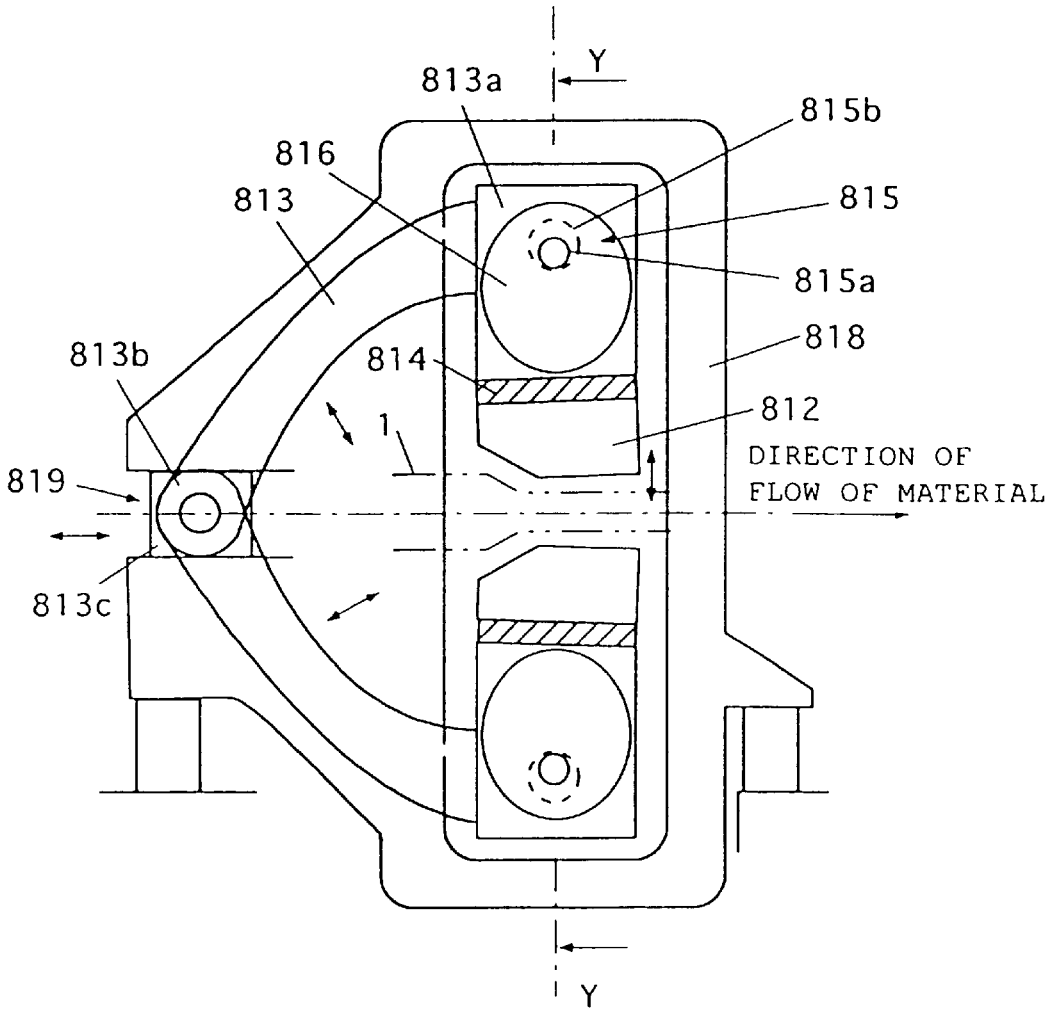
FIG. 49 shows the configuration of the thirteenth embodiment of the present invention.
Figure 50:
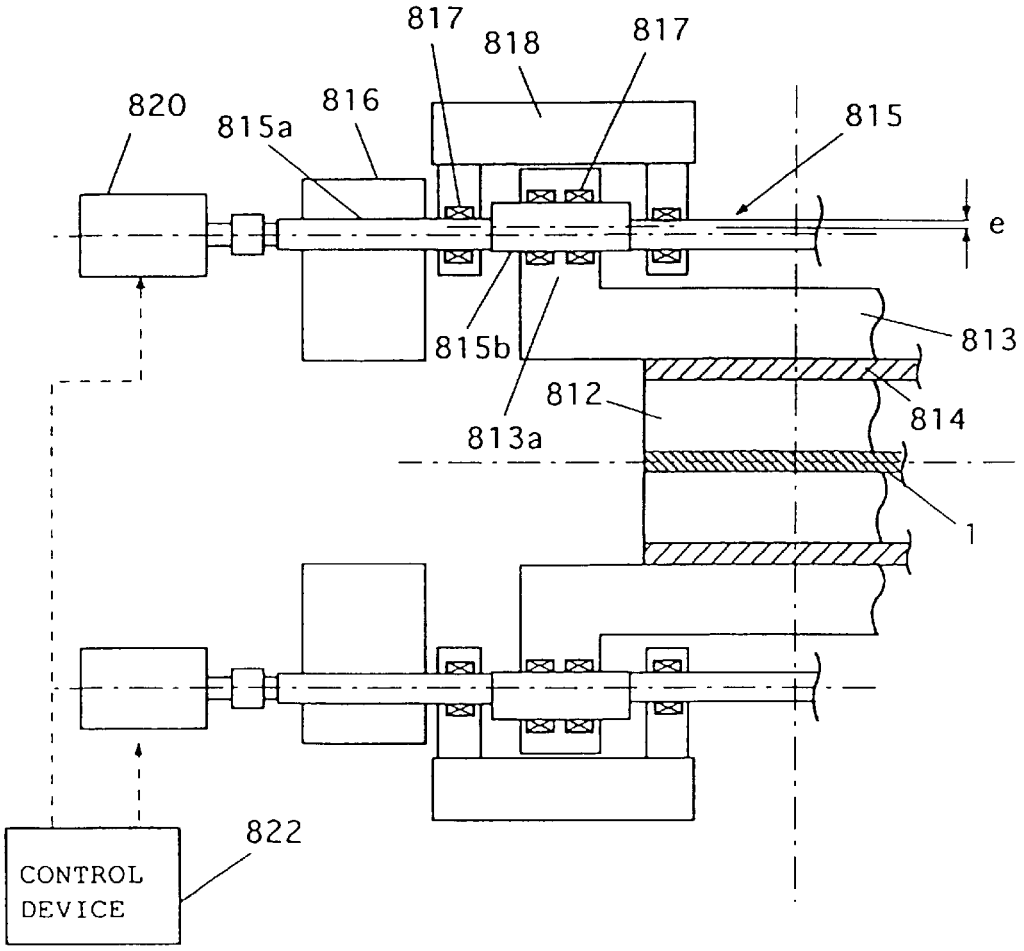
FIG. 50 is a sectional view along the line Y—Y in FIG. 49.

The thirteenth embodiment is described next. FIG. 49 shows the configuration of the plate reduction press apparatus according to this embodiment, and FIG. 50 is a sectional view along the line Y—Y in FIG. 49, showing only the half on one side of the lateral center line of the material 1 to be pressed, because the entire construction is symmetrical about the center line. As shown in FIGS. 49 and 50, this embodiment of the plate reduction press apparatus according to the present invention is composed of upper and lower crank shafts 815 arranged opposite each other above and below the material 1 to be pressed and driven and rotated, upper and lower press frames 813 one end 813*a* (right end in the figure) of each of which is engaged with one of the crank shafts in a freely rotatable manner, and the other ends 813*b* (left ends) are connected together in a freely rotatable manner, horizontal guide devices 819 that guide the connecting portions 813*c* of the press frames 813 so that they can move horizontally, upper and lower dies 812 mounted at one end 813*a* of each of the upper and lower press frames 813, facing the material 1 to be pressed, counterweights 816 installed on the crank shafts 815, and a main frame unit 818 that supports the crank shafts 815. The dies 812 are mounted on the ends 813*a* through the height adjusting plates 814.

The horizontal guide device 819 is either a hydraulic cylinder, crank mechanism or a servo motor, that moves the connection portions 813*c* to which the upper and lower press frames 813 are connected, in the direction of transfer of the material to be pressed when the crank shafts 815 rotate.

The crank shafts 815 are shown in FIG. 50, and are comprised of eccentric shafts 815*b* that engage with the ends 813*a* of the press frames 813, and support shafts 815*a* attached to both ends of the eccentric shafts 815*b* with their axial center lines offset from each other. The support shafts 815*a* are supported by the main frame unit 818 through bearings 817, and the eccentric shafts 815*b* are connected to the ends 813*a* through the bearings 817. On the support shafts 815*a* outside the main frame unit 818, counterweights 816 are mounted the centers of gravity of which are offset from the axial center lines of the support shafts 815*a*, and the angle of the offset is 180° from the direction of the eccentricity of the eccentric shafts 815*b* relative to the support shafts 815*a*. A driving device 820 is provided at the end of a support shaft 815*a* equipped with a counterweight 816, and is controlled by a control device 822.

Figure 51:
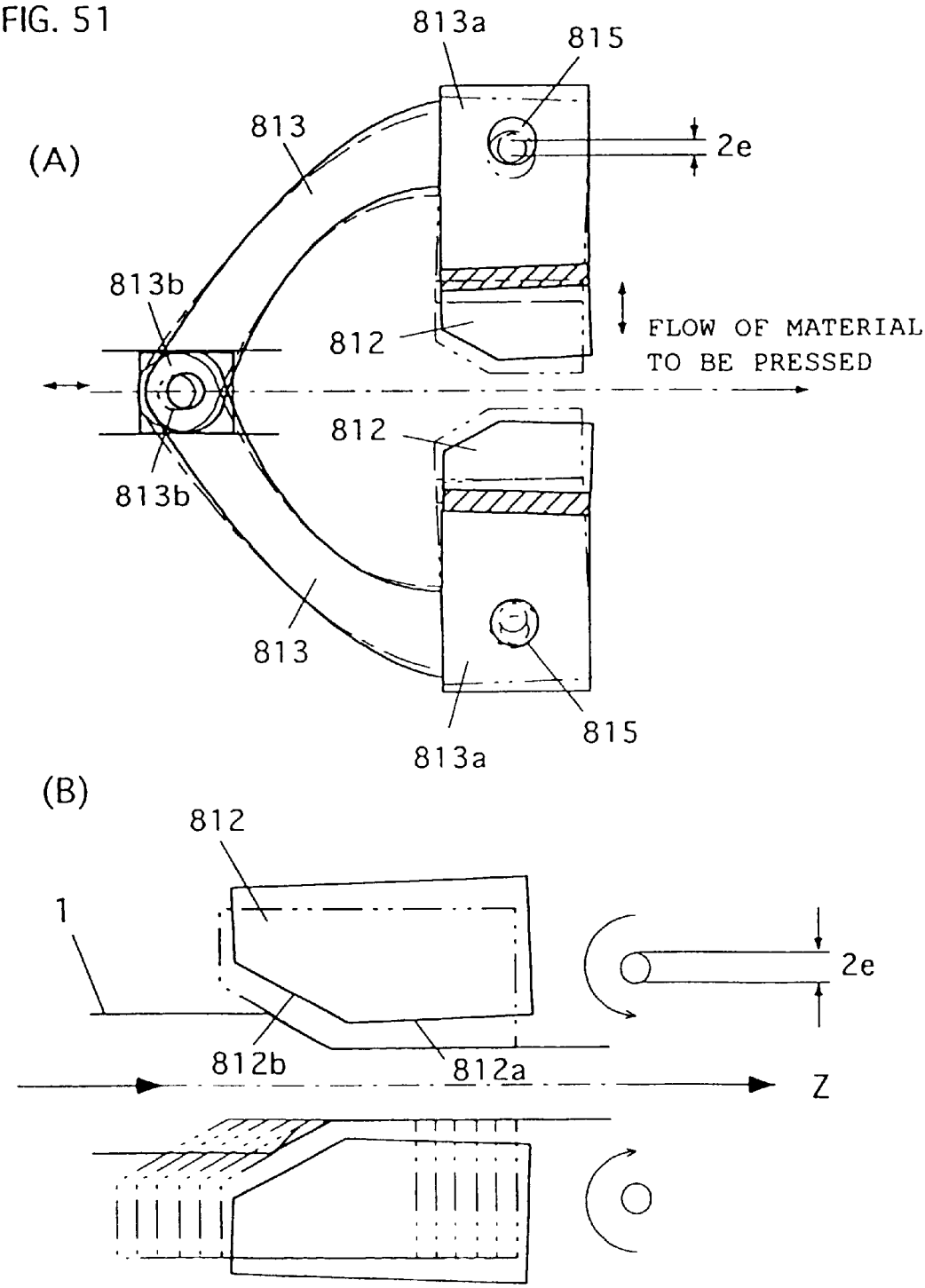
FIGS. 51(A) and 51(B) are schematic views showing the paths in which the dies move.

The operation of the present embodiment is described next. FIG. 51 schematically shows the path in which the dies 812 move; (A) shows the general movements of the dies 812 and the press frames 813, and (B) shows the movements of the dies 812 only. When the crank shafts 815 rotate, the upper and lower eccentric shafts 815*b* are rotated by the support shafts 815*a*, and the eccentric shaft 815*b* rotates in a circle with a diameter equal to twice the eccentricity c thereof, and the outer periphery thereof causes the upper and lower press frames 813 to move in such a manner that the other ends 813*b* reciprocate in the direction of the flow of the material to be pressed, while the ends 813*a* move up and down. Consequently, as shown in FIG. 51(B), the upper and lower dies 812 move up and down as they travel in a circular path with a diameter equal to twice the eccentricity e of the eccentric shafts 815*b*.

As shown in FIG. 49, the horizontal guide device 819 allows the connecting portion 813*c* of the press frames 813 to move in the direction of flow of the material to be pressed when the dies 812 are pressing, thus the upper and lower dies 812 can move in the direction of the flow of the material to be pressed while the dies are pressing the material. At this time, the amount of the reduction depends on the eccentricity e of the eccentric shafts 815*b*, therefore high-reduction pressing can be carried out without being limited by a nip angle etc. Because the horizontal guide device 819 allows the material 1 to be pressed to be transferred while being pressed, flying press operations can be easily carried out. In addition, as the counterweights 816 move with an angular offset of 180° from the motion of the ends 813*a*, they cancel the vibrations due the ends 813*a*, which reduces the vibration as a whole. In addition, the counterweights can also function as a flywheel which contributes to reducing the power required from the driving devices.

As can be easily understood from the description above, the present invention can provide a flying reduction press system in which a material to be pressed is reduced while it is being conveyed, by directly rotating the ends of sliders or press frames by eccentrics on crank shafts. Furthermore, as counterweights are provided on the crank shafts, the vibration of the system can be reduced, and because the counterweights function as flywheels, the power required from the driving devices can be reduced. Moreover, because the dies can be moved in the direction of flow of the material to be pressed during the pressing period, thanks to the eccentric motion of the crank shafts, no mechanisms are required to move the dies in the direction of flow of the material to be pressed during pressing, so the construction of the apparatus becomes simple.

(Fourteenth Embodiment)

Figure 52:
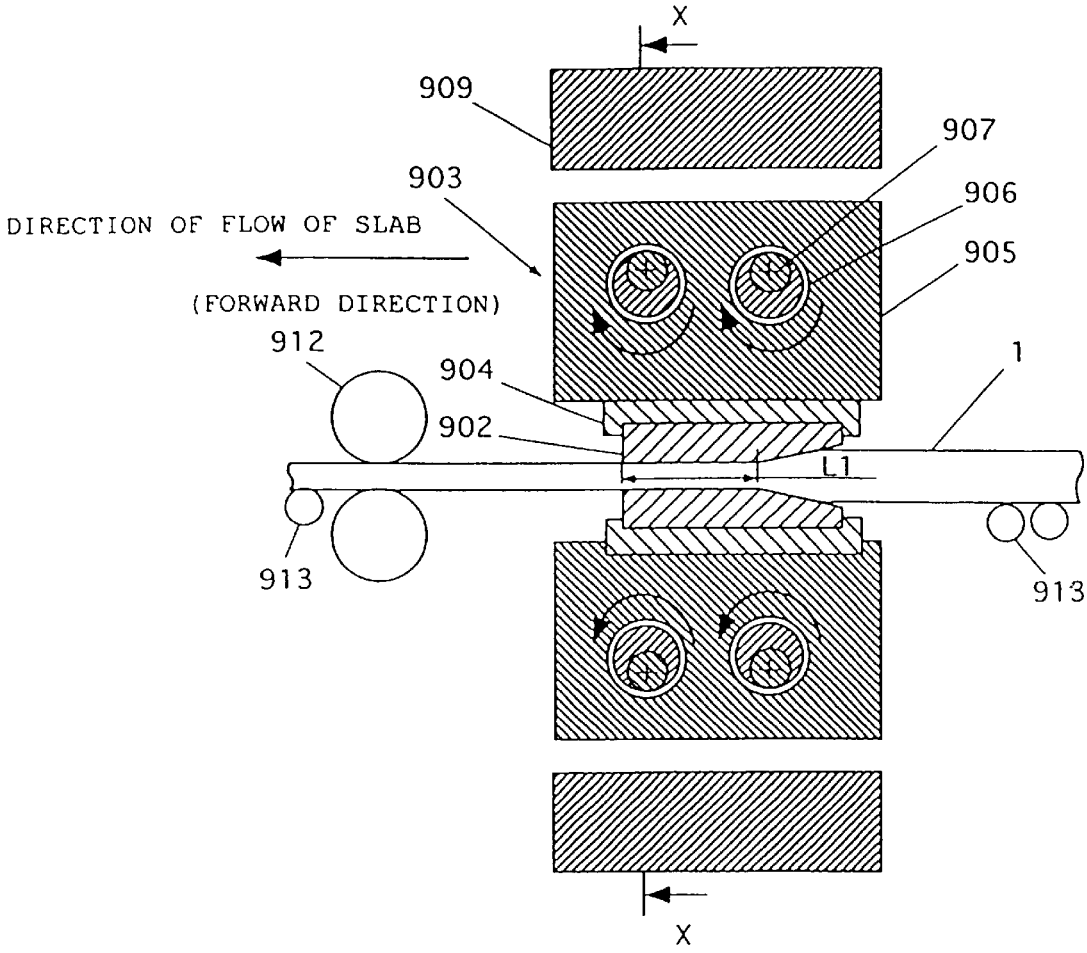
FIG. 52 is a view showing the configuration of the fourteenth embodiment of the present invention.
Figure 53:
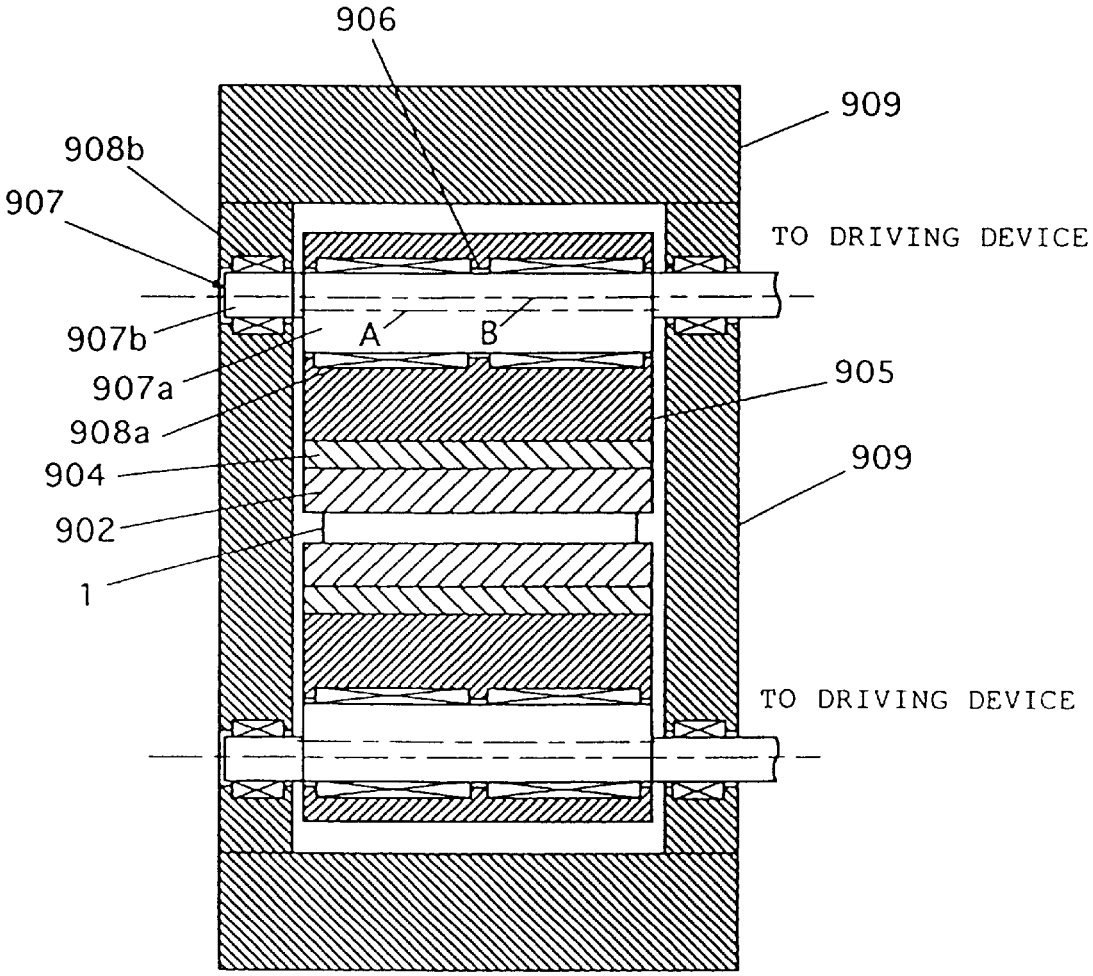
FIG. 53 is a sectional view along the line X—X in FIG. 52.

FIG. 52 is a sectional view showing a configuration of the plate reduction press apparatus of the fourteenth embodiment according to the present invention, and FIG. 53 is a sectional view along the line X—X in FIG. 52. Dies 902 are arranged above and below a slab 1. Cooling water is supplied to the dies 902 to cool the interior of the dies 902. Otherwise, cooling water may also be sprayed on the outside. The dies 902 are mounted on sliders 903 through the die holders 904, in a detachable manner. The sliders 903 are composed of main units 905 and cranks 907; on each main unit 905, two circular holes 906 are arranged in a row in the direction of flow (forward direction) of the slab, in which the shafts of the cranks 907 are directed in the lateral direction of the slab. The cranks 907 shown in FIG. 53 are composed of a first shaft 907*a* engaging with the circular hole 906 through a first bearing 908*a*, and second shafts 907*b* attached to both ends of the first shaft 907*a*, with a diameter smaller than the diameter of the first shaft, and the center lines thereof are made eccentric to each other, and one end of the second shaft 907*b* is connected to a driving device that is not illustrated. The second shafts 907*b*, in the upper or lower sliders 903, are supported by a common frame 909 through the second bearings 908*b*. Pinch rolls 912 are arranged on the downstream side of the dies 902, and control the transfer speed of the slab 1. Table rollers 913 are provided on the inlet or outlet side of the pinch rolls 912, and transfer the material to be pressed or being pressed. In FIG. 53, A and B indicate the axes of the first and second shafts, respectively.

Figure 54:
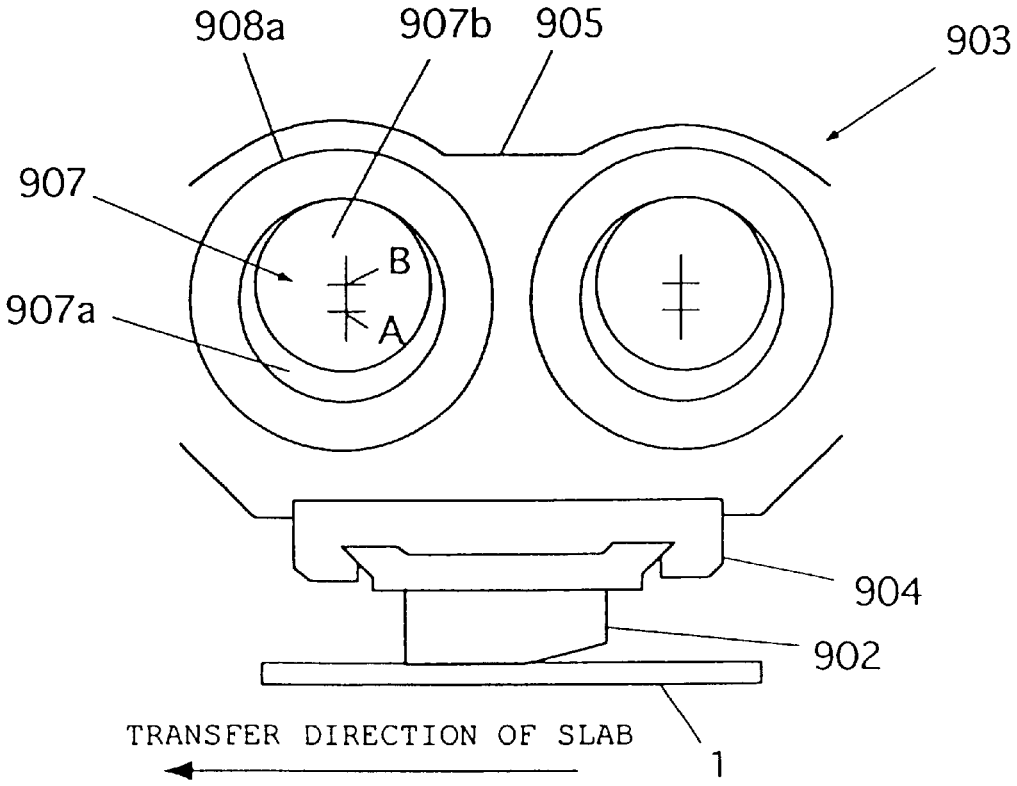
FIG. 54 shows a practical construction of a slider.

FIG. 54 is a view showing the construction of the sliders; since FIGS. 52 and 53 illustrated the sliders in a slightly schematic way, a practical example is shown in FIG. 54, showing the upper half above the slab 1. The die 902 for pressing the slab 1 is mounted on a main unit 905 by means of a die holder 904. The main unit 905 is provided with a row of two circular holes 906 arranged in the direction of transfer of the slab 1. A crank 907 is comprised of a first shaft 907*a* and second shafts 907*b* attached to both ends of the first shaft, with a diameter smaller than the diameter of the first shaft; the first shaft 907*a* is connected through a first bearing 908*a*, and the second shafts are supported by the second bearings 908*b*. The circular hole 906 indicates the inner surface of the first bearing 908*a*. A and B indicate the axial center lines of the first and second shafts, respectively, and both shafts rotate around the center line B.

Figure 55:
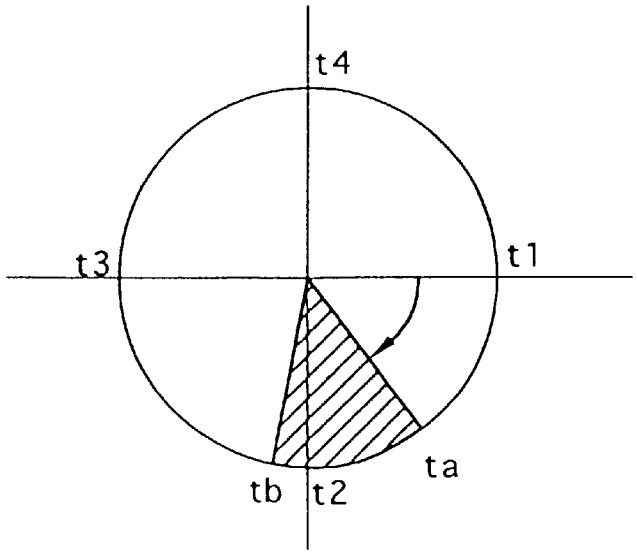
FIG. 55 shows one cycle of the operation of a slider.
Figure 56:
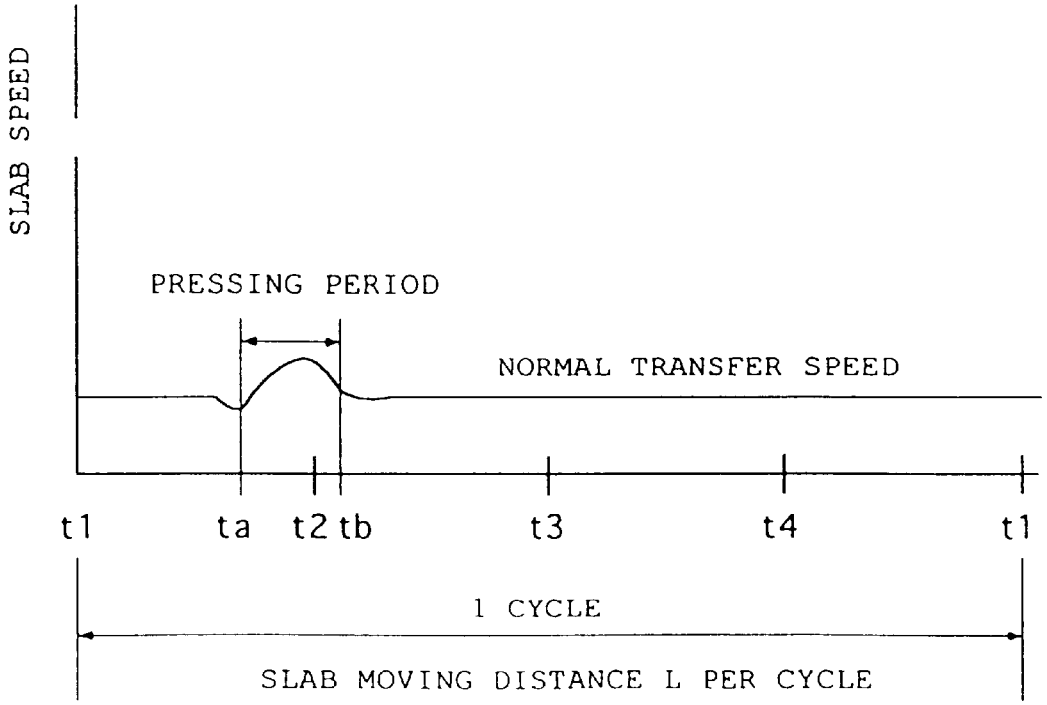
FIG. 56 shows the moving speed of a slab during one cycle.
Figure 57:
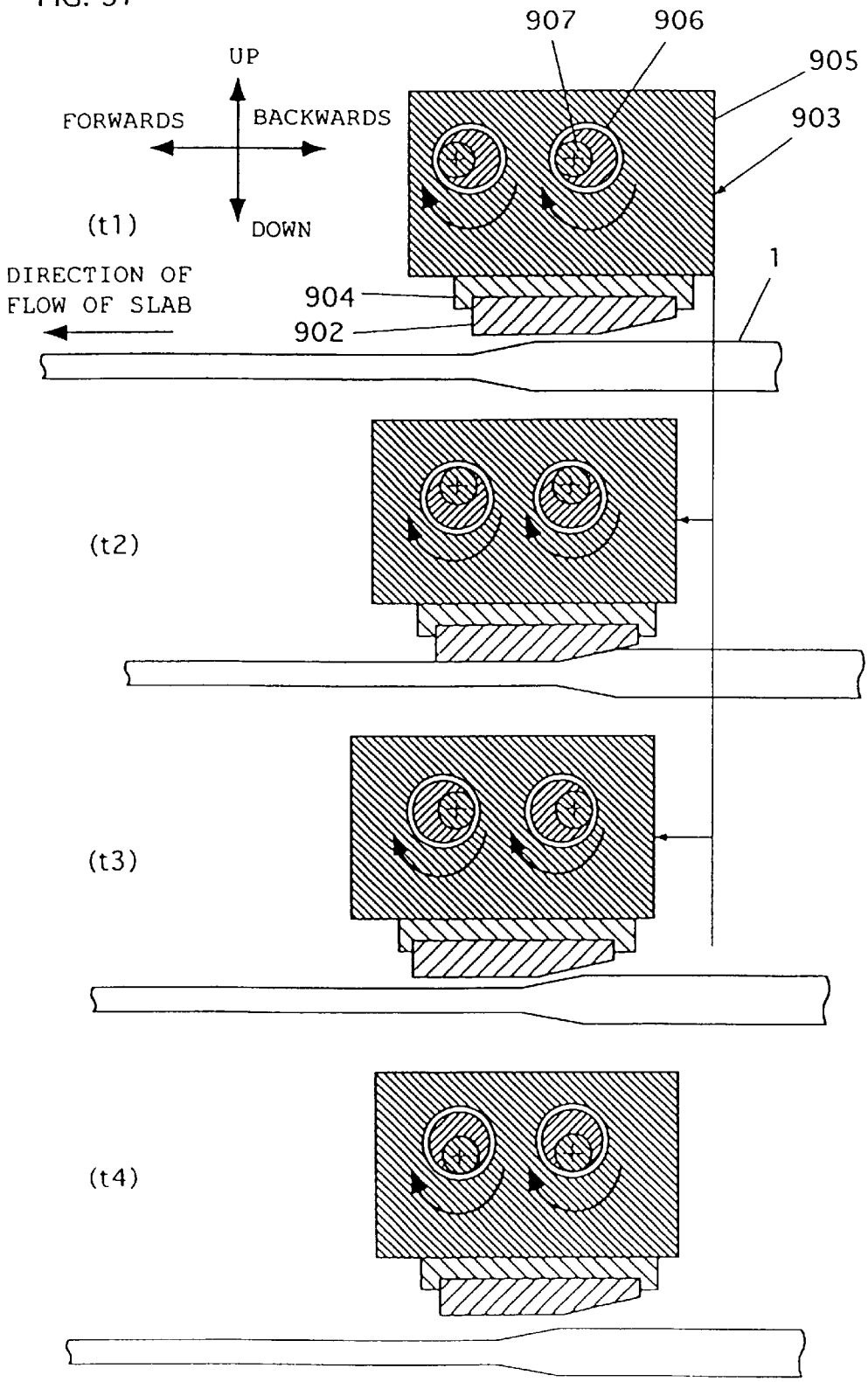
FIG. 57 shows one cycle of the operation of a slider and a slab.

Next, the operation of the fourteenth embodiment is described. FIG. 55 shows one cycle of operation of the slider 903, and FIG. 56 shows the speed of the slab during such a cycle. FIG. 57 shows the movements of the slider 903 and the slab 1 during a cycle. In FIG. 55, during the cycle time changes in the sequence t1–t2–t3–t4–t1, and the slab is pressed during the interval ta–tb which includes t2. In FIG. 56, the transfer speed of the slab 1 is controlled by pinch rolls 912. During pressing, the slab 1 is conveyed in synchronism with the forward speed of the slider 903, and at other times, the slab 1 is transferred at the normal transfer speed. The normal transfer speed is adjusted such that the distance L moved by the slab per cycle is not longer than the pressing length L1 of the dies 902 shown in FIG. 52, and also the speed must match the speed of a downstream apparatus. Using such a moving distance L as described above, the length of the slab pressed in the previous cycle is slightly superimposed by the length pressed in the next cycle, so pressing is carried out appropriately.

In FIG. 57, t1–t4 corresponds to t1_t4 in FIGS. 55 and 56. At t1, the slider 903 is raised to an intermediate position, and is located at the farthest position in the backward direction. At t2, the state during pressing is show, in, in which the slider is located at an intermediate position in the backward and forward direction. The slider is partly raised at t3, and located at the farthest position in the forward direction. The slider is located at the highest position at t4, but at an intermediate position in the backward and forward direction. The slider 903 is driven forwards during the period t1–t2–t3 as shown by the arrows, as described above, and the speed thereof becomes a maximum near t2 during pressing. Therefore, the slab 1 can be continuously transferred at the most suitable speed for pressing even during the pressing period, by conveying the slab 1 by means of the pinch rolls 912 in synchronism with the speed of the slider 903.

(Fifteenth Embodiment)

Figure 58:
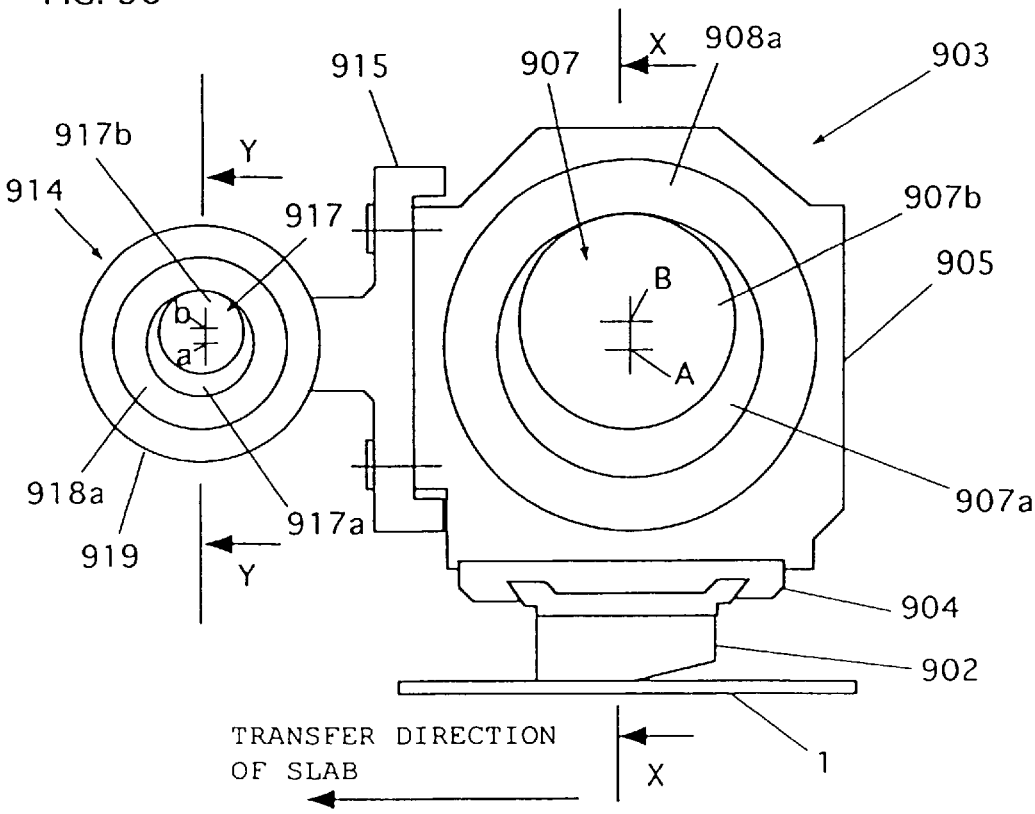
FIG. 58 shows the configuration of the fifteenth example of the present invention.
Figure 59:
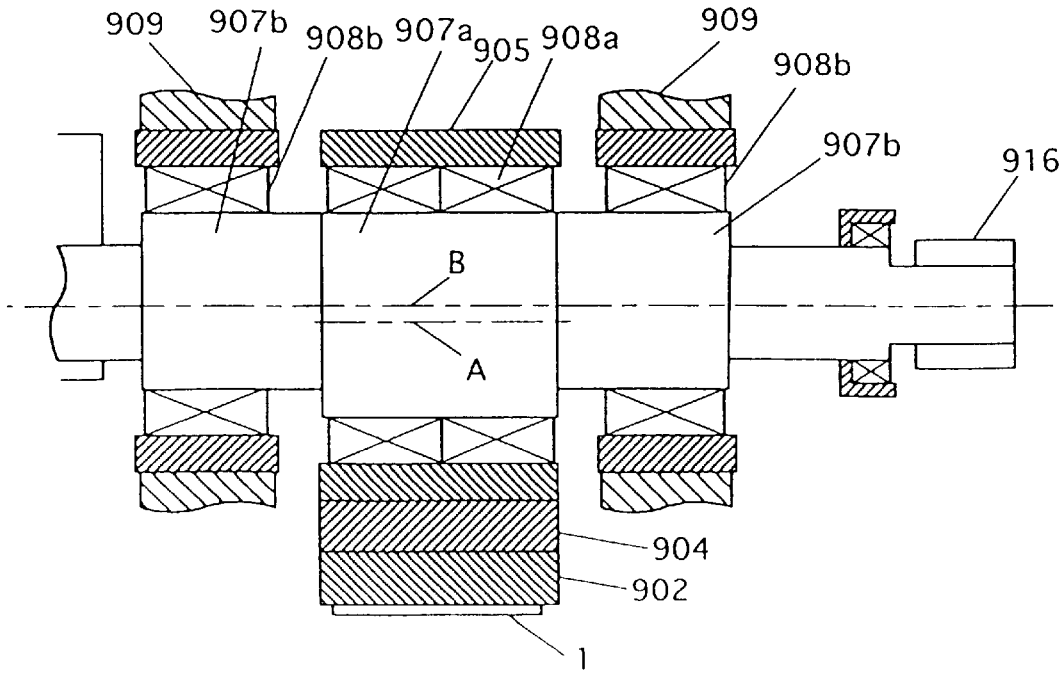
FIG. 59 is a sectional view along the line X—X in FIG. 58.
Figure 60:
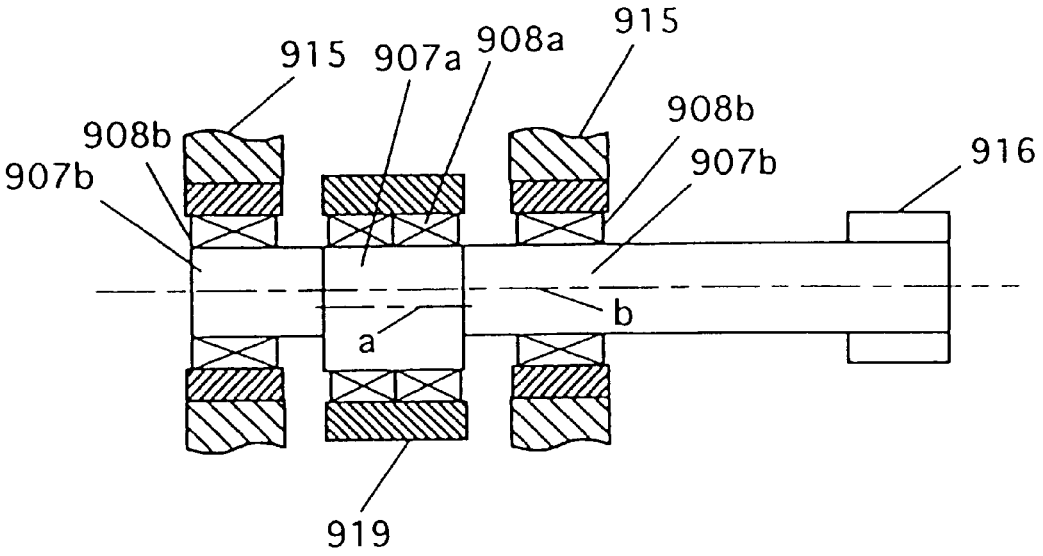
FIG. 60 is a sectional view along the line Y—Y in FIG. 58.

The fifteenth embodiment is described next. With this embodiment, balancers that absorb the unbalanced moments are provided on the sliders. FIG. 58 is a side view of the fifteenth embodiment, showing the upper half of the structure which is symmetrical in the vertical direction; FIG. 59 is a sectional view along the line X—X in FIG. 58, and FIG. 60 is a sectional view along the line Y—Y shown in FIG. 58. As shown in FIG. 58, the slider 903 is composed of a large crank 907 the unbalanced moment of which due to the load, is absorbed by the balancer 914 using a crank 917.

Referring to FIGS. 58 and 59, a die 902 is provided above a slab 1, and the die 902 is mounted on a main unit 905 by means of a die holder 904, in a detachable manner. In the crank 907, a first shaft 907*a* is connected to two second shafts 907*b* at both ends of the first shaft with the shaft center lines offset. The first shaft 907*a* is connected through first bearings 908*a*, and the second shafts 907*b* are supported by the second bearings 908*b* provided on the frame 909 shown in FIGS. 52 and 53. A and B indicate the center lines of the first and second shafts, respectively. A gear coupling 916 is provided at the end of one of the second shafts 907*b*, through which the second shaft 907*h* is rotated by a driving device not illustrated.

The balancer 914 is provided with the crank 917 which is comprised of a first shaft 917*a* and second shafts 917*b* attached to both ends of the first shaft, with a diameter smaller than the diameter of the first shaft 917*a*, and the axial center line "a" of the first shaft is offset from the axial center line B of the second shaft. The first shaft 907*a* is connected to the first bearings 908*a* which are fixed to an outer ring 919. The second shafts 907*b* are supported by the second bearings 908*b* which are fixed to a support structure 915.

The support structure 915 is installed on the main unit 905 using bolts. At the end of the other second bearing 907*b*, the gear coupling 916 is provided and driven by a driving device that is not illustrated. "a" and "b" indicate the axial center lines of the first shaft 917*a* and the second shafts 917*b*, respectively.

Next, the operation of the fifteenth embodiment is described. The operation of the slider 903 during the reduction of a slab 1 is same as that of the first embodiment. However, because a crank 907 is provided on each of the upper and lower sides, an unbalanced moment is produced by the reaction force when the slab 1 is pressed. The balancer 914 functions to cancel this unbalanced moment.

(Sixteenth Embodiment)

Figure 61:
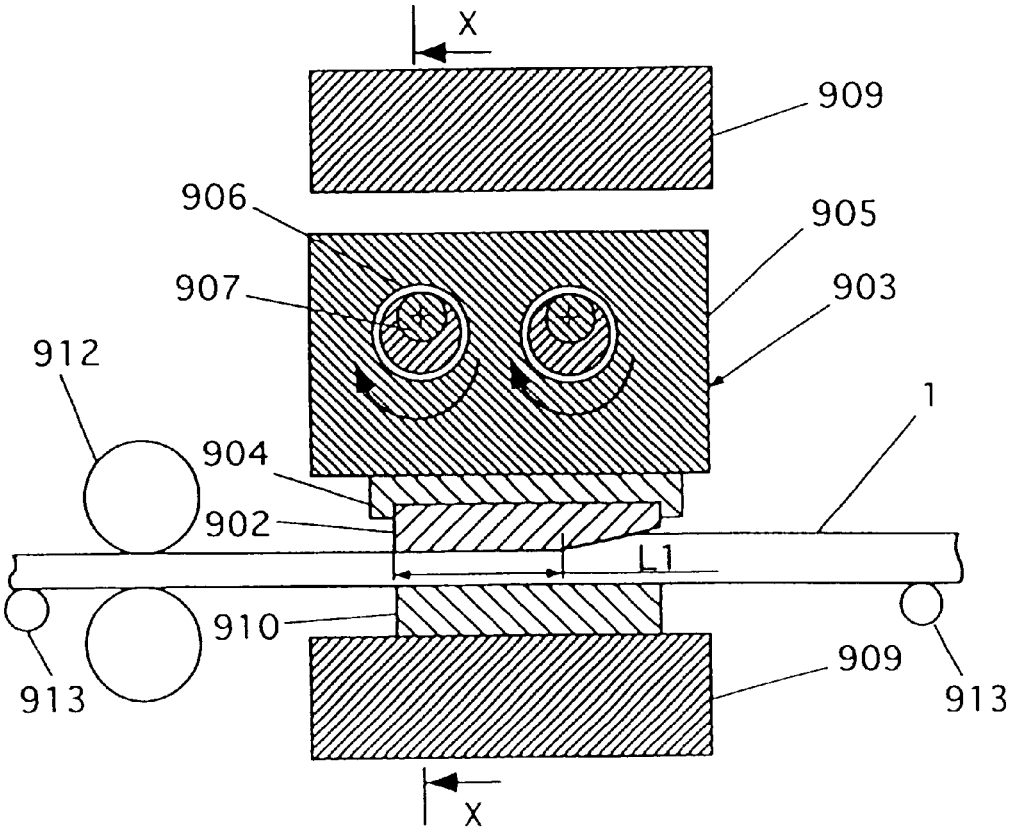
FIG. 61 shows the construction of the sixteenth embodiment of the present invention.
Figure 62:
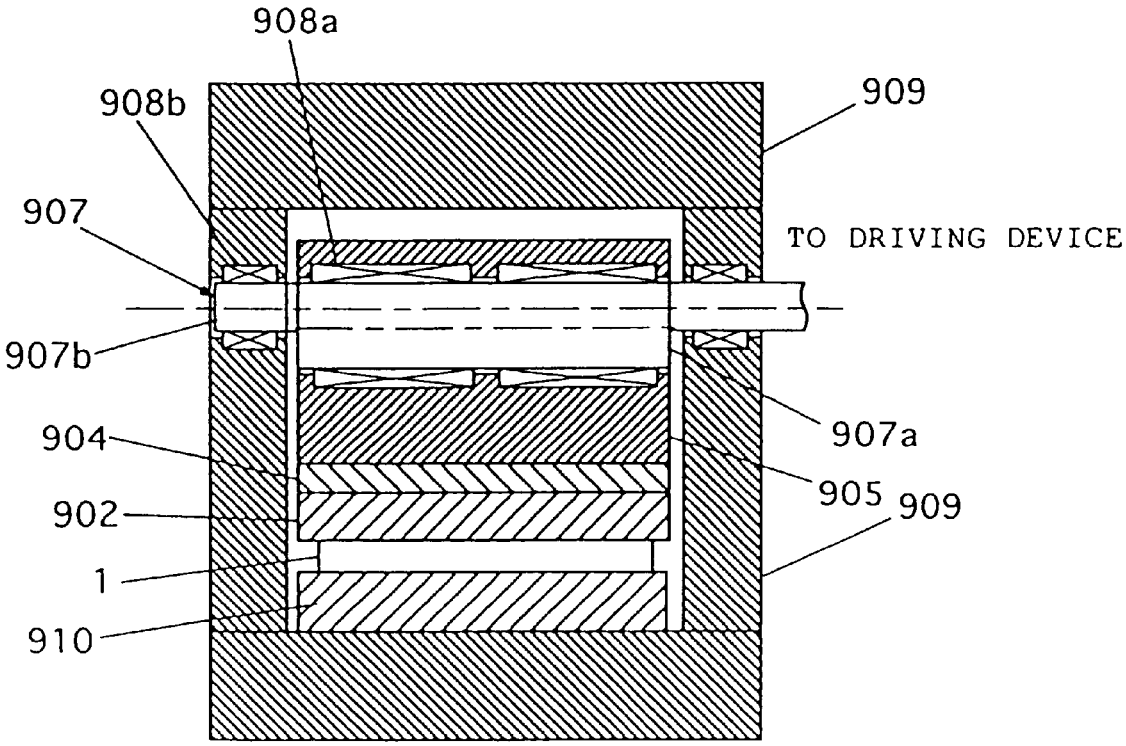
FIG. 62 is a sectional view along the line X—X in FIG. 61.

Next, the sixteenth embodiment is described. FIG. 61 is a sectional view of the configuration of the plate reduction press apparatus according to the sixteenth embodiment, and FIG. 62 is a sectional view along the line X—X in FIG. 61. The same item numbers as in FIGS. 52 and 53 are used to indicate the same components and functions. With the present embodiment, a die 902 and a slider 903 are provided either above or below a slab, but on the side opposite the die 902, a support member 910 is installed, and pressing is carried out from one side. Reducing operations and backward and forward movements of the slider are carried out in the same way as in the fourteenth embodiment shown in FIG. 57, but the amount of the reduction due to pressing is less. In addition, during the backward and forward movements of the die when it presses a slab 1, the transfer of the slab is resisted by a friction force produced between the slab and the support member 910, so the driving device of the slider 903 and the pinch rolls 912 are more heavily loaded. However, the construction is simpler and the cost of manufacture is reduced.

Obviously as described above, according to the present invention, the die and the backwards and forwards moving slider are provided, so that the slab can be transferred while being pressed and a downstream rolling operation can be carried out continuously. A plurality of cranks are also provided and can maintain the die parallel to the transfer line. Alternatively one pressing crank and a balancing crank can also be provided to maintain the die parallel. The die can also be easily cooled internally or externally, therefore the life of the die can be prolonged. It is also possible to reduce a slab by more than 50 mm during one pressing operation. Furthermore, the entire apparatus can be made compact.

(Seventeenth Embodiment)

Figure 63:
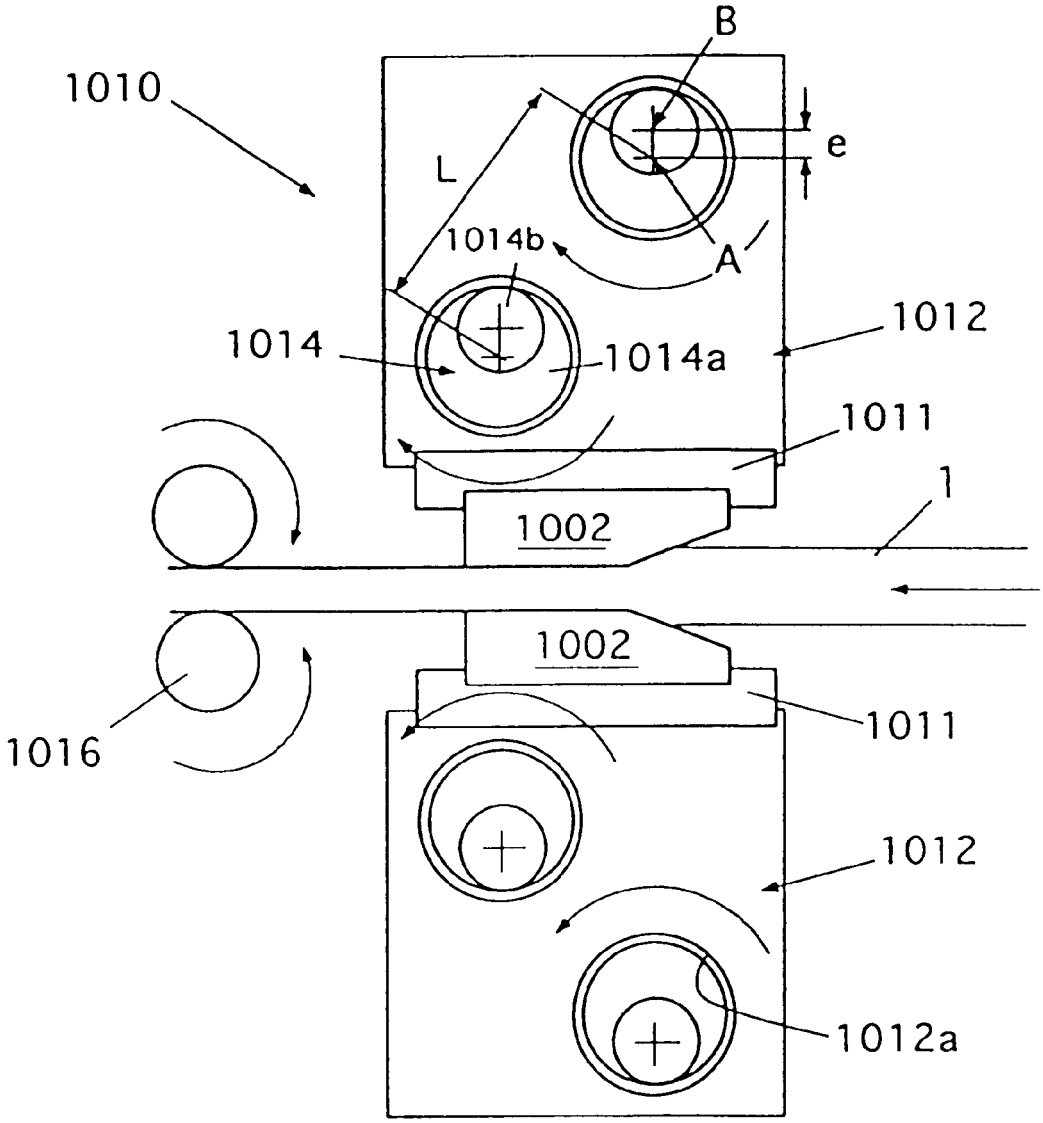
FIG. 63 shows the configuration of the seventeenth embodiment of the present invention.

FIG. 63 shows the configuration of the seventeenth embodiment according to the present invention. As shown in this figure, the plate reduction press apparatus of the present invention is provided with a pair of dies 1002 opposite each other above and below a slab 1, and devices 1010 for swinging the dies provided for each die 1002, that drive the dies backwards and forwards with respect to the slab 1.

As shown in FIG. 63, the devices 1010 for swinging the dies are composed of sliders 1012 each of which is provided with a pair of circular holes 1012*a* positioned obliquely to the direction of feed of the slab with an interval L between each hole, and eccentric shafts 1014 rotating inside the circular holes 1012*a*.

Each of the eccentric shafts 1014 is comprised of a first shaft 1014*a* that rotates in the circular hole 1012*a* around the center line A of the circular hole, and a second shaft 1014*b* driven and rotated around a center line B offset from the first center line 1014*a* by the eccentricity e. The second shaft 1014*b* is supported by bearings not illustrated, and is driven and rotated by a driving device also not illustrated.

Cooling water is supplied to the dies 1002 to cool the dies 1002. Cooling water can also be sprayed from the outside of the dies. The dies 1002 are mounted detachably on the sliders 1012 through the die holders 1011. Pinch rolls 1016 are installed downstream of the dies 1002 and control the transfer speed of the slab 1, table rollers 107 are provided at the inlet or outlet side of the pinch rolls 1016 and transfer the material to be pressed. In FIG. 63, A and B indicate the axial center lines of the first and second shafts, respectively.

(Eighteenth Embodiment)

Figure 64:
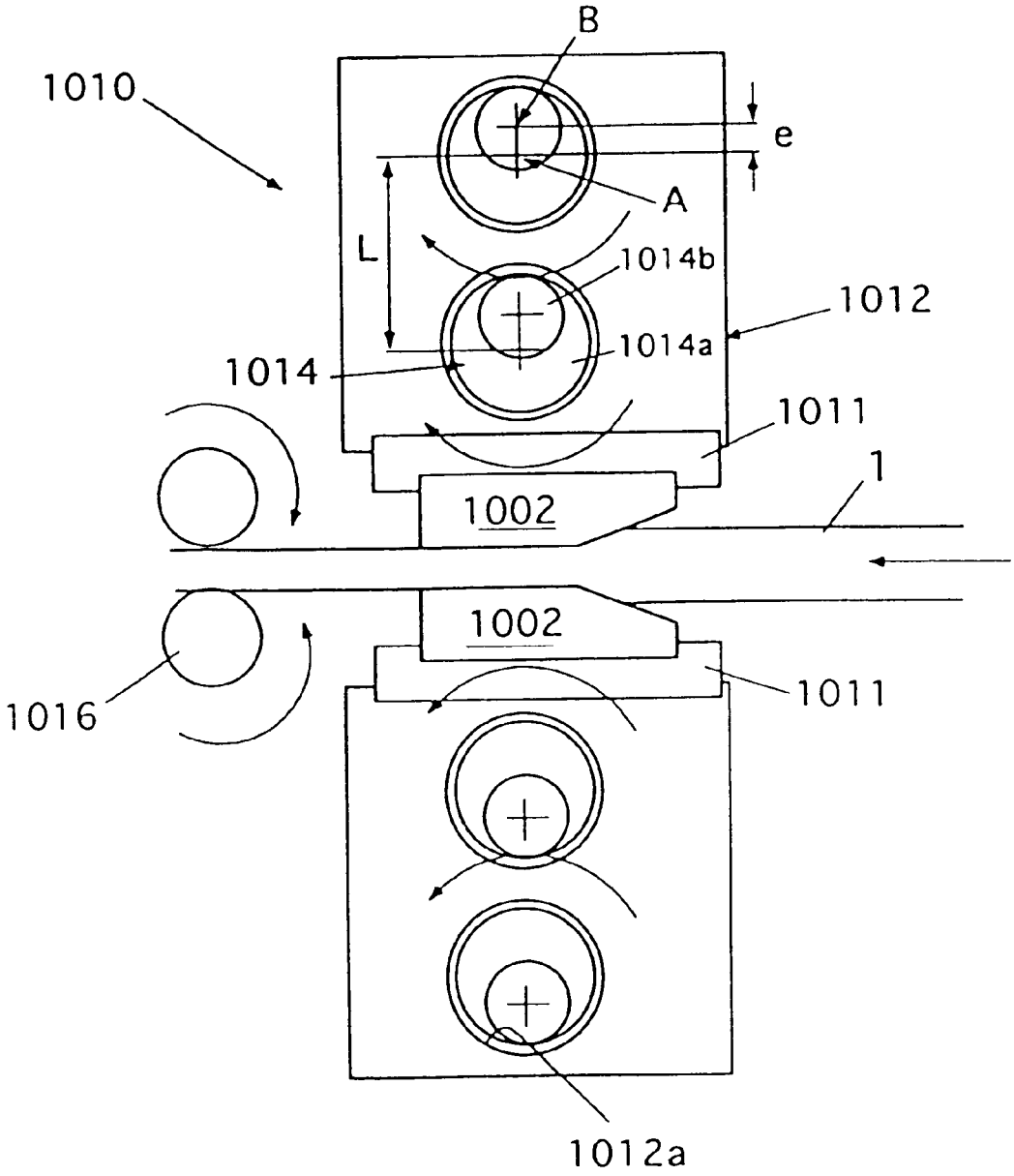
FIG. 64 shows the configuration of the eighteenth embodiment of the present invention.

FIG. 64 shows the configuration of the eighteenth embodiment according to the present invention. In this figure, a pair of circular holes 1012*a* in the sliders 1012 are positioned perpendicular to the transfer direction of a slab, and a pair of eccentric shafts 1014 are also located perpendicular to the direction of feed of the slab. The other details of the configuration are the same as those in FIG. 63.

Figure 65:
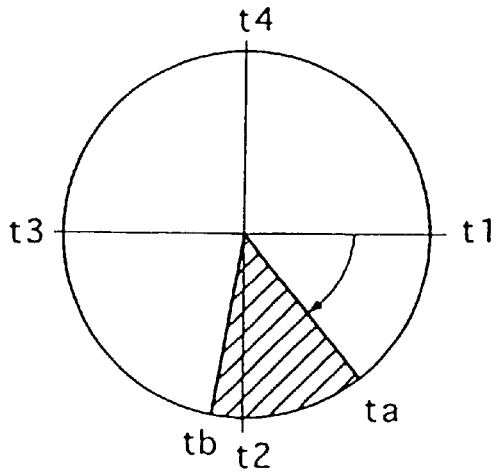
FIG. 65 shows one cycle of operation of a slider.
Figure 66:
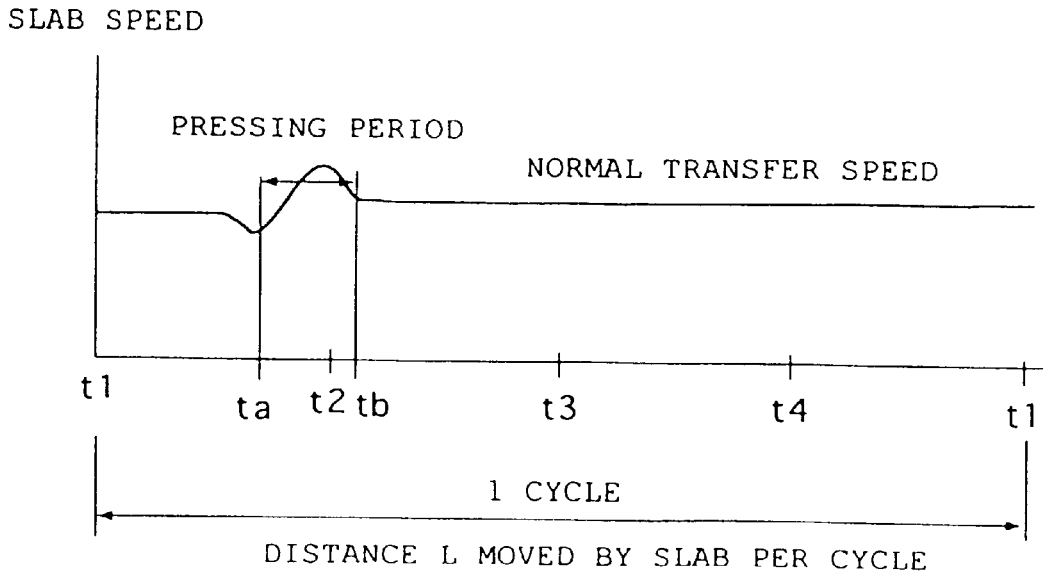
FIG. 66 shows the moving speed of a slab during one cycle.

Next, the operation is described. FIG. 65 shows one cycle of operation of the sliders 1012, and FIG. 66 shows the slab speed during the cycle. In FIG. 65, time during the cycle changes in the sequence t1–t2–t3–t4–t1, and the slab is pressed within the period ta–tb which includes t2. In FIG. 66, the transfer speed of the slab 1 is controlled by the pinch rolls 1016. The speed is synchronized with the speed at which the slab 1 is fed by the dies 1002 during the pressing time (reducing time) in which the dies 1002 press the slab 1, and during the period in which there is no pressing and the slab 1 is not in contact with the dies 1002, the slab is conveyed at a constant speed so that a specified cycle speed is achieved. In other words, the slab 1 is transferred in synchronism with the forward speed of the sliders 1012 during pressing, and otherwise a normal conveying speed is used. The normal speed is selected such that the distance in which the slab is moved per cycle is not longer than the pressing length of the dies 1002, and so that the speed is also suitable for a downstream system. The moving distance selected as above results in the length being pressed in the present cycle, being slightly superimposed on the length pressed in the previous cycle so that the reduction is performed properly.

At t1 shown in FIGS. 65 and 66, the sliders 1012 are raised to an intermediate position and are located in the farthest position in the backward direction. At t2, the sliders are in the pressing position and are located at an intermediate position in the backward and forward direction. The sliders are partially raised at t3, and located at the farthest position in the forward direction. At t4, the sliders are located at the highest point, and are in an intermediate position in the backward and forward direction. The sliders 1012 are advanced as shown by the arrows during the period t1–t2–t3, and the speed thereof becomes a maximum near t2 during pressing. Consequently, by conveying the slab 1 with the pinch rolls 1016 in synchronism with the speed of the sliders 1012 during pressing, the slab can be transferred continuously at the most suitable speed for reducing, even during pressing.

According to the configurations of the present invention as described above, the two eccentric shafts 1014 rotating in a pair of circular holes 1012*a* in the sliders 1012 are positioned at an inclined angle or perpendicular to the direction of feed of the slab, so the required length of the apparatus in the direction of the line can be reduced from the case where the eccentric shafts are installed on the same level parallel to the direction of the line. In particular, when the eccentric shafts on one side of the transfer line are installed at different distances from the line, the forces acting on the two eccentric shafts during pressing can be made identical to each other, so that the length of the apparatus in the direction of the line can be reduced while at the same time achieving uniform loading of each eccentric shaft. When the two eccentric shafts on one side of the slab feeding direction are arranged vertically to the direction as shown in FIG. 64, the load applied to the lower eccentric shaft can be made greater, therefore the upper eccentric shaft can be made compact.

Obviously from the description above, the present invention provides dies and sliders that press the dies and move them backwards and forwards, with which a slab can be conveyed while being pressed, hence a downstream rolling operation can be carried out continuously. In addition, the necessary length of the press apparatus in the direction of the line can be reduced, and while transferring the slab, the plate thickness of the slab can be reduced with a high reduction ratio.

(Nineteenth Embodiment)

Figure 67:
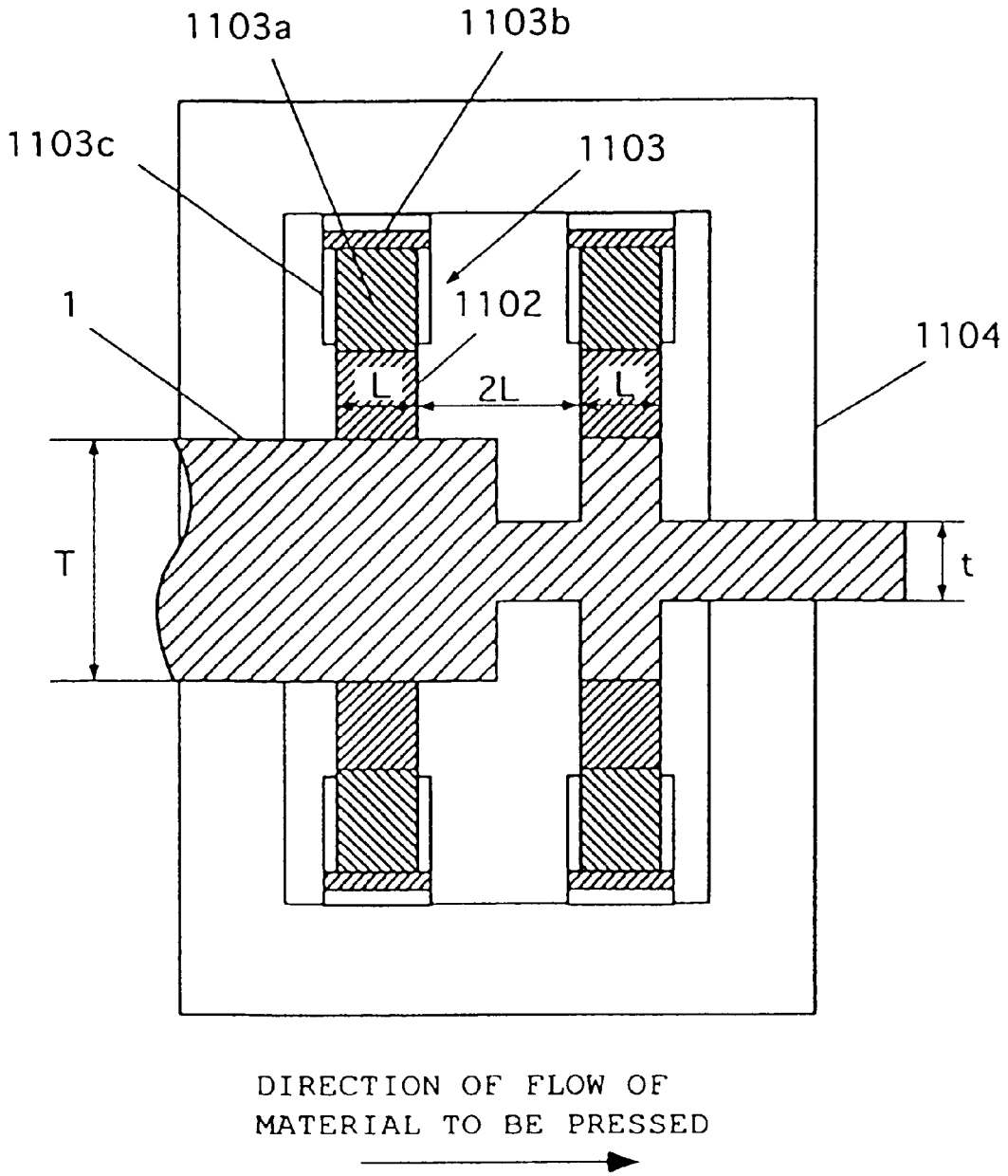
FIG. 67 shows the configuration of the nineteenth embodiment of the present invention.

FIG. 67 is a view showing the configuration of the plate reduction press apparatus according to the nineteenth embodiment. The press machine is provided with upper and lower dies 1102 above and below a material to be pressed 1, hydraulic cylinders 1103 that press the dies 1102, and frames 1104 supporting the hydraulic cylinders 1103. Assuming the thickness of the material 1 to be pressed is T, that is, T is reduced to a thickness t. The longitudinal length of the dies 1102 is indicated by L which is shorter than the width of the material 1 to be pressed. The hydraulic cylinders 1103 are composed of rods 1103*a* connected to the dies 1102, pistons 1103*b* pushing the rods 1103*a*, and cylinders 1103*c* that house the rods 1103*a* and the pistons 1103*b*. In addition, a device for supplying a hydraulic fluid under pressure to the hydraulic cylinders is also provided, although not illustrated. The present embodiment relates to a case in which two pairs of the dies 1102 are provided above and below the material to be pressed, in which the two pairs of the dies 1102 are arranged at intervals of 2L in the longitudinal direction.

The operation is described below.

Figure 68:
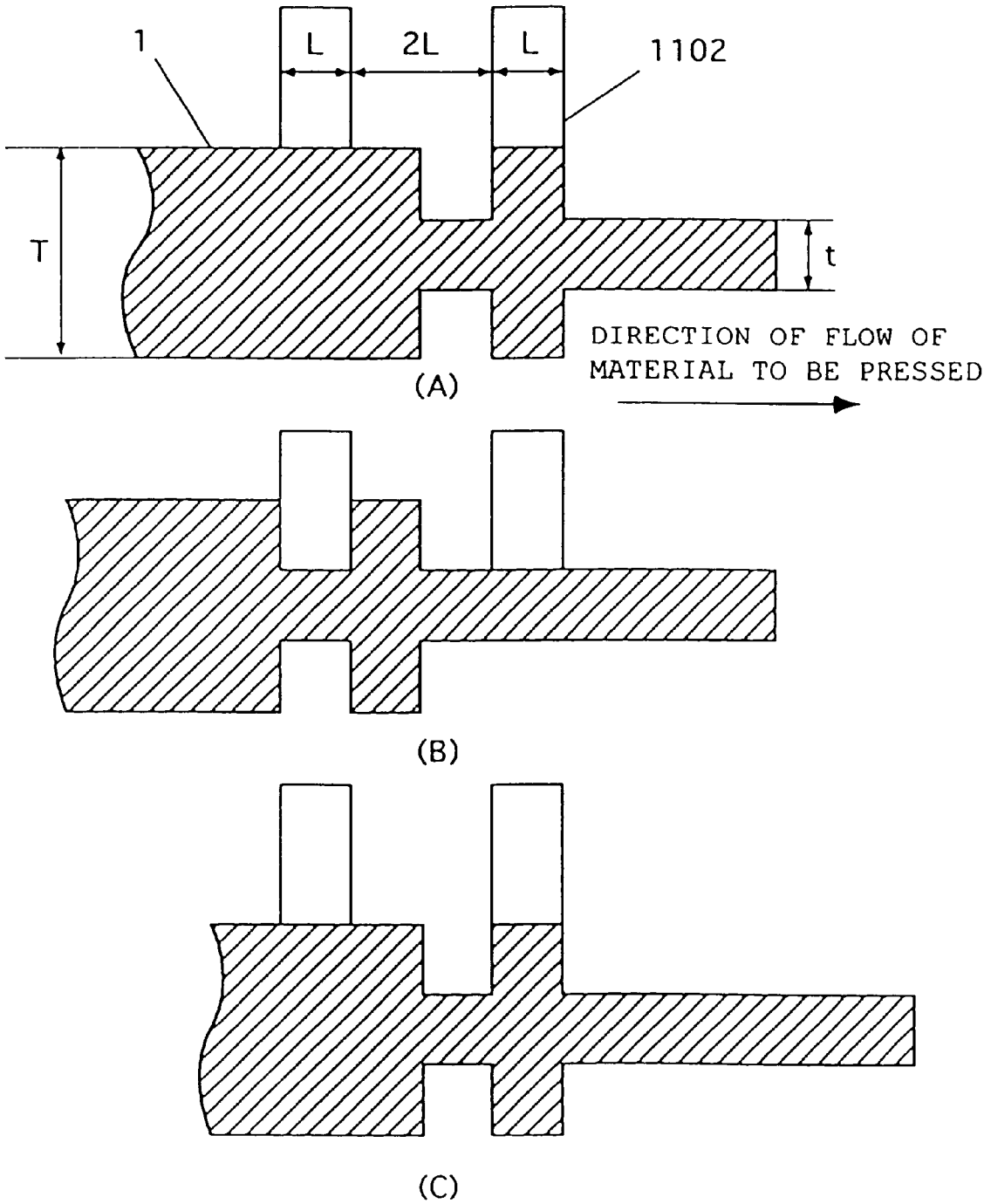
FIGS. 68(A), 68(B) and 68(C) show the operation of the nineteenth embodiment, for the case in which each die presses at the same time.

FIG. 68 shows the configuration in which the two pairs of dies 1102 are pressed simultaneously. (A) shows the state when pressing begins in the present step of the process after the material has been reduced in a previous step of the process. (B) shows the state in which the material has been pressed from the state shown in (A). In (C), the dies 1102 are ready to reduce the material 1 to be pressed, after the dies 1102 have been separated from each other from the state shown in (B), and the material was moved a distance 2L in the longitudinal direction. In (C) the state has returned to the state of (A). Thus by repeating steps (A) through (C), the thickness T can be reduced to t. As two pairs of dies 1102 press simultaneously, high-speed pressing can be carried.

Figure 69:
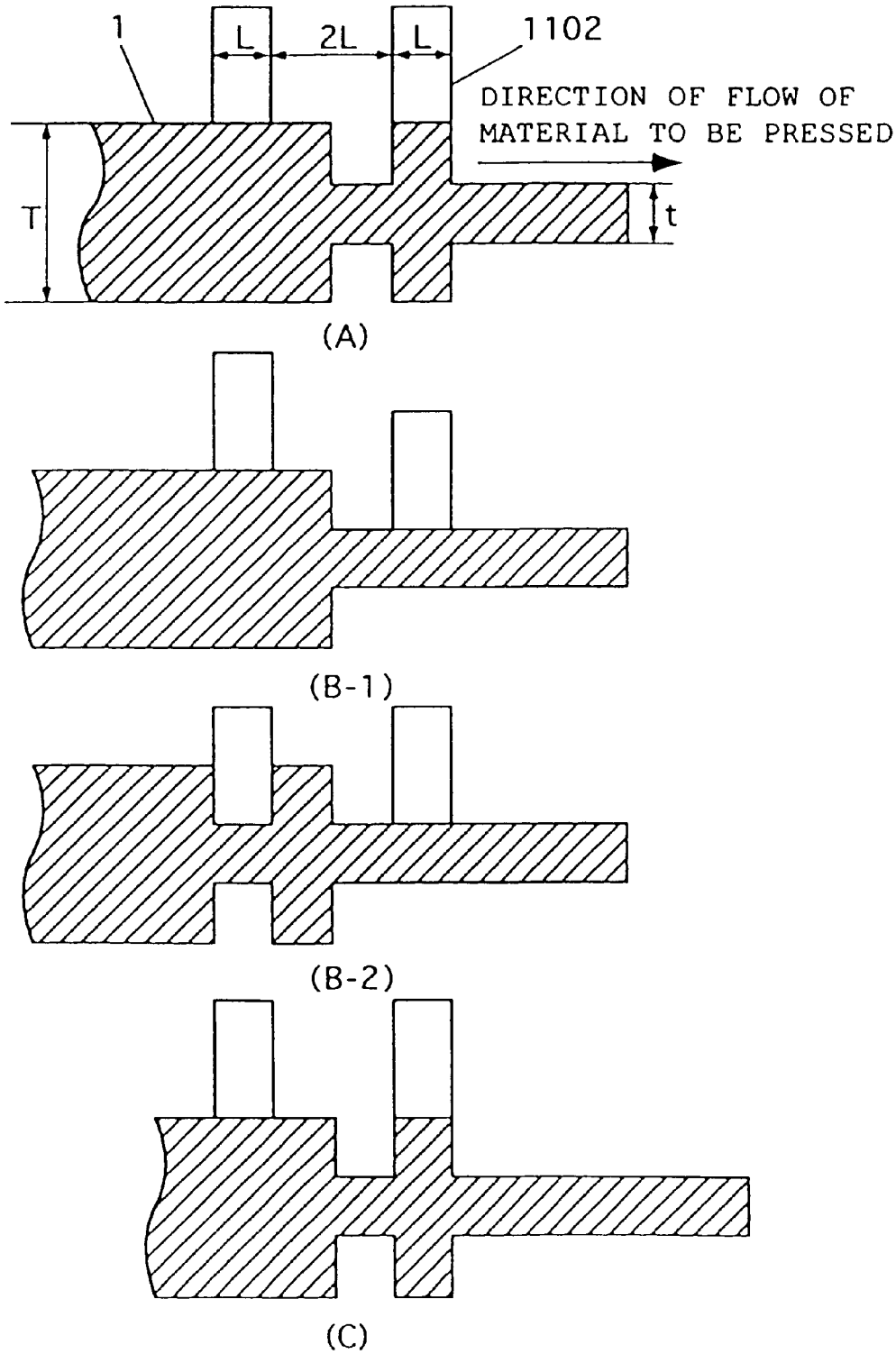

FIG. 69 shows the case in which the pressing operations of the two pairs, of dies 1102 are shifted in time. (A) shows the state when pressing begins in the present step of the process after the material has been reduced in a previous step of the process. (B-1) shows the status when the material 1 to be pressed has been pressed by the downstream dies 1102 from the state of (A). (B-2) shows the condition after the material has been pressed by the upstream dies from the state of (B-1). (C) is a sectional view of the material 1 to be pressed after the dies 1102 have been opened from the state of (B-2) and the material has been moved a distance 2L longitudinally, and the two pairs of dies 1102 are ready to press. The state in (C) has returned to the state (A). Thus by repeating the steps (A) through (C), the thickness T can be reduced to t. In this way, the power required to press the dies 1102 becomes only one half of the power required to drive all the dies during pressing as shown in FIG. 68, accordingly the capacity of the driving devices can also be halved together with a reduction in the cost.

(Twentieth Embodiment)

Figure 70:
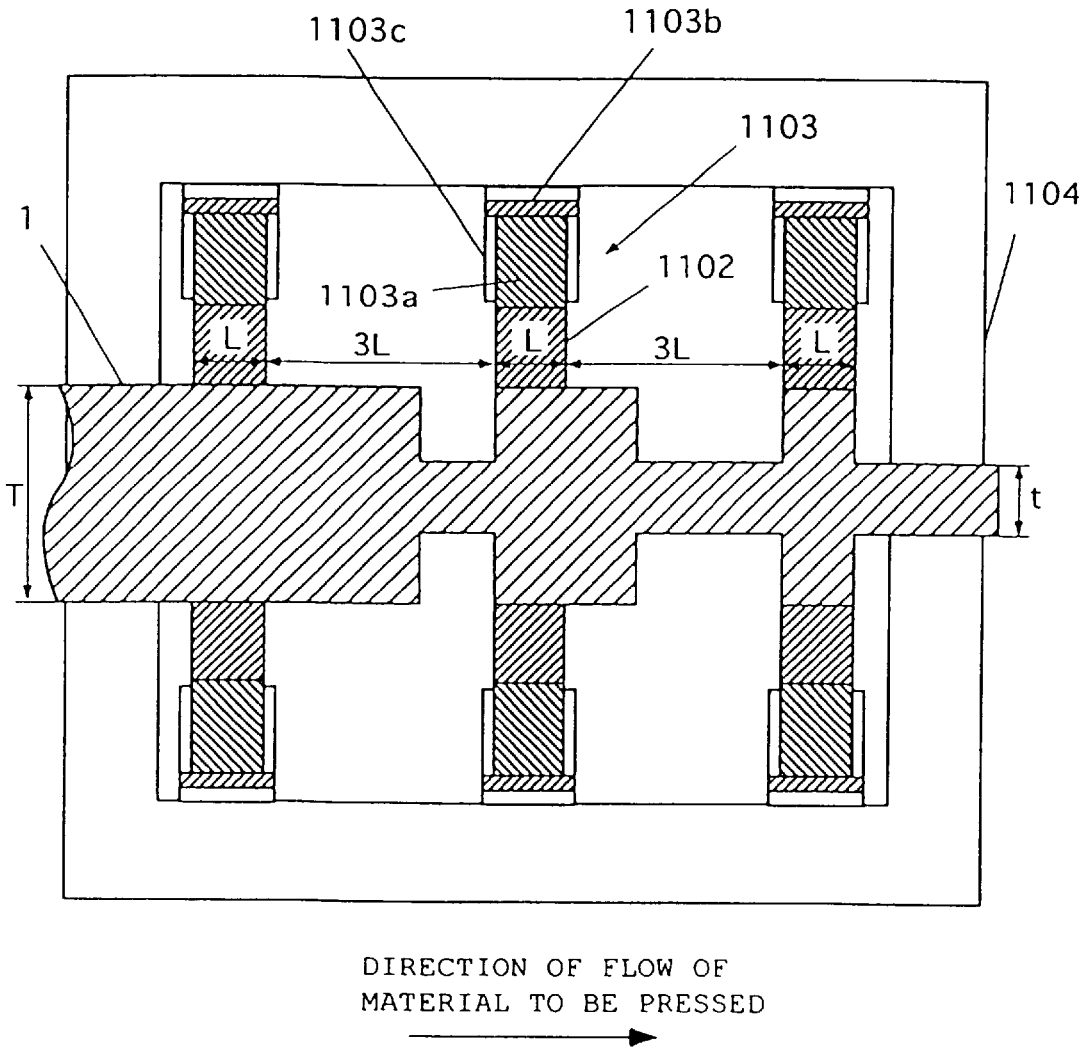
FIG. 70 shows the configuration of the twentieth embodiment of the present invention.
Figure 71:
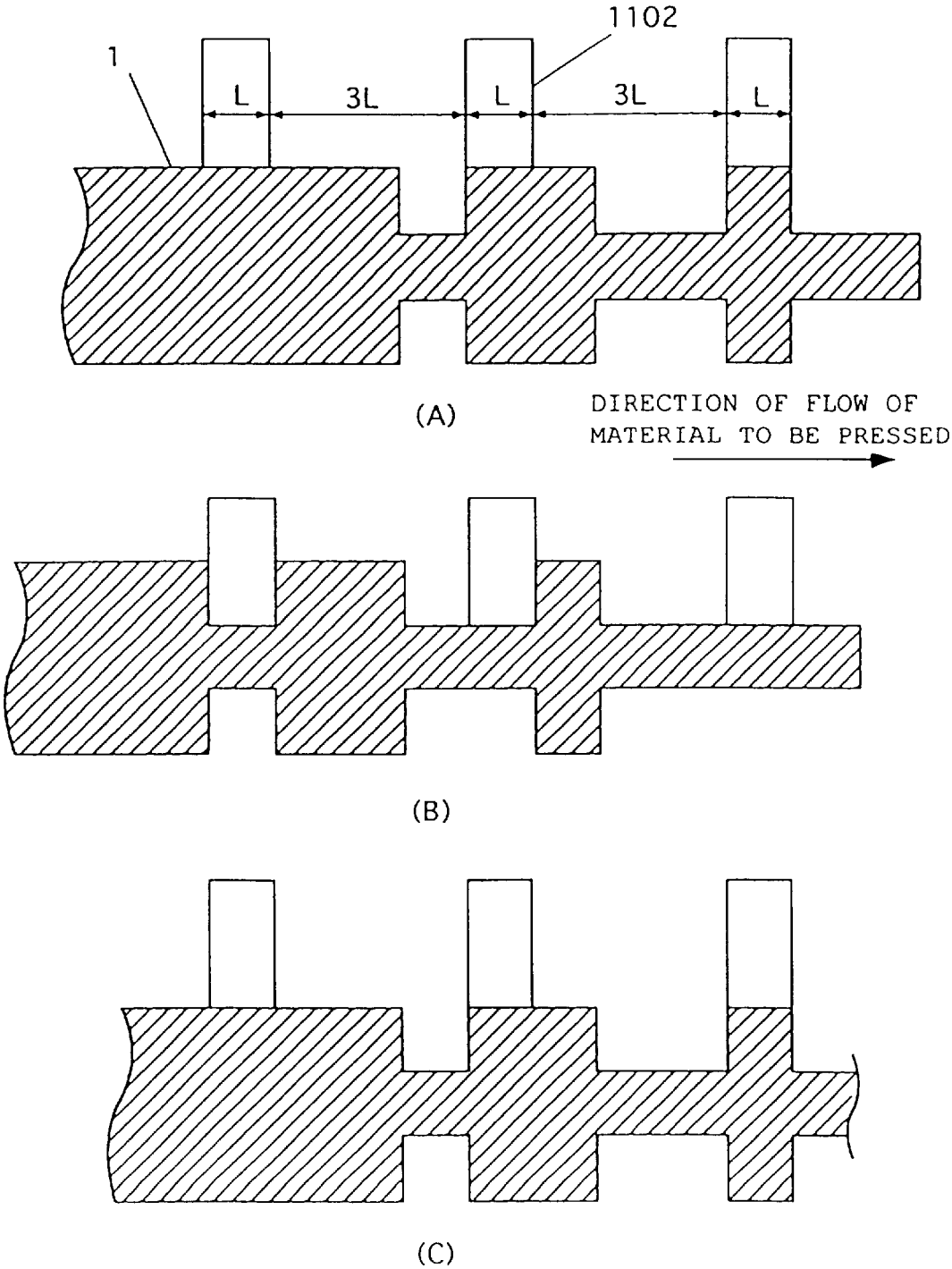
FIGS. 71(A), 71(B) and 71(C) show the operation of the twentieth embodiment, for the case in which all the dies press simultaneously.

The twentieth embodiment is described below. FIG. 70 shows the configuration of the plate reduction press apparatus of the twentieth embodiment, and FIG. 71 shows its operation. According to the present embodiment, three pairs of dies 1102 are arranged in the direction of movement of the material 1 to be pressed at intervals of 3L where L is the length of a die 1102, and the other details are the same as those of the previous embodiment shown in FIG. 67. FIG. 71 shows the operations when the three pairs of dies 1102 press simultaneously. FIG. 71(A) shows the state when pressing is just beginning in the present step of the process after the material has been pressed in a previous step of the process. (B) shows the condition of the material after it has been pressed from the state shown in (A). (C) shows a view of the material 1 after it has been pressed by the dies 1102 after the dies 1102 have been separated from each other from the state shown in (B) and after the material has been moved a distance 3L longitudinally. (C) has returned to the state of (A). By repeating steps (A) through (C), the thickness T can be reduced to t. Because three pairs of dies 1102 press simultaneously, high-speed pressing can be carried out. When three pairs of dies 1102 press sequentially, the process shown in (B) is divided into sub-processes, the upstream dies 1102 press first, the middle dies 1102 press next, and then the downstream dies 1102 press. Although this method requires a long pressing time, the power to drive the dies can be as low as the power for a single pair of dies, so the cost is reduced.

The above explanation of the embodiment is related to two and three pairs of dies, however N pairs of dies can also be introduced into a press machine.

It can easily be understood from the above description, that because a plurality of short dies are arranged in tandem according to the present invention, the masses of the dies and the driving devices can be reduced to permit high-speed reduction and large-reduction pressing can be carried out. In addition, the material to be pressed can be conveyed smoothly in the longitudinal direction, resulting in reducing the power required for driving the dies. When a plurality of dies are operated sequentially, the power required for driving the dies can be greatly reduced.

(Twenty-First Embodiment)

Figure 72:
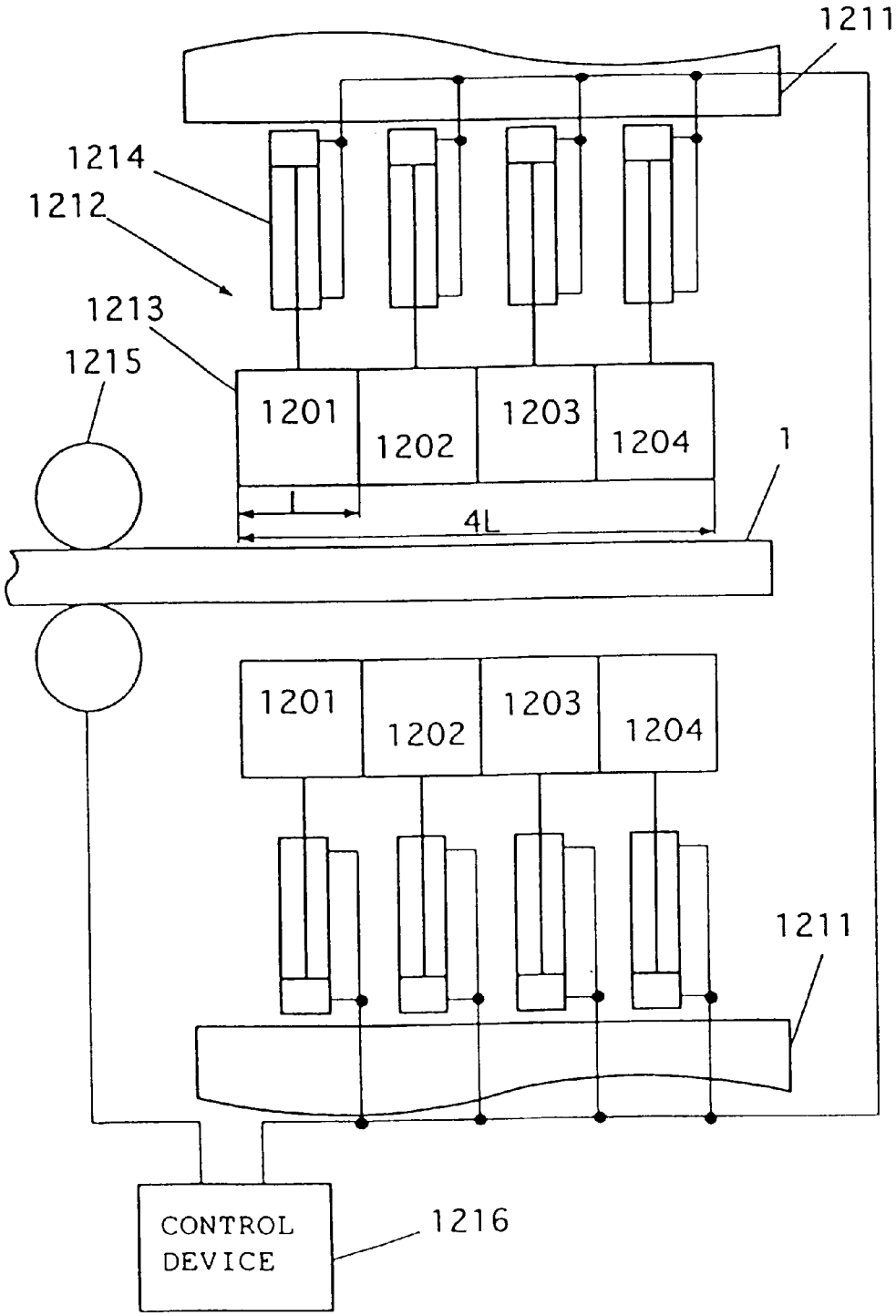
FIG. 72 is a side view showing the twenty-first embodiment of the present invention.

FIG. 72 shows a configuration of the plate reduction press apparatus according to the present embodiment. In FIG. 72, the plate reduction press apparatus is provided with N press machines 1212 installed in a housing 1211. The following description assumes N=4, which is not a necessary condition. The press machines 1212 are composed of pairs of upper and lower machines above and below a material 1 to be pressed, and four pairs are arranged in tandem in the direction of flow of the material 1 to be pressed. A press machine 1212 is comprised of dies 1213 and pressing devices 1214 that press the dies. Although the pressing devices 1214 are shown in an example in which hydraulic cylinders 1214 are used, other devices may also be used. The dies 1213 are numbered 1201 through 1204 sequentially from the upstream end. The length of a pair of dies 1213 in the direction of the flow of the material to be pressed is shown as L, so the pressing length of the four pairs of dies 1213 is 4L. Pinch rolls 1215 are installed at the inlet of the housing 1211, and feed out the material 1 to be pressed as required to suit the pressing operation of the press machines 1212. The hydraulic cylinders 1214 and the pinch rolls 1215 are controlled by a control device 1216.

Figure 73:
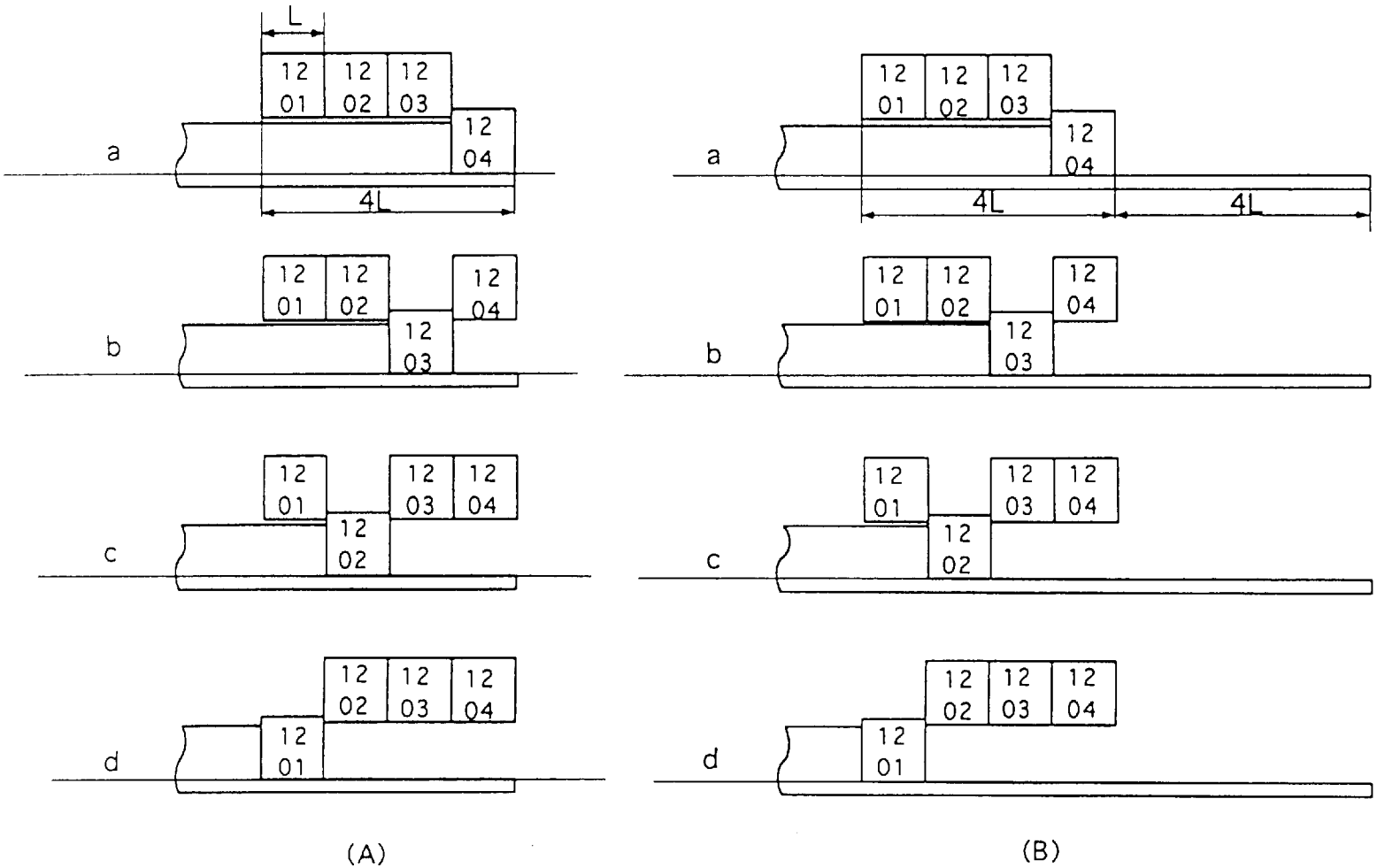
FIGS. 73(A) and 73(B) are views describing the operation of the twenty-first embodiment.

Next, the operation of the twenty-first embodiment is described. With this embodiment, the material 1 to be pressed is reduced sequentially to a predetermined thickness by means of the downstream reduction press machines 1212. FIG. 73 is a descriptive diagram of the operation of the twenty-first embodiment. FIG. 73 and subsequent figures show only the upper half of the material 1 to be pressed, and also the upper half of the reduction press machines 1212. FIG. 73(A) shows the process in which a length 4L of material, that is, 4 times the length L of a die, is reduced by pressing the material using dies 1204 through 1201 in that order, and (B) shows the conditions during pressing of the next length 4L. As shown in (A), the material 1 to be pressed is conveyed by pinch rolls 1215 under the dies 1204 through 1201, where each of dies 1204 to 1201 press one at a time and is retracted, and then the next die presses, that is, one die completes its pressing in one operation. Consequently, two or more reduction press machines 1212 never operate at the same time, so the pressing loads are small. At that time, the corresponding upper and lower hydraulic cylinders 1214 operate simultaneously. After the die 1201 has finished pressing, the material is fed by a length 4L by pinch rolls 1215 as shown in (B), and pressing of the next length 4L begins.

(Twenty-Second Embodiment)

Figure 74:
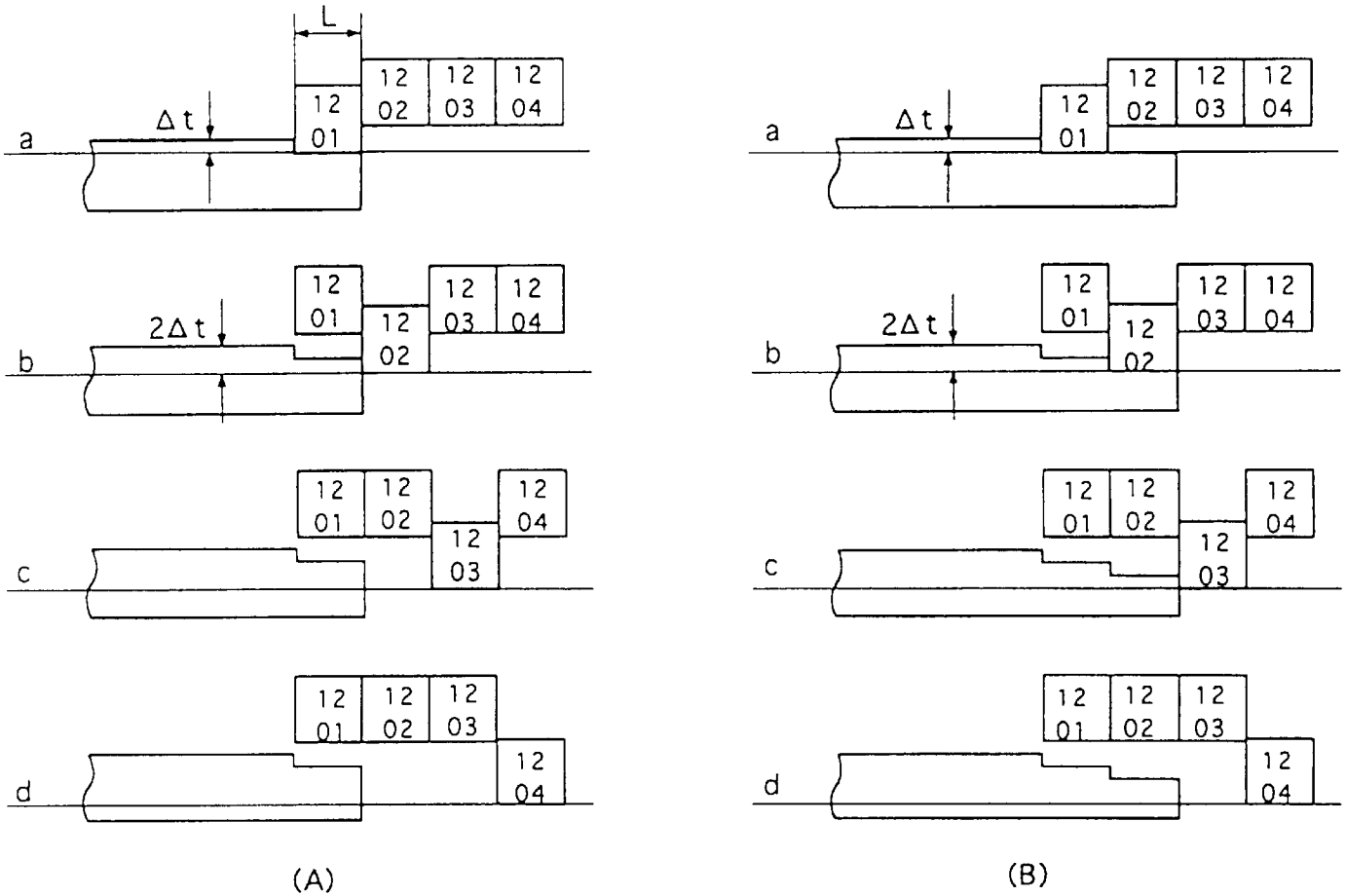
FIGS. 74(A) and 74(B) describe the operation of the twenty-second embodiment, when the tip of the material to be pressed has been moved to dies 1201 and dies 1202.

The operation of the twenty-second embodiment is described as follows. With this embodiment, every time a material 1 to be pressed is conveyed by a length L, each of the dies 1201 to 1204 presses the material in that order. Each of dies 1201 through 1204 presses the material by an amount Δt from the thickness already reduced by the preceding dies. After the pinch rolls 1215 feed the material through a distance L, each of dies 1201 to 1204 presses once in that order. FIG. 74(A) is a view showing that the material 1 to be pressed after it has been conveyed only up to the die 1201 only. At this time, the dies 1202 through 1204 operate idly. (B) shows the state after the material 1 to be pressed has been fed so that the end is under the die 1202. In "a", the material is pressed by an amount Δt with the die 1201 and in "b," the material is pressed by another amount Δt, that is, the original thickness is reduced by 2Δt.

As shown in c and d, dies 1203 and 1204 press idly.

Figure 75:
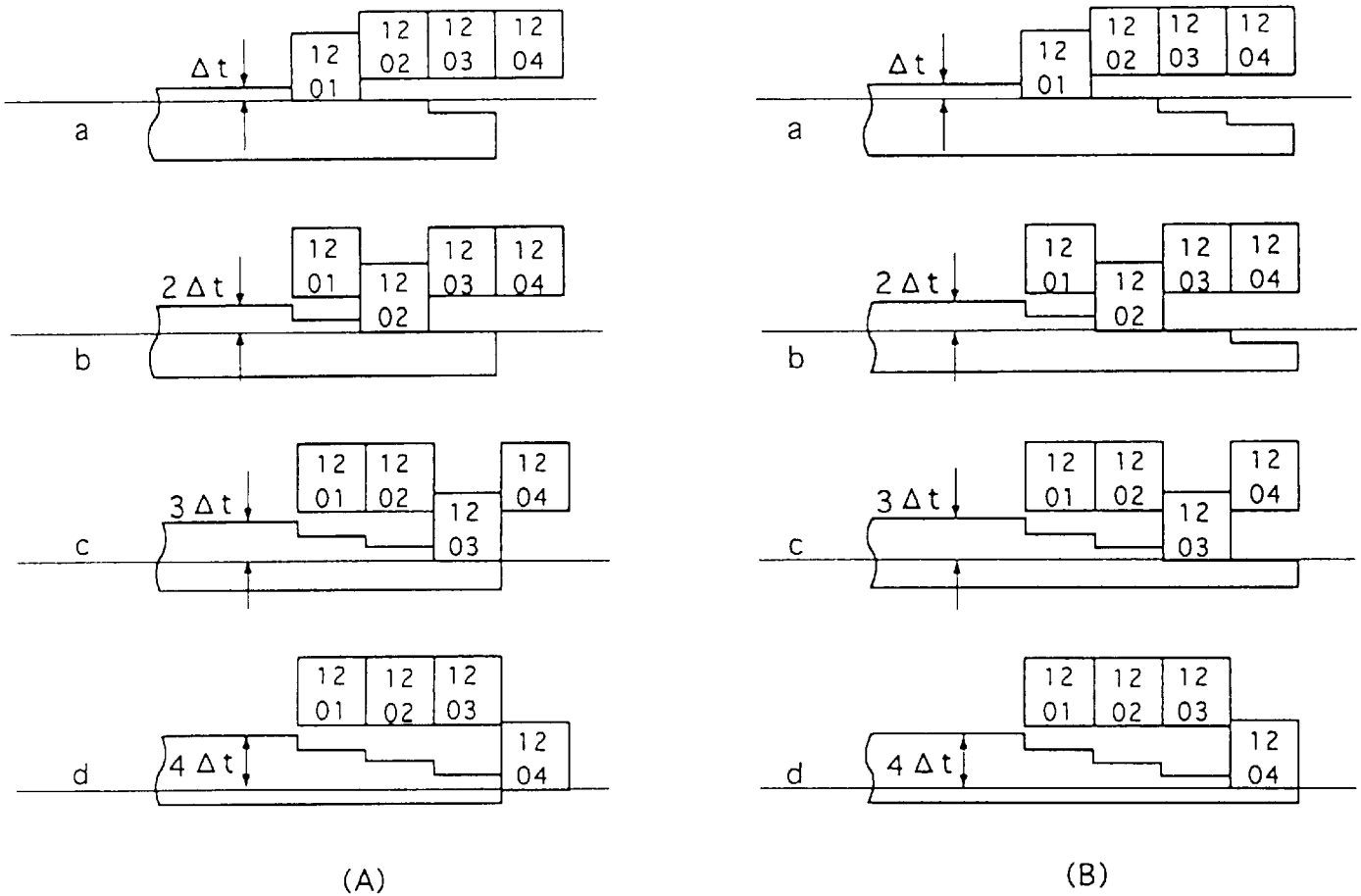
FIGS. 75(A) and 75(B) describe the operations of the twenty-second embodiment, when the tip of the material to be pressed has been moved to dies 1203 and dies 1204.

In FIG. 75(A), the material 1 to be pressed has been fed so that the end is under the die 1203. In "a," the die 1201 presses the material by an amount Δt. In "b," the die 1202 presses by a further amount Δt to give a total of 2Δt. In "c," the die 1203 reduces the material from the reduction of 2Δt to 3Δt. The die 1204 presses idly as shown in "d." FIG. 75(B) shows the condition in which the material 1 to be pressed has been conveyed so that the end is under the die 1204. In "a," the die 1201 presses the material by an amount Δt. In "b," the die 1202 reduces the material from a reduction of Δt to 2Δt. In "c," the die 1203 presses to reduce from 2Δt to 3Δt. In "d", the die 1204 presses, from the reduction of 3Δt to 4Δt. At this time, the amount of reduction of 4Δt is the planned reduction.

Figure 76:
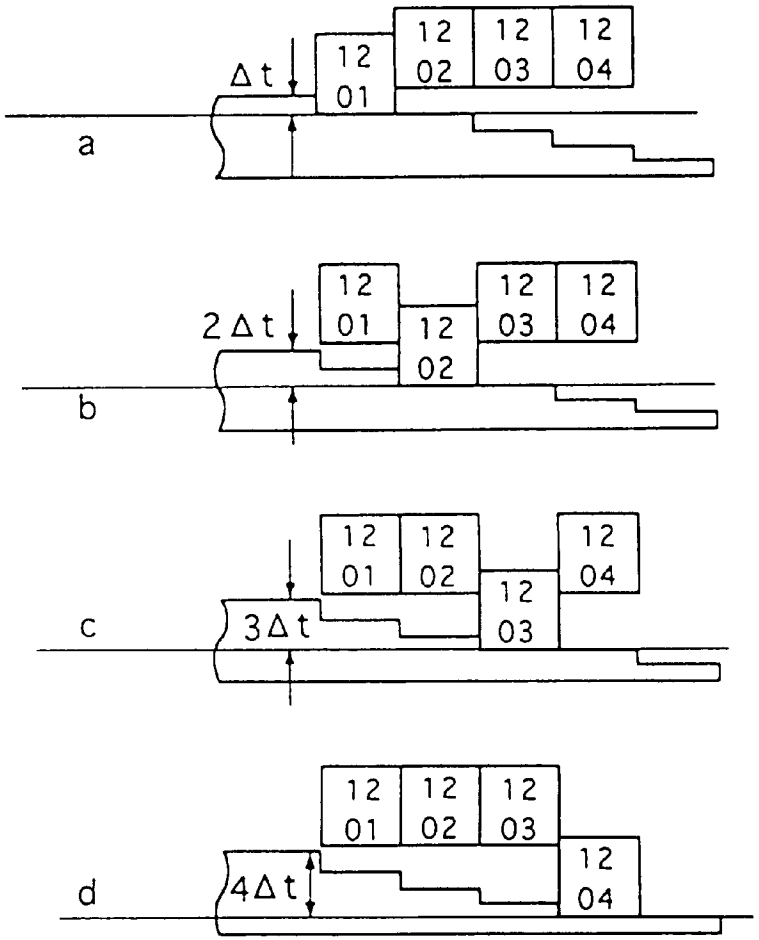
FIGS. 76(A), 76(B), 76(C) and 76(D) describe the operation of the twenty-second embodiment, when the tip of the material to be pressed has passed the dies 1204.

FIG. 76 is a view in which the leading end of the material 1 to be pressed has been transferred beyond the die 1204 by a length L. In "a," the die 1201 presses the material by an amount Δt. In "b," the die 1202 presses the material from a reduction of Δt to 2Δt. In "c," the die 1203 presses from a reduction of 2Δt to 3Δt. In "d," the die 1204 reduces the material from 3Δt to 4Δt. In this way, the planned reduction of 4Δt is achieved. Because each reduction press machine works sequentially, and only one machine is actuated at a time, the loads applied to the entire reduction equipment are small, and the equipment can be made small.

In the aforementioned embodiment, the material 1 to be pressed has been assumed to move only in the forward direction, but the amount of the reduction can be increased to twice as much by feeding the material backwards and then pressing again.

As can easily be understood from the above description, according to the present invention, the pressing length of each of a plurality of reduction press machines is made short, and the machines press the material sequentially, so that two or more machines will not be working at the same time, therefore the loads applied to the entire reduction press equipment are small and the equipment becomes compact.

(Twenty-Third Embodiment)

Figure 77:
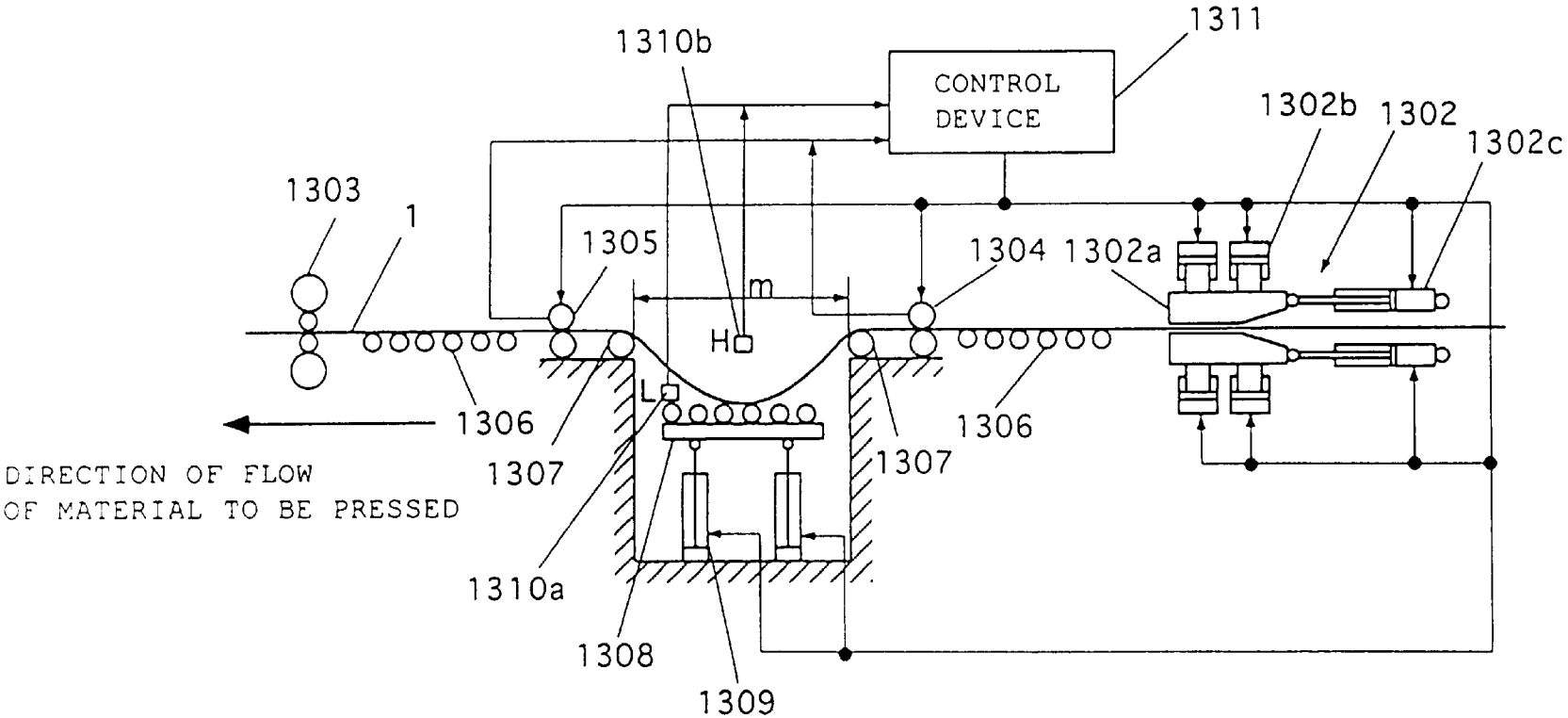
FIG. 77 shows the configuration of the twenty-third embodiment of the present invention.

FIG. 77 shows the configuration of the plate reduction press apparatus of the twenty-third embodiment. A flying press machine 1302 is installed in the upstream direction of the flow of a material 1 to be pressed, and a rolling mill 1303 is installed in the downstream direction of the flow. The flying press machine 1302 is provided with dies 1302*a* that press the material 1 to be pressed, pressing cylinders 1302*b* that depress the dies 1302*a*, and transfer cylinders 1302*c* that move the dies 1302*a* and the pressing cylinders 1302*b* backwards and forwards in the direction of flow of the material to be pressed. The rolling mill 1303 is either a roughing-down mill and a finishing rolling mill, or a finishing rolling mill. Press-side speed adjusting rolls 1304 are provided on the downstream side of the flying press machine 1302, and rolling-mill-side speed adjusting rolls 1305 are installed on the upstream side of the rolling mill 1303, between the flying press machine 1302 and the rolling mill 1303. For the speed adjusting rolls 1304, 1305, pinch rolls, and measuring rolls, etc. are provided, which adjust the speed of the material 1 to be transferred and pressed and also measure the length of the material passed. Transfer tables 1306 are installed between the flying press machine 1302 and the press-side speed adjusting rolls 1304 and between the rolling mill 1303 and the rolling-mill-side speed adjusting rolls 1305.

Guide rolls 1307 are provided with a spacing m between each other, between the press-side speed adjusting rolls 1304 and the rolling-mill-side speed adjusting rolls 1305, and this space between the two guide rolls 7 constitutes a section m in which the material 1 to be pressed is deflected. In the deflection section m, a pit has been formed in the foundations in which an up/down table 1308 with rollers for transferring the material 1 to be pressed is installed and can be raised and lowered by means of up/down cylinders 1309 provided under the table. In the deflection section m, there is a low-position detector 1310*a* that detects the occurrence of a large deflection and a high-position detector 1310*b* that detects the occurrence of a small deflection. A control device 1311 controls the flying press machine 1302, the press-side speed adjusting rolls 1304, the rolling-mill-side speed adjusting rolls 1305, and the up/down cylinders 1309 based on data for the lengths passing the press-machine side speed adjusting rolls 1304 and the rolling-mill-side speed adjusting rolls 1305 and deflection data from the low-position detector 1310*a* and the high-position detector 1310*b*.

Next, the operations are described. First, the up/down table 1308 is positioned at the highest level, that is, the rolls of the up/down table 1308 are on the same level as the level of the guide rolls 1307, by means of the up/down cylinders 1309, and then the flying press machine 1302 is operated to reduce the material 1 to be pressed and feed the material to the rolling mill 1303. At the rolling mill 1303, continuous rolling begins. When the material 1 to be pressed enters between the rolling-mill-side speed adjusting rolls 1305, the up/down table 1308 is lowered to the lowest position to enable the material to be deflected. At the same time, the press-side speed adjusting rolls 1304 and the rolling-mill-side speed adjusting rolls 1305 provide data for the lengths passed, and the low position detector 1310*a* and the high position detector 1310*b* provide data about the deflection, and these data are input to the control device which determines the difference between the lengths passed, that is, the difference between two lengths passed during one cycle or a plurality of cycles of the flying press machine, and the control device adjusts the transfer speeds of the material 1 to be pressed by the press-side speed adjusting rolls 1304 and the rolling-mill-side speed adjusting rolls 1305, and increases or decreases the number of operating cycles in a predetermined time period, and so forth. These three adjustments are performed by selecting either one, two or three of them. In addition, data from the low position detector 1310*a* and the high position detector 1310*b* are monitored continuously, and the deflection data is checked to see if the deflection remains within a predetermined range, and if not, the speed adjusting rolls 1304, 1305 adjust the deflection to keep it in the range. When the trailing end of the material 1 to be pressed approaches the press-side speed adjusting rolls 1304, the up/down cylinders 1309 are operated in such a manner that the position of the rollers on the up/down table 1308 match the guide rolls 1307.

Figure 78:
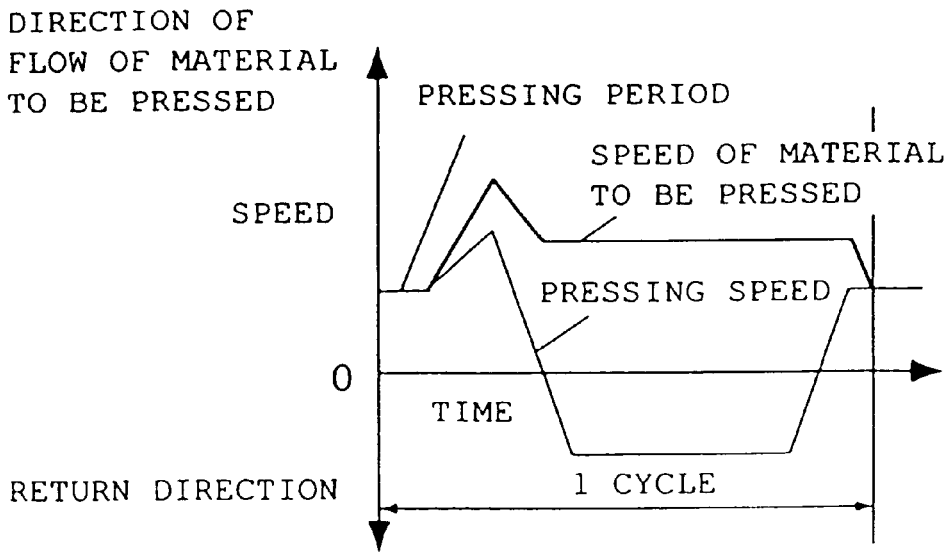
FIGS. 78(A) and 78(B) show the speed of the material to be pressed in the twenty-third embodiment; (A) the transfer speed of the material to be pressed at the outlet of the flying press machine, and (B) the transfer speed at the inlet of the rolling mill.
Figure 78:
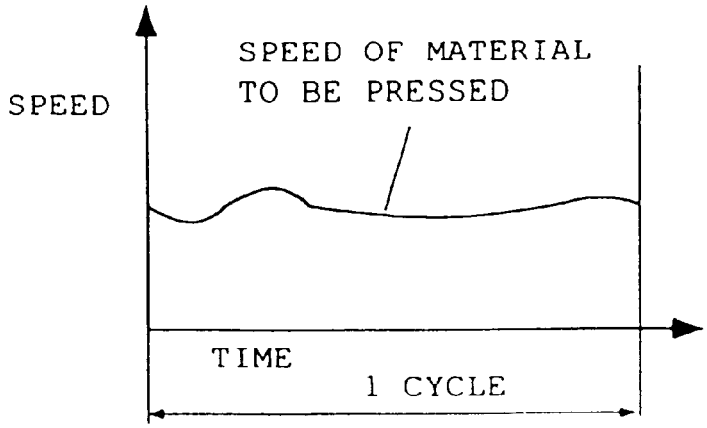

FIG. 78(A) shows the variations in the speed of the material to be pressed at the inlet of the press-side speed adjusting rolls, and (B) shows the speed at the outlet of the rolling-mill-side speed adjusting rolls 1305. The transfer speed of the material 1 to be pressed, as it passes through the flying press machine 1302, is adjusted by the press-side speed adjusting rolls 1304, and the speed of the material 1 to be pressed, sent into the rolling mill 1303, is adjusted by the rolling-mill-side speed adjusting rolls 1305. In (A), the pressing period is determined by the transfer cylinders so that an optimum transfer speed for pressing is established, and the press-side speed adjusting rolls 1304 are adjusted to establish this speed. After pressing, the transfer speed is increased from the low speed used during pressing, and then after the speed is decreased to the normal transfer speed and maintained at that speed, the speed is reduced to the pressing speed for the next cycle. The dies 1302*a* and the pressing cylinders 1302*b* are moved by the transfer cylinders 1302*c* in such a manner that during a predetermined period from before pressing, during pressing and after pressing, the dies and the cylinders move in the direction of flow of the material 1 to be pressed and then return to the upstream side. The press-side speed adjusting rolls 1304 adjust the transfer speed during the period other than the pressing period (the period in which the dies 1302*a* are separated from the material 1 to be pressed). The rolling-mill-side speed adjusting rolls 1305 adjust the transfer speed of the material 1 to be pressed so as to convey the material at as even a speed as possible to the rolling mill 1303.

(Twenty-Fourth Embodiment)

Figure 79:
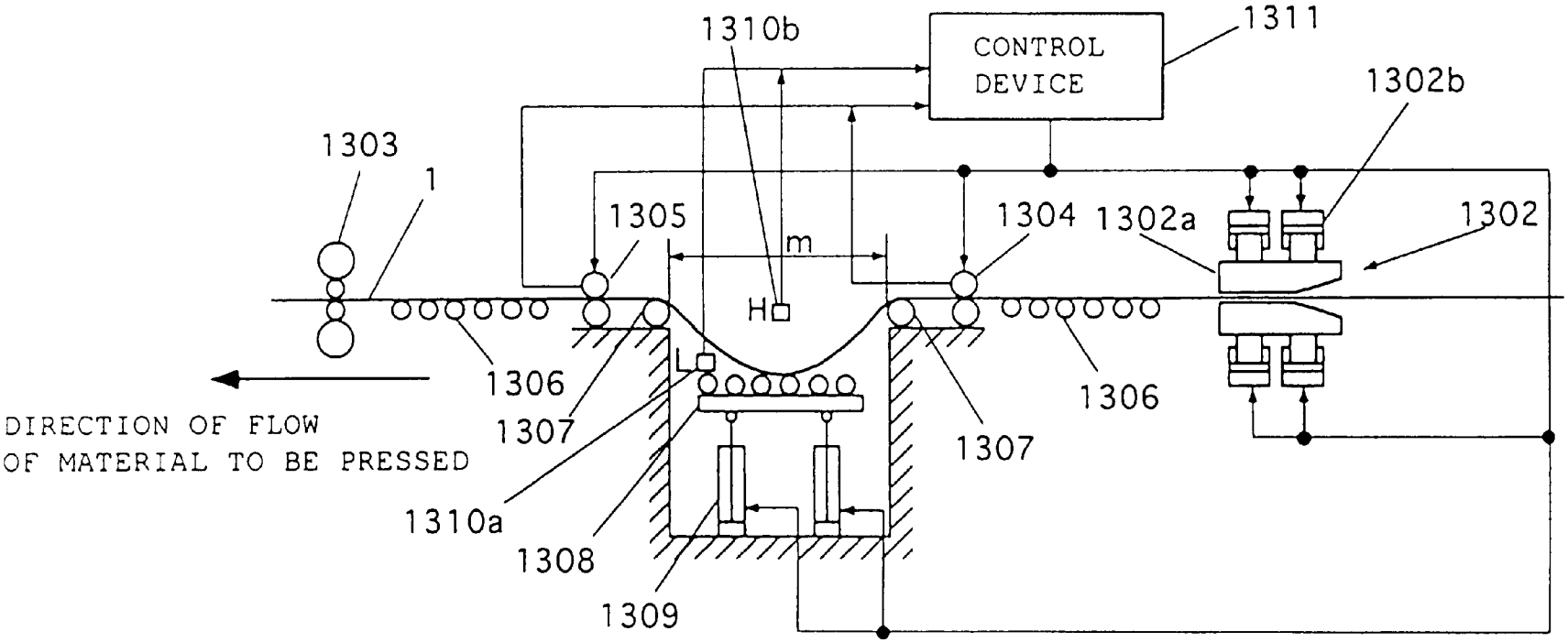
FIG. 79 shows the configuration of the twenty-fourth embodiment of the present invention.
Figure 80:
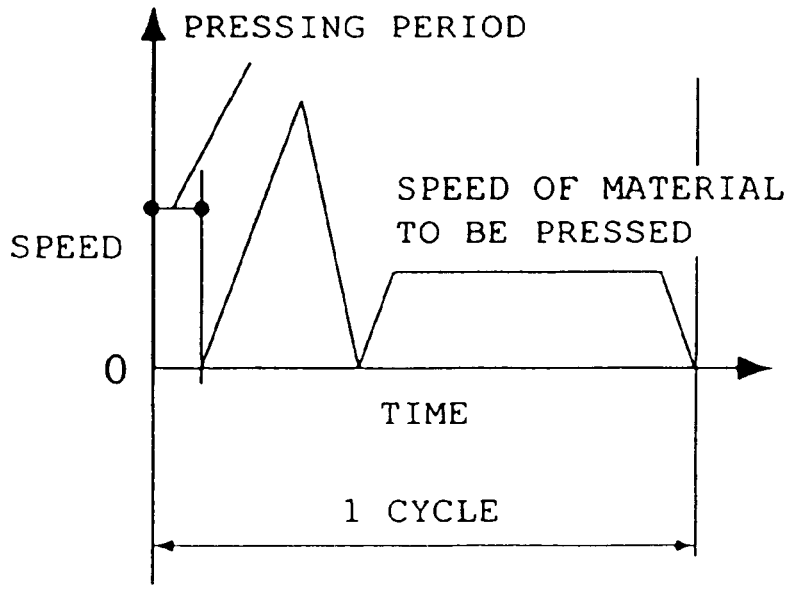
FIGS. 80(A) and 80(B) show the speed of the material to be pressed in the twenty-fourth embodiment; (A) the transfer speed of the material to be pressed at the outlet of the flying press machine, (B) the transfer speed at the inlet of the rolling mill.
Figure 80:
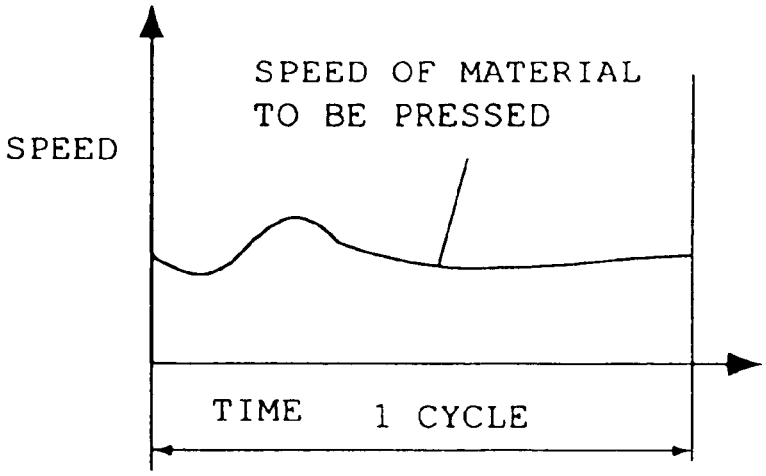

The twenty-fourth embodiment is described next. FIG. 79 shows the configuration of the plate reduction press apparatus according to the twenty-fourth embodiment. Item numbers refer to the same components as those in FIG. 77. The present embodiment is different from the embodiment shown in FIG. 77, in that a start-stop reduction press machine 1320 is used in place of the flying press machine 1302 shown in FIG. 77, in which transfer of the material 1 to be pressed is stopped during pressing, and the other details of the configuration are same. Because the transfer speed adjusting methods are considerably different for the two embodiments, the method is described by referring to FIG. 80. FIG. 80(A) shows the transfer speed of the material 1 to be pressed as it passes through the reduction press machine 1320. One cycle means that of the reduction press machine 1320. The transfer speed during the pressing period is 0. After completing the pressing of the material, the transfer speed is increased abruptly to recover the delay caused by pressing, and then it is decreased sharply down to the normal speed. When the next cycle of pressing approaches, the speed is adjusted to close to zero. At the rolling-machine-side speed adjusting rolls 1305, as shown in (B), the deflection absorbs a length of the material when the transfer speed suddenly changes, and the material 1 to be pressed is fed into the rolling mill 1303 at a speed as uniform as possible, but the deflection changes depending on the magnitude of the speed change. Therefore, the plate reduction press apparatus according to the present embodiment can be applied also to a start-stop reduction press machine as well as a flying press machine 1302.

Obviously from the above, according to the present invention, a press machine and a rolling mill can be operated simultaneously to press and roll a material, respectively, by adjusting the transfer speed of the material to be pressed, when the material flows through the upstream press machine and the downstream rolling mill.

(Twenty-Fifth Embodiment)

Figure 81:
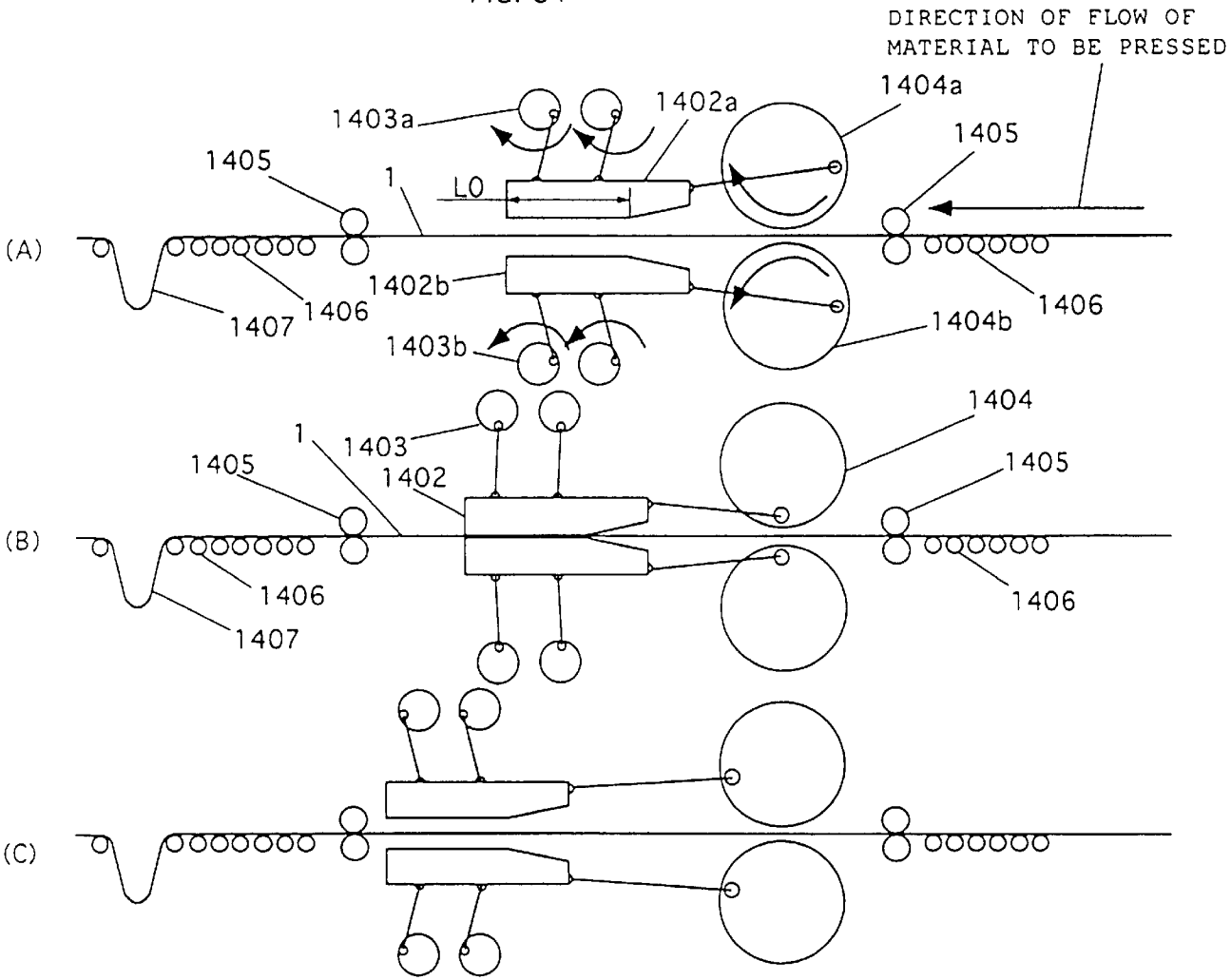
FIGS. 81(A) and 81(B) show the configuration of the twenty-fifth embodiment of the present invention.

FIG. 81 is a view showing the configuration and operations of the plate reduction press apparatus according to the twenty-fifth embodiment of the present invention. Dies 1402 are provided above and below a material 1 to be pressed, and the dies 1402 are moved up and down by crank devices 1403 and press the material 1. The dies 1402 and the crank devices 1403 are moved backwards and forwards in the direction of flow of the material to be pressed, by means of reciprocating crank devices 1404. The crank devices 1403 and the reciprocating crank devices 1404 are operated in synchronism with each other. Item numbers indicate various components; 1402*a* for an upper die, 1402*b* for a lower die, 1403*a* for an upper crank device, 1403*b* for a lower crank device, 1404*a* for an upper reciprocating crank device, and 1404*b* for a lower reciprocating crank device. Pinch rolls 1405 are arranged upstream and downstream of the dies 1402, and control the transfer speed of the material 1 to be pressed, and are controlled by a control device not illustrated. Transfer tables 1406 are installed near the pinch rolls 1405 and transfer the material 1 to be pressed. A looper 1407 is provided downstream of the downstream pinch rolls 1405 and the downstream transfer table 1406, on the downstream side of the dies 1402, and the looper holds up a length of the material 1 to be pressed in a loop, to cope with the transfer speed of the material 1 to be pressed in a subsequent system. The transfer device specified in the claim 56 refers to the pinch rolls 1405.

Figure 82:
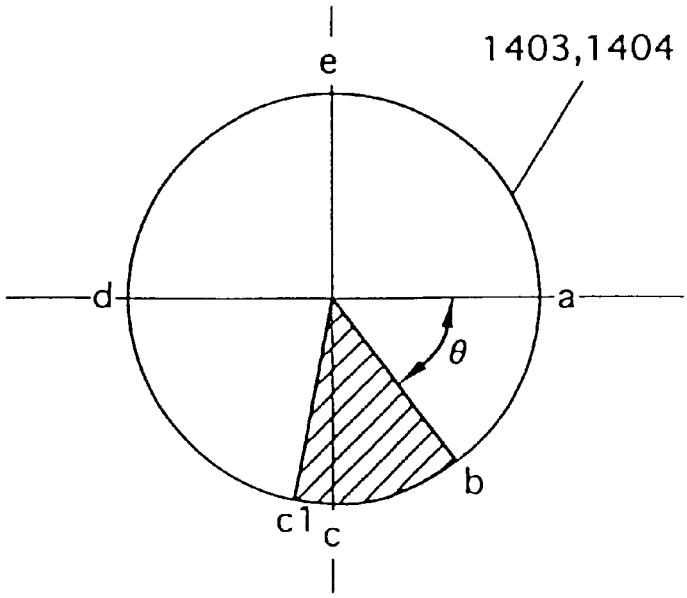
FIG. 82 shows the crank angle θ and the pressing range of the crank device.
Figure 83:
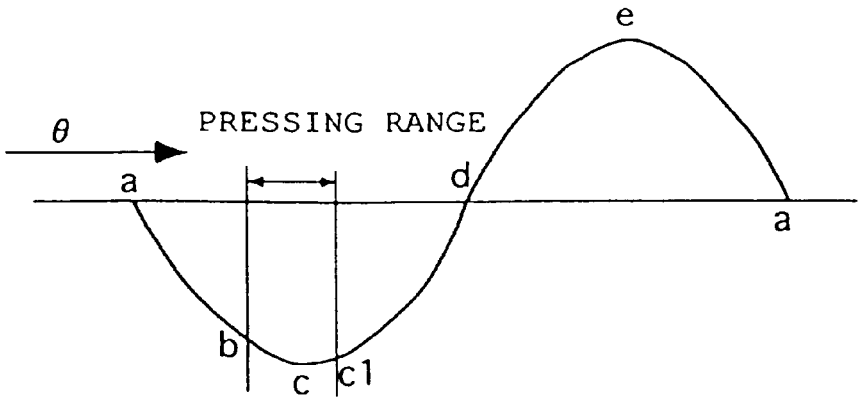
FIG. 83 is a diagram developed from FIG. 82, with the crank angle θ on the x-axis.
Figure 84:
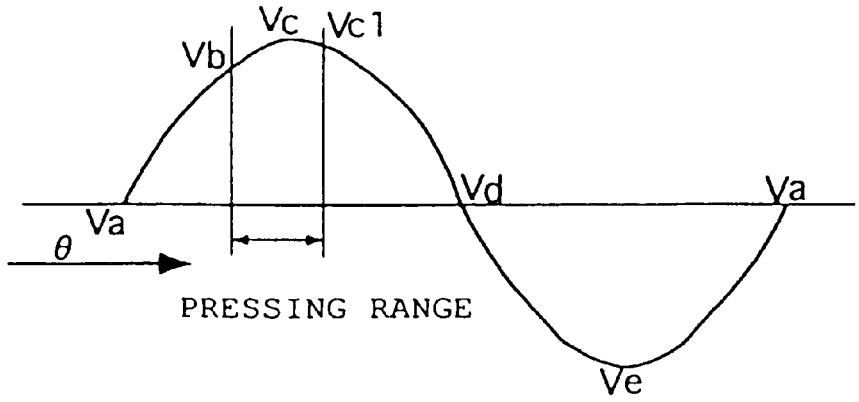
FIG. 84 shows the speed of the reciprocating motion of the dies.

FIG. 82 is a diagram describing the operations of the crank devices 1403. 1404. FIG. 83 is a curve showing the operations of the crank devices 1403 shown in FIG. 82, developed along the crank angle θ, and FIG. 84 is a diagram showing the speed of the material 1 to be pressed in the direction of flow by the dies 1402 driven by the reciprocating crank devices 1404 in FIG. 82, as a function of the crank angle θ. In FIG. 82, the letter c denotes the bottom dead center of the upstream crank devices 1403*a* or the top dead center of the downstream crank devices 1403*b*, and the material 1 to be pressed is reduced by the dies 1402 in a range of crank angles θ from b to c1, which includes the point c. The speed of the dies 1402 during pressing in the direction of flow of the material to be pressed is shown in FIG. 84; Vb, Vc, and Vc1 indicate the speeds at the points b, c, and c1, respectively.

Figure 85:
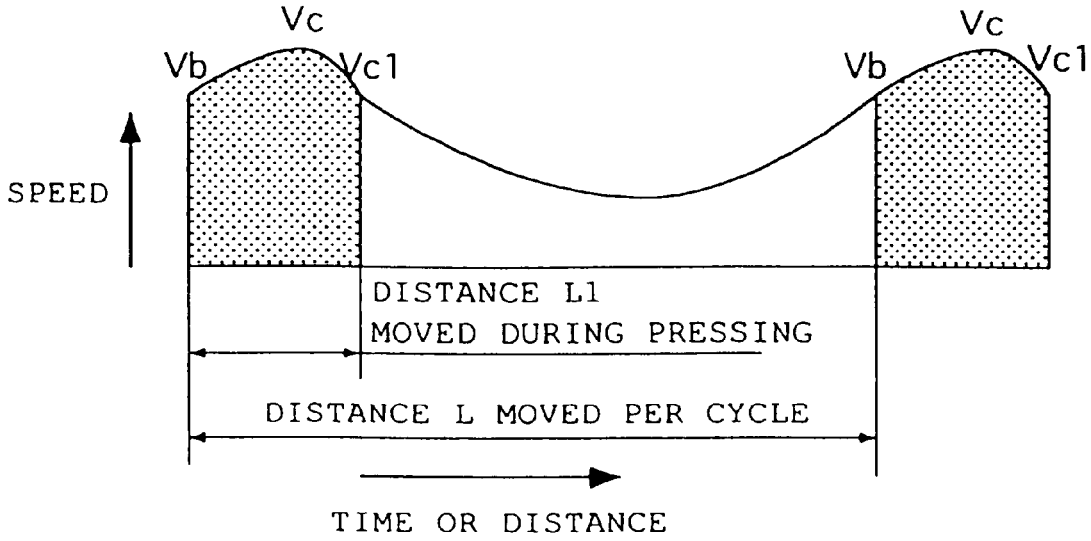
FIG. 85 shows the speed variations of the transfer devices.

FIG. 85 shows the transfer speed of the material 1 to be pressed, transferred by the pinch rolls 1405. Vb, Vc and Vc1 indicate the speeds of the dies 1402, shown in FIG. 84. The pinch rolls 1405 convey the material 1 to be pressed at the same speed as the speed of the dies 1402 moved by the reciprocating crank devices 1404 when the crank devices 1403 are causing the dies 1402 to press. In other words, the speed becomes Vb when pressing begins, the same as the dies 1402, and after reaching the maximum speed Vc, it becomes Vc1, i.e. the speed when pressing ends, and after that, the speed changes to the original speed Vb for the beginning of the next pressing operation. The pinch rolls 1405 are controlled in such a manner that the length L is less than the effective pressing length L0 of the dies 1402 shown in FIG. 81, where one cycle of the pinch rolls is defined by the time period from the speed Vb when pressing starts to the next speed Vb when pressing starts again, and L represents the distance moved by the material 1 to be pressed during one cycle. As described above, the length L of the material 1 to be pressed is reduced during one cycle of the pinch rolls 1405 (which is the same length as that of one cycle of the crank devices 1403).

In FIG. 81, (A) shows the status at point a, (B) shows the conditions during pressing from point b to c1, and (C) shows the conditions at point d, corresponding to d in FIG. 82. The material is pressed sequentially by the length L each cycle, while repeating steps (A), (B) and (C).

(Twenty-Sixth Embodiment)

Figure 86:
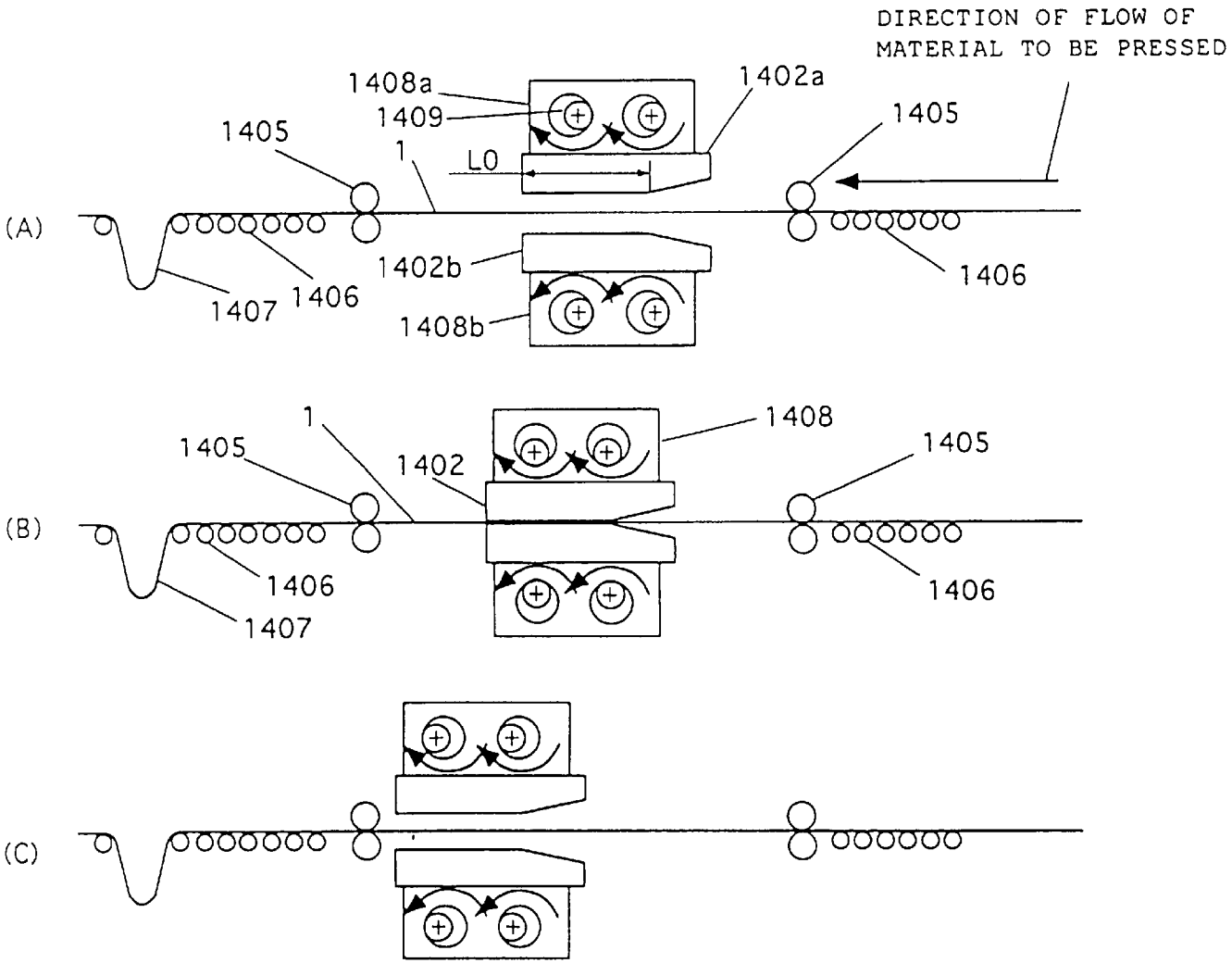
FIGS. 86(A), 86(B) and 86(C) are views showing the configuration of the twenty-sixth embodiment of the present invention.

The twenty-sixth embodiment is described next. FIG. 86 is a view showing the configuration of the twenty-sixth embodiment. The twenty-sixth embodiment is provided with the two-dimensional crank devices 1408 which drive the dies 1402 backwards and forwards (the direction of transfer and the direction opposite to the direction of transfer) as well as in the up and down direction. In other words, the two-dimensional crank devices 1408 function like a combination of the crank devices 1403 and the reciprocating crank devices 1404 in the twenty-fifth embodiment. The two-dimensional crank devices 1408 move up, down, and backwards and forwards as they are connected eccentrically to the rotating shafts 1409. Although the operations are the same as those of the crank devices 1403 and the reciprocating crank devices 1404, the amplitude of the movement in the up and down direction is the same as the amplitude of the movement in the backward and forward direction. Except for the crank devices 1408 the components are the same as those of the twenty-fifth embodiment.

(Twenty-Seventh Embodiment)

Figure 87:
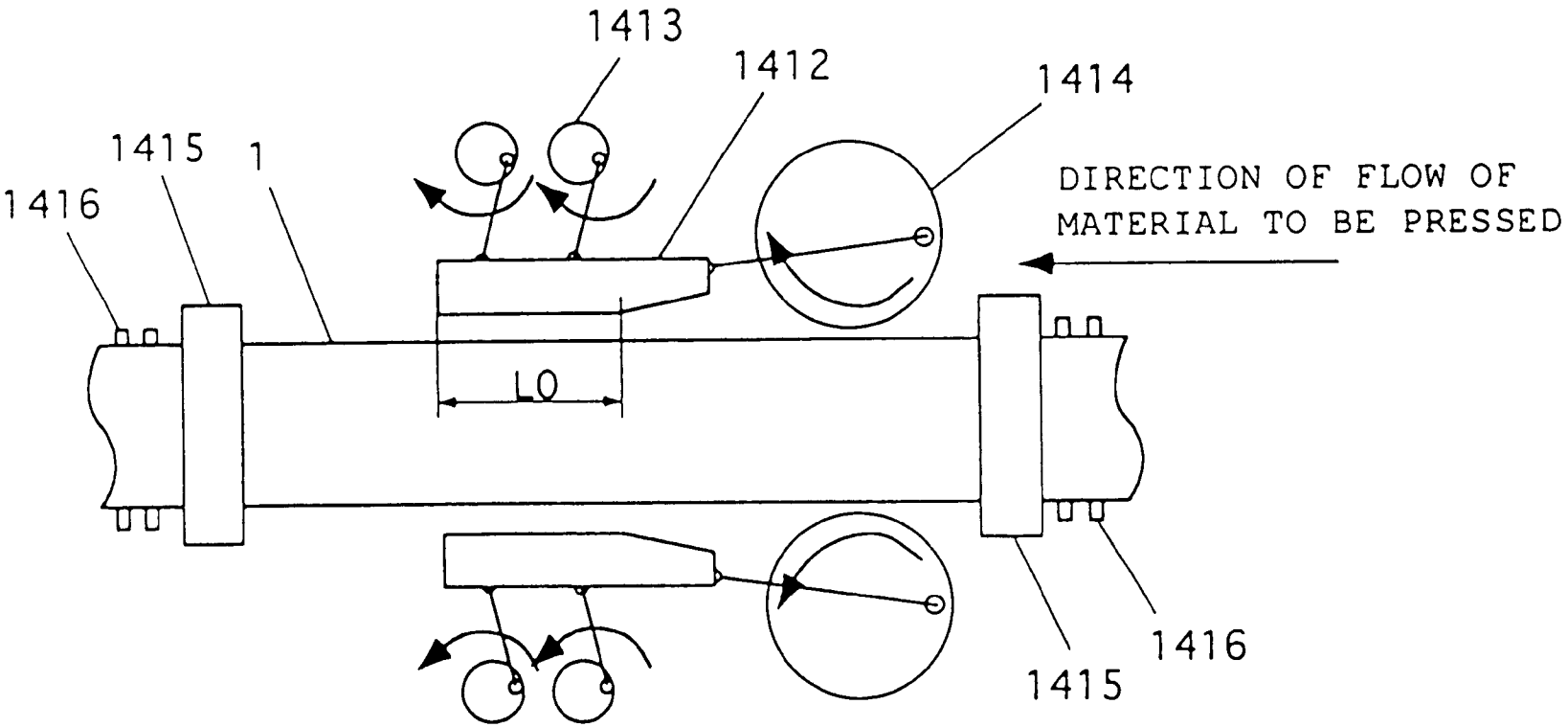
FIG. 87 is a view showing the configuration of the twenty-seventh embodiment of the present invention.

The twenty-seventh embodiment is explained below. FIG. 87 is a view showing the configuration of the crank type stentering press machine. Stentering dies 1412 are provided at both lateral ends with a material 1 to be pressed between them, and the dies 1412 press the material 1 to be pressed in the lateral direction by means of the lateral crank devices 1413. The lateral dies 1412 and the lateral crank devices 1413 are moved backwards and forwards in the direction of flow of the material to be pressed, by means of the reciprocating lateral crank devices 1414. The lateral crank devices 1413 and the reciprocating lateral crank devices 1414 operate in synchronism together. Pinch rolls 1415 are arranged upstream and downstream of the stentering dies 1412, and control the transfer speed of the material 1 to be pressed, and are controlled by a control device not illustrated. Transfer tables 1416 are provided near the pinch rolls 1415 and transfer the material 1 to be pressed. Although not illustrated, a looper 1417 is arranged downstream of the downstream pinch rolls 1415 of the stentering dies 1412 and the transfer table 1416, in which the material 1 to be pressed is looped and a surplus length thereof is retained, to match the transfer speed of the material 1 conveyed to a subsequent machine. The reciprocating devices specified in claim 58 correspond to the reciprocating lateral crank devices 1414, and the transfer devices are represented by the pinch rolls 1415. Operations of the twenty-seventh embodiment are substantially the same as those of the twenty-fifth embodiment.

In the above descriptions of the twenty-fifth and twenty-seventh embodiments, the reciprocating devices were described as crank devices, but hydraulic cylinders, ball screws, etc. may also be used to give the reciprocating motions.

As shown in the descriptions above, the present invention provides the following advantages as the dies are driven by the crank devices to press the material, and the material is transferred in synchronism with the reciprocating speed during pressing, using transfer devices.

(1) Because the speed of the material to be pressed does not change so much during transfer, no large-capacity transfer devices such as pinch rolls and transfer tables are required.

(2) No high-capacity swinging devices are needed because there are no heavy sliders such as those used in a flying system (3) Vibration is moderate because of (2) above.

(4) The apparatus according to the present invention can be easily operated together with a subsequent machine by using a looper etc.

(Twenty-Eighth Embodiment)

Figure 88:
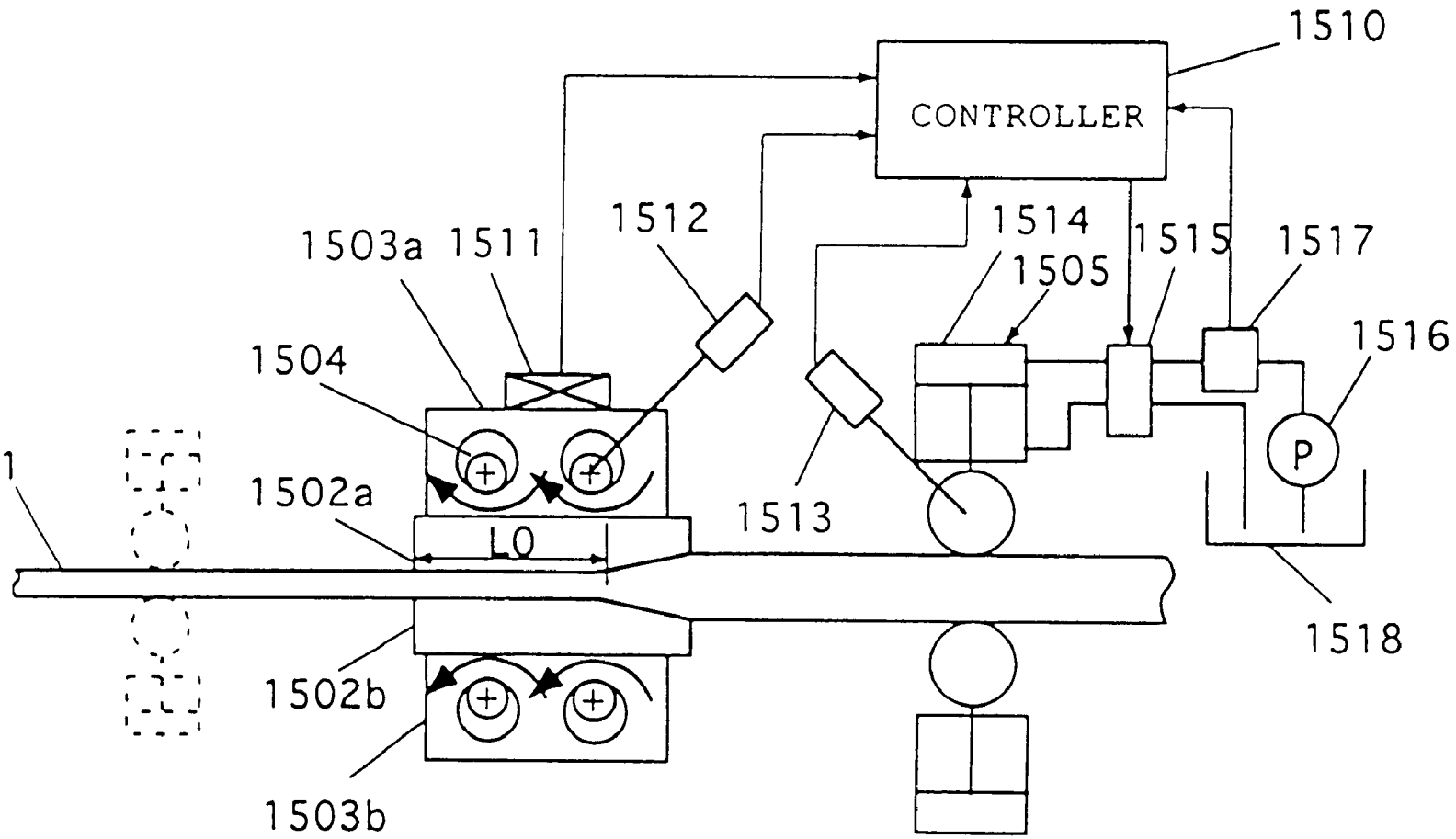
FIG. 88 is a view showing the configuration of the twenty-eighth embodiment of the present invention.
Figure 89:
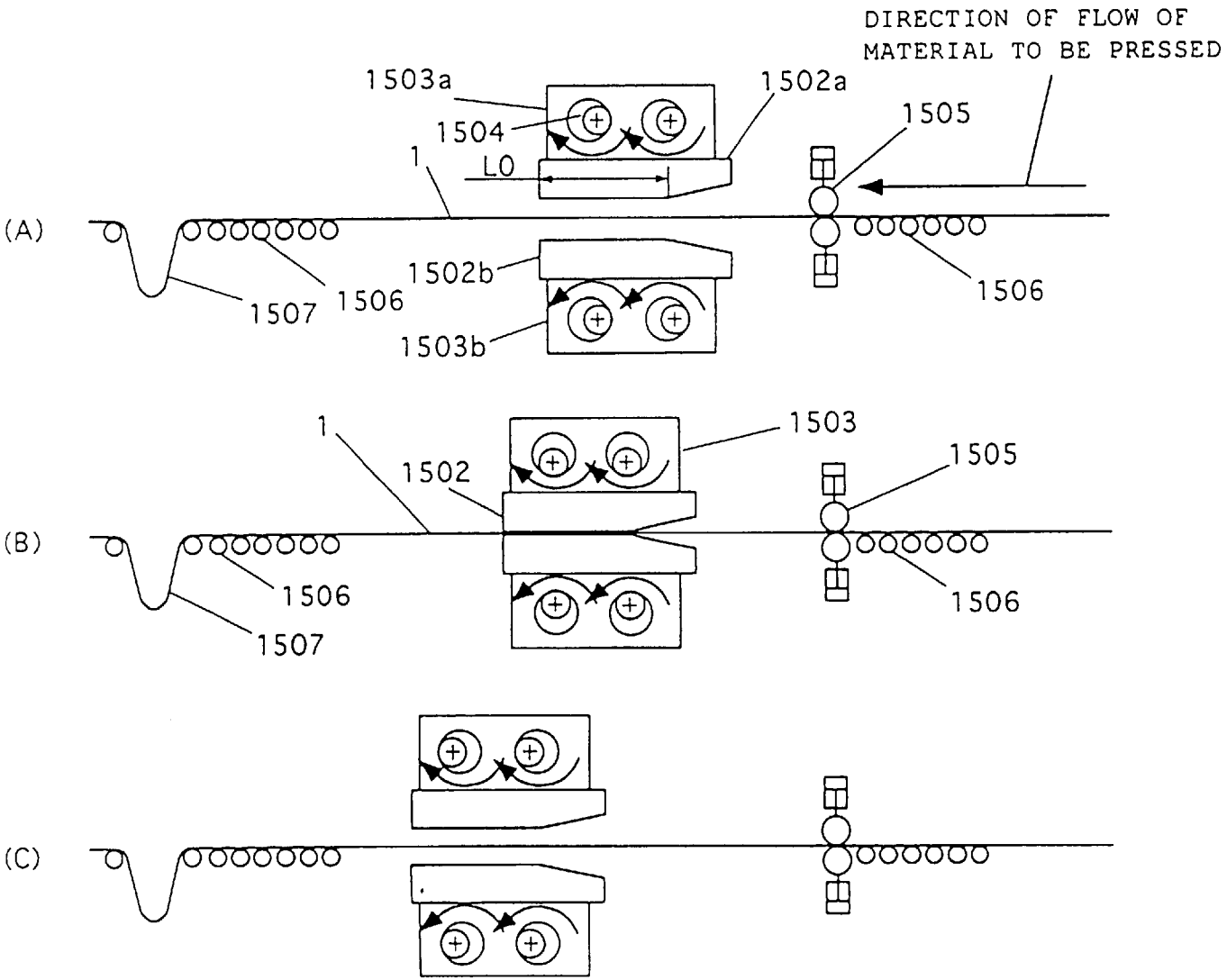
FIGS. 89(A), 89(B) and 89(C) show one cycle of operation of a press machine.

FIG. 88 is a view showing the plate reduction press apparatus of the twenty-eighth embodiment. FIG. 89 shows the operation of the twenty-eighth embodiment. Dies 1052 are arranged above and below a material 1 to be pressed, and the dies 1502 are connected to eccentric portions of the crank shafts 1504 of the crank devices 1503. The crank devices 1503 are provided with eccentric portions rotated by the crank shafts 1504, and move the dies 1502 up and down, while moving them backwards and forwards in the direction of flow of the material to be pressed. Item numbers refer to components, such as 1502*a* for the upper die, 1502*b* for the lower die, 1503*a* for the upper crank devices, and 1503*b* for the lower crank devices. Pinch rolls 1505 are installed upstream of the dies 1502 and control the transfer speed of the material 1 to be pressed, and are controlled by a controller 1510. Pinch rolls may also be installed downstream of the dies 1502. As shown in FIG. 89, transfer tables 1506 are arranged in the vicinity of and on the upstream side of the pinch rolls 1505, and on the downstream side of the dies 1502, and convey the material 1 to be pressed. A looper 1507 is arranged downstream of the downstream transfer table 1506, and retains the material 1 to be pressed in the shape of a loop, to match the speed of processing the material 1 to be pressed in a subsequent system.

In FIG. 88, the crank device 1503 is provided with a load cell 1511 which measures the pressing force applied to the die 1502*a*. A crank shaft rotation sensor 1512 is also provided and measures the rotation of the crank shaft. Measurement data from the load cell 1511 and the crank shaft rotation sensor 1512 are transmitted to the controller 1510.

The pinch rolls 1505 are equipped with a pinch roll rotation sensor 1513 that measures the rotation of the pinch rolls 1505, and outputs the measurement to the controller 1510. The pinch rolls 1505 are provided with a cylinder 1514 for pressing the material 1 to be pressed, a changeover valve 1515 for switching the direction of supplying fluid to the cylinder 1514, a pump 1516 for supplying pressurized fluid, a regulating valve 1517 to reduce the output pressure of the pump 1516, and a tank 1518 for storing the fluid. The regulating valve 1517 is controlled by the controller 1510, to change the pressure of the pinch rolls 1505 applied to the material 1 to be pressed, to P1 or P2.

Figure 90:
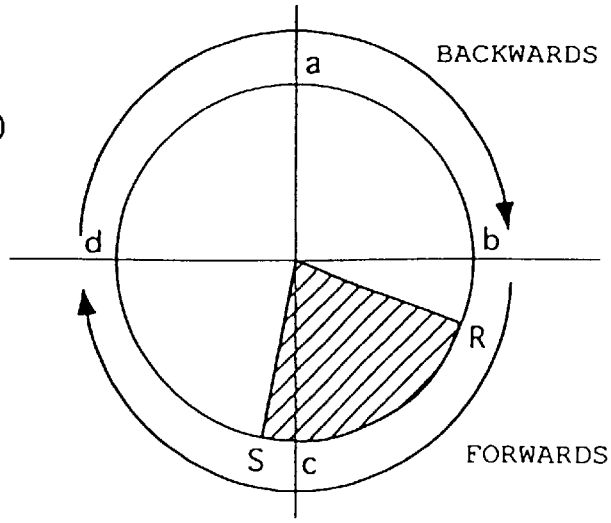
FIG. 90 shows the crank angle θ and the pressing range of the crank devices.

The operations are described next. FIG. 89 shows the operations of the crank devices 1503 and the dies 1502 during a period of one revolution of the crank shafts 1504 of the crank devices 1503 (this period is defined as one cycle). FIG. 90 is a diagram showing the relationship between the angle of rotation and pressing for the crank shafts 1504 of the crank devices 1503. The operations of the upper crank device 1503*a* are described. The operations of the lower crank device 1503*b* are the same as those of the upper crank device 1503*a* as far as backward and forward movements are concerned (movement in the downstream direction is considered the forward movement), although the up and down movements are in the opposite direction. Points a, c, b and d represent top dead center, bottom dead center, most upstream point and most downstream point, respectively, of the movement of the dies 1502. The starting point of a cycle is point b, and in the range b–c–d, movement is in the forward direction, and in the range d–a–b, movement is in the backward direction. From the time R, the material 1 begins to be pressed and pressing is completed at S after passing c. FIG. 89(A) shows the status at point b, and (B) at point c and (C) at point d. The distance between points b and d is the distance that the dies move in one cycle. The distance L that the material 1 to be pressed moves in a cycle is adjusted so as not to exceed the effective pressing length L0 of the dies 1502 in the transfer direction, to assure complete pressing.

Figure 91:
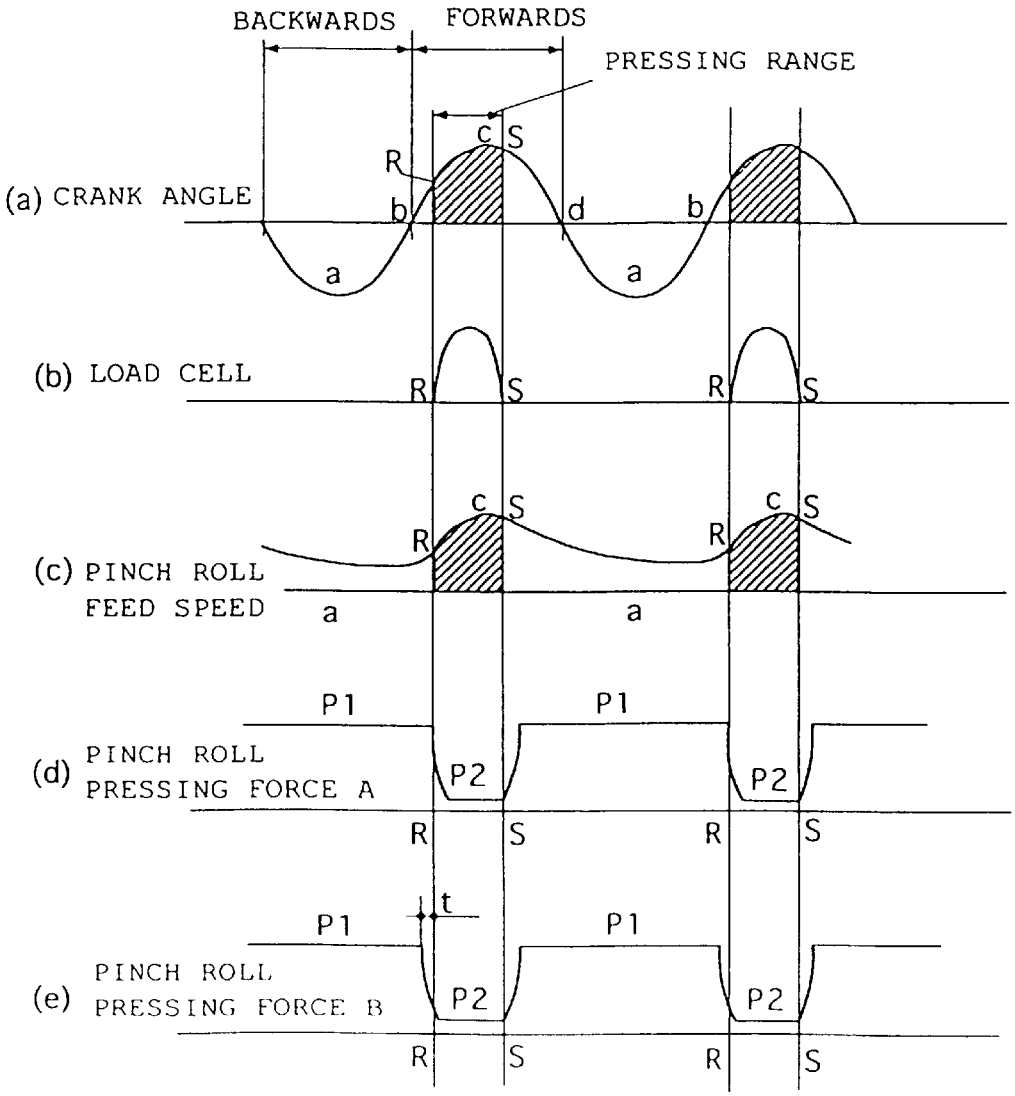
FIGS. 91(A), 91(B), 91(C), 91(D) and 91(E) show the operation of the twenty-eighth embodiment.

FIG. 91 shows the output of the load cell 1511, the crank shaft rotation sensor 1512 and pinch roll rotation sensor 1513, and the pressing force on the pinch rolls 1505, adjusted by controlling the regulating valve 1517 with the controller 1510 using the measurement data. (a) Is a graph of the movements or speeds of the dies 1502 as a function of the crank angle, obtained by developing FIG. 90 along the crank angle. The pressing range R to S is shown by the hatched areas. (b) shows the outputs of the load cell, produced during the pressing range R to S with a peak intermediate between R and S. (c) shows the feeding speeds of the pinch rolls 1505; the speed in the pressing range R to S is the speed of the dies 1502 between R and S, plus or minus the elongation speed of the material 1 due to pressing, and when the pinch rolls 1505 are located on the upstream side of the dies 1502 as shown in FIG. 88, the elongation speed in the upstream direction is subtracted from the transfer speed to compensate for the speed of the material extending in the upstream direction, and when the rolls are located the downstream side as shown in FIG. 90, the elongation speed in the downstream direction is added to the transfer speed to correct for the speed of the material extending in the downstream direction.

The status shown in (d) is that the controller 1510 has detected the point R where pressing begins by means of the crank shaft rotation sensor 1512, or has detected the point R when the pressing load increases by means of the load cell 1511, and the controller has reduced the pressing force of the pinch rolls 1505 from P1 to P2 which is lower than P1, and then at the point S where pressing ends, the force has been returned to the original value P1. By decreasing the pressing force of the pinch rolls 1505 as described above, the material 1 to be pressed, the press machine and pinch rolls 1505 can be protected from the occurrence of flaws or damage even if the combination speed of the speed of the dies 1502 subtracted by the elongation speed of the material deviates from the speed of the pinch rolls 1505. In the above, either the load cell 1511 or the crank shaft rotation sensor 1512 has to be provided.

(e) shows a case in which the controller 1510 detects an angle at a time earlier than the point R where pressing begins by a time t by means of the crank shaft rotation sensor 1512, and at that time, the pressing force of the pinch rolls 1505 has been reduced from P1 to P2 lower than P1, and at the point S where pressing ends, the pressing force has been returned to the original value P1. Thus, the pinch rolls 1505 reduce the gripping force on the material 1 to be pressed before the dies 1502 catch the material 1, so that the material 1 to be pressed can be firmly caught by the dies 1502 without slipping. As in the case of (d), the material 1 to be pressed, the press machine and the pinch rolls 1505 can be protected from the occurrence of flaws or damage even if the combination speed of the speed of the dies 1502 subtracted by the elongation speed of the material differs from the speed of the pinch rolls 1505.

(Twenty-Ninth Embodiment)

Figure 92:
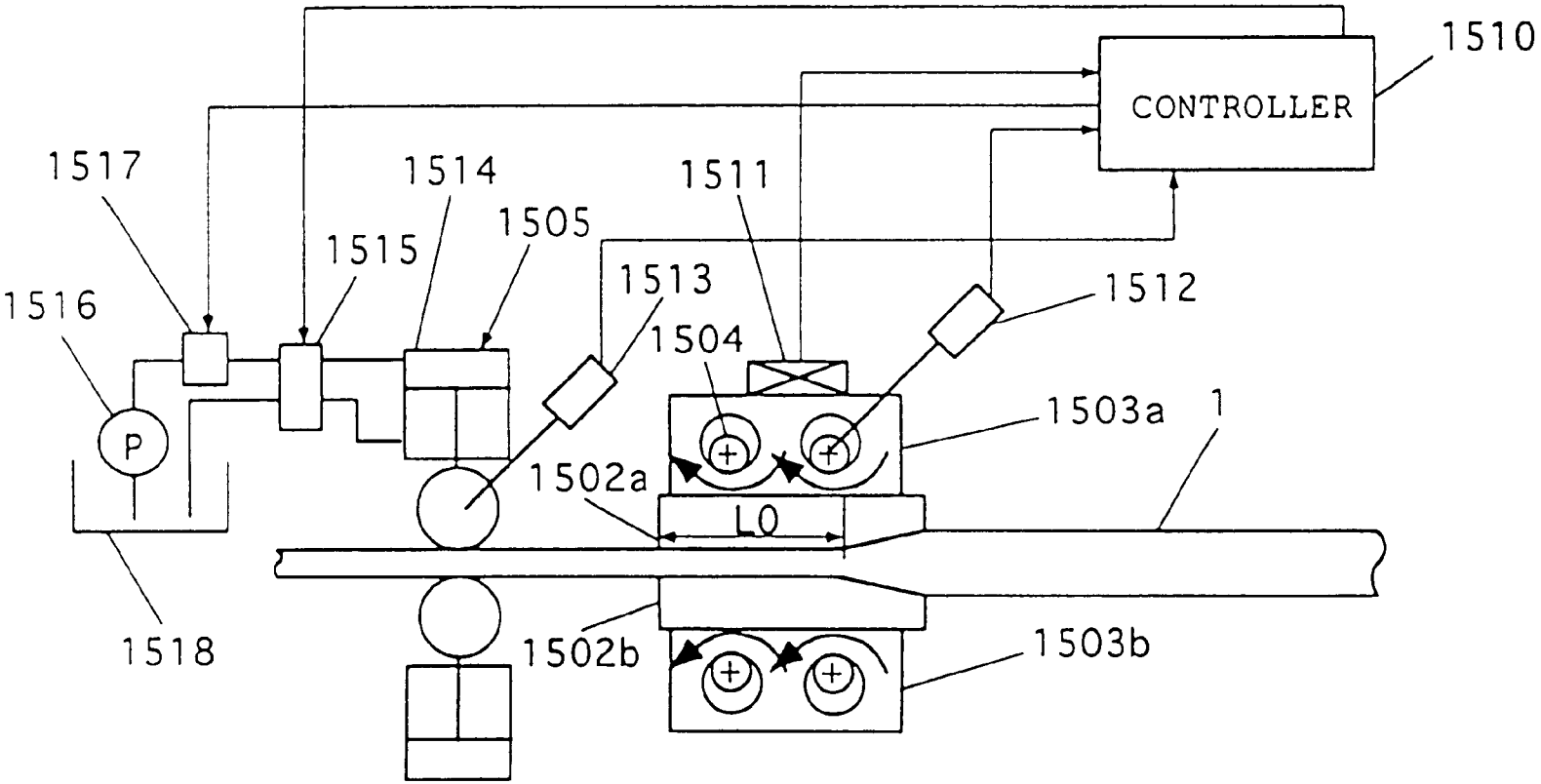
FIG. 92 shows the configuration of the twenty-ninth embodiment of the present invention.

FIG. 92 shows the twenty-ninth embodiment. With the present embodiment, the pinch rolls 1505 of the twenty-eighth embodiment shown in FIG. 88 are changed to the downstream side of the dies 1502, and all other components are the same as those of the twenty-eighth embodiment. According to such a downstream arrangement, the transfer speed of the pinch rolls 1505 while the dies 1502 are pressing, becomes the combination speed of the speed of the dies plus the elongation speed of the material 1 to be pressed.

(Thirtieth Embodiment)

Figure 93:
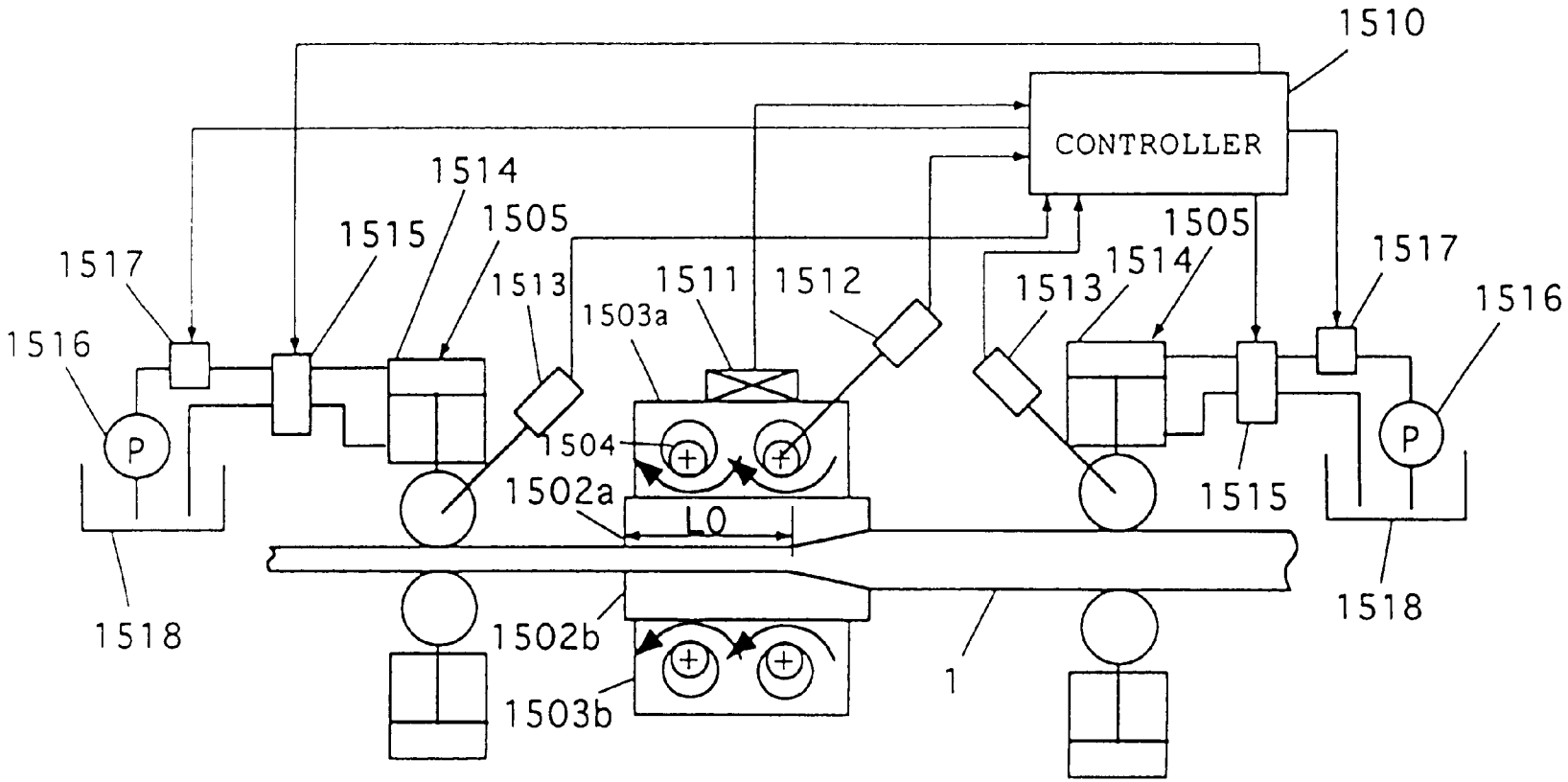
FIG. 93 shows the configuration of the thirtieth embodiment of the present invention.

FIG. 93 illustrates the thirtieth embodiment. The present embodiment combines the twenty-eighth embodiment shown in FIG. 88 and the twenty-ninth embodiment in FIG. 93.

As can easily be understood from the explanation above according to the present invention, the material is transferred while being pressed by the dies, and the pressing force of the pinch rolls is reduced when the dies are pressing, so the following advantages are provided.

(1) Because the transfer speed of the material to be pressed does not change significantly, the transfer devices such as pinch rolls and transfer tables do not need to have a large capacity.

(2) Because no heavy sliders are provided, unlike a flying system, no high-capacity swinging devices are needed.

(3) Even a long (heavy) slab can be securely speeded up and slowed down to feed it precisely at the required rate.

(4) The material to be pressed is protected from being flawed due to slipping without applying an excessive load on the equipment, even when there is a difference between the speeds of feeding the material by the dies and the pinch rolls, during pressing.

(5) Slipping between the material to be pressed and the dies is minimized.

(Thirty-First Embodiment)

Figure 94:
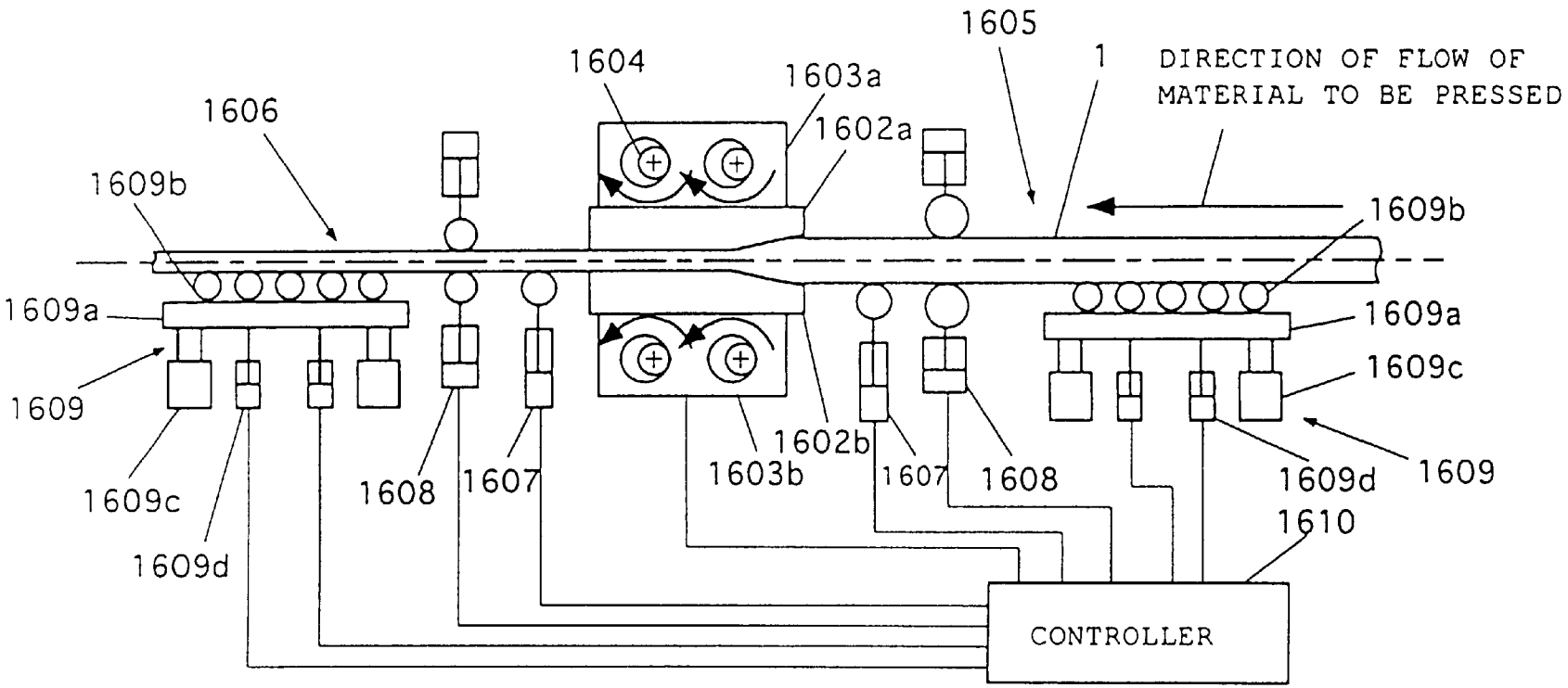
FIG. 94 shows the configuration of the thirty-first embodiment of the present invention.

FIG. 94 shows the configuration of the plate reduction press apparatus of the present embodiment. Dies 1602*a*, 1602*b* are provided above and below a material (slab) 1 to be pressed, and each of the dies 1602*a*, 1602*b* is connected to an eccentric portion of crank shafts 1604 provided on each of the upper and lower crank devices 1603*a*, 1603*b*. The dies 1602*a*, 1602*b* connected to the eccentric portions are driven up and down to press the material 1 to be pressed, while the material is transferred in the direction of flow.

On the upstream and downstream sides of the material 1 to be pressed with respect to the dies 1602*a*, 1602*b*, inlet transfer devices 1605 and outlet transfer devices 1606 are provided, respectively; each of transfer devices 1605, 1606 is composed of, from the closest point to the farthest point from the dies 1602*a*, 1602*b*, feed rolls 1607, pinch rolls 1608 and a transfer table 1609. The feed rolls 1607 are comprised of rolls that convey the material 1 to be pressed and hydraulic cylinders that raise and lower the rolls, thereby the transfer height of the material 1 to be pressed can be adjusted. Although feed rolls 1607 are installed on the upstream and downstream sides of the dies 1602*a*, 1602*b*, a plurality of feed rolls may also be provided. Pinch rolls 1608 are composed of rolls arranged above and below the material 1 to be pressed, and hydraulic cylinders that press each roll, and the pinch rolls pinch and press the material 1 to be pressed; the upstream pinch rolls 1608 push the material into the dies 1602*a*, 1602*b*, and the downstream pinch rolls 1608 pull it out of the dies 1602*a*, 1602*b*.

The transfer table 1609 is composed of a frame 1609*a* extending in the direction of flow of the material 1 to be pressed, a plurality of transfer rollers 1609*b* arranged above the frame 1609*a*, up/down guides 1609*c* that guide the frame 1609*a* when moving up and down, and up/down cylinders 1609*d* for moving the frame 1609*a* up and down. The up and down movement can also be replaced with either a parallel lifting or a tilting method. A controller 1610 controls the crank devices 1603*a*, 1603*b*, the feed rolls 1607, pinch rolls 1608 and transfer tables 1609.

The operation is described next. The controller 1610 is previously provided with information about the thickness of the material to be input and pressed, the amount of reduction during pressing, etc., therefore based on these data, the controller sets the transfer height of feed rolls 1607, pinch rolls 1608 and transfer table 1609 of the inlet transfer device 1605 to the height of the pressing center line (particular to the press machine) subtracted by ½ of the thickness of the material 1 to be pressed, and the controller also sets the transfer height of the feed rolls 1607, pinch rolls 1608 and transfer table 1609 of the outlet transfer device 1606, to the height of the pressing center line subtracted by ½ of the thickness of the material 1 after being pressed. In addition, the upper rolls of the upstream and downstream pinch rolls 1608 are raised to the highest limit, and the upper and lower dies 1602*a*, 1602*b* are also fully opened. Under these circumstances, the material 1 to be pressed is transferred between the dies 1602*a*, 1602*b*, and while the material is being pressed by the upper and lower dies 1602*a*, 1602*b*, the material is fed out in the forward direction (the direction of flow of the material 1 to be pressed).

Figure 95:
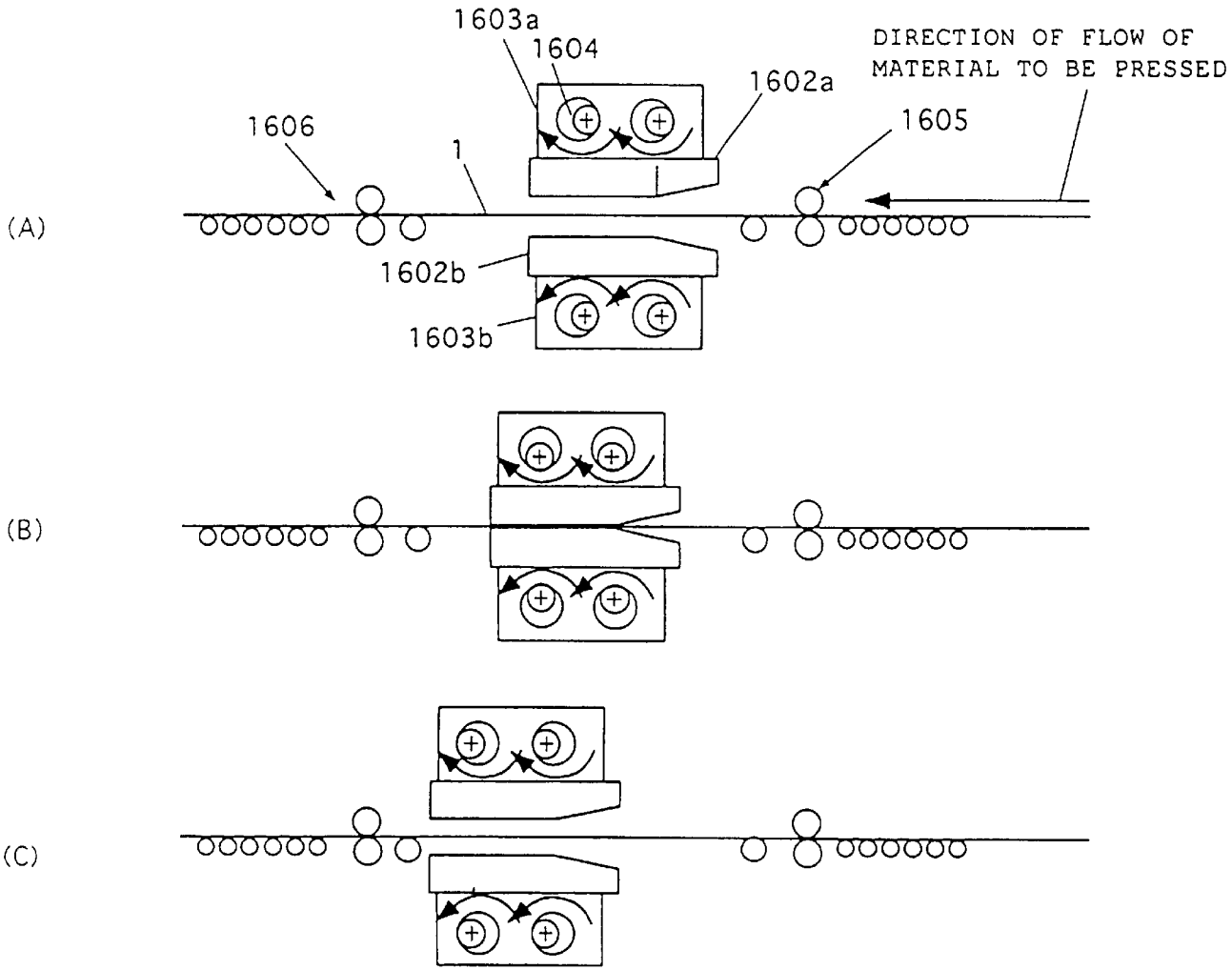
FIGS. 95(A), 95(B) and 95(C) show one cycle of operation of the press machine.

FIG. 95 shows the up and down movements of the press machine and the backward and forward movements during one cycle. (A) is the starting state of one cycle, and the dies 1602*a*, 1602*b* are open and located in the most upstream position. (B) shows the status in which the dies are moving in the downstream direction while pressing. (C) is the state in which pressing is completed and the dies have moved to the most downstream position. During these operations the transfer speeds of the feed rolls 1607, pinch rolls 1608 and transfer tables 1609 of the inlet transfer devices 1605 and outlet transfer devices 1606 are adjusted to be identical to the forward moving speed of the dies 1602*a*, 1602*b* during pressing.

(Thirty-Second Embodiment)

Figure 96:
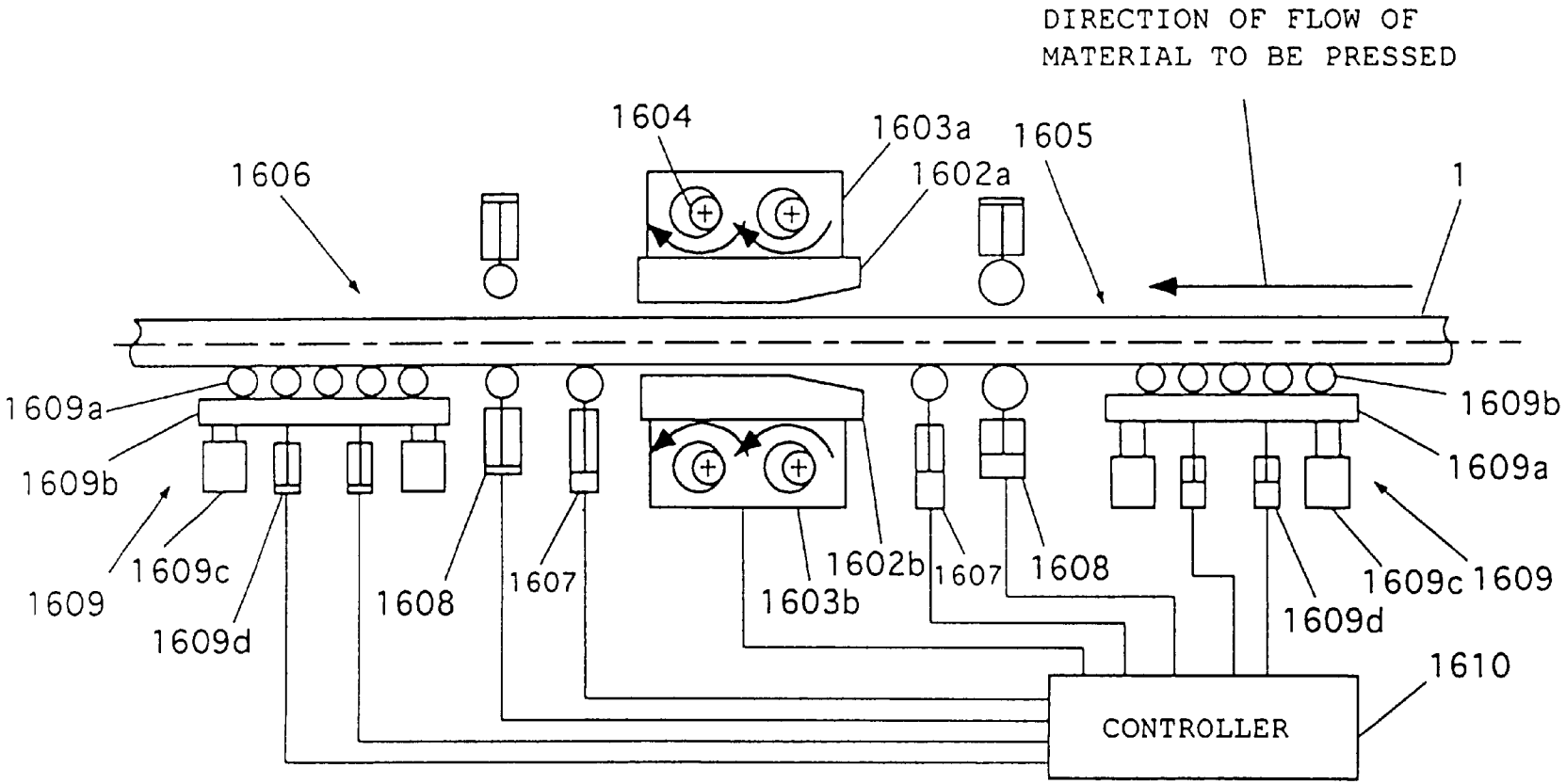
FIG. 96 shows the configuration of the thirty-second embodiment of the present invention.

FIG. 96 shows the thirty-second embodiment. The equipment configuration is the same as that of the thirty-first embodiment shown in FIG. 94, but the operation is different. When a material 1 to be pressed is bypassed through the press machine or the material is conveyed backwards because of a problem that has occurred in the material 1 being pressed, the transfer levels of the inlet transfer devices 1605 and the outlet transfer devices 1606 are made the same as each other, and the upper and lower dies 1602*a*, 1602*b* are fully opened, and the material is conveyed in the condition that the upper surface of the lower die 1602*b* is lower than the transfer level. At that time, the upper rolls of the inlet and outlet pinch rolls 1608 are raised to the highest point, so that the material 1 to be pressed is not constrained Obviously from the description above, according to the present invention, the transfer level of the inlet transfer device is adjusted to the height of the press center line subtracted by one half of the thickness of the material to be input and pressed, and the transfer level of the outlet transfer device is set to the height of the press center line subtracted by a half of the thickness of the material after being pressed, thereby the material after being pressed will not warp or otherwise be deflected, and the transfer devices can be protected from being damaged. When the material to be or being pressed is bypassed through the press machine, the inlet and outlet transfer devices are set at the same transfer level, and the dies are fully opened, so that the material can be conveyed smoothly through the press machine.

Although the present invention has been explained by referring to a number of preferred embodiments, it should be understood that the scope of claims included in the specification of the present invention should not be limited only to the embodiments described above. To the contrary, the scope of rights according to the present invention shall include all modifications, corrections or the like as long as they are included in the scope of the claims attached.

What is claimed is:

1. A plate reduction press apparatus comprising dies arranged vertically opposite each other on opposite sides of a transfer line in which a material to be shaped is transferred horizontally, and moving towards and away from the transfer line in synchronism with each other, a plurality of upstream table rollers arranged on the upstream side of the dies on the transfer line in such a manner that the lower surface of the material to be shaped, which is to be inserted between the dies, can be supported substantially horizontally, a downstream table disposed at a height, a first and a second of downstream up and down table rollers arranged on the downstream side of the dies on the transfer line in such a manner that the downstream up and down table rollers can be raised and lowered and can support the lower surface of the material after being shaped and fed out of the dies, the first downstream up and down table roller being disposed at a height in close vicinity of a main press apparatus unit on the downstream side of the transfer line, and extending substantially horizontally along the transfer line in a manner such that the first downstream up and down table roller can be moved up and down, the second downstream up and down table roller being disposed downstream of the first downstream up and down table roller, and is raised and lowered so that the height of an upstream end is disposed identical to the height of the first downstream up and down table roller, and the height of a downstream end is disposed slightly higher than the height of the downstream table, and a plurality of downstream table rollers arranged on the downstream side of the downstream up and down table rollers on the transfer line in such a manner that the lower surface of the material after being shaped and fed out of the dies can be supported substantially horizontally at a height substantially the same as the height of the said upstream table rollers.

2. A method of operating the plate reduction press apparatus specified in claim 1, in which when a long material to be shaped is inserted between both dies, and reduced and formed in the direction of the plate thickness, the vertical positions of the downstream up and down table rollers near the dies are determined in such a manner that the material after being shaped and fed out of the dies is substantially horizontal, and the vertical positions of the downstream up and down table rollers on the side farther from the dies are determined in such a manner that the material being shaped gradually descends towards the downstream table rollers.

3. The method of operating the plate reduction press apparatus specified in claim 2, in which when a long material to be shaped is not reduced or formed in the direction of the plate thickness by the dies, the positions of the upper surfaces of the downstream up and down table rollers are determined to be identical to the positions of the upper surfaces of the downstream table rollers.

4. A plate reduction press apparatus comprising dies arranged vertically opposite each other on opposite sides of a transfer line in which a material to be shaped is transferred horizontally, and moving towards and away from the transfer line in synchronism with each other;

an upstream table disposed at a height;

a first and a second of upstream up and down table rollers arranged on the upstream side of the dies on the transfer line in such a manner that the upstream up and down table rollers can be raised and lowered, and can support the lower surface of the material to be shaped, which is to be inserted between the dies;

the second upstream up and down table roller being disposed at a height in close vicinity of a main press apparatus unit on the upstream side of the transfer line, and extending substantially horizontally along the transfer line in a manner such that it can be moved up and down;

the first upstream up and down table roller is raised and lowered so that the height of a downstream end becomes identical to the height of the second downstream up and down table roller, and has an upstream end disposed slightly lower than the height of the upstream table, and a plurality of downstream table rollers arranged on the downstream side of the dies on the transfer line in such a manner that the lower surface of the material being shaped and fed out of the dies can be supported.

5. A method of operating the plate reduction press apparatus specified in claim 4, in which when a long material to be shaped is inserted between both dies, and reduced and formed in the direction of the plate thickness, the vertical positions of the upstream up and down table rollers near the dies are determined in such a manner that the material to be shaped, which is to be inserted between the dies, is substantially horizontal.

6. A method of operating the plate reduction press apparatus specified in claim 4, in which when a long material to be shaped is not reduced or formed in the direction of the plate thickness by the dies, the positions of the upper surfaces of the upstream up and down table rollers are determined to be identical to the positions of the upper surfaces of the downstream table rollers.

7. A plate reduction pressing method, in the transfer method of transfer devices that are arranged upstream and downstream of a press machine and can adjust the transfer height of a material to be pressed as specified in claim 4, in which when the material to be pressed is passed through the press machine, the press dies are opened vertically in such a manner that the material to be pressed does not contact the dies, and both transfer devices transfer the material to be pressed at the same height.

8. A plate reduction press apparatus comprising dies arranged vertically opposite each other on opposite sides of a transfer line in which a material to be shaped is transferred horizontally, and moving towards and away from the transfer line in synchronism with each other;

an upstream table disposed at a height;

a downstream table disposed at a height;

a first and a second of upstream up and down table rollers arranged on the upstream side of the dies on the transfer line in such a manner that the upstream up and down table rollers can be raised and lowered, and can support the lower surface of the material to be shaped, which is to be inserted between the dies;

the second upstream up and down table roller being disposed at a height in close vicinity of a main press apparatus unit on the upstream side of the transfer line, and extending substantially horizontally along the transfer line in a manner such that it can be moved up and down;

the first upstream up and down table roller is raised and lowered so that the height of a downstream end becomes identical to the height of the second downstream up and down table roller, and has an upstream end disposed slightly lower than the height of the upstream table;

a first and a second of downstream up and down table rollers arranged on the downstream side of the dies on the transfer line in such a manner that the downstream up and down table rollers can be raised and lowered and can support the lower surface of the material after being shaped and fed out of the dies;

the first downstream up and down table roller being disposed at a height in close vicinity of a main press apparatus unit on the downstream side of the transfer line, and extending substantially horizontally along the transfer line in a manner such that the first downstream up and down table roller can be moved up and down;

the second downstream up and down table roller being disposed downstream of the first downstream up and down table roller, and is raised and lowered so that the height of an upstream end is disposed identical to the height of the first downstream up and down table roller, and the height of a downstream end is disposed slightly higher than the height of the downstream table; and a plurality of downstream table rollers arranged on the downstream side of the downstream up and down table rollers on the transfer line in such a manner that the lower surface of the material after being shaped and fed out of the dies can be supported substantially horizontally at a height substantially the same as the height of the said upstream table rollers.

9. A method of operating the plate reduction press apparatus specified in claim 8, in which when a long material to be shaped is inserted between both dies, and reduced and formed in the direction of the plate thickness, the vertical positions of the upstream up and down table rollers near the dies and the downstream up and down table rollers from the dies are determined in such a manner that the material to be shaped, which is to be inserted between the dies, and the material after being shaped and fed out of the dies are substantially horizontal.

10. A method of operating the plate reduction press apparatus specified in claim 8, in which when a long material to be shaped is not reduced or formed in the direction of the plate thickness by the dies, the positions of the upper surfaces of the upstream up and down table rollers and the downstream table rollers are determined to be identical to each other.

11. A plate reduction press apparatus comprising inlet transfer devices that are arranged upstream of the press machine, and transfer a material to be pressed, and can be raised and lowered, and outlet transfer devices that are arranged downstream of the press machine, and transfer the material being pressed, and can be raised and lowered, in which each of the transfer devices is composed of, from the closest point to the farthest point from the dies, feeds rolls, pinch rolls and a transfer table, the feed rolls comprising rolls conveying the material to be pressed, and hydraulic cylinders that raise and lower the rolls, thereby adjusting a transfer height of the material to be pressed, the pinch rolls comprising rolls arranged above and below the material to be pressed, and hydraulic cylinders that press each roll, and the pinch rolls pinch and press the material to be pressed, the upstream pinch rolls pushing the material into the dies, and the downstream pinch rolls pulling the material out of the dies, the transfer table comprising a frame extending in the direction of flow of the material to be pressed, a plurality of transfer rollers arranged above the frame, up/down guides disposed to guide the frame when moving up and down, and up/down cylinders disposed to move the frame up and down, the inlet transfer devices are adjusted to transfer height according to information about the thickness of the material to be pressed, that has been input, in such a manner that the center line of the thickness of the material to be pressed agrees with the center line of the press machine, and the outlet transfer devices are adjusted to a transfer height according to information about the thickness of the material after being pressed, in such a manner that the center line of the thickness of the material agrees with the center line of the press machine.

12. A plate reduction press apparatus according to claim 11, such that when the material to be pressed is passed through the press machine without being pressed, the upper and lower dies are open, and the transfer heights of the said inlet transfer devices and the said outlet transfer devices are determined to be identical to each other and higher than the upper surface of the lower die in the open position.

13. A plate reduction pressing method, using a plurality of transfer devices that are arranged upstream and downstream of a press machine having a pressing center line at a height, the transfer devices comprising feed rolls, pinch rolls, and a transfer table, each such device having an adjustable transfer height, where based on the thickness of a material to be input and pressed, and an amount of reduction during pressing, the transfer height of the transfer devices is set so that the transfer heights of the feed roll, pinch roll, and transfer table upstream of the press machines are set equal to the height of the pressing center line minus half the thickness of the material before pressing, and the transfer heights of the feed roll, pinch roll, and transfer table downstream of the press machines are set equal to the height of the pressing center line minus half the thickness of the material after pressing, so that the transfer devices can transfer the material to be pressed or being pressed while the transfer devices maintain the height of the center line of the thickness of the material to be pressed, in an unchanged manner during transfer.

* * * * *